US008657512B2

(12) United States Patent
Crystal et al.

(10) Patent No.: US 8,657,512 B2
(45) Date of Patent: Feb. 25, 2014

(54) CRAFTING APPARATUS INCLUDING A WORKPIECE FEED PATH BYPASS ASSEMBLY AND WORKPIECE FEED PATH ANALYZER

(75) Inventors: Jeremy Burton Crystal, Springville, UT (US); Jeffery V. Gubler, Springville, UT (US); James T. Davis, II, Springville, UT (US); Christopher Kenneth Dodge, Highland, UT (US); Jared D. Burton, Payson, UT (US); Matthew B. Strong, Pleasant Grove, UT (US); Jim Allen Colby, Highland, UT (US)

(73) Assignee: Provo Craft and Novelty, Inc., South Jordan, UT (US)

( * ) Notice: Subject to any disclaimer, the term of this patent is extended or adjusted under 35 U.S.C. 154(b) by 440 days.

(21) Appl. No.: 12/869,094

(22) Filed: Aug. 26, 2010

(65) Prior Publication Data

US 2011/0048266 A1 Mar. 3, 2011

Related U.S. Application Data

(60) Provisional application No. 61/237,218, filed on Aug. 26, 2009, provisional application No. 61/237,665, filed on Aug. 27, 2009, provisional application No. 61/237,621, filed on Aug. 27, 2009, provisional application No. 61/238,466, filed on Aug. 31, 2009, provisional application No. 61/287,694, filed on Dec. 17, 2009, provisional application No. 61/289,882, filed on Dec. 23, 2009, provisional application No. 61/296,584, filed on Jan. 20, 2010, provisional application No. 61/351,262, filed on Jun. 3, 2010, provisional application No. 61/367,736, filed on Jul. 26, 2010, provisional application No. 61/368,247, filed on Jul. 27, 2010.

(51) Int. Cl.
*B41J 11/00* (2006.01)

(52) U.S. Cl.
USPC ..... 400/621; 400/595

(58) Field of Classification Search
USPC ..... 400/621
See application file for complete search history.

(56) References Cited

U.S. PATENT DOCUMENTS 3,951,252 A 4/1976 Selke et al.
4,152,962 A 5/1979 Hendrischk (Continued)

FOREIGN PATENT DOCUMENTS

CN 1103274 A 6/1995
DE 10239792 A1 4/2003

(Continued)

OTHER PUBLICATIONS

U.S. Appl. No. 60/517,550.

(Continued)

*Primary Examiner* — Anthony Nguyen
(74) *Attorney, Agent, or Firm* — Honigman Miller Schwartz and Cohn LLP

(57) ABSTRACT

A method of operating a crafting apparatus. The method includes moving a workpiece along a first feed path for printing on the workpiece with a printer and moving the workpiece along a second feed path for cutting the workpiece with a cutter. The first feed path bypasses a workpiece mover of the cutter.

18 Claims, 134 Drawing Sheets

(56) References Cited

U.S. PATENT DOCUMENTS

| | | | | |
|---|---|---|---|---|
| 4,192,618 | A | 3/1980 | Kondur, Jr. et al. | |
| 4,211,498 | A | 7/1980 | Shimizu et al. | |
| 4,302,119 | A | 11/1981 | Siegenthaler | |
| 4,512,839 | A | 4/1985 | Gerber | |
| 4,544,293 | A | 10/1985 | Cranston et al. | |
| 4,592,669 | A | 6/1986 | Lohse et al. | |
| 4,604,032 | A | 8/1986 | Brandt et al. | |
| 4,696,592 | A * | 9/1987 | Oka et al. | 400/636 |
| 4,721,058 | A | 1/1988 | Hayamizu et al. | |
| 4,854,205 | A | 8/1989 | Anderka | |
| 4,982,437 | A | 1/1991 | Loriot | |
| 5,007,752 | A * | 4/1991 | Yasumi et al. | 400/636 |
| 5,074,178 | A | 12/1991 | Shetley et al. | |
| 5,089,971 | A | 2/1992 | Gerber | |
| 5,172,871 | A | 12/1992 | Schutt et al. | |
| 5,296,872 | A | 3/1994 | Caamano | |
| 5,363,123 | A | 11/1994 | Petersen et al. | |
| 5,524,996 | A | 6/1996 | Carpenter et al. | |
| 5,537,135 | A | 7/1996 | Hevenor et al. | |
| 5,551,786 | A | 9/1996 | Webster et al. | |
| 5,553,528 | A | 9/1996 | Zoltner | |
| 5,613,788 | A | 3/1997 | Dobring | |
| 5,671,065 | A | 9/1997 | Lee | |
| 5,727,889 | A | 3/1998 | Koyabu | |
| 5,829,897 | A | 11/1998 | Murai | |
| 5,833,380 | A | 11/1998 | Hosomi et al. | |
| 5,876,131 | A | 3/1999 | Parker et al. | |
| 5,881,624 | A | 3/1999 | Brugue et al. | |
| 5,882,128 | A | 3/1999 | Hinojosa | |
| 5,938,354 | A | 8/1999 | Yasui et al. | |
| 5,971,639 | A | 10/1999 | Park | |
| 5,993,093 | A | 11/1999 | Schoennauer et al. | |
| 6,089,136 | A | 7/2000 | Hinojosa et al. | |
| 6,109,745 | A | 8/2000 | Wen | |
| 6,112,630 | A | 9/2000 | Miura | |
| 6,113,293 | A | 9/2000 | Schanke et al. | |
| 6,117,061 | A | 9/2000 | Popat et al. | |
| 6,146,035 | A | 11/2000 | Ishigouoka et al. | |
| 6,151,037 | A | 11/2000 | Kaufman et al. | |
| 6,152,619 | A | 11/2000 | Silverbrook | |
| 6,173,211 | B1 | 1/2001 | Williams et al. | |
| 6,217,167 | B1 | 4/2001 | Wen et al. | |
| 6,237,240 | B1 | 5/2001 | Nelson et al. | |
| 6,260,457 | B1 | 7/2001 | Hakkaku | |
| 6,270,215 | B1 | 8/2001 | Miyasaka et al. | |
| 6,270,269 | B1 | 8/2001 | Watanabe et al. | |
| 6,281,981 | B1 | 8/2001 | Yasui et al. | |
| 6,302,602 | B1 | 10/2001 | Kiyohara et al. | |
| 6,339,982 | B1 | 1/2002 | Angel et al. | |
| 6,343,884 | B1 | 2/2002 | Watanabe et al. | |
| 6,347,896 | B1 | 2/2002 | Robinson | |
| 6,352,381 | B1 | 3/2002 | Gonmori et al. | |
| 6,361,231 | B1 | 3/2002 | Sato et al. | |
| 6,408,750 | B1 | 6/2002 | Goto et al. | |
| 6,434,444 | B2 | 8/2002 | Herman, Jr. | |
| 6,443,645 | B1 | 9/2002 | Takei et al. | |
| 6,447,187 | B1 | 9/2002 | Robinson | |
| 6,491,361 | B1 | 12/2002 | Spann | |
| 6,499,840 | B2 | 12/2002 | Day et al. | |
| 6,520,701 | B2 | 2/2003 | Kaya | |
| 6,554,511 | B2 | 4/2003 | Kwasny et al. | |
| 6,572,291 | B1 | 6/2003 | Ho et al. | |
| 6,599,044 | B2 | 7/2003 | Paris | |
| 6,616,360 | B2 | 9/2003 | Lehmkuhl | |
| 6,619,166 | B2 | 9/2003 | Miyazaki et al. | |
| 6,648,533 | B2 | 11/2003 | Lo et al. | |
| 6,732,619 | B2 | 5/2004 | Carriere et al. | |
| 6,739,777 | B2 | 5/2004 | Kobayashi et al. | |
| 6,749,352 | B2 | 6/2004 | Yamada et al. | |
| 6,785,025 | B1 | 8/2004 | Dawe et al. | |
| 6,786,125 | B2 | 9/2004 | Imai | |
| 6,793,424 | B2 | 9/2004 | Yamada et al. | |
| 6,814,516 | B2 | 11/2004 | Tsuchiya et al. | |
| 6,814,517 | B2 | 11/2004 | Fisher et al. | |
| 6,830,304 | B2 | 12/2004 | Suzuki et al. | |
| 6,848,779 | B2 | 2/2005 | Lo et al. | |
| 6,848,847 | B2 | 2/2005 | Murakoshi et al. | |
| 6,887,003 | B2 | 5/2005 | Someno | |
| 6,905,269 | B2 | 6/2005 | Hansburg | |
| 6,906,643 | B2 | 6/2005 | Samadani et al. | |
| 6,926,400 | B2 | 8/2005 | Kelley | |
| 6,945,645 | B2 | 9/2005 | Baron | |
| 6,946,645 | B2 | 9/2005 | Tarvin et al. | |
| 7,054,708 | B1 | 5/2006 | Aamodt et al. | |
| 7,056,410 | B2 | 6/2006 | Kuller et al. | |
| 7,059,793 | B2 | 6/2006 | Mori et al. | |
| 7,149,599 | B2 | 12/2006 | Arai et al. | |
| 7,163,287 | B2 | 1/2007 | Silverbrook et al. | |
| 7,217,051 | B2 | 5/2007 | Silverbrook et al. | |
| 7,245,227 | B2 | 7/2007 | Winter et al. | |
| 7,261,477 | B2 | 8/2007 | Silverbrook et al. | |
| 7,267,500 | B2 | 9/2007 | Tsuchiya et al. | |
| 7,269,471 | B2 | 9/2007 | Kadono | |
| 7,380,907 | B2 | 6/2008 | Nunokawa | |
| 7,385,724 | B2 | 6/2008 | Brown | |
| 7,393,096 | B2 | 7/2008 | Takagi | |
| 7,403,211 | B2 | 7/2008 | Sheasby et al. | |
| 7,566,124 | B2 | 7/2009 | Kan et al. | |
| 7,572,000 | B2 | 8/2009 | Silverbrook | |
| 2002/0093570 | A1 | 7/2002 | Silverbrook et al. | |
| 2002/0187285 | A1 | 12/2002 | Mitchell et al. | |
| 2002/0192003 | A1 | 12/2002 | Koike et al. | |
| 2003/0103793 | A1 | 6/2003 | Murakoshi et al. | |
| 2003/0120375 | A1 | 6/2003 | Arai et al. | |
| 2003/0134615 | A1 | 7/2003 | Takeuchi | |
| 2003/0146943 | A1 | 8/2003 | Lehmkuhl et al. | |
| 2003/0168148 | A1 | 9/2003 | Gerber et al. | |
| 2003/0206211 | A1 | 11/2003 | Baron | |
| 2004/0120008 | A1 | 6/2004 | Morgan | |
| 2004/0160462 | A1 | 8/2004 | Sheasby et al. | |
| 2005/0021172 | A1 | 1/2005 | Winter et al. | |
| 2005/0044485 | A1 | 2/2005 | Mondry et al. | |
| 2005/0097081 | A1 | 5/2005 | Sellen et al. | |
| 2005/0123336 | A1 | 6/2005 | Oshida et al. | |
| 2005/0143855 | A1 | 6/2005 | Arai et al. | |
| 2005/0156954 | A1 | 7/2005 | Silverbrook et al. | |
| 2005/0157141 | A1 | 7/2005 | Silverbrook et al. | |
| 2005/0162445 | A1 | 7/2005 | Sheasby et al. | |
| 2005/0166159 | A1 | 7/2005 | Mondry et al. | |
| 2005/0243124 | A1 * | 11/2005 | Miyazaki et al. | 347/37 |
| 2006/0055408 | A1 | 3/2006 | Sambandamurthy et al. | |
| 2006/0117922 | A1 | 6/2006 | Causse et al. | |
| 2006/0200267 | A1 | 9/2006 | Aamodt et al. | |
| 2006/0228151 | A1 | 10/2006 | Vogel | |
| 2007/0013959 | A1 | 1/2007 | Miwa | |
| 2007/0056414 | A1 | 3/2007 | Saeterbo et al. | |
| 2007/0076178 | A1 | 4/2007 | Ueda et al. | |
| 2007/0105076 | A1 | 5/2007 | Causse et al. | |
| 2007/0126786 | A1 | 6/2007 | Ohmori et al. | |
| 2007/0189831 | A1 | 8/2007 | Silverbrook et al. | |
| 2007/0227332 | A1 | 10/2007 | Causse et al. | |
| 2008/0117455 | A1 | 5/2008 | Tomono et al. | |
| 2008/0120071 | A1 | 5/2008 | Minatogawa et al. | |
| 2008/0134853 | A2 | 6/2008 | Causse et al. | |
| 2008/0282859 | A2 | 11/2008 | Causse et al. | |
| 2009/0050003 | A1 | 2/2009 | Dubois, III | |
| 2009/0158182 | A1 | 6/2009 | McCurdy et al. | |
| 2009/0158183 | A1 | 6/2009 | McCurdy et al. | |

FOREIGN PATENT DOCUMENTS

| | | | |
|---|---|---|---|
| EP | 0509102 | A1 | 10/1992 |
| GB | 02295584 | A | 6/1996 |
| WO | WO-9212087 | A1 | 7/1992 |
| WO | WO-2005004051 | A1 | 1/2005 |
| WO | WO-2005017780 | A1 | 2/2005 |
| WO | WO-2006055408 | A2 | 5/2006 |

(56) References Cited

FOREIGN PATENT DOCUMENTS

| | | | |
|---|---|---|---|
| WO | WO-2007090189 | A2 | 8/2007 |
| WO | WO-2008013727 | A2 | 1/2008 |
| WO | WO-2008036290 | A2 | 3/2008 |
| WO | WO-2008142935 | A1 | 11/2008 |
| WO | WO-2009042804 | A1 | 4/2009 |
| WO | WO-2009042808 | A1 | 4/2009 |

OTHER PUBLICATIONS

U.S. Appl. No. 60/627,179.
International Search Report for Application PCT/US2010/046767 dated May 23, 2011.

* cited by examiner

| VA | RA | NAME |
|---|---|---|
| 1(+) | 0 | Vector Art (VA) |
| 1(+) | 1 | Vector Raster Art (VRA) |
| 1+ | 1+ | Digitally Layered Art (DLA) |

FIG. 17A

| # of Glyphs | Default Print Data (color/pattern) | Name |
|---|---|---|
| 1 | None | Original Art |
| 1 | One Per Glyph | Icon |
| 1+ | At Least One Per Glyph | Digitally Layered Art |
| None | Many | Paper Palette |

FIG. 17B

| | | | Cart works in... | | Functionality of cartridge | | |
|---|---|---|---|---|---|---|---|
| VA | RA | NAME | CUT | PRINT & CUT | CUT | PRINT | PRINT & CUT |
| 1(+) | 0 | Vector Art (VA) | Y | Y | UL, L | OP-UL, FF-UL, OP-FF-UL | Same as VA Print + Everything Layered (L) |
| 1(+) | 1 | Vector Raster Art (VRA) | N | Y | UL | Same as VA Print + RP-UL | Same as VRA Print + Everything Collaged (CL) |
| 1+ | 1+ | Digitally Layered Art (DLA) | N | Y | Le, Lc | Same as VRA Print + Explode (e). Composite (c) and Paper Pallet (PP) | Same as DLA Print + Everything Layered (L) |

FIG. 17C

| | Works in... | | Use Cases | | |
|---|---|---|---|---|---|
| **Name** | **Machine with Only Cutting Ability** | **Machine with Printing and Cutting Abilities** | **Cut** | **Print** | **Print & Cut** |
| Original Art | Y | Y | UL | OP-UL, FF-UL,OP-FF-UL | OP-UL, FF-UL,OP-FF-UL |
| Icon | N | Y | UL | OP-UL, FF-UL, OP-FF-UL | OP-UL, FF-UL, OP-FF-UL |
| Digitally Layered Art | N | Y | Le, Lc | OP-Le, OP-Lc, FF-Le, FF-Lc, OP-FF-Le, OP-FF-Lc | OP-Le, OP-Lc, FF-Le, FF-Lc, OP-FF-Le, OP-FF-Lc |
| Paper Palette | N | Y | NA | Used as a FF | Used as a FF |

UL = Unlayered
L = Layered
Lc = Layered Composite (where all layers are printed and/or cut in their composite positions resulting in the layers being cut together.)
Le = Layered Exploded (where all layers are printed and/or cut not in the their composite positions resulting in each layer being cut separate from the others).
OP = Outline Print (where the cut path is printed)
FF = Flood Fill (where the cut path is filled with a color/pattern and printed)

*FIG. 17D*

| | Cart works in... | | Functionality of cartridge | | |
|---|---|---|---|---|---|
| CONTENT | CUT | PRINT & CUT | CUT | PRINT | PRINT & CUT |
| Cut Only | Y | Y | Enhanced Design | Enables PP; Sharing PP Between Carts; Enhanced Design | Enables PP; Sharing PP Between Carts; Enhanced Design |
| Print and Cut | Y | Y | Enhanced Design | Enables PP; Sharing PP Between Carts; Enhanced Design | Enables PP; Sharing PP Between Carts; Enhanced Design |
| | Y | Y | Enhanced Design | Enables PP; Sharing PP Between Carts; Enhanced Design | Enables PP; Sharing PP Between Carts; Enhanced Design |

*FIG. 17E*

| | Works in... | | Use Cases | | |
|---|---|---|---|---|---|
| **Name** | **Machine with Only Cutting Ability** | **Machine with Printing and Cutting Abilities** | **Cut** | **Print** | **Print & Cut** |
| Original Art | Y | Y | User manipulation* of cut paths | OP-UL, FF-UL,OP-FF-UL | OP-UL, FF-UL,OP-FF-UL |
| Icon | Y | Y | User manipulation of cut paths and art | Use Paper Palette from a different source for FF. | Use Paper Palette from a different source for FF. |
| Digitally Layered Art | Y | Y | User manipulation of cut paths and art | Use Paper Palette from a different source for FF. | Use Paper Palette from a different source for FF. |
| Paper Palette | Y | Y | NA | Used as a FF | Used as a FF |

*Examples of manipulation may include welding, rotation, slanting, stretching, and deleting parts of glyphs.

FIG. 17F

| # | CONTENT TYPE | RULE |
|---|---|---|
| 1 | VA, VRA, DLA | Any vector path can be either cut or printed (user chooses color). |
| 2 | VA, VRA, DLA | Any area enclosed by a vector loop can be flood filled and printed. |
| 3 | VRA, DLA | Shapes and paper pallets can be mixed between content. |
| 4 | DLA | Digitally layered art can be exploded or used as a composite imaged (some art is digitally layered and some is not). |
| 5 | VA, VRA, DLA | Attributes of content may be showed with other content. |

FIG. 17G

| # | Rules |
|---|---|
| 1 | Any vector path can either cut or printed. |
| 2 | Any area enclosed by a cut path can be flood filled and printed. |
| 3 | Cut paths and paper palettes can be mixed within a collection/cartridge. |
| 4 | Digitally layered art can be printed and/or cut as a composite or exploded into layers. |
| 5 | When an external controller is used or a personal computer, paper palettes and cut paths can be mixed from more than one collection/cartridge/source. |

FIG. 17H

CRAFTING APPARATUS INCLUDING A WORKPIECE FEED PATH BYPASS ASSEMBLY AND WORKPIECE FEED PATH ANALYZER

CROSS REFERENCE TO RELATED APPLICATIONS

This U.S. patent application claims priority under 35 U.S.C. §119(e) to Provisional Patent Application No. 61/237,218, filed on Aug. 26, 2009; Provisional Patent Application No. 61/237,621, filed on Aug. 27, 2009; Provisional Patent Application No. 61/237,665, filed on Aug. 27, 2009; Provisional Patent Application No. 61/238,466, filed on Aug. 31, 2009; Provisional Patent Application No. 61/289,882, filed on Dec. 23, 2009; Provisional Patent Application No. 61/287,694, filed on Dec. 17, 2009; Provisional Patent Application No. 61/296,584, filed on Jan. 20, 2010; Provisional Patent Application No. 61/351,262, filed on Jun. 3, 2010; Provisional Patent Application No. 61/367,736, filed on Jul. 26, 2010; and Provisional Patent Application No. 61/368,247, filed on Jul. 27, 2010. The disclosures of these prior applications are considered part of the disclosure of this application and are hereby incorporated by reference in their entireties.

TECHNICAL FIELD

The disclosure relates to a crafting apparatus including a workpiece feed path bypass assembly and/or a workpiece feed path analyzer.

BACKGROUND

Throughout history, it has been known that individuals have found a sense of personal fulfillment/achievement/satisfaction/expression by creating art. In recent times, during the late 19$^{th}$ century, an art reform & social movement led by skilled tradesmen was slowly starting to be recognized by many people across America, Canada, Great Britain and Australia. This movement has often been referred to as the "Arts-and-Crafts Movement."

The so-called "Arts-and-Crafts Movement" that began many years ago has continued to evolve today by many persons that may not necessarily be skilled in a particular trade. As such, it may be said that non-skilled persons may be involved in the "arts-and-crafts" as a social activity or hobby. In some circumstances, the activity or hobby may be practiced for any number of reasons ranging from, for example: economic gain, gifting, or simply to pass time while finding a sense of personal fulfillment/achievement/satisfaction/expression.

With advances in modern technology, the "Arts-and-Crafts Movement" that began many years ago is nevertheless susceptible to further advancements that may enhance or improve, for example, the way a skilled or non-skilled person may contribute to the arts-and-crafts. Therefore, a need exists for the development of improved components, devices and the like that advance the art.

SUMMARY

One aspect of the disclosure provides a method of operating a crafting apparatus. The method includes moving a workpiece along a first feed path for printing on the workpiece with a printer and moving the workpiece along a second feed path for cutting the workpiece with a cutter. The first feed path bypasses a workpiece mover of the cutter.

Implementations of the disclosure may include one or more of the following features. In some implementations, the cutter is spaced upstream of the printer. The workpiece mover of the cutter may include a pair of cutter rollers disposed adjacent the cutter. The method may include moving a workpiece mover of the printer to an engaged position while moving the workpiece along the first feed path. Moreover, the method may include moving the workpiece mover of the printer to a disengaged position while moving the workpiece along the second feed path.

In some implementations, the workpiece mover of the printer includes upper and lower rollers disposed adjacent the printer and moving the workpiece mover of the printer to its disengaged position includes moving the upper roller away from a lower roller to allow free movement of the workpiece received therebetween. Moving the workpiece mover of the printer to its engaged position may include moving the upper roller against the lower roller to selectively engage the workpiece received therebetween.

In some examples, the method includes inducing a curvature in the workpiece about a direction of movement of the workpiece as the workpiece moves downstream of the printer. The method may include moving the workpiece past an exit ramp disposed downstream of the printer. A portion of the exit ramp may define an arcuate profile transverse to the feed path of the workpiece to induce the curvature of the workpiece. The method may further include maintaining the workpiece substantially flat upstream of the arcuate profiled portion of the exit ramp and/or moving the workpiece past edge holders that engage lateral edge portions of the workpiece to maintain the workpiece substantially flat.

The method may include determining a workpiece alignment that includes at least one of an angular skew and a lateral offset of the workpiece with respect to the feed path of the workpiece. The method may also include moving first and second sensors along respective first and second orthogonal directions for detecting at least one of an edge of the workpiece and a fiducial on at least one of a mat supporting the workpiece and the workpiece and determining the workpiece alignment based on a coordinate signal from each sensor. The method may include cutting the workpiece based on the determined workpiece alignment and/or printing an image on the workpiece based on the determined workpiece alignment.

In another aspect, a method of operating a crafting apparatus includes moving a feed path bypass assembly disposed along at least one passageway between a cutter and a printer to a first position. The feed path bypass assembly directs movement of a received workpiece along a first feed path that bypasses a first pair of rollers disposed adjacent the cutter. The method also includes receiving the workpiece between a second pair of rollers disposed adjacent the printer for selectively controlling movement of the workpiece with respect to the printer during printing operations, printing on the workpiece using the printer, moving the feed path bypass assembly to a second position, and cutting the workpiece using the cutter. The feed path bypass assembly directs movement of the workpiece along a second feed path between the first pair of rollers that receive and selectively control movement of the workpiece with respect to the cutter during cutting operations.

Implementations of the disclosure may include one or more of the following features. In some implementations, the method includes moving the workpiece along the first feed path in a first direction while the feed path bypass assembly is in its first position and moving the workpiece along the second feed path in a second direction substantially opposite to the first direction while the feed path bypass assembly is in its second position. The method may include moving the second pair of rollers to an engaged position for engaging and moving the workpiece therebetween when the feed path bypass assembly is in its first position. Movement of the feed path bypass assembly to its first position may cause movement of the second pair of rollers to its engaged position. The method may include moving the second pair of rollers to a disengaged position allowing free movement of the workpiece therebetween when the feed path bypass assembly is in its second position. Movement of the feed path bypass assembly to its second position may cause movement of the second pair of rollers to its disengaged position.

In some implementations, the method includes moving a first toggle member to a first position allowing a second toggle member disposed along the at least one passageway downstream of the cutter and upstream of the printer to pivot to a corresponding first position, allowing movement of the workpiece along the first feed path bypassing the first pair of rollers. The method may further include moving a carrier arm disposed along the at least one passageway and rotatably supporting an upper roller of the second pair of rollers to a first position upon moving the second toggle member to its first position. The carrier arm selectively engages the upper roller of the second pair of rollers against a lower roller of the second pair of rollers while in its first position. The method may include moving the first toggle member to a second position allowing the second toggle member to pivot to a corresponding second position, allowing movement of the workpiece along the second feed path between the first pair of rollers. Moreover, the method may include moving the carrier arm to its second position disengaging contact between the second pair of rollers upon moving the second toggle member to its second position.

In some implementations, the method includes inducing a curvature in the workpiece about a direction of movement of the workpiece as the workpiece moves downstream of the printer. To include the curvature of the workpiece, the method may include moving the workpiece past an exit ramp disposed downstream of the printer, a portion of the exit ramp defining an arcuate profile transverse to the feed path of the workpiece. Moreover, the method may include maintaining the workpiece substantially flat upstream of the arcuate profiled portion of the exit ramp. The method may include moving the workpiece past edge holders that engage lateral edge portions of the workpiece to maintain the workpiece substantially flat.

The method may include determining a workpiece alignment that includes at least one of an angular skew and a lateral offset of the workpiece with respect to the feed path of the workpiece. In some examples, the method includes moving first and second sensors along respective first and second orthogonal directions for detecting at least one of an edge of the workpiece and a fiducial on at least one of a mat supporting the workpiece and the workpiece and determining the workpiece alignment based on a coordinate signal from each sensor. Each sensor may detect at least one of a top edge, a left edge and a right edge of the workpiece. The method may include cutting and/or printing the workpiece based on the determined workpiece alignment.

In yet another aspect, a method of operating a crafting apparatus includes establishing communication between at least one cartridge and a processor of the crafting apparatus and selecting a composite image associated with the at least one cartridge. The composite image includes component images. The method further includes presenting a workpiece to the crafting apparatus, printing at least one of the composite image and the component images on the workpiece, and cutting at least a portion of the at least one printed image out of the workpiece.

Implementations of the disclosure may include one or more of the following features. In some implementations, the method includes exploding the composite image into the component images spaced from each other. Each component image may be placed on a respective layer, where each layer is arrangeable with respect to each other and capable of receiving additional images. The method may include one or more of assigning a layer order for each layer, setting a cut pressure for at least one layer, setting a cut speed for at least one layer, and setting a number of cut passes on the workpiece for at least one layer.

In some implementations, the method includes selecting an aspect ratio corresponding to a size of the workpiece before printing on and cutting the workpiece and sizing the at least one of the composite image and the component images according to the selected aspect ratio.

In another aspect, a method of operating a crafting apparatus includes establishing communication between at least one cartridge and a processor of the crafting apparatus, selecting at least one glyph associated with the at least one cartridge, adding the at least one selected glyph to a job, and selecting a design object comprising at least one of the job, the at least one glyph, a region of the at least one glyph, and a layer of the job. The method further includes determining a perimeter of the selected design object, offsetting a cut path from the design object perimeter by a cut offset distance, offsetting a border from the design object perimeter by a border offset distance, altering a color of a region defined between the design object perimeter and the border, presenting a workpiece to the crafting apparatus, printing at least a portion of the job on the workpiece, and cutting at least a portion of the job out of the workpiece.

Implementations of the disclosure may include one or more of the following features. In some implementations, the method includes receiving a user defined border thickness and setting the border offset distance equal to the user defined border thickness plus at least a fraction of a threshold print-to-cut alignment tolerance. The method may include setting the border offset distance equal to the cut offset distance plus at least a fraction of a threshold print-to-cut alignment tolerance. The method may include altering at least one of a relative size and a true size of the selected design object, and optionally assigning a relative size of the selected design object with respect of another design object. In some examples, the method includes altering an orientation of the selected design object with respect to the workpiece.

The method may include duplicating the selected design object by a duplication quantity and spacing the duplicated design objects by a threshold distance. The duplicated design objects may be arranged in a pattern. Moreover, a duplication quantity may be selected to substantially fill a workable area of the workpiece.

In some implementations, the method includes assigning a number of cut passes along the cut path of the selected design object and/or assigning a cut pressure along the cut path of the selected design object. The method may include flipping the selected design object with respect to an axis. In some examples, the method includes executing a graphical operation on the selected design object, the graphical operation comprising at least one of cutting, copying, pasting, flood filling, rasterizing, exploding, compositing, grouping, ungrouping, shadowing, auto-filling a page, quantity filling a page, flipping about an axis, setting a relative size, setting a true size, orienting, and assigning an edge effect of the selected design object.

In yet another aspect, a method of aligning a cutter of a crafting apparatus with a printer of the crafting apparatus includes determining a number of steps to move the cutter a first distance in a first direction, determining a number of steps to move the cutter a second distance in a second direction orthogonal to the first direction, printing calibration images with the printer, and cutting the calibration images with the cutter. Each calibration image is cut with a cutter offset different from the other calibration images. The method includes selecting a cut calibration image and using the cutter offset of the selected calibration image for cutting operations. In some implementations, the method includes locating first and second marks spaced from each other along the first direction on a mat received by the crafting apparatus and then determining a number of steps to move the cutter along the first direction between the first and second marks. The method may also include locating third and fourth marks spaced from each other along the second direction on the mat and then determining a number of steps to move the cutter along the second direction between the third and fourth marks. In some examples, printing calibration images comprises printing at least one of horizontal lines and vertical lines.

In another aspect, a method includes providing vector artwork, raster artwork and digitally layered artwork, determining the artwork to print, cut, and layer, and printing and cutting a medium to produce the artwork. The method may also include providing a paper palette for said digitally layered artwork and/or determining what color to print for said artwork.

In yet another aspect, a method includes receiving an image having a boundary, determining a border thickness, applying a border at said thickness to said boundary, and cutting said image from a sheet material within said border. Determining a border thickness may include receiving a thickness input from a user, extending the boundary outwardly a predetermined distance, and/or scaling said border.

The details of one or more implementations of the disclosure are set forth in the accompanying drawings and the description below. Other aspects, features, and advantages will be apparent from the description and drawings, and from the claims.

DESCRIPTION OF THE DRAWINGS

The disclosure will now be described, by way of example, with reference to the accompanying drawings, in which:

FIGS. 17A and 17B each provide a schematic view of an exemplary matrix of different classifications of artwork.

FIGS. 17C and 17D each provide a schematic view of an exemplary use-case matrix for various types of artwork.

FIGS. 17E and 17F each provide a schematic view of an exemplary use-case matrix for vector art, vector raster art, and digitally layered art.

FIGS. 17G and 17H each provide a schematic view of exemplary use rules that may apply to vector art, vector raster art, and digitally layered art.

FIG. 48 is a schematic view of an exemplary arrangement of operations for tiling an image.

FIG. 48A is a schematic view of an image printed and cut at boundary from a plurality of sheets.

FIG. 48B is a schematic view of a key image.

FIG. 49 is a schematic view of an exemplary arrangement of operations for determining the number of ink cartridges used, and provide warnings to the user.

FIG. 50 is a system diagram of a combined stepper motor and DC motor driver for the cutting and printing system.

FIG. 51A is a perspective view of an exemplary printing and cutting apparatus.

FIG. 51B is a front view of the printing and cutting apparatus shown in FIG. 51A.

FIG. 51C is a back view of the printing and cutting apparatus shown in FIG. 51A.

FIG. 51D is a right side view of the printing and cutting apparatus shown in FIG. 51A.

FIG. 51E is a left side view of the printing and cutting apparatus shown in FIG. 51A.

FIG. 51F is a top view of the printing and cutting apparatus shown in FIG. 51A.

FIG. 51G is a bottom view of the printing and cutting apparatus shown in FIG. 51A.

Figure 51A:
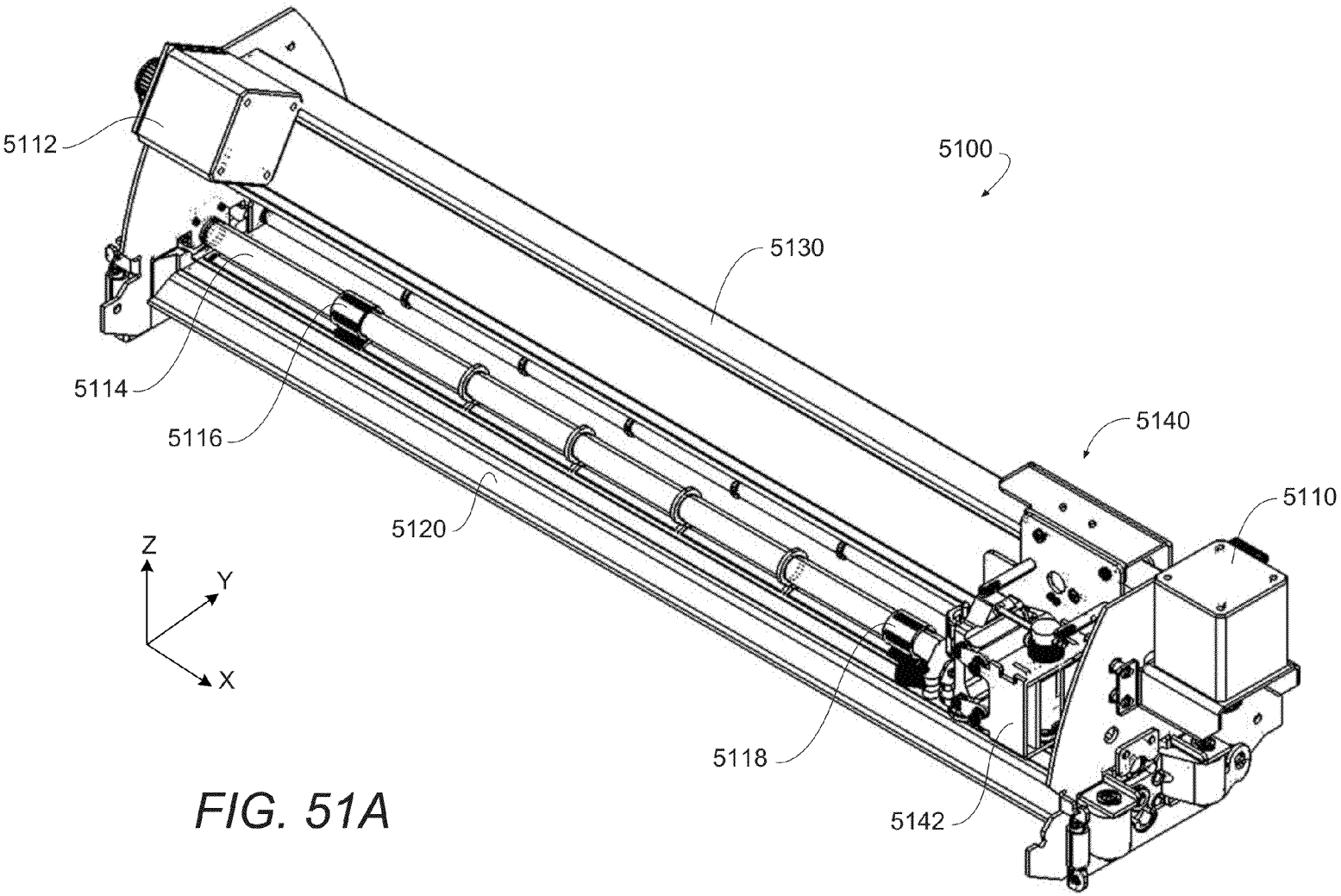
Figure 51B:
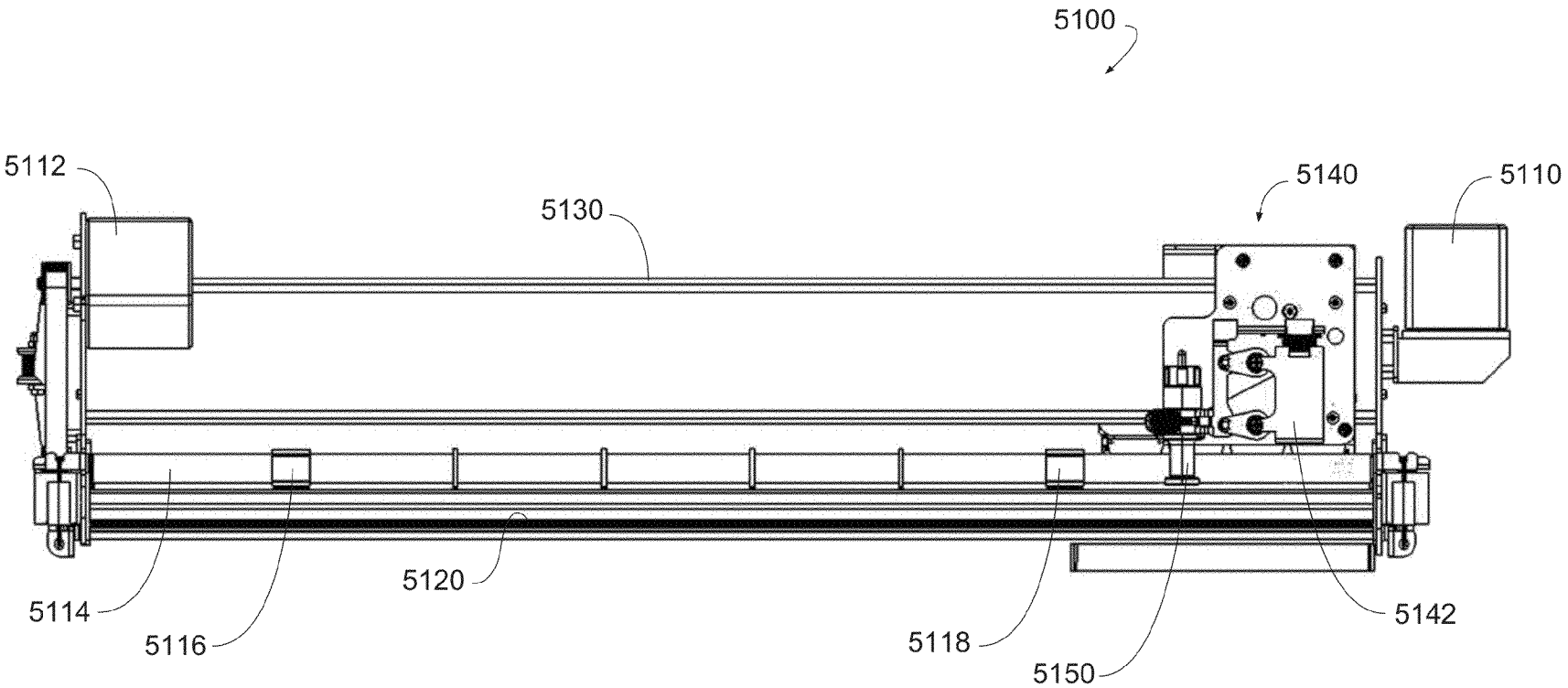
Figure 51C:
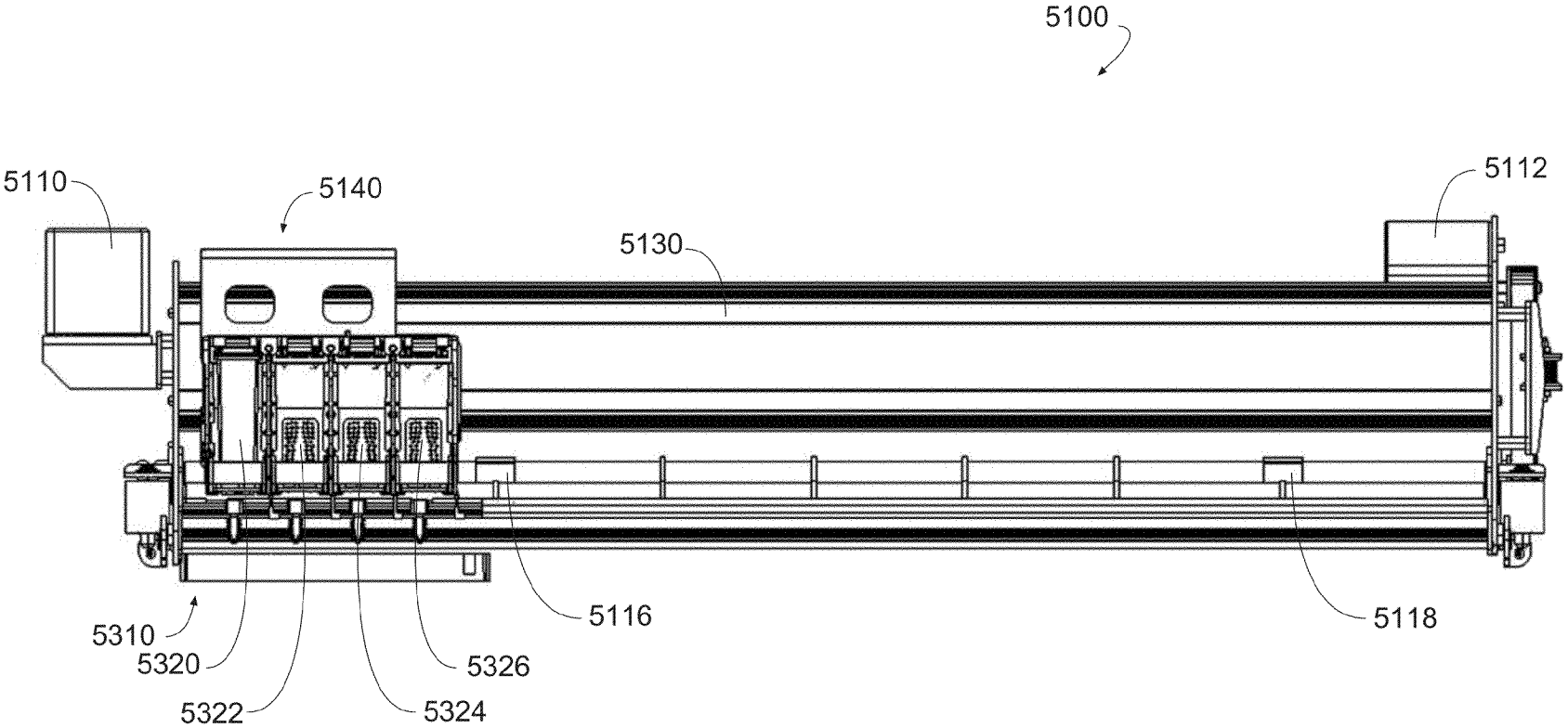
Figure 51D:
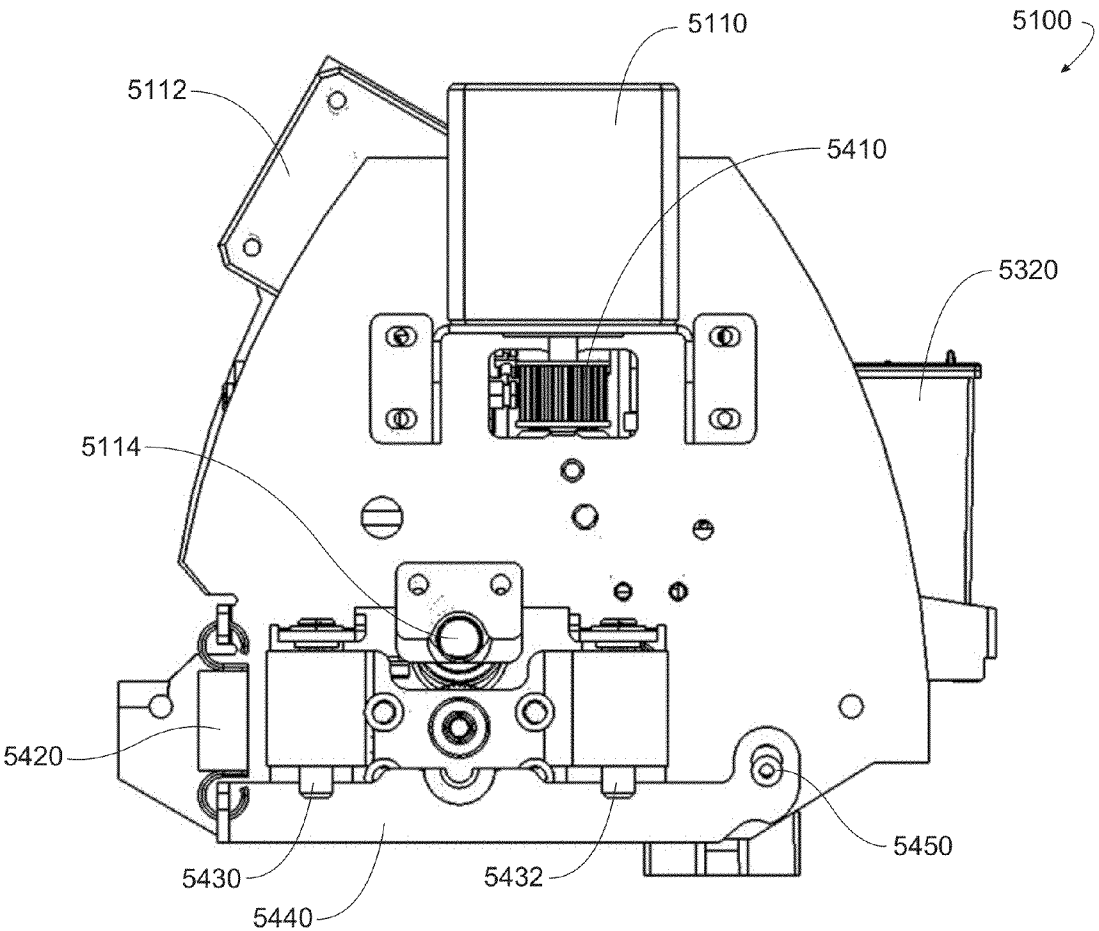
Figure 51E:
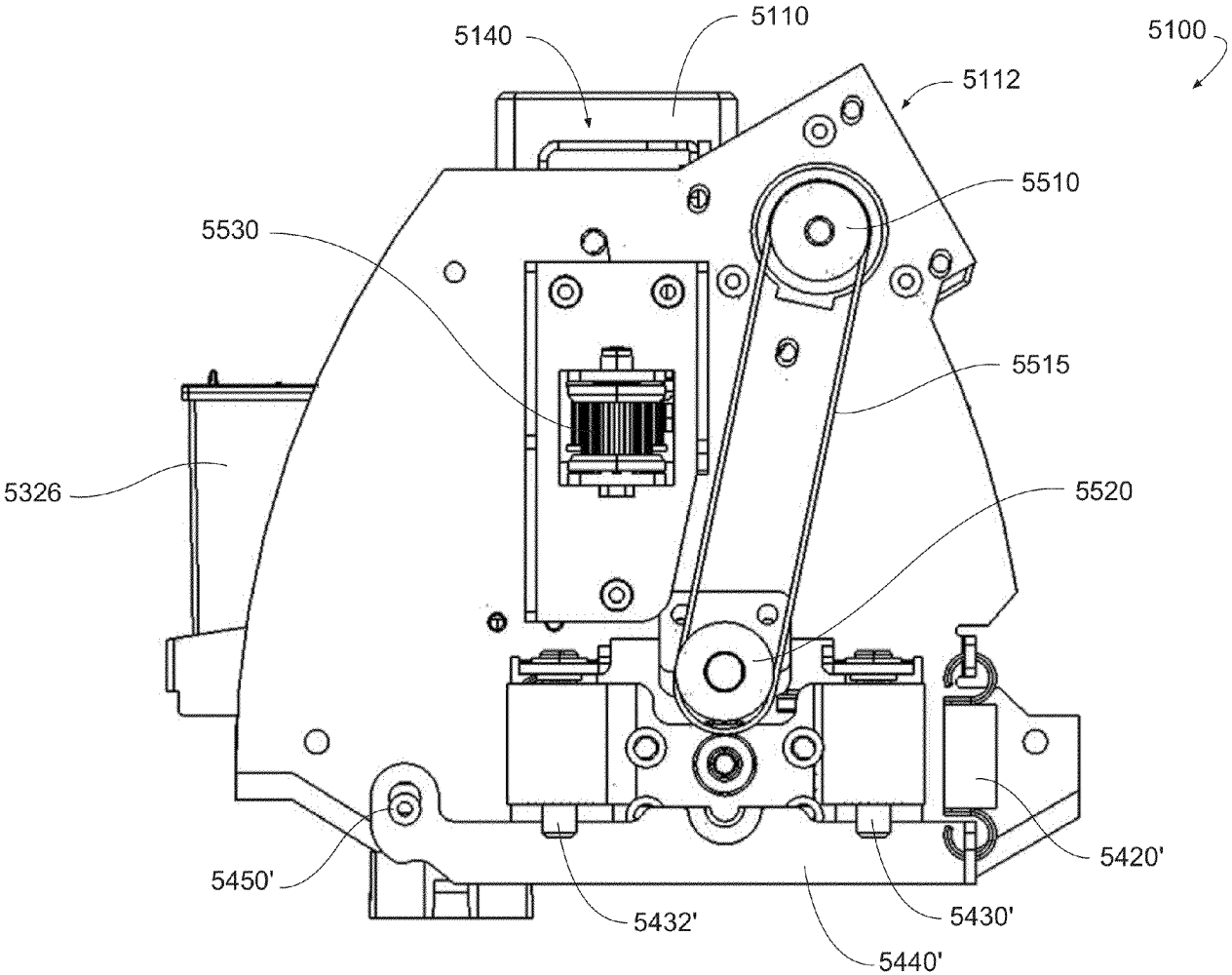
Figure 51F:
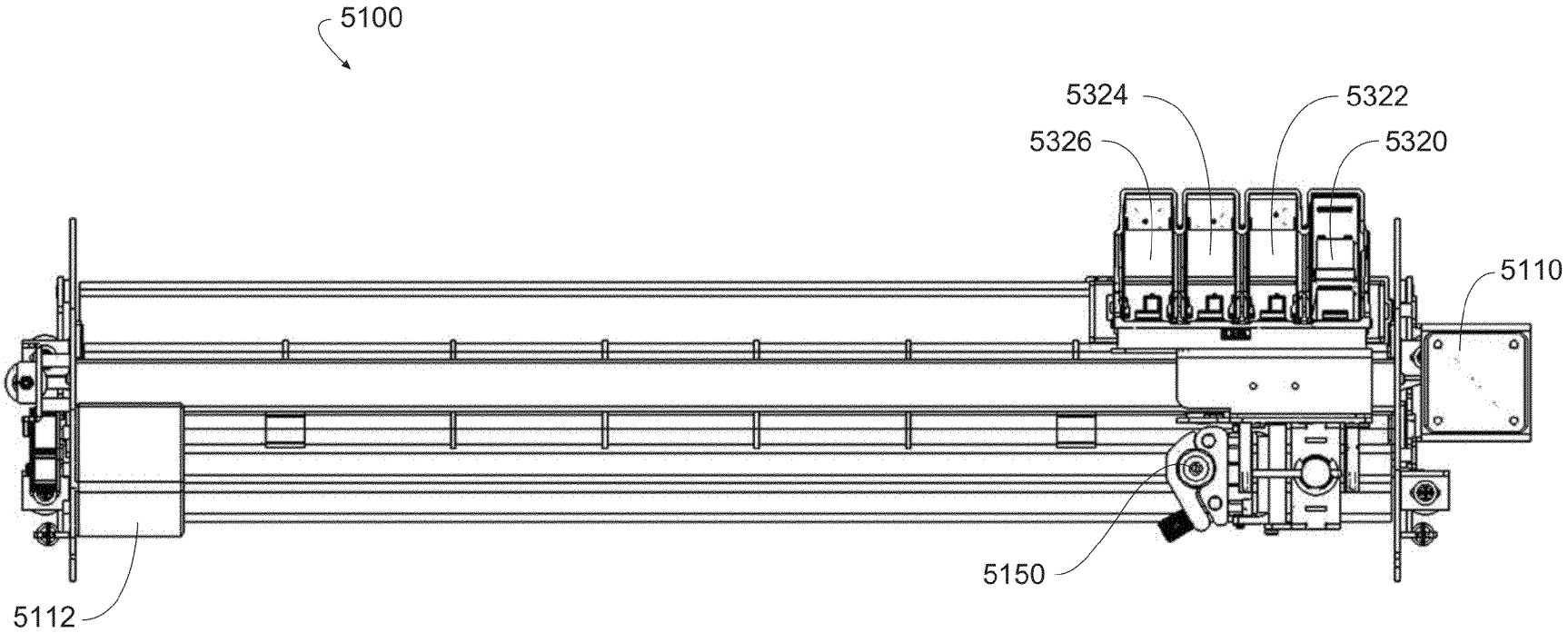
Figure 51G:
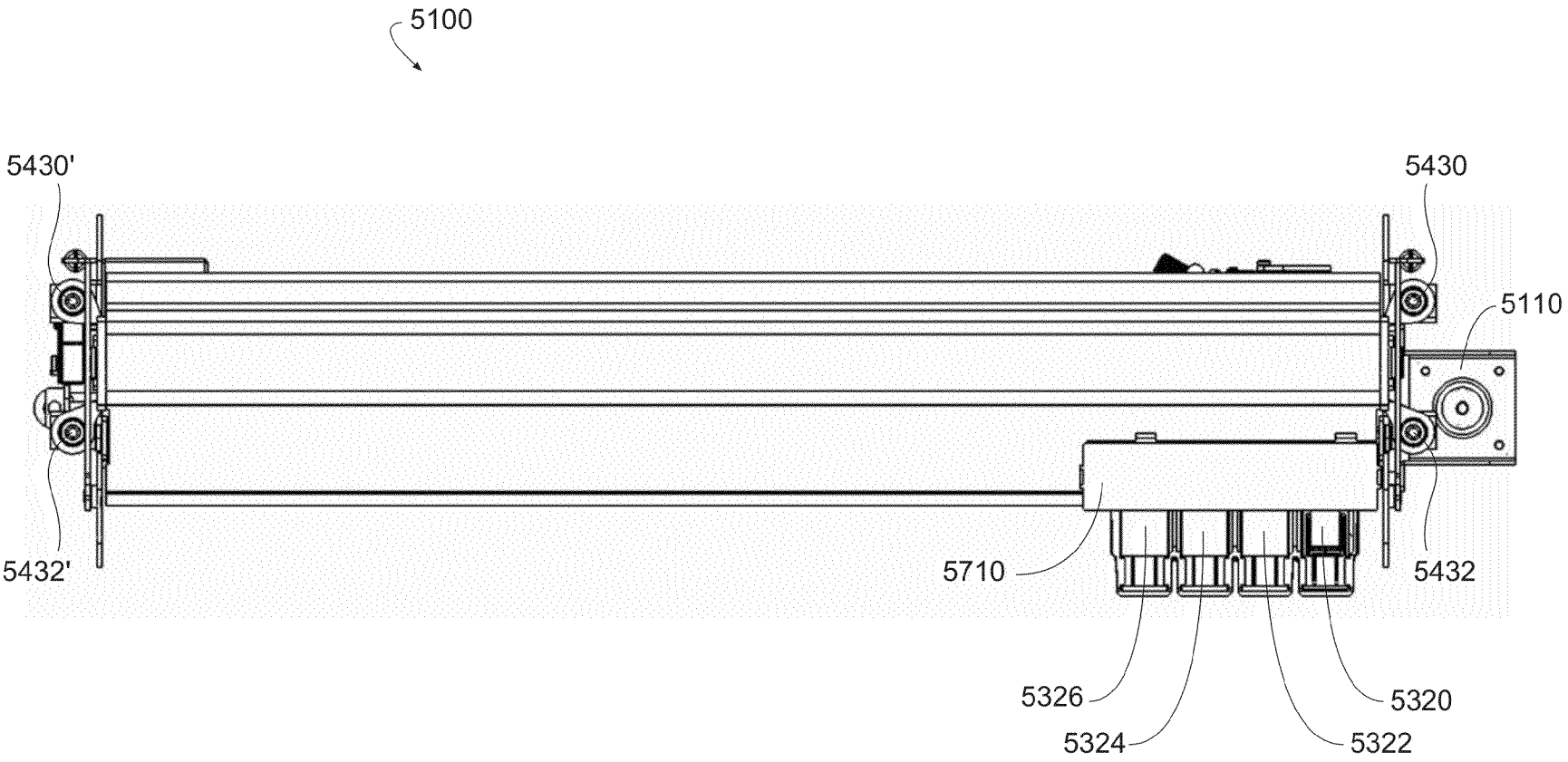
Figure 51H:
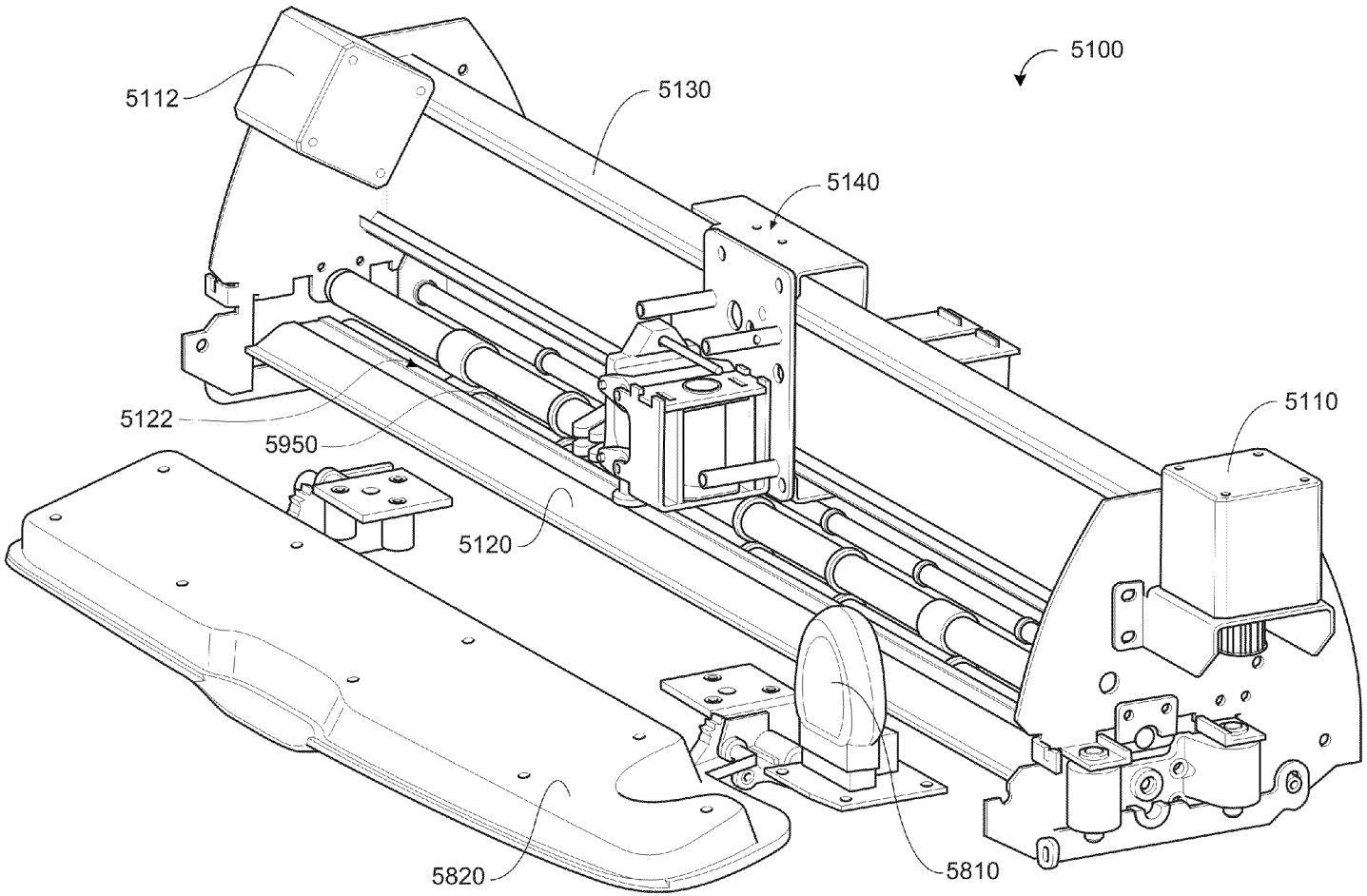

FIG. 51H is a perspective view of the printing and cutting apparatus shown in FIG. 51A.

Figure 51I:
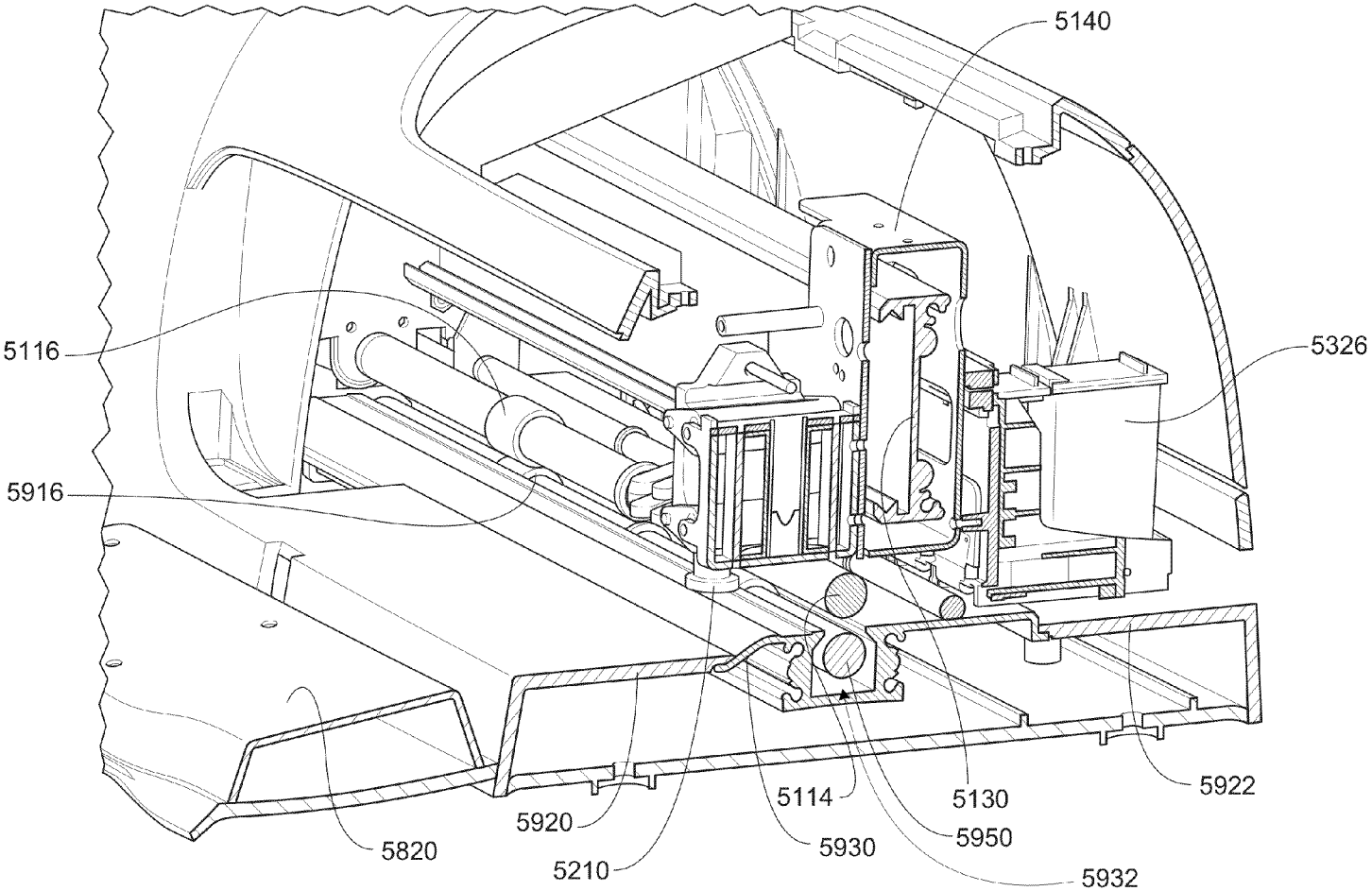

FIG. 51I is a perspective cutaway view of the printing and cutting apparatus shown in FIG. 51A.

Figure 51J:
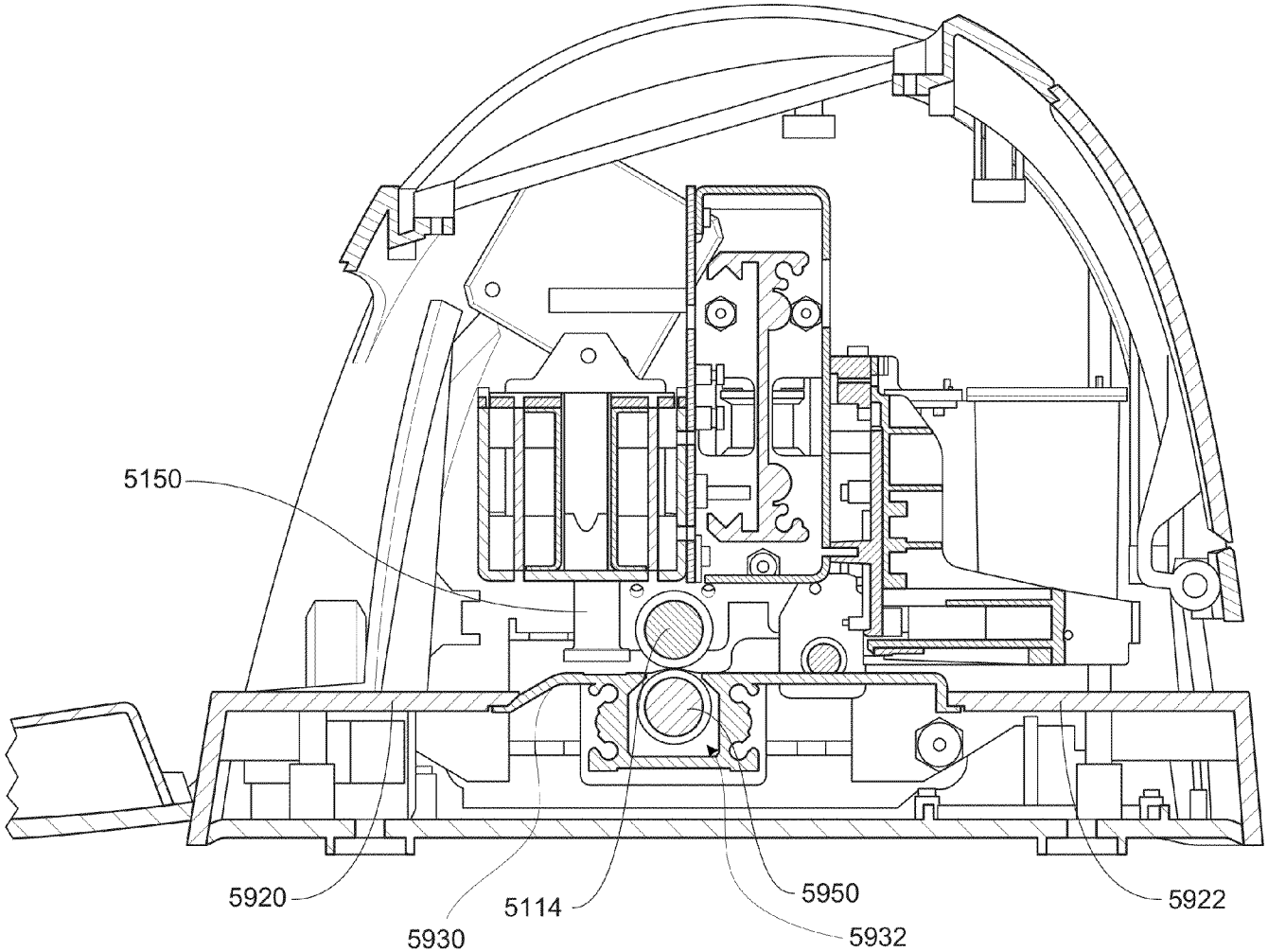

FIG. 51J is a side cutaway view of the printing and cutting apparatus shown in FIG. 51A.

Figure 51K:
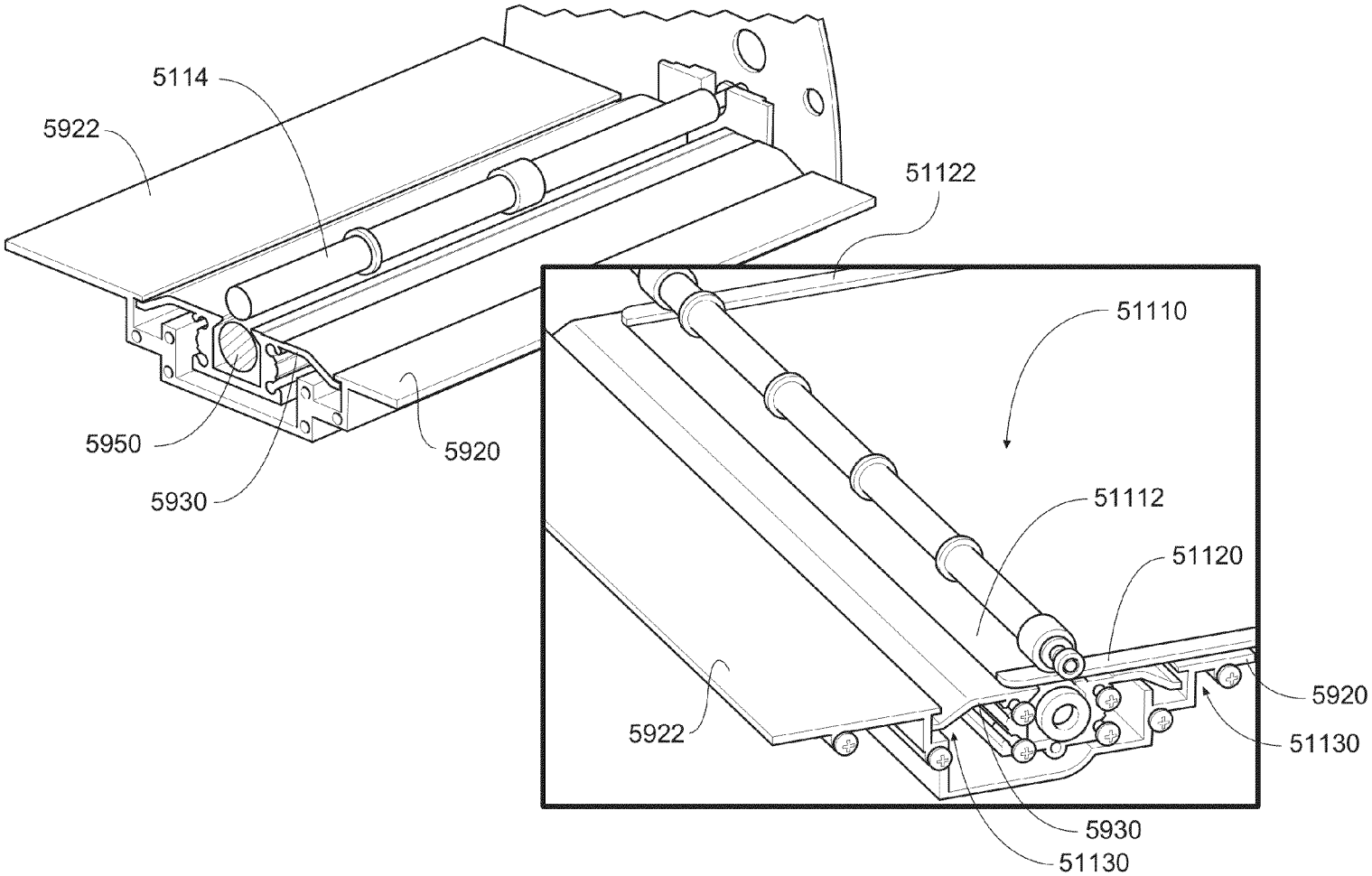

FIG. 51K provides perspective views of a roller system for engaging a mat.

Figure 52:
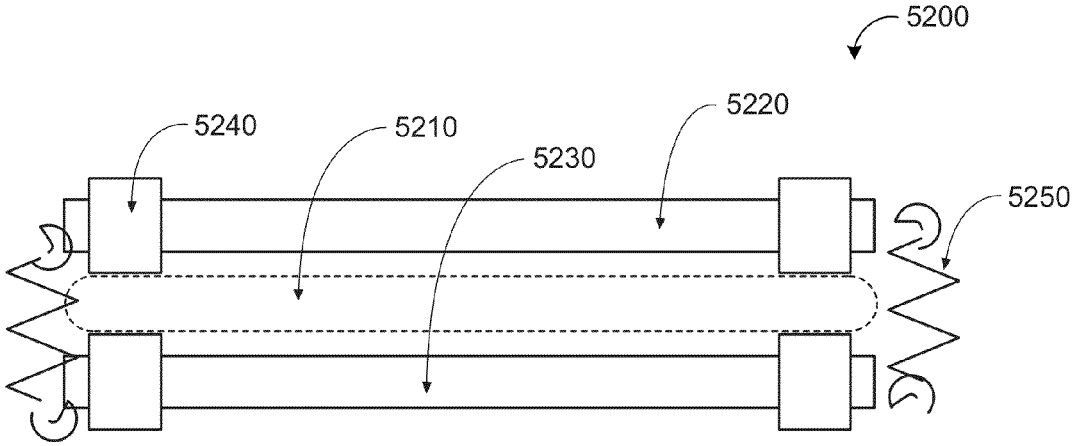

FIG. 52 is a front schematic view of a floating roller system that accepts relatively thick material stock.

Figure 53:
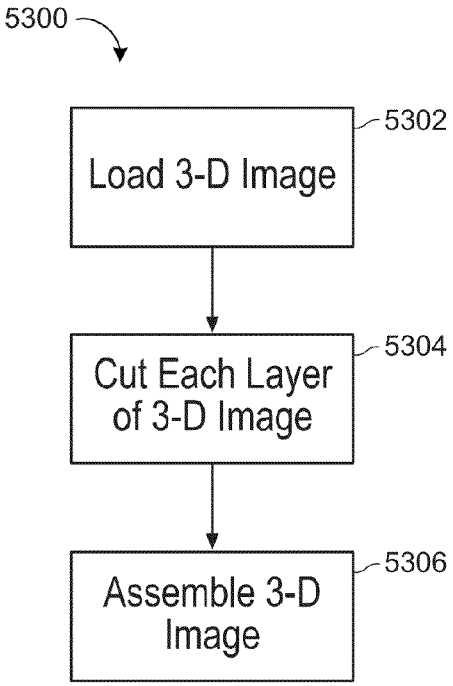

FIG. 53 is a schematic view of an exemplary arrangement of operations for cutting three-dimensional shapes.

Figure 54:
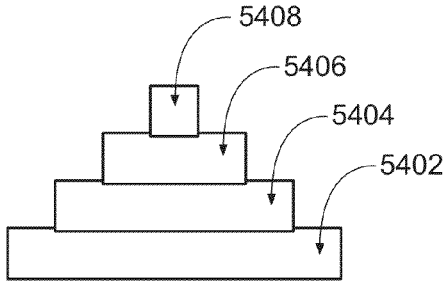

FIG. 54 is a schematic view of a layered 3-D image in cross section of a pyramid.

Figure 55:
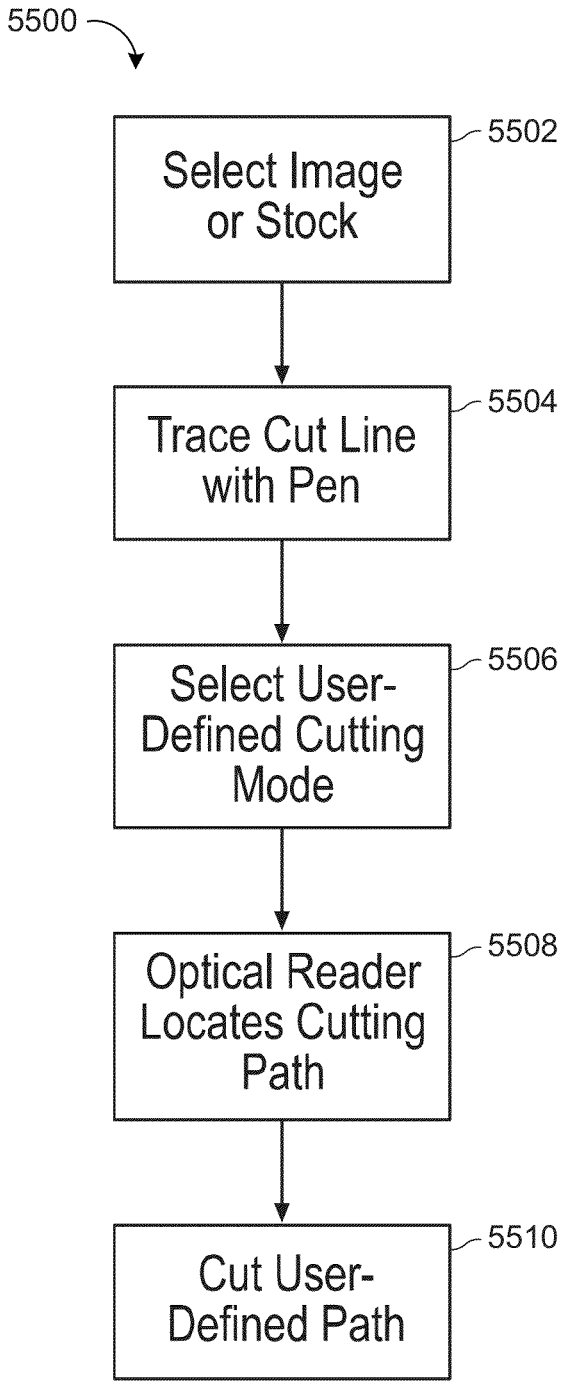

FIG. 55 is a schematic view of an exemplary arrangement of operations for user-defined cutting of a shape.

Like reference symbols in the various drawings indicate like elements.

DETAILED DESCRIPTION

A system and method for printing and cutting may be configured as a printing system combined with a cutting system for use in the craft industry, among others. An example of a cutting system is described in U.S. patent application Ser. No. 11/457,417, to Workman et al., filed Jul. 13, 2006, and entitled "ELECTRONIC PAPER CUTTING APPARATUS AND METHOD", and U.S. patent application Ser. No. 12/020,547, to Johnson et al., filed Jan. 27, 2009, and entitled "METHODS FOR CUTTING", the entirety of each is incorporated by reference herein.

Figure 1:
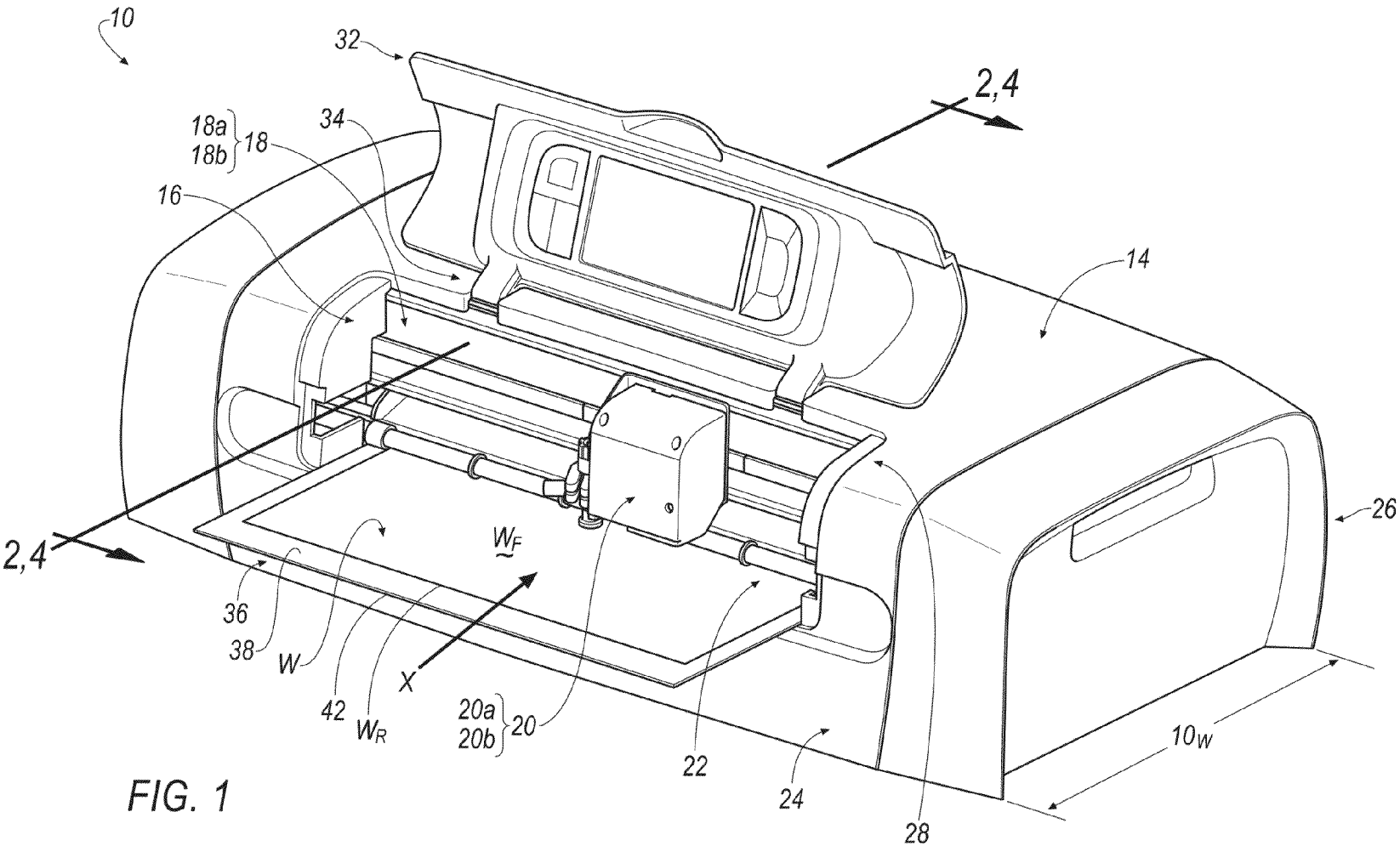
FIG. 1 is a perspective view of an exemplary crafting apparatus.

FIG. 1 illustrates an exemplary implementation of a crafting apparatus 10 that conducts "work" upon a workpiece W (see also, e.g., FIGS. 11A-11E). The term "work" that is conducted upon the workpiece W may include, but is not limited to, any number of tasks/functions. For example, the "work" may include a "cutting operation" that functionally includes contact of a blade 12*a* (see, e.g., FIG. 3D) of the crafting apparatus 10 with the workpiece W. In some implementations, the blade 12*a* partially or fully penetrates a thickness $W_T$ (see, e.g., FIGS. 11A-11E) of the workpiece W. The thickness $W_T$ of the workpiece W may be said to be bound by the first, front surface $W_F$ and the second, rear surface $W_R$.

Although the foregoing description is directed to the use of a blade 12*a*, other cutting devices may be utilized instead of a blade 12*a*. Other cutting devices may include a laser, an electrically-powered rotary cutter, or the like.

In some implementations, the "work" includes a printing operation. The printing operation may including depositing ink I from a nozzle 12*b* (see, e.g., FIG. 3B) of the crafting apparatus 10 (see, e.g., FIGS. 3B, 4, 11A) onto one or more of a first, front surface $W_F$ of the workpiece W and a second, rear surface $W_R$ of the workpiece W. The crafting apparatus 10 may conduct work in a manner that provides a combo operation such as a print and cut operation. The "print and cut operation" may in some instances be executed as a "print then cut" operation such that the printing operation is conducted prior to the cutting operation.

If the "work" is to include a "cutting operation," which includes contact of the blade 12*a* with the workpiece W, the contact of the blade 12*a* with the workpiece W may result in the workpiece W being scored 51 (see, e.g., FIG. 11B), such that the blade 12*a* does not entirely penetrate through the thickness $W_T$ of the workpiece W. In some examples, the contact of the blade 12*a* with the workpiece W may result in the workpiece W being formed to include one or more slits S2 (see, e.g., FIG. 11C), such that the blade 12*a* may be permitted to penetrate through the thickness $W_T$ of the workpiece W. The one or more slits S2 may form the workpiece W to include one or more openings or passages. In some examples, the contact of the blade 12*a* with the workpiece W results in the workpiece W being cut (see, e.g., FIGS. 4 and 11D), such that the workpiece W may be separated into two or more parts P1, P2, in order to alter the workpiece W to include one or more designs, shapes, geometries or configurations. Moreover, in additional examples, the contact of the blade 12*a* with the workpiece W results in the workpiece W including a plurality of small slits S3 (see, e.g., FIG. 11E) to form the workpiece W to include a line, predetermined pattern or the like such that the workpiece W may be said to include one or more perforations or perforated designs, shapes, geometries or configurations.

In some implementations, the workpiece W includes any desirable shape, size, geometry or material composition. The shape/geometry may include, for example, a square or rectangular shape. Alternatively, the shape may include non-square or non-rectangular shapes, such as circular shapes, triangular shapes or the like. The material composition of the workpiece W may include paper-based (e.g., paperboard or cardboard) and/or non-paper-based products (e.g., foam, rigid foam, cushioning foam, plywood, veneer, balsawood or the like). Nevertheless, although various implementations of workpiece material composition may be directed to paper or foam-based products, the material composition of the workpiece W is not limited to a particular material and may include any cuttable material. For example, the workpiece W may include an edible material, such as cake or fondant, which may alternatively be referred to as "rolled fondant," "fondant icing" or "poured fondant." Accordingly, a user may utilize the crafting apparatus 10 in order to conduct work upon an edible work piece W. For example, the crafting apparatus 10 may print edible ink [e.g., food coloring] upon and/or cut rolled fondant. The worked-on rolled fondant, as the workpiece W, may then be discharged/removed from the crafting apparatus 10 and applied to, for example, a baked good, such as a confectionery, cake, pastry, candy or the like.

Referring to FIG. 1, the workpiece W is shown to be at least partially disposed within the crafting apparatus 10 in order to permit the crafting apparatus 10 to conduct work on the workpiece W. In some implementations, the crafting apparatus 10 may be utilized in a variety of environments when conducting work on the workpiece W. For example, the crafting apparatus 10 may be located within one's home and may be connected to an external computer system (e.g., a desktop computer, a laptop computer, a dedicated/non-integral/dockable [standalone] controller device which is not a general purpose computer or the like) such that a user may utilize software that may be run by the external computer system in order for the crafting apparatus 10 to conduct work on the workpiece W.

The crafting apparatus 10 may be referred to as a "stand alone system," in some implementations, that integrally includes one or more of an on-board monitor, an on-board keyboard, an on-board processor and the like (not shown). In such an implementation, the crafting apparatus 10 may operate independently of any external computer systems (not shown) in order to permit the crafting apparatus 10 to conduct work on the workpiece W.

The crafting apparatus 10 may be implemented to have any desirable size, shape or configuration. For example, the crafting apparatus 10 may be sized to work on a relatively large workpiece W (e.g., plotting paper). Alternatively, the crafting apparatus 10 may be configured to work on a relatively small workpiece W. In implementations where the crafting apparatus 10 operates independently of an external computer system and is sized to work on relatively small workpieces, the crafting apparatus 10 may be said to be a "portable" crafting apparatus 10. Accordingly, the crafting apparatus 10 may be sized to form a relatively compact shape/size/geometry that permits a user to easily carry/move the crafting apparatus 10 from one's home, for example, to a friend's home where the friend may be hosting, for example, a "scrap-booking party."

In the example shown in FIG. 1, the crafting apparatus 10 includes a body 14 that may form or define an interior compartment 16 that houses one or more assemblies 18 including one or more working components 20 that perform work (e.g., printing and/or cutting) on the workpiece W. The interior compartment 16 may define a passage 22 extending through a width $\mathbf{10}_W$ of the crafting apparatus 10 from a front side 24 to a rear side 26 of the crafting apparatus 10. The passage 22 permits the workpiece W to be at least partially disposed within the crafting apparatus 10 for arrangement in a substantially opposing relationship with respect to the one or more working components 20.

With further reference to FIG. 1, the front side 24 of the crafting apparatus 10 may define a first opening 28 that provides access to one or more of the interior compartment 16 and the passage 22. Moreover, the rear side 26 of the crafting apparatus 10 may define a second opening 30 (see, e.g., FIGS. 3A-3D) that permits access to one or more of the interior compartment 16 and the passage 22. The second opening 30 may be substantially similar in shape/size as the first opening 28. The first opening 28 may be referred to as an "insertion opening," and the second opening 30 may be referred to as a "discharge opening." Accordingly, the workpiece W may be inserted into the crafting apparatus 10 by way of the insertion opening 28 and discharged from the crafting apparatus 10 by way of the discharge opening 30 after the crafting apparatus 10 has worked on the workpiece W, for example. Accordingly, in some implementations, the crafting apparatus 10 may operate in any manner such that the first opening 30 receives the workpiece W for work operations thereon and the second opening 28 at least partially discharges the workpiece W.

In some implementations, the crafting apparatus 10 receives the workpiece W (1) by way of the insertion opening 28 along a first feed direction X (see, e.g., FIG. 3A), (2) works on (e.g., "prints") the workpiece W with a working component 20*b* of the one or more of the working components 20, (3) partially discharges the workpiece W from the discharge opening 30 along the first feed direction X (see, e.g., FIG. 3B), (4) reverse-feeds the workpiece W back into the crafting apparatus 10 along a second feed direction X' (see, e.g., FIG. 3C) substantially opposite to the first feed direction X, (5) works on (e.g., "cuts") the workpiece W by another working component 20*a* of the one or more working components 20, and (6) discharges the work piece W from the crafting apparatus 10 by way of the insertion opening 28. Therefore, the first opening 28 may function not only as an "insertion opening" but also as a "discharge opening." Moreover, the crafting apparatus 10 may not partially discharge the workpiece W through the second opening 30, if, for example, the workpiece W is sized relatively small.

Referring again to FIG. 1, the crafting apparatus 10 may further comprise a first door 32 and a second door (not shown). In the example shown, a hinge 34 pivotally connects the first door 32 to the body 14 of the crafting apparatus 10. The first door 32 pivots between a first, open position and a second, closed position to respectively permit or deny access to one or more of the interior compartment 16 and the passage 22 by way of the first opening 28. Similarly, another hinge (not shown) may pivotally connect the second door to the body 14 of the crafting apparatus 10 to respectively permit or deny access to one or more of the interior compartment 16 and passage 22 by way of the second opening 30.

The crafting apparatus 10 may or may not operate in conjunction with a mat 36. For example, a scrapbooking kit may include the crafting apparatus 10 and/or the mat 36 for use with the crafting apparatus 10. In some implementations, the mat 36 supports the workpiece W as the workpiece W is advanced through the crafting apparatus 10 in one or more of the feed directions X, X' therethrough. While in other implementations, the workpiece W advances through the crafting apparatus 10 without the utilization of the mat 36.

One of the first, front surface $W_F$ and the second, rear surface $W_R$ of the workpiece W may be disposed substantially adjacent an upper support surface 38 of the mat 36. Moreover, the mat 36 may support the workpiece W before/during/after a period of time that the crafting apparatus 10 works on the workpiece W. In some examples, the mat 36 is formed from a material (e.g., a plastic material) that resists deformation by the blade 12*a* when the blade 12*a* penetrates through the thickness $W_T$ of the workpiece W. Furthermore, the upper support surface 38 of mat 36 may include a tacky surface that permits the workpiece W to be removably-coupled to the mat 36.

Figure 2:
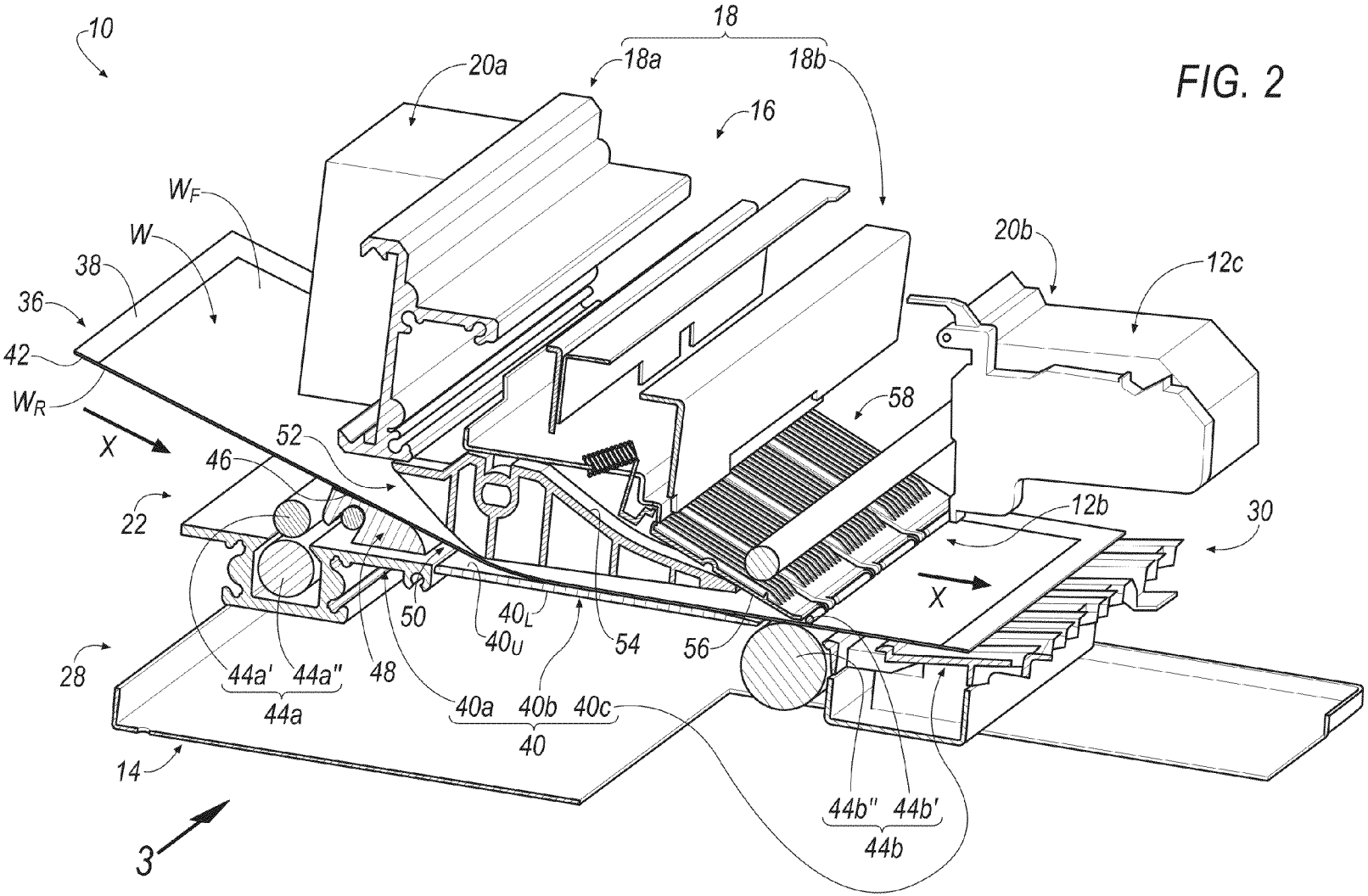
FIG. 2 is a perspective, partial, cut-away, cross-sectional view of the crafting apparatus according to line 2-2 of FIG. 1.

FIG. 2 provides a partial, cut-away view of the body 14 of the crafting apparatus 10 illustrating an example having the one or more assemblies 18 including the one or more working components 20 housed within interior compartment 16. In this example, the crafting apparatus 10 further comprises a support assembly 40.

In some implementations, the support assembly 40 includes a first support portion 40*a*, a second support portion 40*b* and a third support portion 40*c*. Although the cross-sectional hatching of the support assembly 40 indicates that the first, second and third support portions 40*a*-40*c* are unique segments, which may be formed from different materials, the first, second and third support portions 40*a*-40*c* may nevertheless include the same material and may be integrally formed from a single unitary body that may be demarcated to form the support assembly 40 into three unique segments.

In the example shown, the support assembly 40 includes a first, upper support surface $\mathbf{40}_U$ and a second, lower surface $\mathbf{40}_L$. Each of the first, second and third support portions 40*a*-40*c* may form a segment of the first, upper support surface $\mathbf{40}_U$ and the second, lower surface $\mathbf{40}_L$. Further, each segment of the first, upper support surface $\mathbf{40}_U$ and the second, lower surface $\mathbf{40}_L$ formed by each of the first, second and third support portions 40*a*-40*c* may not be co-planar with one another. In some examples, the first, upper support surface $\mathbf{40}_U$ supports one or more of the mat 36 and the workpiece W. A lower support surface 42 of the mat 36 and/or the second, rear surface $W_R$ of the workpiece W may be disposed substantially adjacent the first, upper support surface $\mathbf{40}_U$ of the support assembly 40.

In some implementations, the one or more working assemblies 18 include a first working assembly 18*a* and a second working assembly 18*b*. The first working assembly 18*a* includes a first working component 20*a*, and the second working assembly 18*b* includes a second working component 20*b*.

Referring to FIGS. 3A-3D, in some implementations, the first working component 20*a* includes the blade 12*a* and may be referred to as a "cutting head." The second working component 20*b* includes the nozzle 12*b* and may be referred to as a "printing head." In some examples, as seen in FIG. 2, the printing head 18*b* further includes one or more cartridges 12*c* containing one or more colors of ink I and is in fluid communication with the nozzle 12*b*.

Although in some implementations the crafting apparatus 10 includes one or more working assemblies 18 having a first working assembly 18*a* and a second working assembly 18*b* each respectively including a first working component 20*a* and a second working component 20*b*, the crafting apparatus 10 may include other configurations. For example, the crafting apparatus 10 may include one working assembly 18 that includes one working component 20 as a hybrid working component 20 that includes both of the blade 12*a* and the nozzle 12*b*.

As the workpiece W is not limited to a particular size, shape, geometry or configuration, the crafting apparatus 10 is configured to receive and work on a variety of different workpieces W that may each include a different thickness $W_T$. For example, the thickness $W_T$ of a workpiece W may depend upon the type of material composition and/or use of the workpiece W (i.e., the thickness $W_T$ of a sheet of paper W may be substantially less than that of the thickness $W_T$ of a sheet of cardboard W). Thus, since the thickness $W_T$ of a workpiece W may not be the same for all workpieces W, the crafting apparatus 10 may include an adjustment assembly (not shown) that permits the workpiece W and/or the one or more components of the assemblies 18 (e.g., the blade 12*a*/the nozzle 12*b*) to be spaced away from each other. One or more exemplary adjustment assemblies are shown and described in commonly-owned U.S. Application Ser. No. 61/289,882, filed on Dec. 23, 2009, the contents of which is hereby incorporated by reference in its entirety.

Further, depending on the type of material composing the workpiece W and/or thickness $W_T$ of the workpiece W, the crafting apparatus 10 may include a motor (not shown) providing enough torque for driving one or more of the first and second working assemblies 18*a*, 18*b* in order to permit one or more of the first and second working assemblies 18*a*, 18*b* to conduct work on the workpiece W. For example, if the workpiece W is composed of a thin sheet of paper, the torque applied by the motor during a cutting operation may be less than that if, for example, the workpiece W is composed of balsawood, veneer or the like. Accordingly, the amount of torque provided by the motor may be computed in view of a sensor (not shown) that determines the material composition of the workpiece, or, a user input that informs the crafting apparatus 10 as to what particular type of material composes the workpiece W. Rather than sensing/computing the amount of torque, a user may manually select the amount of torque by adjusting, for example, a dial (not shown). The dial may be adjusted to any desirable motor torque setting at or ranging between a low torque setting and a high torque setting.

Figure 3A:
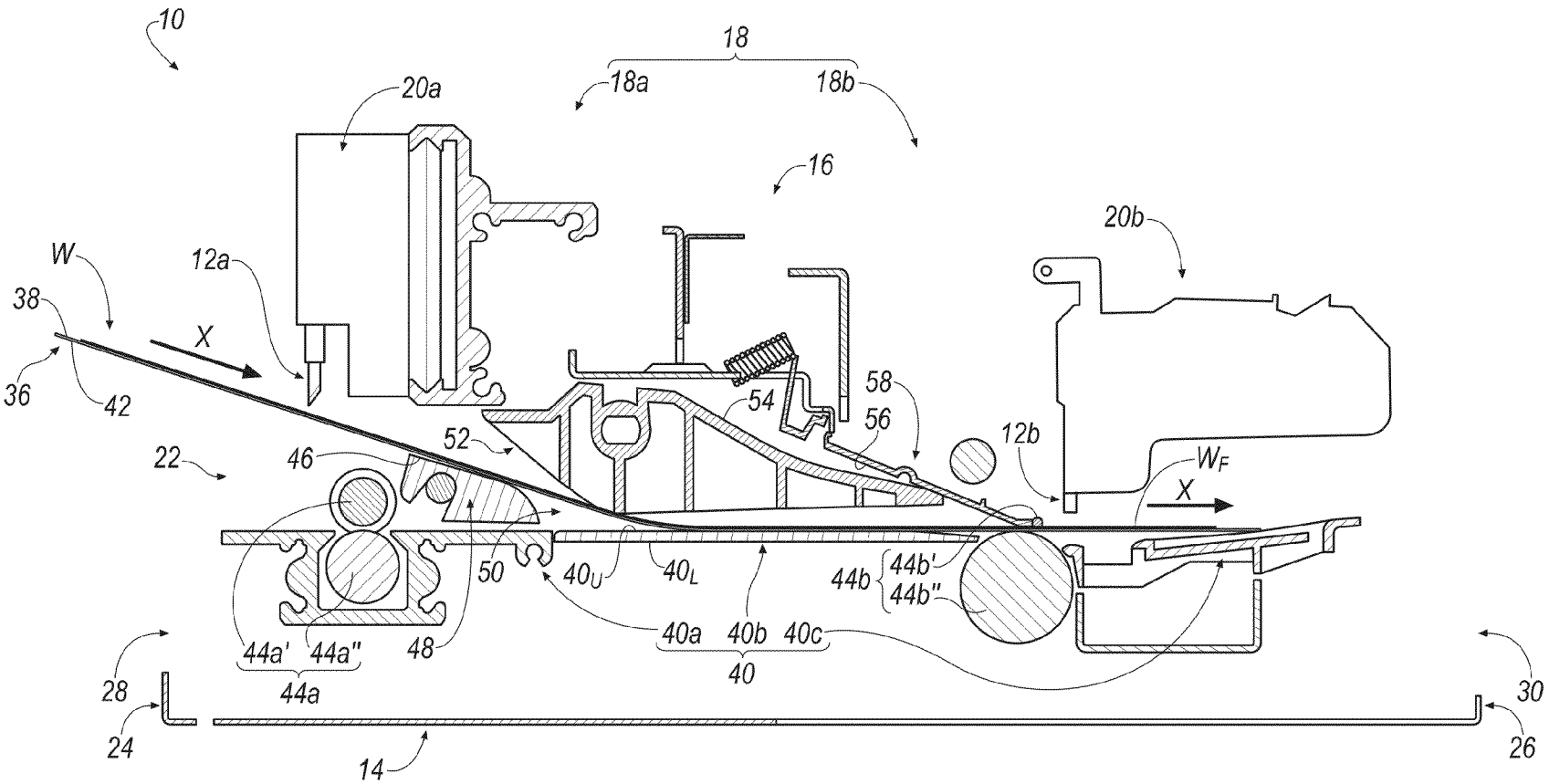
FIGS. 3A-3D each illustrate a partial, cross-sectional view of the crafting apparatus according to line 3 of FIG. 2.
Figure 3B:
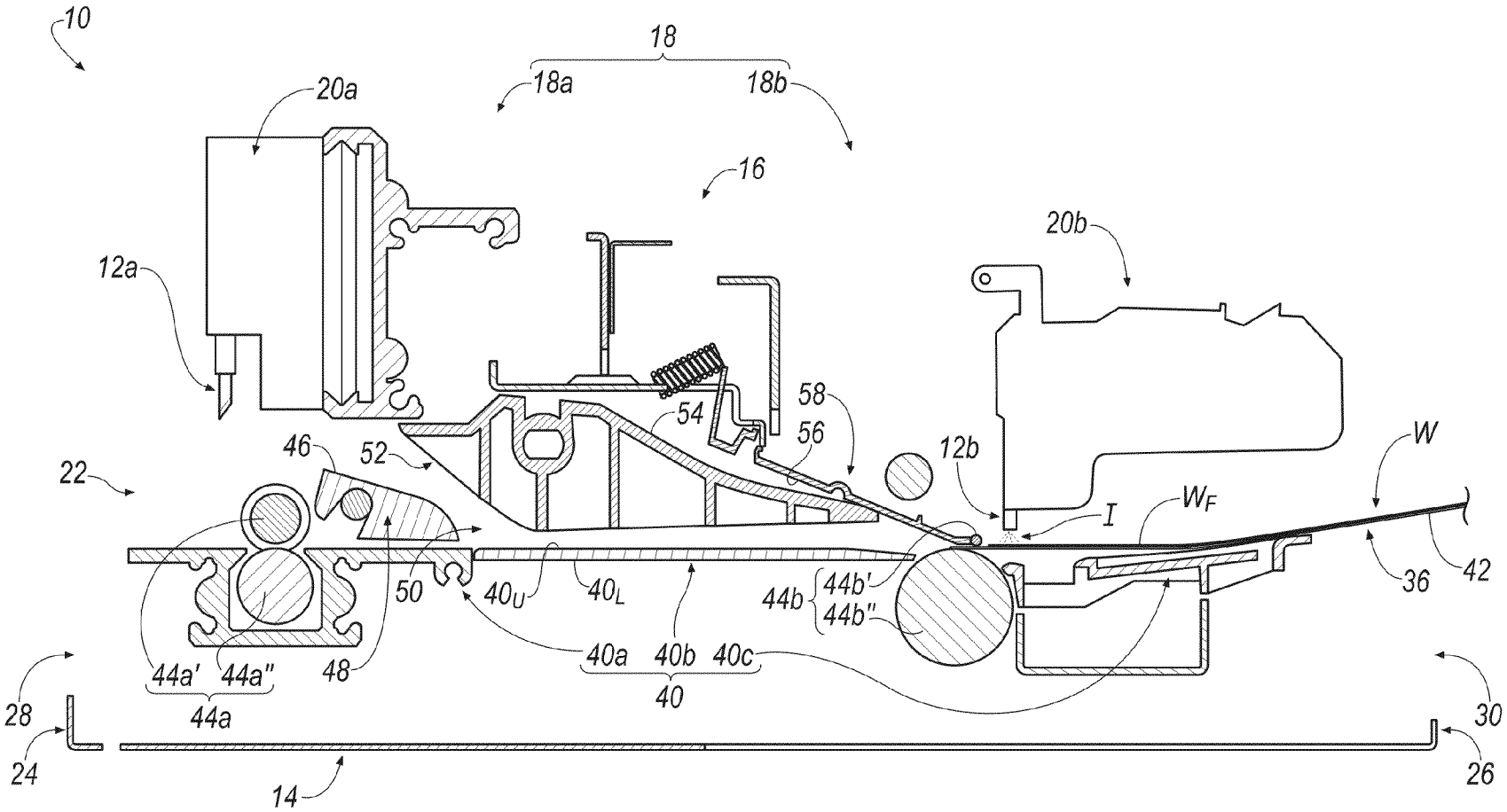
Figure 3C:
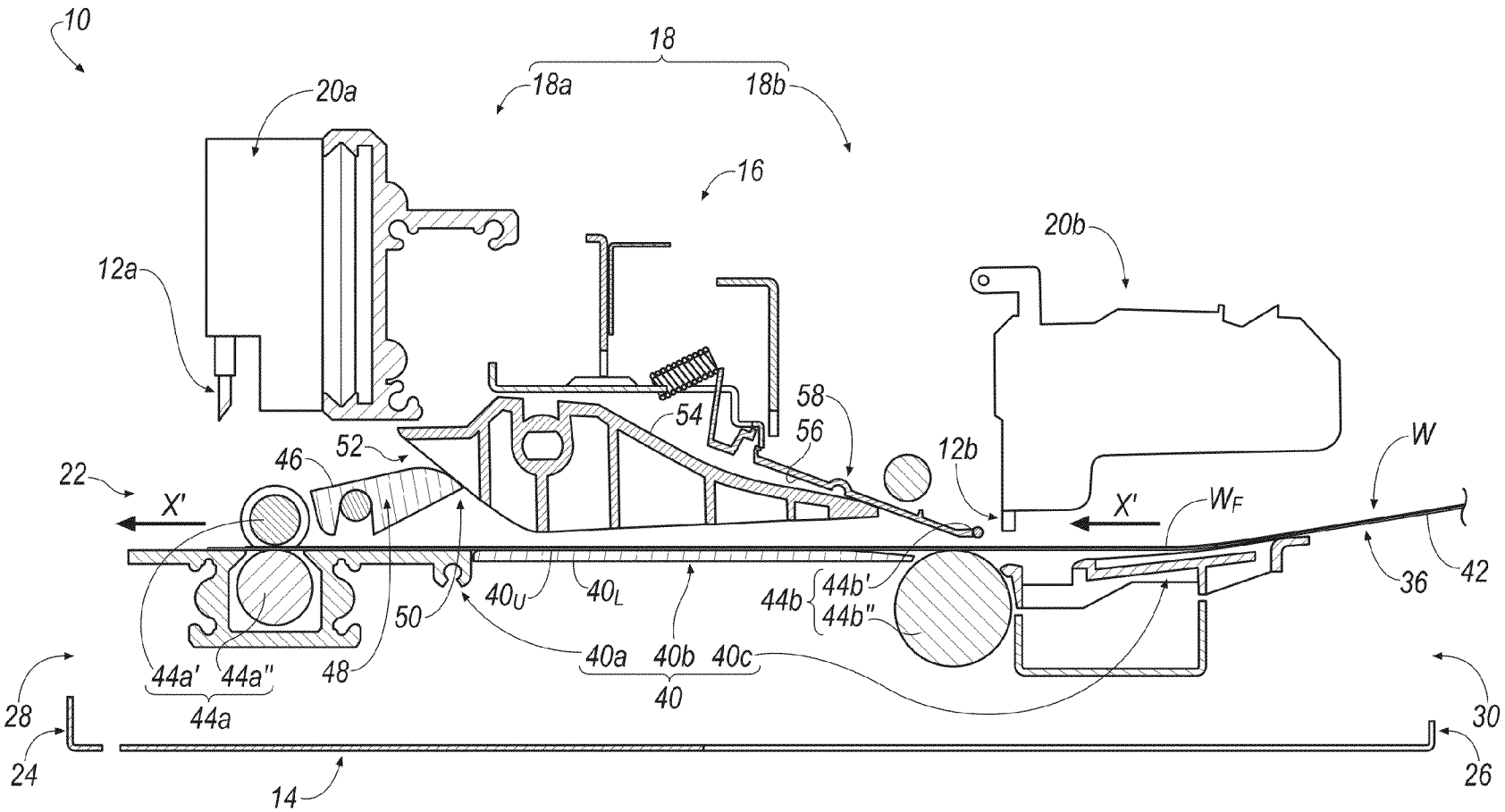
Figure 3D:
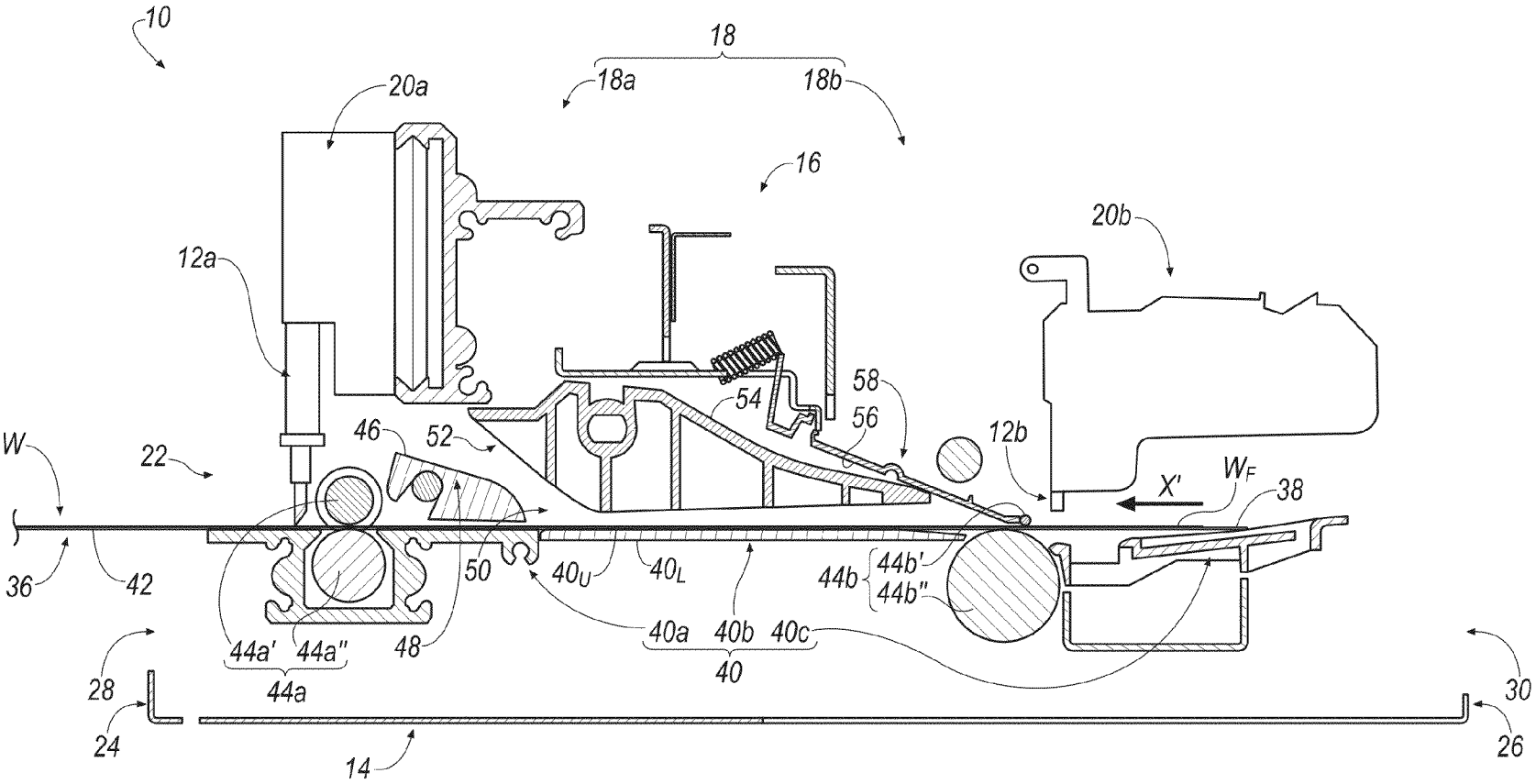
Figure 4:
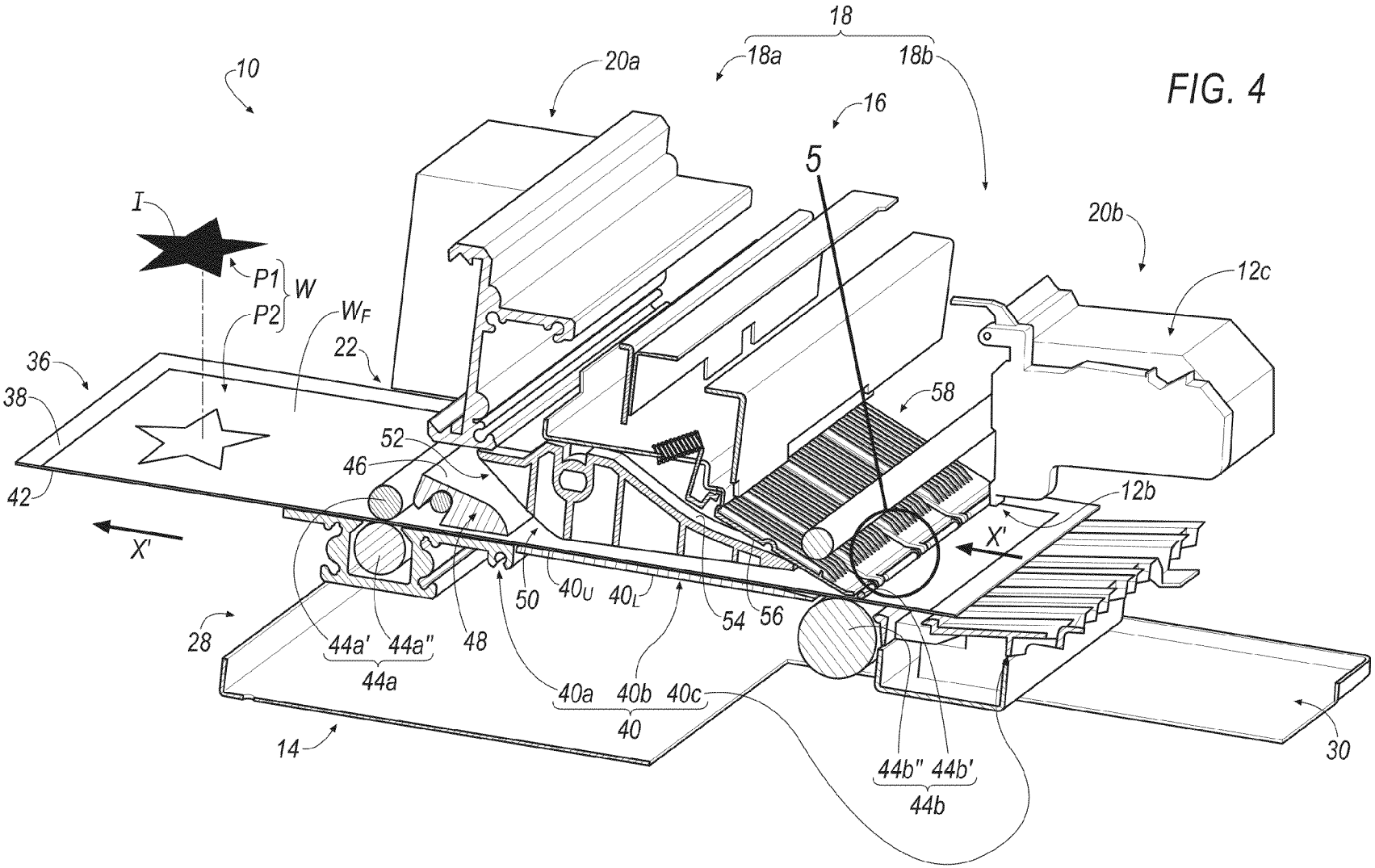
FIG. 4 is a perspective, partial, cut-away, cross-sectional view of the crafting apparatus according to line 4-4 of FIG. 1.

Referring to FIGS. 2-4, each of the first and second working assemblies 18*a*, 18*b* include a pair of rollers 44*a*, 44*b* having a first, upper roller 44*a*', 44*b*' and a second, lower roller 44*a*", 44*b*". The first, upper roller 44*a*', 44*b*' and the second, lower roller 44*a*", 44*b*" may be arranged substantially close to/adjacent one another such that the first, upper roller 44*a*', 44*b*' and the second, lower roller 44*a*", 44*b*" may be said to be arranged in an "engagement orientation." Moreover, the first, upper roller 44*a*', 44*b*' and the second, lower roller 44*a*", 44*b*" may be arranged in separated/spaced-apart manner such that the first, upper roller 44*a*', 44*b*' and the second, lower roller 44*a*", 44*b*" may be said to be arranged in a "disengaged orientation."

In some implementations, a passage or opening 22 defined by the support assembly 40 allows physical communication of the first, upper roller 44*a*', 44*b*' with the second, lower roller 44*a*", 44*b*". Further, as seen in FIGS. 3A-3D, the first, upper roller 44*a*', 44*b*' may be arranged proximate the first, upper support surface $\mathbf{40}_U$ of the support assembly 40 whereas the second, lower roller 44*a*", 44*b*" may be arranged proximate the second, lower surface $\mathbf{40}_L$. of the support assembly 40.

Before, during or after work being conducted upon the workpiece W, the workpiece W may be arranged between the first, upper roller 44*a*', 44*b*' and the second, lower roller 44*a*", 44*b*" such that one or more of the pairs of rollers 44*a*, 44*b* may advance the workpiece W through the passage 22 along at least one of the first and second feed directions X, X'. The motor, having a selected/determined torque as described above, may drive the rollers 44*a*, 44*b*. The first feed direction X may be referred to as a "forward feed direction" whereas the second feed direction X' may be referred to as a "reverse feed direction," which is substantially opposite to the forward direction X. However, other feed directions are possible as well. For example, if the workpiece W is inserted into the passage 22 by way of the second opening 30, movement of the workpiece W along the second feed direction X' may be referred to as the "forward feed direction" and the first feed direction X may be referred to as the "reverse feed direction."

In the examples shown in FIGS. 2-4, the crafting apparatus 10 includes a feed path bypass assembly for providing one or more feed paths of the workpiece W and/or the mat 36 through the passage 22 of crafting apparatus 10 along at least one of the first and second feed directions X, X'. In some implementations, the feed path along the first and/or second feed direction X, X' includes a controlled movement of the workpiece W and/or the mat 36 through the passage 22 of the crafting apparatus 10 such that the workpiece W and/or the mat 36 may bypass at least one of the pairs of rollers 44*a*, 44*b*. Further, the first, upper roller 44*a*'/44*b*' and the second, lower roller 44*a*"/44*b*" may be arranged in one of the "engagement orientation" and the "disengaged orientation."

In some implementations, when the first, upper roller 44*a*'/44*b*' and the second, lower roller 44*a*"/44*b*" are positioned substantially close to/adjacent one another, the first, upper roller 44*a*', 44*b*' and the second, lower roller 44*a*", 44*b*" may be said to be arranged in an "engagement orientation" when one or more of the workpiece W and mat 36 is/are moved through the passage 22 of the crafting apparatus 10. Conversely, when the first, upper roller 44*a*'/44*b*' and the second, lower roller 44*a*"/44*b*" are positioned away from one another, the first, upper roller 44*a*', 44*b*' and the second, lower roller 44*a*", 44*b*" may be said to be arranged in a "disengaged orientation" when one or more of the workpiece W and mat 36 is/are moved through the passage 22 of the crafting apparatus 10.

Referring to FIGS. 2 and 3A, a user may initiate a feed path of the workpiece W and/or the mat 36 by inserting the workpiece W and/or the mat 36 through the opening 28 and into the passage 22 along the first feed direction X, such that the rear surface 42 of the mat 36 may be initially supported by an upper surface 46 (see, e.g., FIG. 3A) of a bypass toggle member 48. In some implementations, the bypass toggle member 48 is arranged within the interior compartment 16 between the first pair of rollers 44*a* and the second pair of rollers 44*b*. In the example shown, since the workpiece W and the mat 36 are inserted through the opening 28 along the first feed direction X, the bypass toggle member 48 may be said to be relatively located downstream of the first pair of rollers 44*a* and upstream of the second pair of rollers 44*b*. Further, because the workpiece W and the mat 36 are inserted into the opening 28 and initially supported by or comes into contact with the bypass toggle member 48 that is downstream of the first pair of rollers 44*a*, the workpiece W and the mat 36 bypass the pair of rollers 44*a* associated with the cutting head 18*a* upon initiation of movement of the workpiece W along the first feed direction X and along the feed path. Although the examples shown illustrate the workpiece W being fed along the first feed direction X, which results in the workpiece W being "fed over" and bypassing the first pair of rollers 44*a*, the workpiece W may be initially fed through while also bypassing the first pair of rollers 44*a*, if, for example, the first pair of rollers 44*a* are arranged in a spaced-apart, disengaged orientation. The direct or indirect bypassing of the first pair of rollers 44*a* may reduce an amount of force or friction applied to the workpiece W such that the first pair of rollers 44*a* may not interfere with movement of the workpiece W during a printing operation performed on the workpiece W by the printing head 18*b*.

After bypassing the first pair of rollers 44*a*, a bypass roller (not shown) may advance the workpiece W and/or the mat 36 through the passage 22 along the first feed direction X, until the workpiece W and/or the mat 36 comes into contact with the second pair of rollers 44*b* associated with the printing head 18*b*. Once the workpiece W and/or the mat 36 engage the second pair of rollers 44*b*, the second pair of rollers 44*b* may further advance of the workpiece W and the mat 36 along at least one of the first and second feed directions X, X' before, during or after the depositing of the ink I (see, e.g., FIG. 3B) onto the workpiece W.

In some implementations, the feed path includes the step of bypassing the first pair of rollers 44*a* which may be advantageous when work (i.e., the deposition of ink I onto the workpiece W) is performed by the printing head 18*b*. In the examples shown, the blade 12*a* of the cutting head 18*a* directly contacts the workpiece W (see, e.g., FIG. 3D), whereas the nozzle 12*b* does not contact the workpiece W (see, e.g., FIG. 3B) when the heads 18*a*, 18*b* conduct work on the workpiece W; as such, in order for the blade 12*a* to cut into/slit the workpiece W the first pair of rollers 44*a* may need to apply a greater amount of force/frictional resistance to the workpiece W and/or the mat 36 as compared to that of the force/frictional resistance applied by the second pair of rollers 44*b* to the workpiece W. Accordingly, in some circumstances, where the workpiece W and/or the mat 36 contact (i.e. not bypass) the first pair of rollers 44*a* at the outset of the feed path, the force/frictional resistance applied by the first pair of rollers 44*a* to the workpiece W and/or the mat 36 may interfere with and/or prevent the movement of the workpiece W and the mat 36 along one of the feed directions X, X' by the second pair of rollers 44*b* when the printing head 18*a* performs work on the workpiece W. As such, if the first pair of rollers 44*a* engage the workpiece W and/or the mat 36 during a printing operation by the printing head 18*b*, an undesirable deposition of ink I onto the workpiece W may occur. In turn, the crafting apparatus 10 may execute a failed or defective printing operation. Thus, bypassing the first pair of rollers 44*a* at the outset of the feed path permits the crafting apparatus 10 to eliminate the possibility of the first pair of rollers 44*a* applying a force/frictional resistance to one or more or the workpiece W and the mat 36 when the printing head 18*b* conducts work upon the workpiece W.

Although some implementations of the feed path include "directly bypassing" the first pair of rollers 44*a* by arranging the workpiece W and/or the mat 36 on the upper surface 46 of the bypass toggle member 48, as illustrated in FIGS. 2-3A, other feed path implementations are possible as well. For example, the bypassing step may also be provided by arranging the first pair of rollers 44*a* in the "disengaged orientation" such that the first, upper roller 44*a*' and the second, lower roller 44*a*" are arranged in a separated/spaced-apart manner. When the first, upper roller 44*a*' and the second, lower roller 44*a*" are arranged in the separated/spaced-apart manner, one or more of the workpiece W and mat 36 may be said to "indirectly bypass" the first pair of rollers 44*a* due to the fact that one or more of the workpiece W and mat 36 are inserted through/between the first, upper roller 44*a*' and the second, lower roller 44*a*" without the first, upper roller 44*a*' and the second, lower roller 44*a*" applying a force/frictional resistance to one or more of the workpiece W and the mat 36.

As illustrated in FIG. 3B, once the workpiece W and/or the mat 36 has bypassed the first pair of rollers 44*a*, the second pair of rollers 44*b* may move the workpiece W and/or the mat 36 along one of the feed directions X, X' before/during/after the printing head 18*b* conducts work on the workpiece W. Moreover, as seen in FIG. 3B, the second pair of rollers 44*b* may at least partially discharge the workpiece W and/or the mat 36 through the second opening 30.

Referring to FIG. 3C, at least one of the rollers 44*b*', 44*b*" of the second pair of rollers 44*b* may move the workpiece W and/or the mat 36 on the upper support surface $\mathbf{40}_U$ of the support assembly 40 along the second feed direction X', in order to locate the workpiece W and/or the mat 36 proximate the cutting head 18*a* so that the cutting head 18*a* may conduct work on (i.e., cut or slit) the workpiece W. Moving the workpiece W and/or the mat 36 along the feed path in the second feed direction X' may be referred to as reverse feeding the workpiece W and/or the mat 36 back into the crafting apparatus 10 such that any partially-discharged portion of the workpiece W and/or the mat 36 are drawn back into the crafting apparatus 10 through the second opening 30.

Further, as seen in FIG. 3C, prior to arranging the workpiece W and/or the mat 36 proximate the first pair of rollers 44*a* of the cutting head 18*a*, the user or the crafting apparatus 10 may pivot the bypass toggle member 48 from a "down orientation" (see, e.g., FIGS. 2-3B) to an "up orientation." Pivoting of the bypass toggle member 48 to the "up orientation" may provide the crafting apparatus 10 with several operational advantages. For example, pivoting the bypass toggle member 48 from the "down orientation" to the "up orientation," selectively directs the workpiece W and/or the mat 36 toward the first pair of rollers 44*a* when advancing the workpiece W and/or the mat 36 toward the first pair of rollers 44*a* along the second feed direction X'. Moreover, pivoting the bypass toggle member 48 from the "down orientation" to the "up orientation" may also selectively close-out a bypass opening 50 (see, e.g., FIGS. 2-3B) formed by the bypass toggle member 48 and a print head roller actuator toggle member 52.

In some implementations, pivoting the bypass toggle member 48 from the "down orientation" to the "up orientation" selectively cause the bypass toggle member 48 to pivot the print head roller actuator toggle member 52 from a "down orientation" (see, e.g., FIGS. 2-3B) to an "up orientation" (see, e.g., FIG. 3C) in order to cause an upper surface 54 of the print head roller actuator toggle member 52 to engage a lower surface 56 of one or more carriers 58 coupled to the first, upper roller 44*b*' of the second pair of rollers 44*b*. Engagement of the upper surface 54 of the print head roller actuator toggle member 52 with the lower surface 56 of one or more carriers 58 also correspondingly results in the one or more carriers 58 pivoting from a "down orientation" (see, e.g., FIGS. 2-3B) to an "up orientation" (see, e.g., FIG. 3C) in order to move the first, upper roller 44*b*' away from the second, lower roller 44*b*". As such, pivoting the one or more carriers 58 from a "down orientation" (see, e.g., FIGS. 2-3B) to an "up orientation" (see, e.g., FIG. 3C) may result in the second pair of rollers 44*b* being moved from an "engaged orientation" (see, e.g., FIGS. 2-3B) to a "disengaged orientation" (see, e.g., FIG. 3C). Although the second pair of rollers 44*b* may be arranged in the "disengaged orientation," the second, lower roller 44*b*" may also assist in moving one or more of the workpiece W and mat 36 along the second feed direction X'.

Referring to FIG. 3D, in some implementations, the user or the crafting apparatus 10 pivots the bypass toggle member 48 from the "up orientation" back to the "down orientation" once the workpiece W and/or the mat 36 engages the first pair of rollers 44*a*. Upon re-orientating the bypass toggle member 48 to the "down orientation," the print head roller actuator toggle member 52 and one or more carriers 58 may also correspondingly move back to the "down orientation" such that the first, upper roller 44*b*' moves toward the second, lower roller 44*b*" for locating the second pair of rollers 44*b* in the "engaged orientation."

Figure 5A:
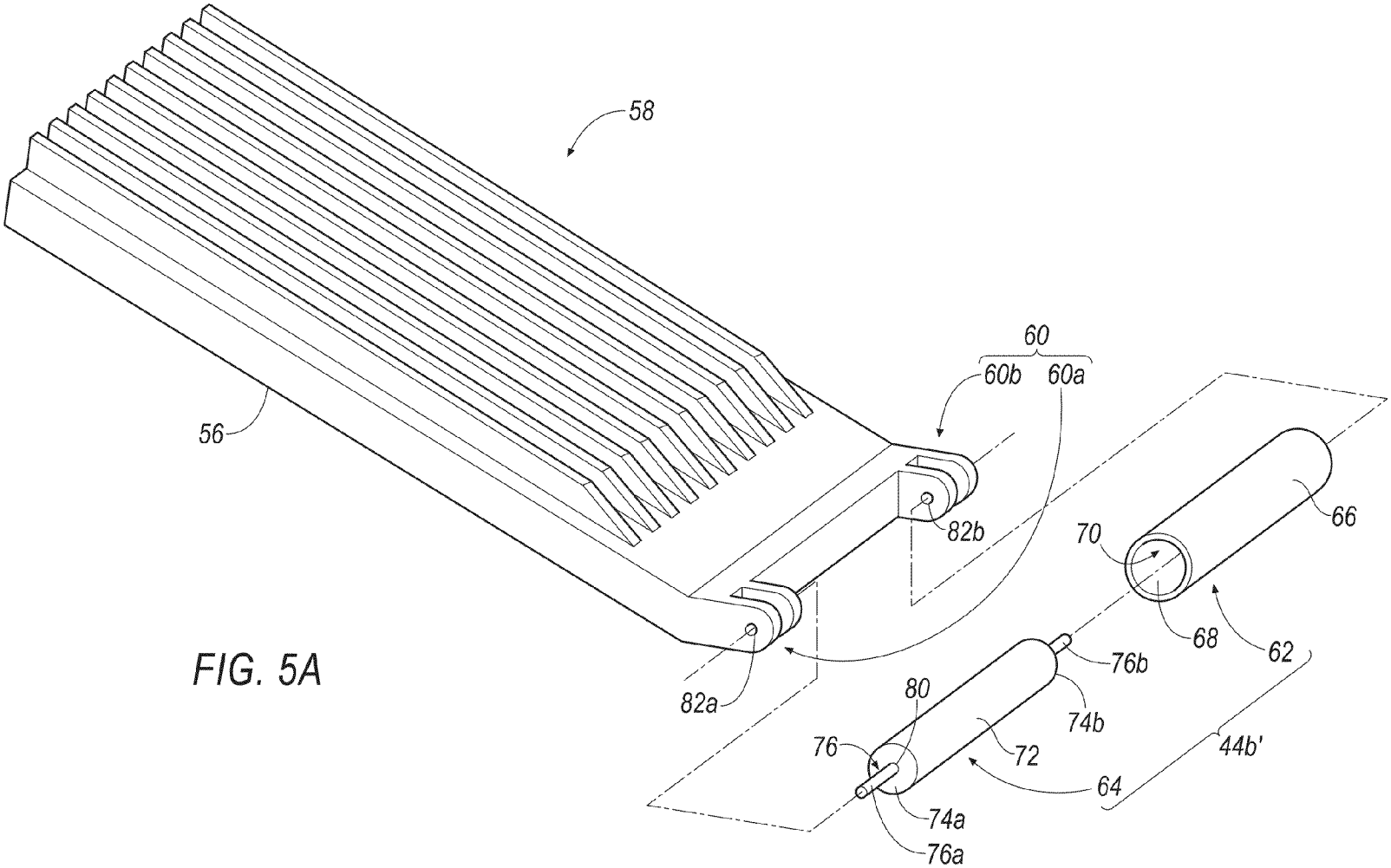
FIG. 5A is an enlarged, exploded perspective view of a portion of the crafting apparatus according to line 5 of FIG. 4.

FIGS. 5A-6 illustrate an exemplary arrangement of the first, upper roller 44*b*' and the one or more carriers 58. In the example shown, the one or more carriers 58 include a pair of support flanges 60 that permit the first, upper roller 44*b*' to rotatably-connect to the one or more carriers 58.

In some examples, the first, upper roller 44*b*' includes a cylindrical sleeve 62 and core cylinder 64. The cylindrical sleeve 62 includes an outer surface 66 and an inner surface 68, where the inner surface 68 defines a bore 70 into or through the cylindrical sleeve. The core cylinder 64 includes an outer surface 72, a first lateral end 74*a* and a second lateral end 74*b*.

Figure 5B:
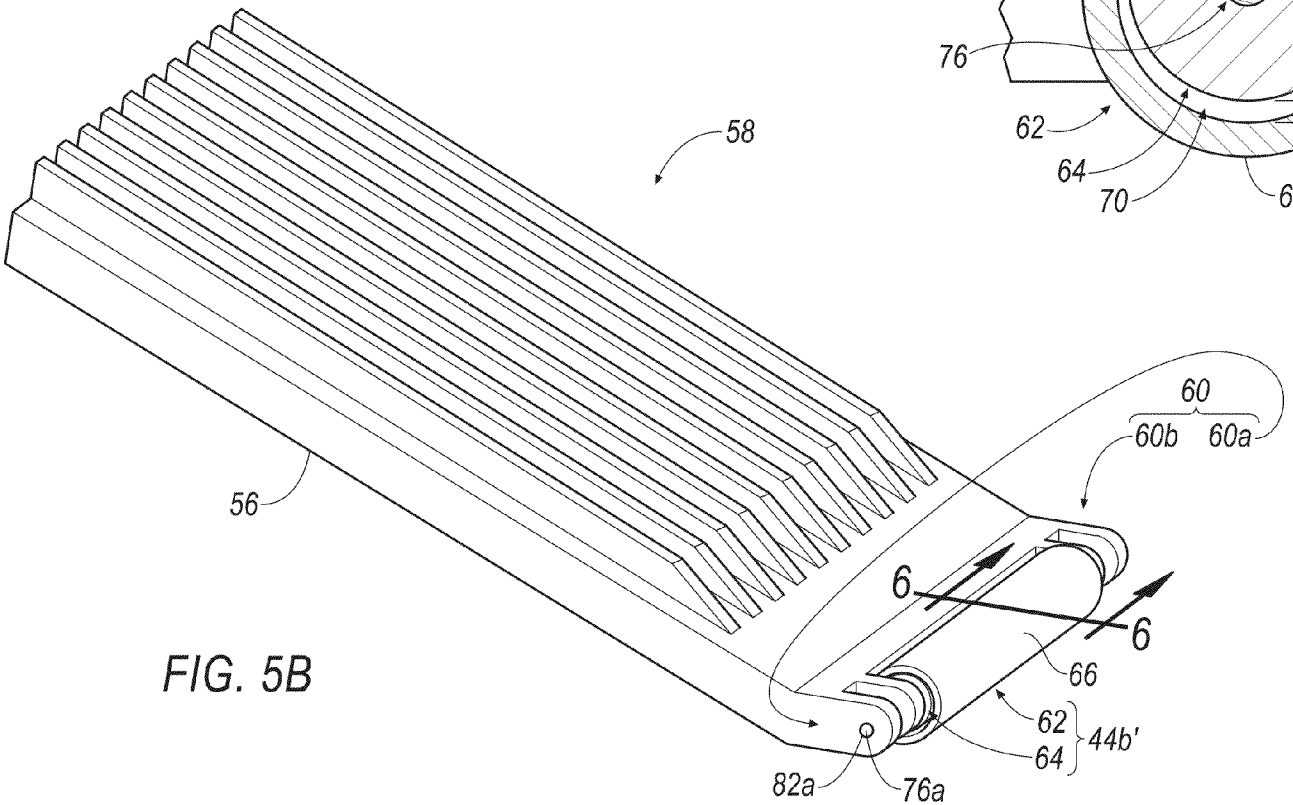
FIG. 5B is an enlarged, assembled perspective view of a portion of the crafting apparatus according to line 5 of FIG. 4.

Referring to FIG. 5A, a pin 76 may extend through a bore 80 defined by the core cylinder 64. The bore 80 may extend through the core cylinder 64 from the first lateral end 74*a* to the second lateral end 74*b*. In some examples, the pin 76 includes a length that is approximately equal to a width of the one or more carriers 58. In additional examples, the length of the pin 76 is greater than a width of the core cylinder 64 such that, as shown in FIG. 5A, a first distal end 76*a* of the pin 76 extends beyond the first lateral end 74*a*. Similarly, a second distal end 76*b* of the pin 76 may extend beyond the second lateral end 74*b*. Referring to FIG. 5B, the first distal end 76*a* of the pin 76 may be arranged within a first passage 82*a* formed by a first support flange 60*a* of the pair of support flanges 60, and the second support pin 76*b* may be arranged within a second passage 82*b* (see, e.g., FIG. 5A) formed by a second support flange 60*b* of the pair of support flanges 60.

Figure 6A:
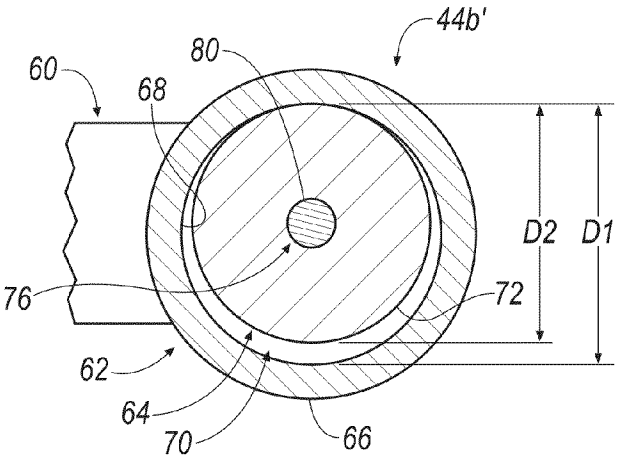
FIG. 6A is a cross-sectional view of the portion of the crafting apparatus according to line 6-6 of FIG. 5B.

Referring to FIG. 6A, in some implementations, the inner surface 68 of the cylindrical sleeve 62 defines the bore 70 to have a diameter, D1, and the outer surface 72 of the core cylinder 64 forms the core cylinder 64 to include a diameter, D2. Each of the distal ends 76*a*, 76*b* of the pin 76 may be fixed within the passages 82*a*, 82*b* of the one or more carriers 58 such that the core cylinder 64 is non-rotatably-fixed to the one or more carriers 58; however, because the diameter, D2, of the core cylinder 64 is less than the diameter, D1, of the bore 70 of the cylindrical sleeve 62, the cylindrical sleeve 62 may be loosely-arranged upon the outer surface 72 of the core cylinder 64 such that cylindrical sleeve 62 may be permitted to rotate relative the core cylinder 64 when, for example, the outer surface 66 of the cylindrical sleeve 62 engages or comes into contact with one or more of the mat 36 and workpiece W. In some implementations, the bore 70 defined by the cylindrical sleeve 62 has a diameter D1 of between about 1% and about 25% larger than the diameter D2 of the core cylinder 64.

Referring back to FIGS. 2-4, each of the first, upper roller 44*a*', 44*b*' and the second, lower roller 44*a*", 44*b*" may include metal chrome plated cylinders. In some examples, the metal chrome plated cylinders 44*a*'-44*b*" provide a consistent feed rate of the workpiece W and/or the mat 36 through the passage 22 of the crafting apparatus 10. However, if a relatively small workpiece W is placed upon the support surface 38 of the mat 36, an adhesive that causes the support surface 38 to include a tacky surface quality (i.e., for permitting the workpiece W to be removably-coupled to the mat 36) may be exposed to the metal chrome plated cylinders 44*a*'-44*b*". As such, because the first, upper roller 44*b*' of the second pair of rollers 44*b* may come into contact with the exposed adhesive, the core cylinder 64 may be formed to include the metal chrome plated cylinder whereas the cylindrical sleeve 62 may include a material (e.g., polyoxymethylene (POM)) having a very high lubricity value in order to deter adhesion of the exposed adhesive on the surface 38 to the outer surface 66 of the cylindrical sleeve 62. Thus, because the cylindrical sleeve 62 inhibits the exposed adhesive on the surface 38 from adhering to the first, upper roller 44*b*' of the second pair of rollers 44*b*, the feed rate of one or more of the workpiece W and mat 36 according to one or more of the directions, X, X', is maintained at a desirable rate in order to increase the likelihood of an acceptable quality of a printed image on the workpiece W by the printing head 18*b*.

Although the first, upper roller 44*b*' is described to include a cylindrical sleeve 62 and a core cylinder 64, the upper roller 44*b*' is not limited to a particular shape, design or configuration. For example, as seen in FIGS. 6B-6D, the first, upper roller 44*b*' may include one or more alternative shapes, designs or configurations.

Figure 6B:
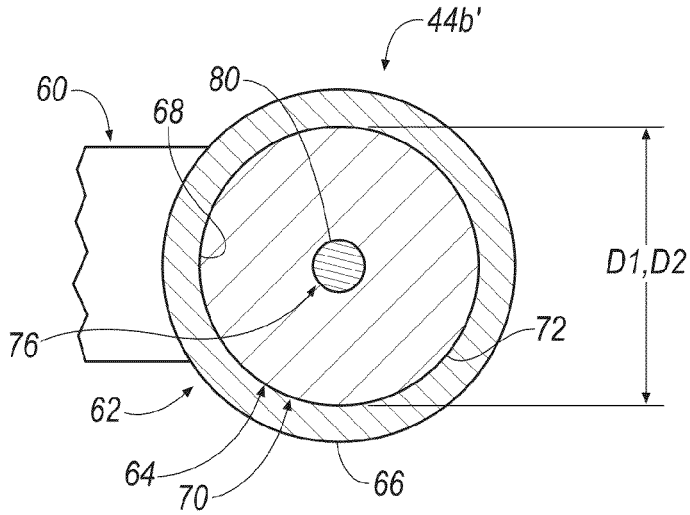
FIG. 6B is a cross-sectional view of the portion of the crafting apparatus according to line 6-6 of FIG. 5B.

Referring to FIG. 6B, in some implementations, the cylindrical sleeve 62 and core cylinder 64 are arranged press-fitted to one another. For example, an outer diameter, D2, of the core cylinder 64 may be approximately equal to, but less than the diameter, D1, of the bore 70 of the cylindrical sleeve 62 such that substantially all of the inner surface 68 of the cylindrical sleeve 62 is pressed adjacent substantially all of the outer surface 72 of the core cylinder 64. For example, the core cylinder 64 of FIG. 6B may include metal and the cylindrical sleeve 62 of FIG. 6B may include a material (e.g., polyoxymethylene (POM)) having a very high lubricity value in order to deter adhesion of the exposed adhesive on the surface 38 of the mat 36 to the outer surface 66 of the cylindrical sleeve 62.

Figure 6C:
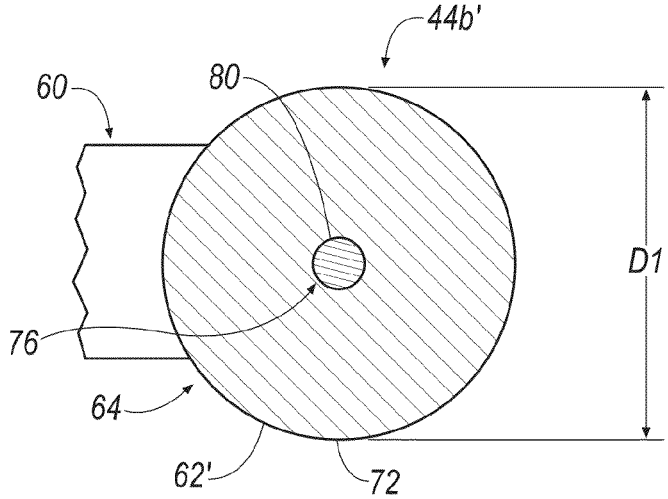
FIG. 6C is an alternative, cross-sectional view of a portion of the crafting apparatus as referenced from line 6-6 of FIG. 5B.

Referring to FIG. 6C, in some implementations, the first, upper roller 44*b*' only includes a core cylinder 64 without a cylindrical sleeve 62. The core cylinder 64 may include a material (e.g., polyoxymethylene (POM)) having a very high lubricity value in order to deter adhesion of the exposed adhesive on the surface 38 of the mat 36 to the outer surface 72 of the core cylinder 64.

Figure 6D:
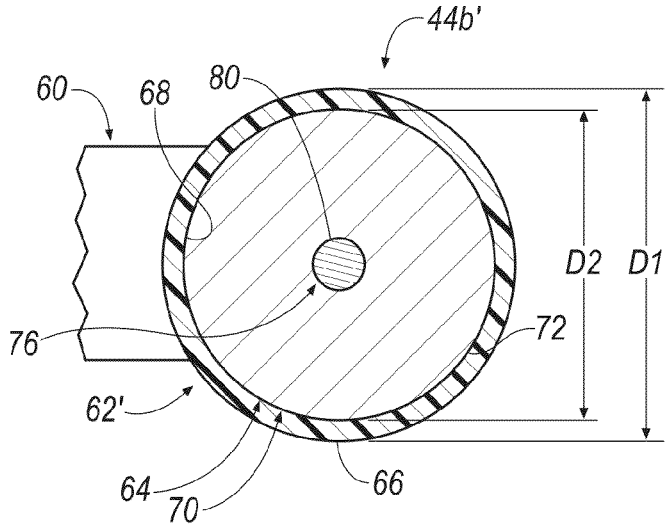
FIG. 6D is an alternative, cross-sectional view of a portion of the crafting apparatus as referenced from line 6-6 of FIG. 5B.

Referring to FIG. 6D, in some implementations, the first, upper roller 44*b*' includes a core cylinder 64 and a coating 62' disposed over substantially all of the outer surface 72 of the core cylinder 64. The core cylinder 64 of FIG. 6D may include metal, and the coating 62' of FIG. 6D may include TEFLON®. In some instances, the coating 62' may prevent or otherwise deter adhesion of the exposed adhesive on the surface 38 of the mat 36 to the outer surface 64 of the core cylinder 64.

Figure 7A:
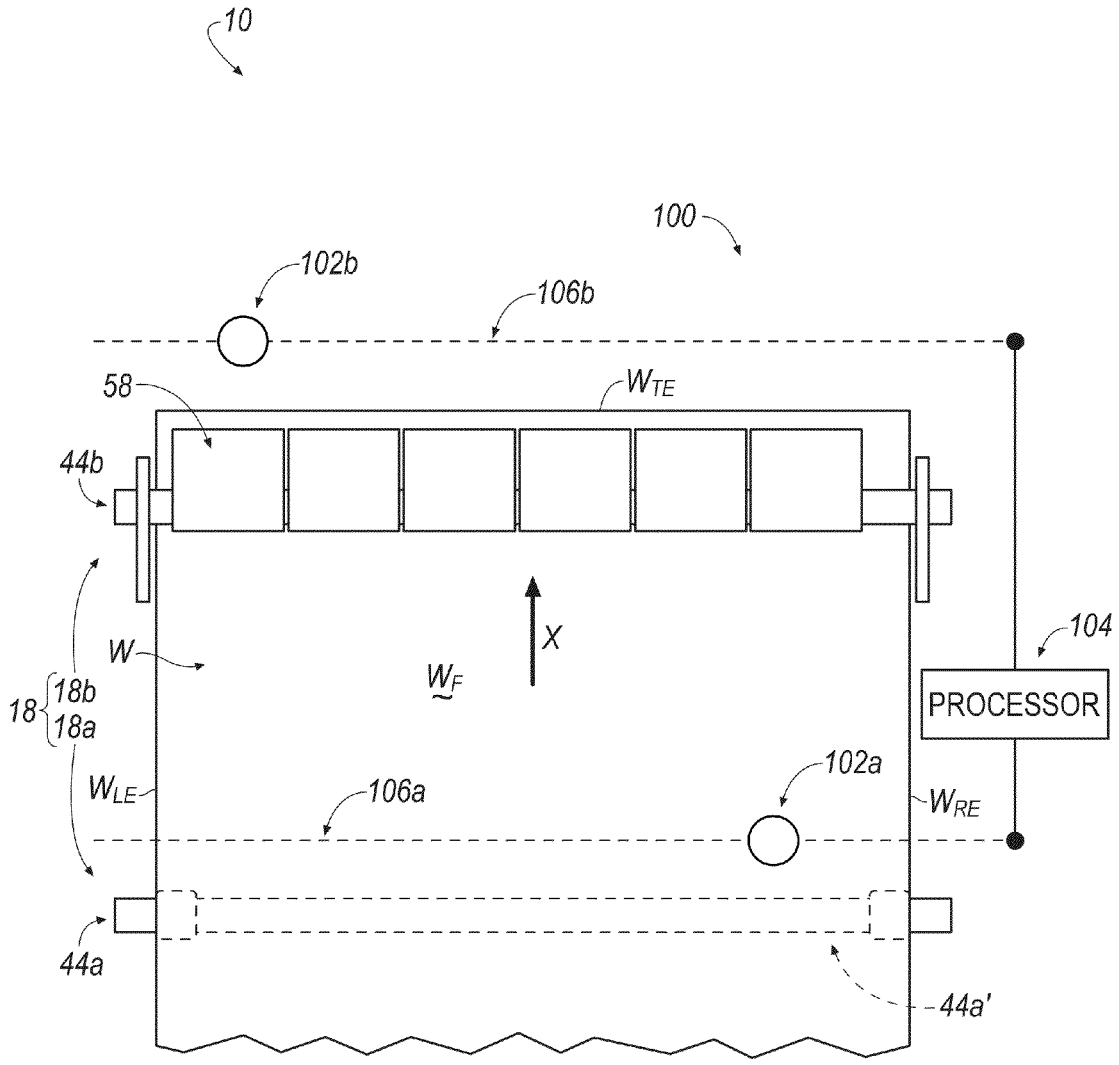
FIGS. 7A-7N illustrate a partial, top view of a crafting apparatus including an exemplary workpiece feed path analyzer.
Figure 7B:
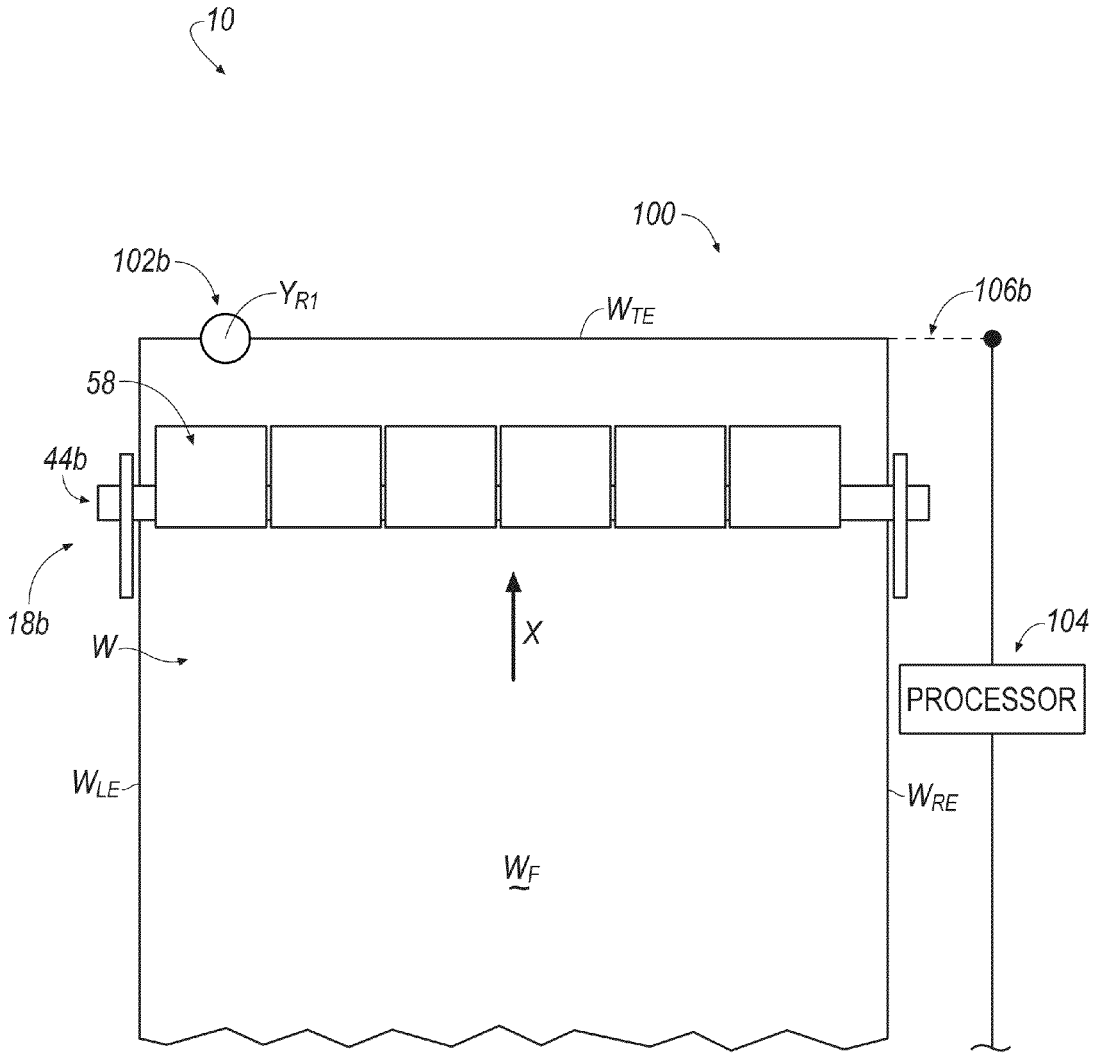
FIGS. 7O and 7P provide an exemplary arrangement of operations for obtaining reference coordinate data for determining one or more of an angular skew and a lateral offset of a workpiece moving through a crafting apparatus.
FIGS. 7Q and 7R are schematic views of alignment processes for determine mat skew.
FIGS. 7S-7U are schematic views of calibration processes for aligning a cutting head with a printing head.
Figure 7C:
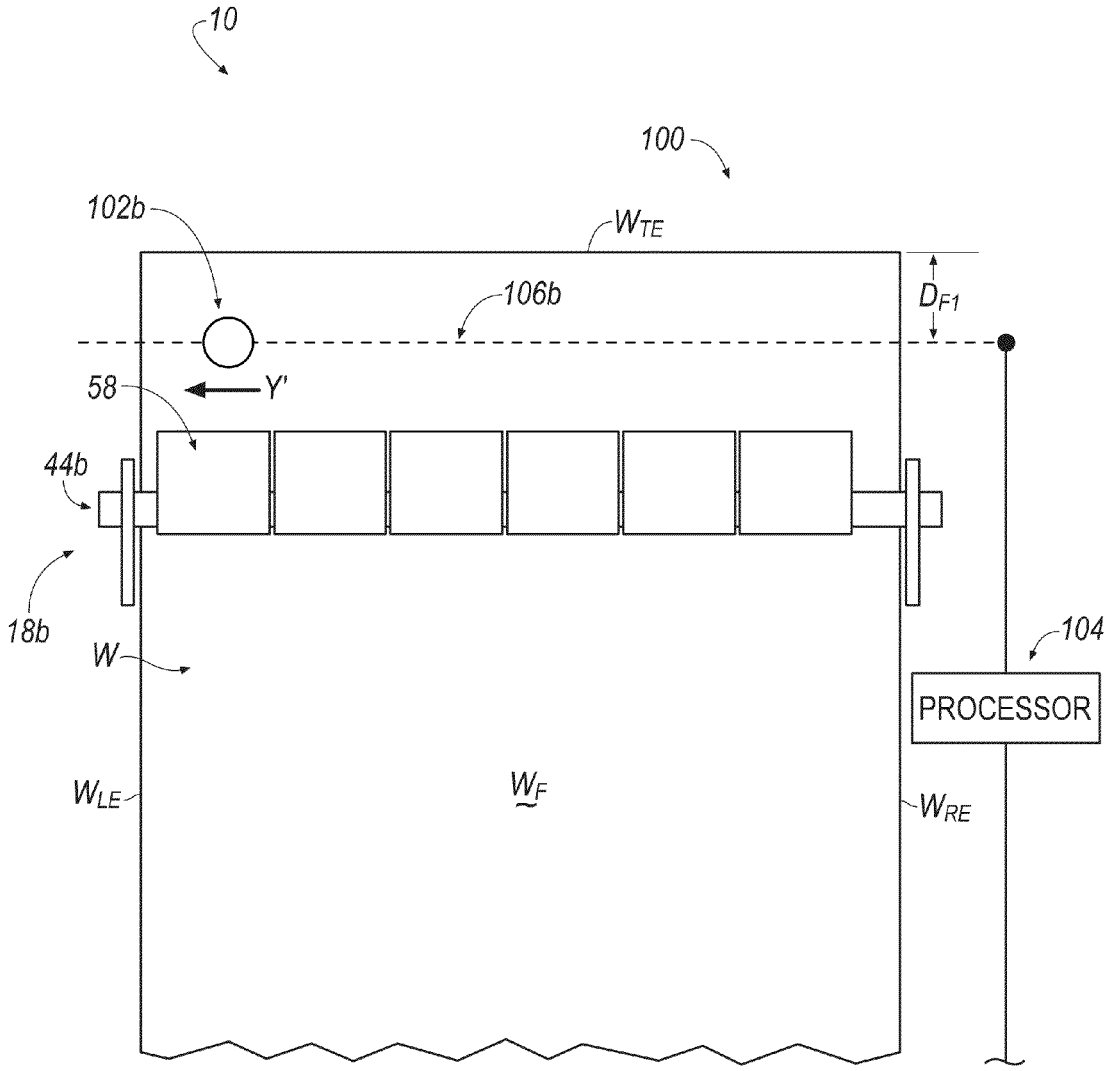
Figure 7D:
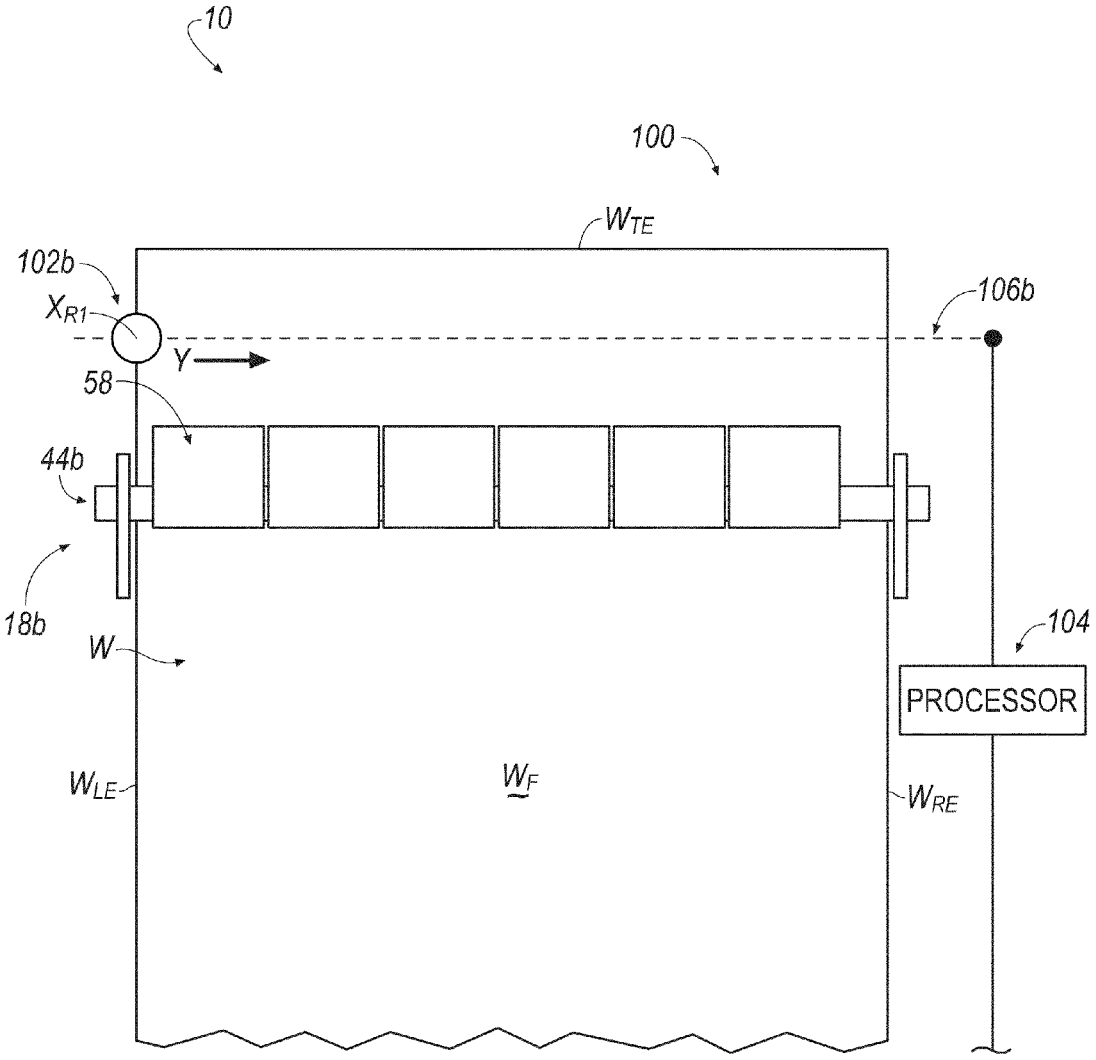
Figure 7E:
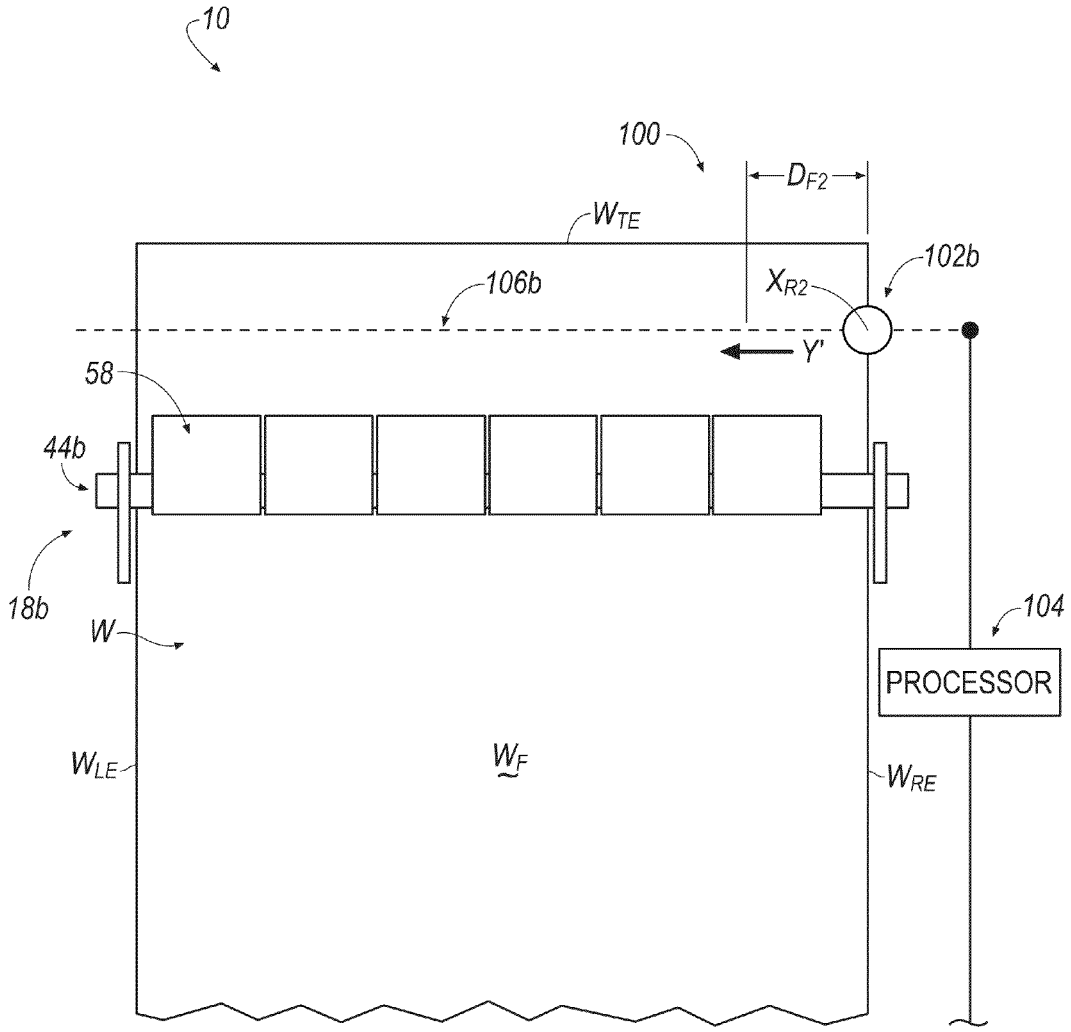
Figure 7F:
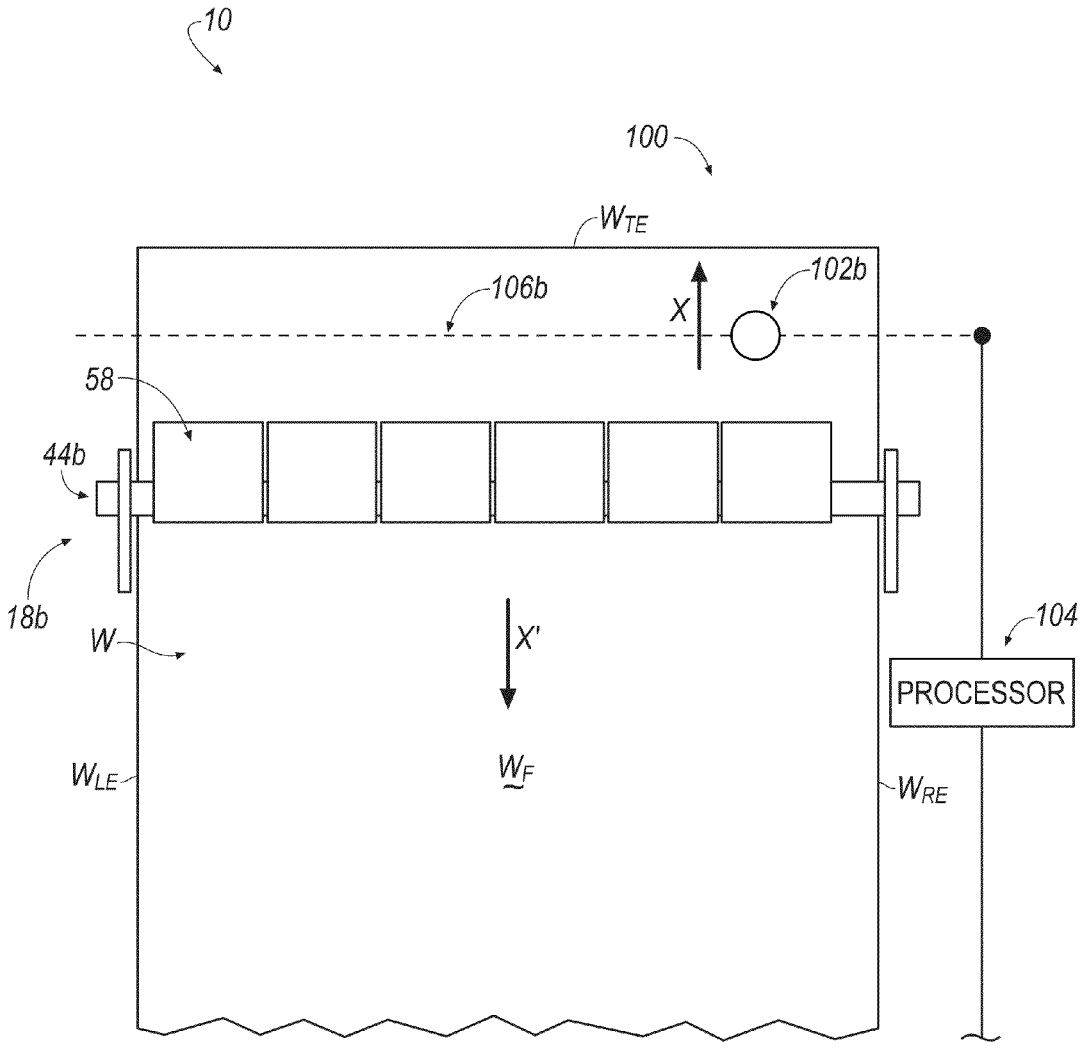
Figure 7G:
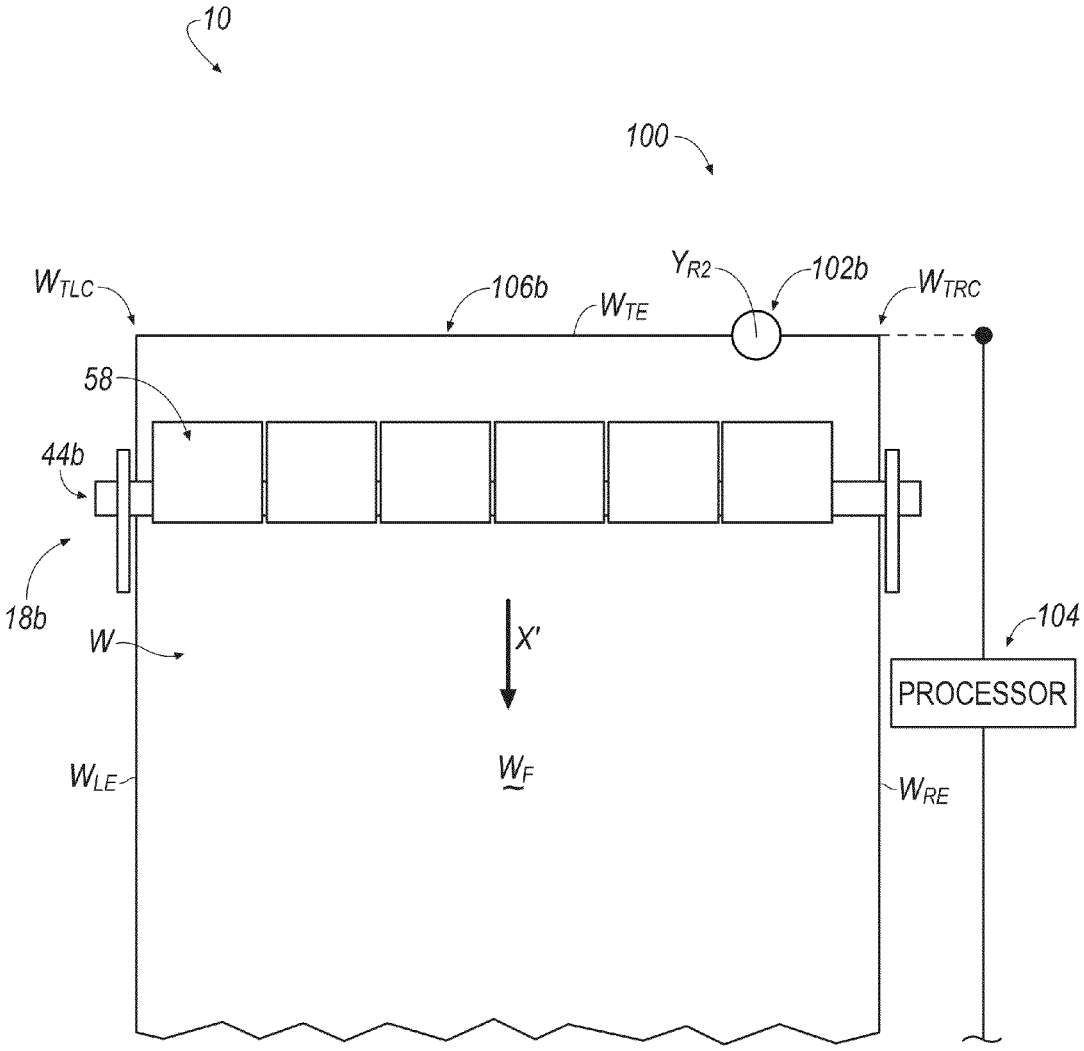
Figure 7H:
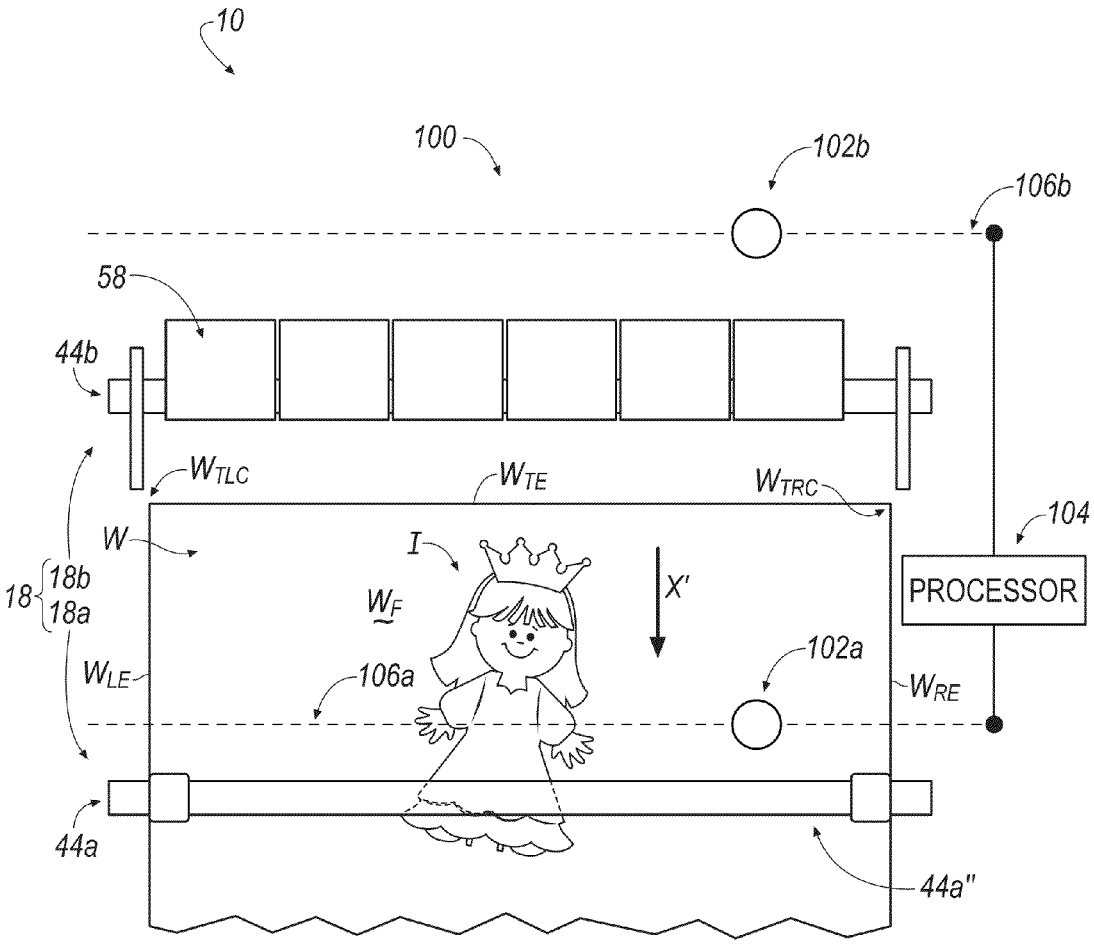
Figure 7I:
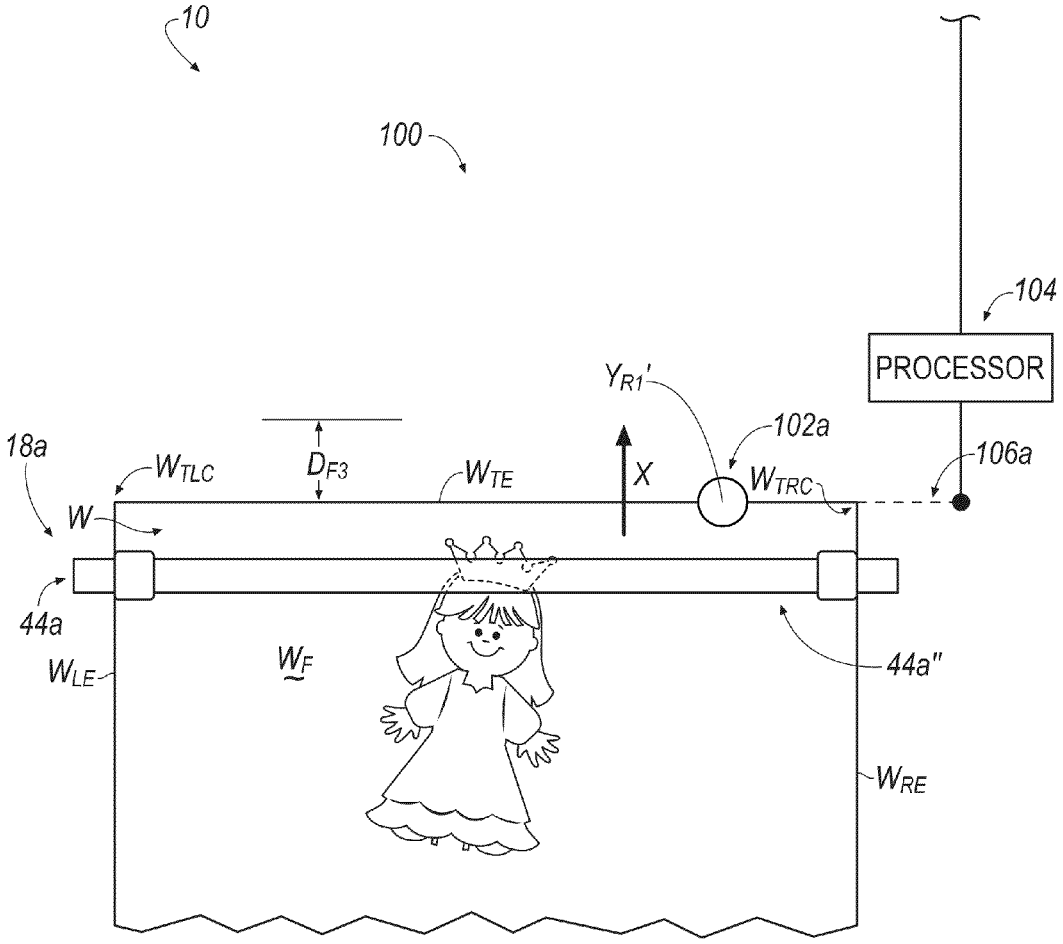
Figure 7J:
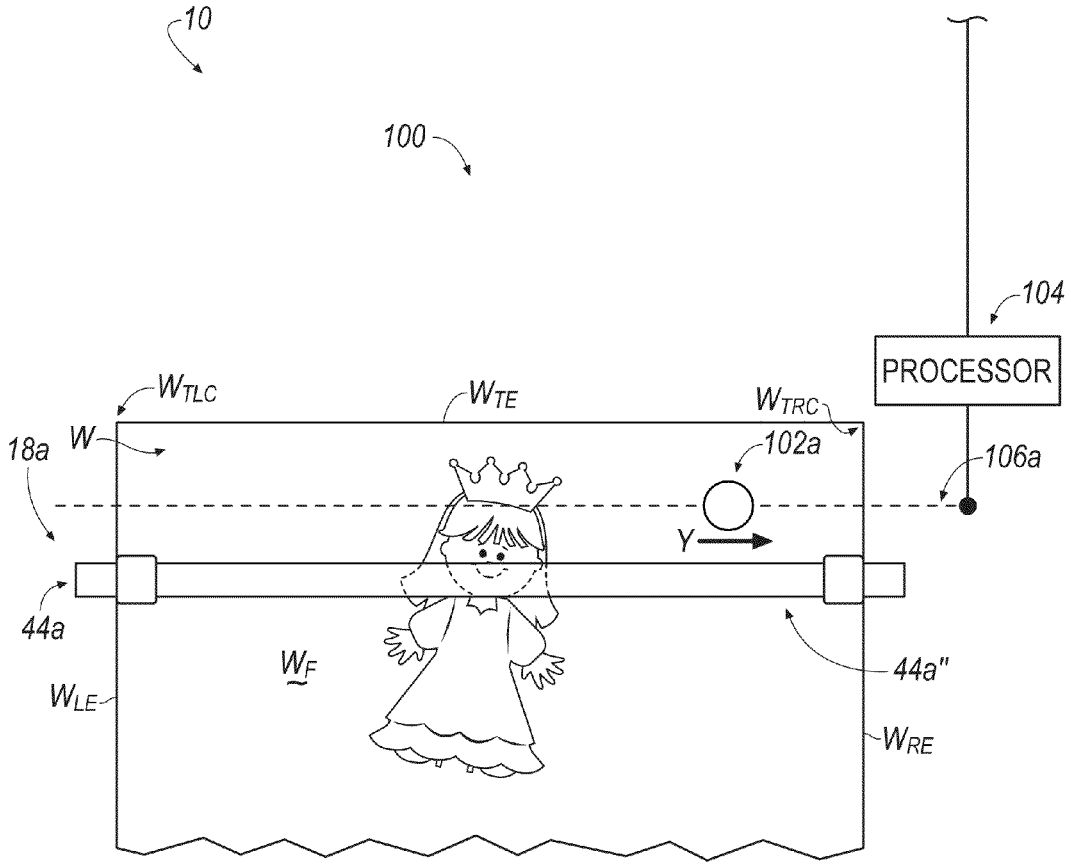
Figure 7K:
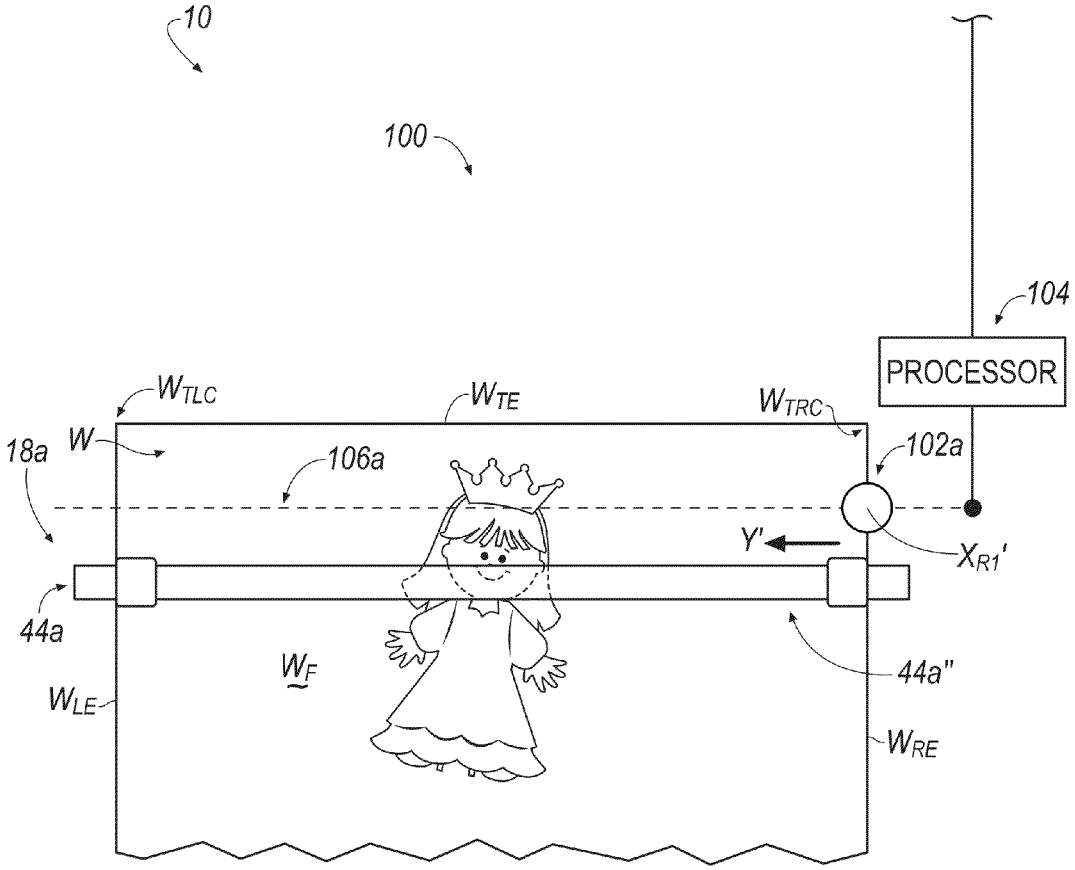
Figure 7L:
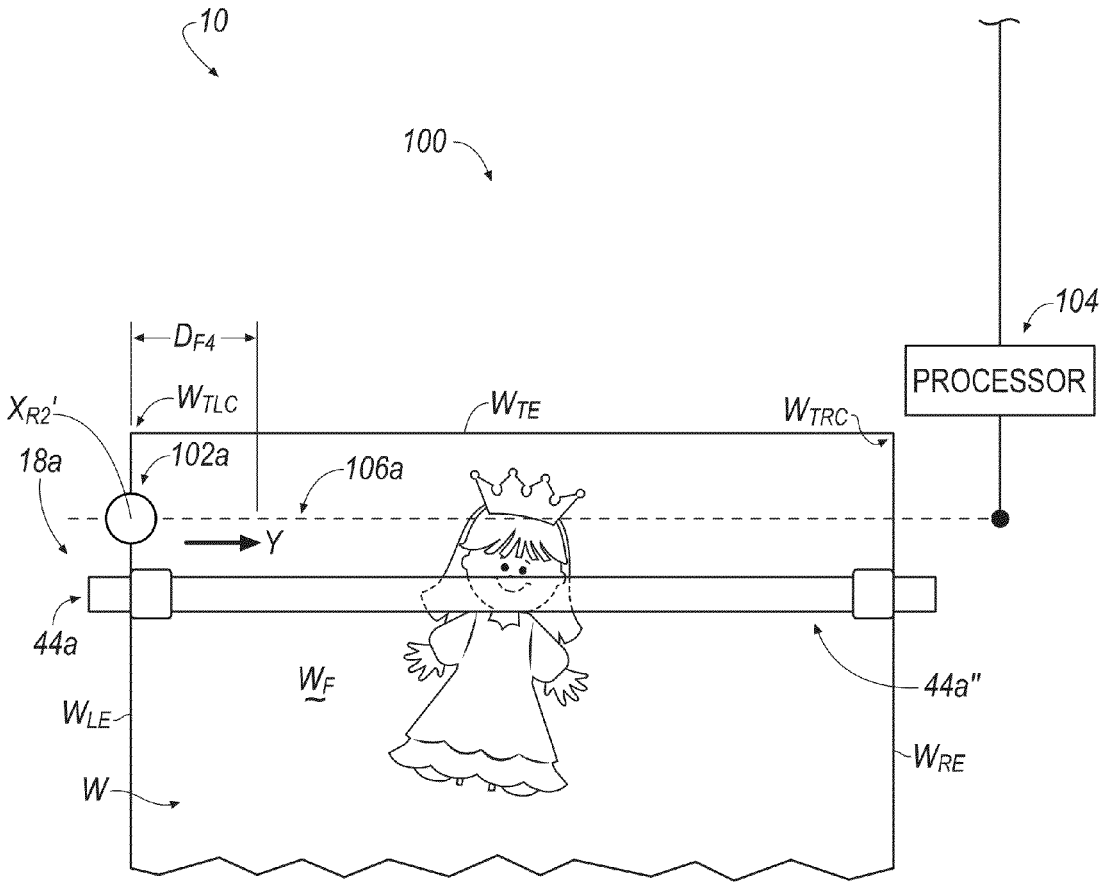
Figure 7M:
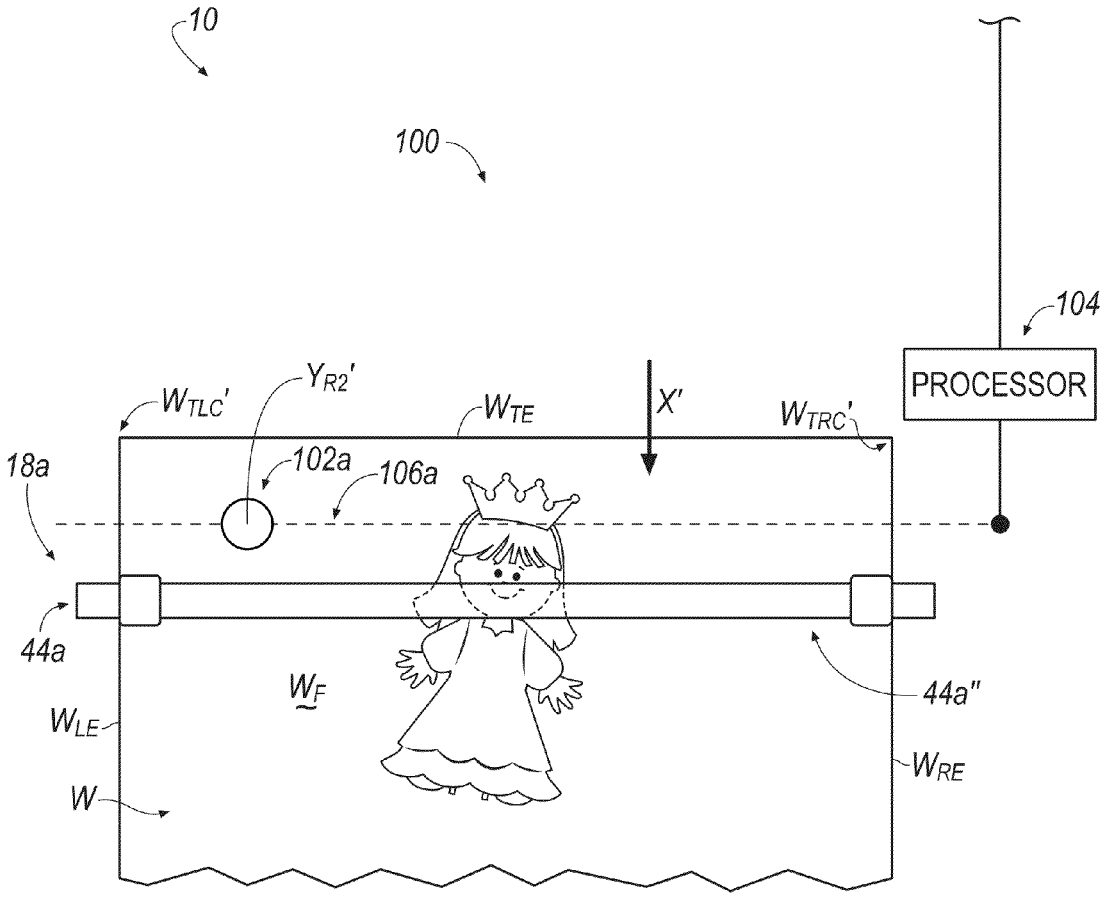
Figure 7N:
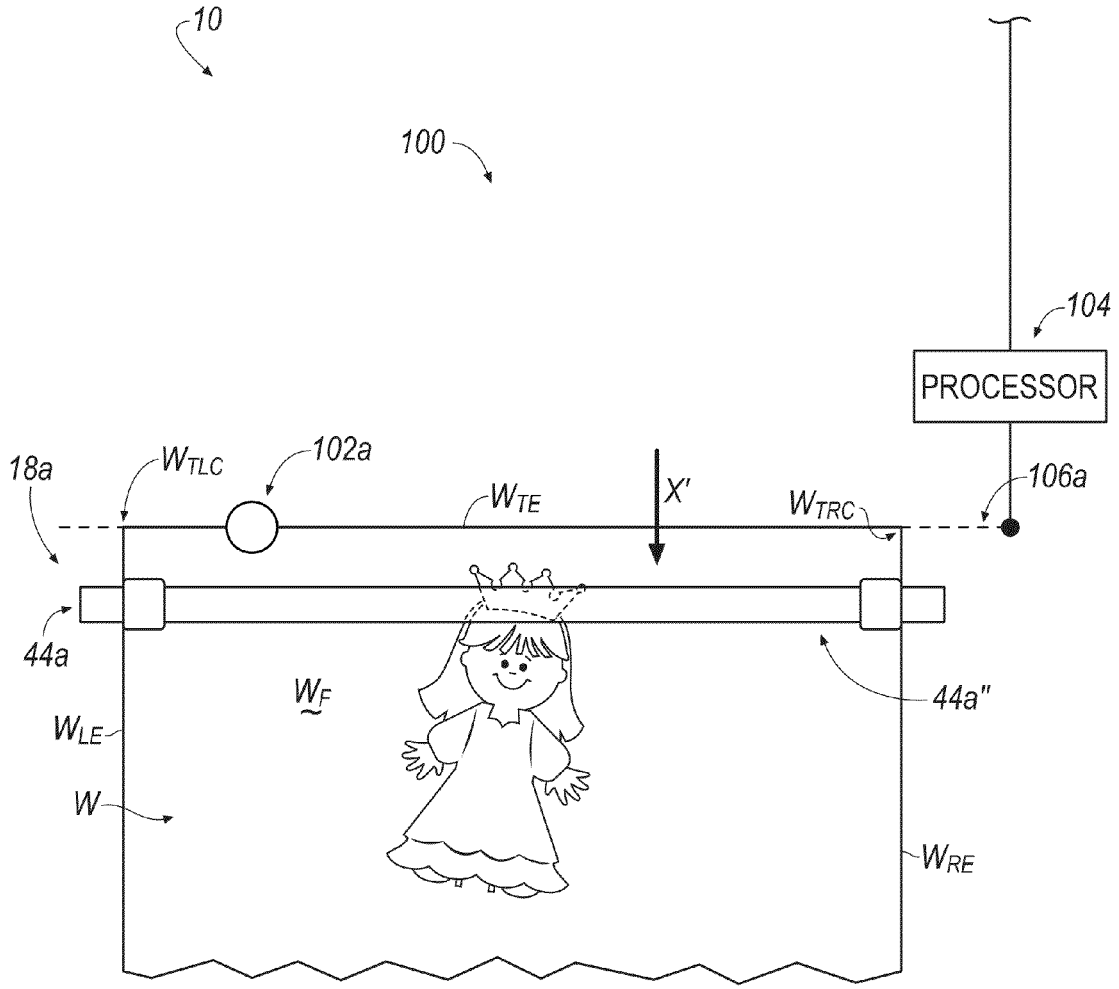

Referring to FIGS. 7A-7N, the crafting apparatus 10 may further include a workpiece feed path analyzer 100. The workpiece feed path analyzer 100 determines one or more of an angular skew θ (see, e.g., FIG. 8A) and a lateral offset LO (see, e.g., FIG. 8B) of a workpiece W as the workpiece W moves along the feed path FP along the second feed direction X', from the printing head 18*b* to the cutting head 18*a*. In practice, the angular skew θ and/or lateral offset LO of the workpiece W may be associated with a "print then cut" operation executed by the crafting apparatus 10. In addition to or in lieu of determining the angular skew θ and/or the lateral offset LO of the workpiece W, the workpiece feed path analyzer 100 may be used to determine other forms of offset, such as, a longitudinal offset (not shown) of the workpiece W may also be determined by the workpiece feed path analyzer 100.

Figure 8B:
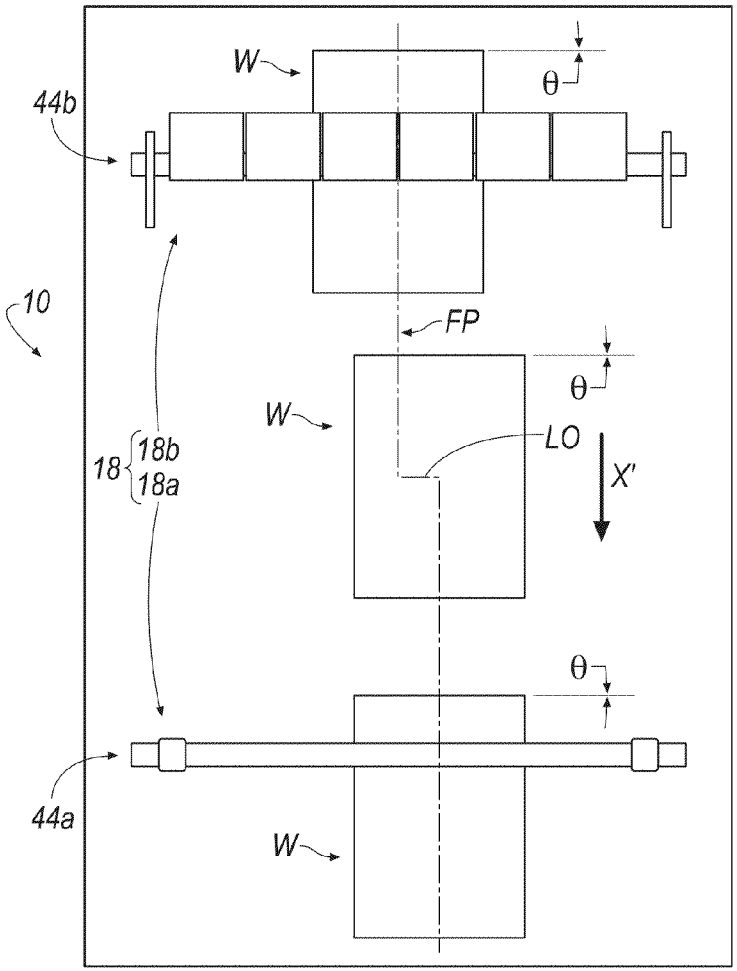
FIG. 8B illustrates lateral offset of a workpiece along a feed path of a crafting apparatus.
Figure 8A:
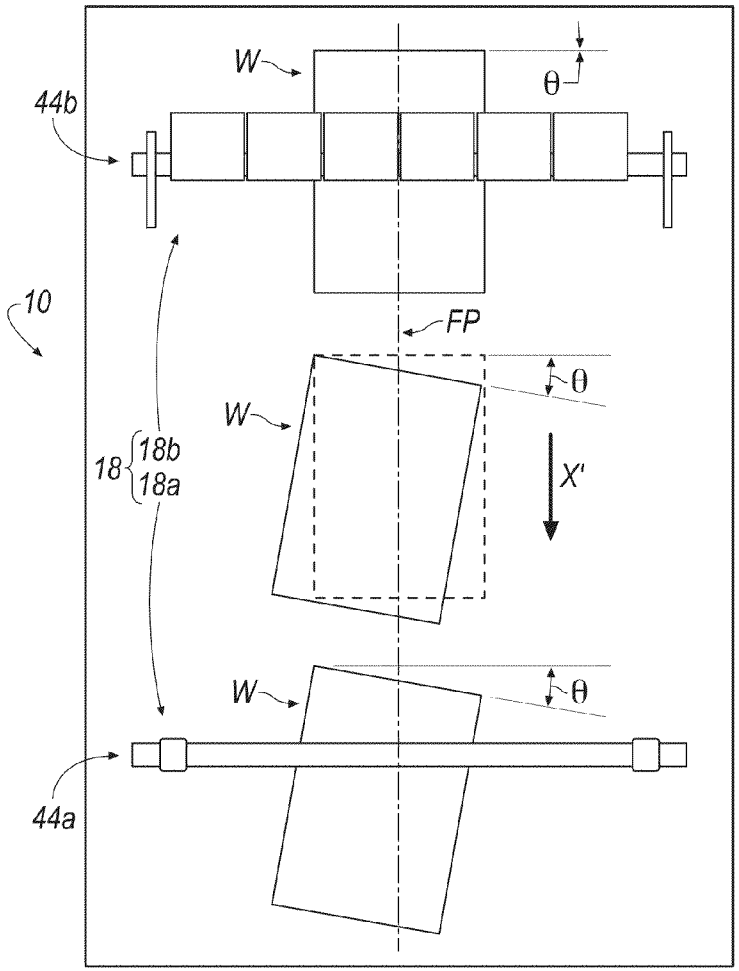
FIG. 8A illustrates angular skew of a workpiece along a feed path of a crafting apparatus.

FIG. 8A illustrates an example of an angular skew θ of the workpiece W occurring along the feed path FP. The feed path FP of the workpiece W along the second feed direction X' may be substantially linear as the workpiece W moves from the printing head 18*b* to the cutting head 18*a*; however, during this movement the workpiece W may be or become slightly pivoted, introducing an angular skew θ in the travel of the workpiece W along the feed path FP. The pivoting of the workpiece W may arise from, for example, the deposition of residual adhesive of the mat 36 onto one or more of the rollers 44*a*'-44*b*" which partially impedes movement of one side of the workpiece W in the second feed direction X'.

FIG. 8B illustrates an example of a lateral offset LO of the workpiece W along the feed path FP. The feed path FP of the workpiece W may be shifted such that the feed path FP becomes substantially non-linear as the workpiece W moves from the printing head 18*b* to the cutting head 18*a* along the second feed direction X'. The non-linearity of the feed path FP may be defined by a lateral offset LO, which may result from a forward-feeding of the workpiece W that is not initialized in a substantially linear orientation. Although the example of FIG. 8B does not illustrate an angularly skewed workpiece W, in addition to a lateral offset LO of the workpiece W, an angular skew θ may also be introduced as the workpiece W moves along the feed path FP along the second feed direction X'.

Figure 9B:
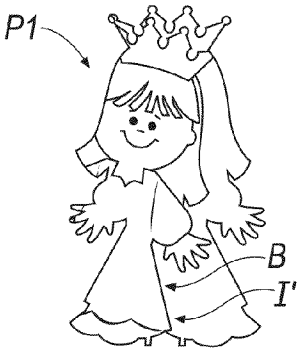
FIG. 9B illustrates a portion of the workpiece of FIG. 9A that is cut by the cutting head.
Figure 9A:
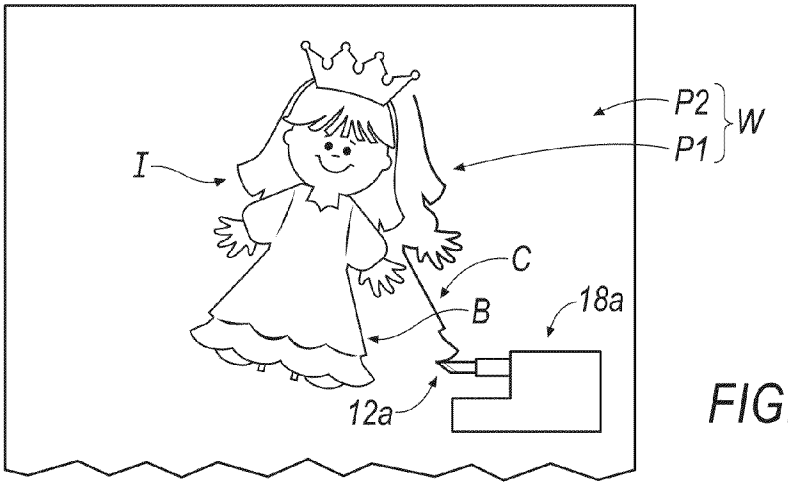
FIG. 9A illustrates a workpiece being worked on by a cutting head that does not compensate for one or more of an angular skew and lateral offset of a workpiece along a feed path of a crafting apparatus.

Referring to FIG. 9A, in the absence of utilizing the workpiece feed path analyzer 100 for obtaining and subsequently applying one or more of the angular skew θ and lateral offset LO of the workpiece W arising from a "print then cut" operation, the blade 12*a* of the cutting head 18*a* may otherwise be unable to compensate for misalignments of the workpiece W. As a result, the cutting head 18*a* may perform a cutting operation C on the workpiece W that does not correspond to an outer perimeter/border B of an image printed with the ink I (hereinafter, reference character "I" may be interchangeably used to reference "ink," an "image" or a "printed image" formed by the ink). As seen in FIG. 9B, when the workpiece W is separated into two parts P1, P2, the first part P1, which is desired to include the entire printed image I may only include a portion of the printed image I', due to the fact that the blade 12*a* of the cutting head 18*a* did not perform the cutting operation C along the outer perimeter/border B of the printed image I. As such, the remaining portion of the printed image I may reside on the second part P2 (not shown) of the workpiece W.

Figure 10B:
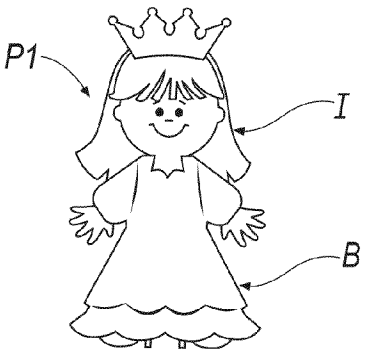
FIG. 10B illustrates a portion of the workpiece of FIG. 10A that is cut by the cutting head.
Figure 10A:
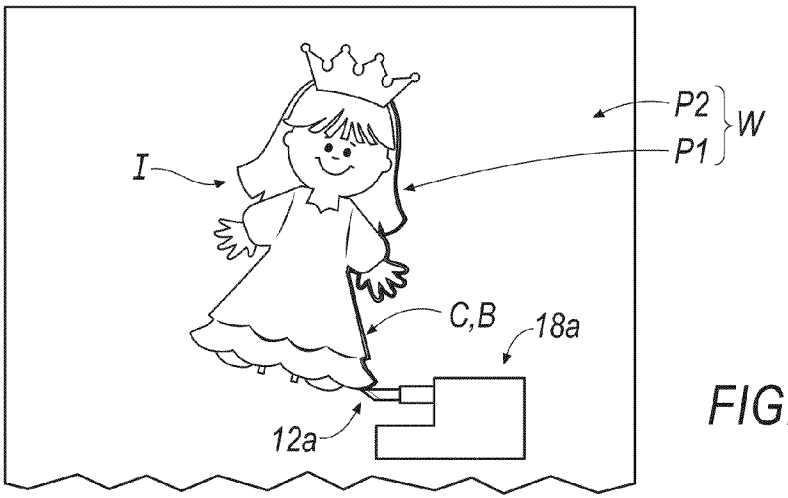
FIG. 10A illustrates a workpiece being worked on by an exemplary cutting head that compensates for one or more of an angular skew and lateral offset of a workpiece along a feed path of a crafting apparatus.
Figure 11A:
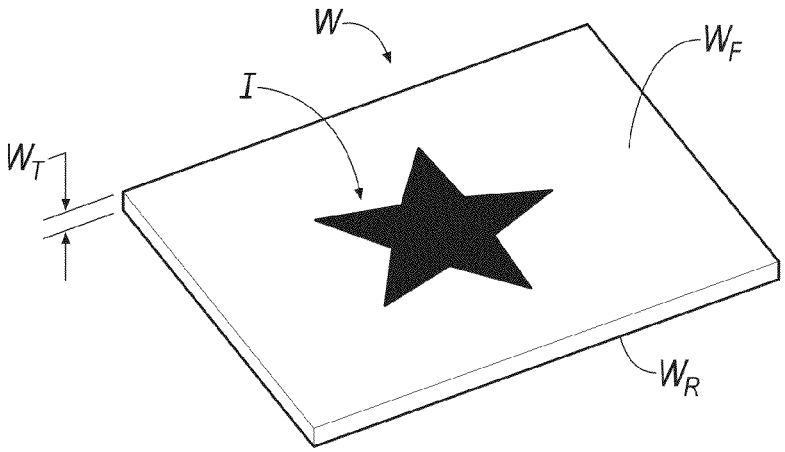
FIGS. 11A-11E illustrate workpieces that are modified by the crafting apparatus of FIGS. 1-7L.
Figure 11B:
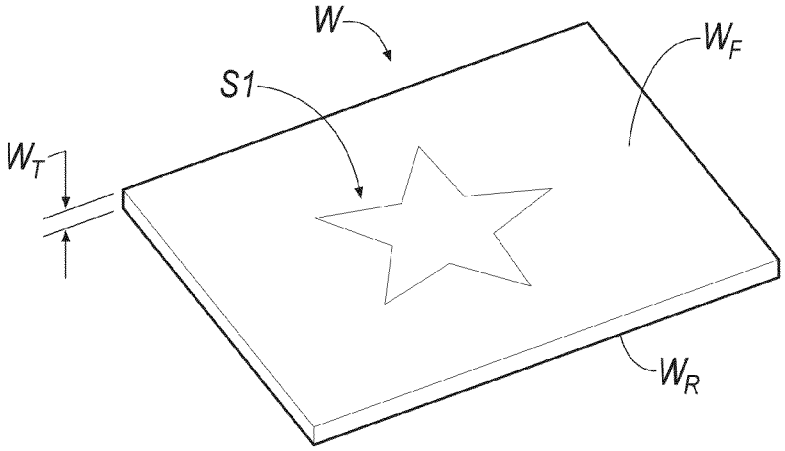
Figure 11C:
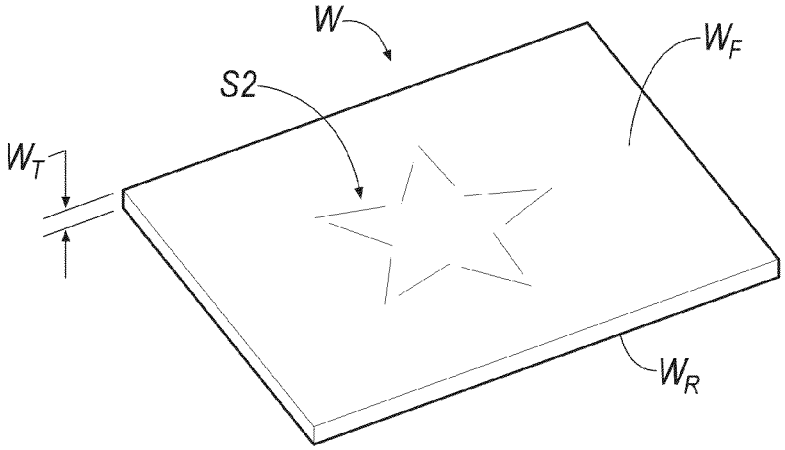
Figure 11D:
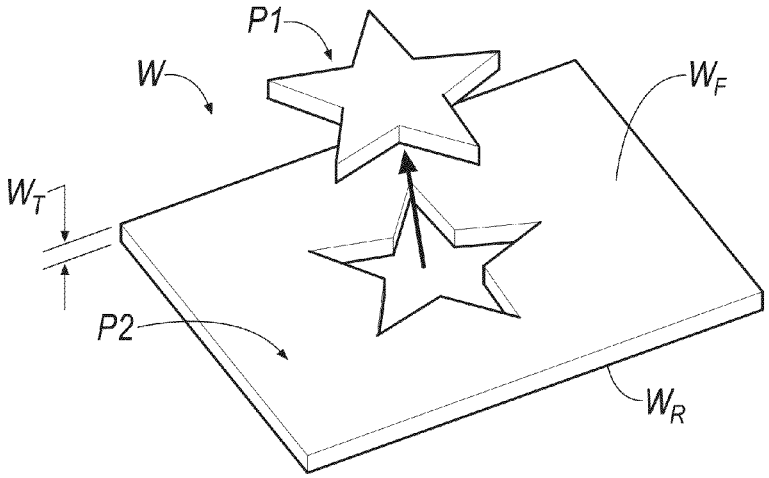
Figure 11E:
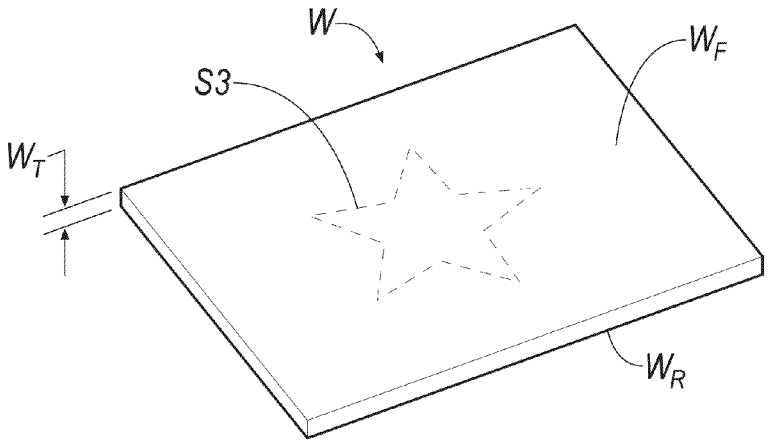

Referring to FIG. 10A, when at least one of the angular skew θ and the lateral offset LO of the workpiece W arising from a "print then cut" operation is obtained by the workpiece feed path analyzer 100 and subsequently applied by the crafting apparatus 10, the blade 12*a* of the cutting head 18*a* may compensate for workpiece misalignment, such that the cutting head 18*a* performs a cutting operation C on the workpiece W that corresponds to the outer perimeter/border B of a printed image I. Thus, as shown in the example of FIG. 10B, when the workpiece W is separated into two parts P1, P2, the first part P1 substantially includes all of the printed image I due to the fact that the blade 12*a* of the cutting head 18*a* performed the cutting operation C along the outer perimeter/border B of the printed image I.

Referring back to FIG. 7A, in some implementations, the workpiece feed path analyzer 100 includes a first sensor 102*a* and a second sensor 102*b* for detecting edges of the workpiece W in order to compensate for any skew or offset of the workpiece W as the workpiece W travels through the crafting apparatus 10. In some examples, the first sensor 102*a* is associated with the cutting head 18*a* and the second sensor 102*b* is associated with the printing head 18*b*. As FIGS. 7A-7N provide exemplary views of a portion of the crafting apparatus 10, the first pair of rollers 44*a* associated with the cutting head 18*a* and the second pair of rollers 44*b* associated with the printing head 18*b* are shown in order to provide a frame of reference of the workpiece W relative the cutting head 18*a* and the printing head 18*b* as the workpiece W is moved along the feed path FP along at least one of the feed directions X, X'. In addition to or in lieu of utilizing sensors 102*a*, 102*b* to detect edges of the workpiece W to compensate for skew or offset, the crafting apparatus 10 may print and/or detect printed fiducials (see, e.g., FIG. 12) on the workpiece W to compensate for skew or offset of the workpiece W.

In the example shown in FIG. 7A, the sensors 102*a*, 102*b* are utilized to sense edges (e.g., a top edge $W_{TE}$, a left edge $W_{LE}$, and a right edge $W_{RE}$) of the workpiece W. The sensed edges of the workpiece W establish reference coordinates that may be used as inputs to a processor 104 of the crafting apparatus 10 for determining one or more of an angular skew θ and a lateral offset LO of the workpiece W as a result of moving the workpiece W along the feed path FP from the printing head 18*b* to the cutting head 18*a* along the second feed direction X'. In some implementations, the workpiece feed path analyzer 100 includes the processor 104.

In some implementations, each of the sensors 102*a*, 102*b* are laterally moveable along a path or track 106*a*, 106*b*. The processor 104 receives signals from the sensors 102*a*, 102*b* corresponding to sensed edges. The signals may be communicated via a hard-wired connection between the sensors 102*a*, 102*b* and processor 104 (e.g., via one or more wires (not shown) disposed on the tracks 106*a*, 106*b*) and/or wirelessly.

Figure 7O:
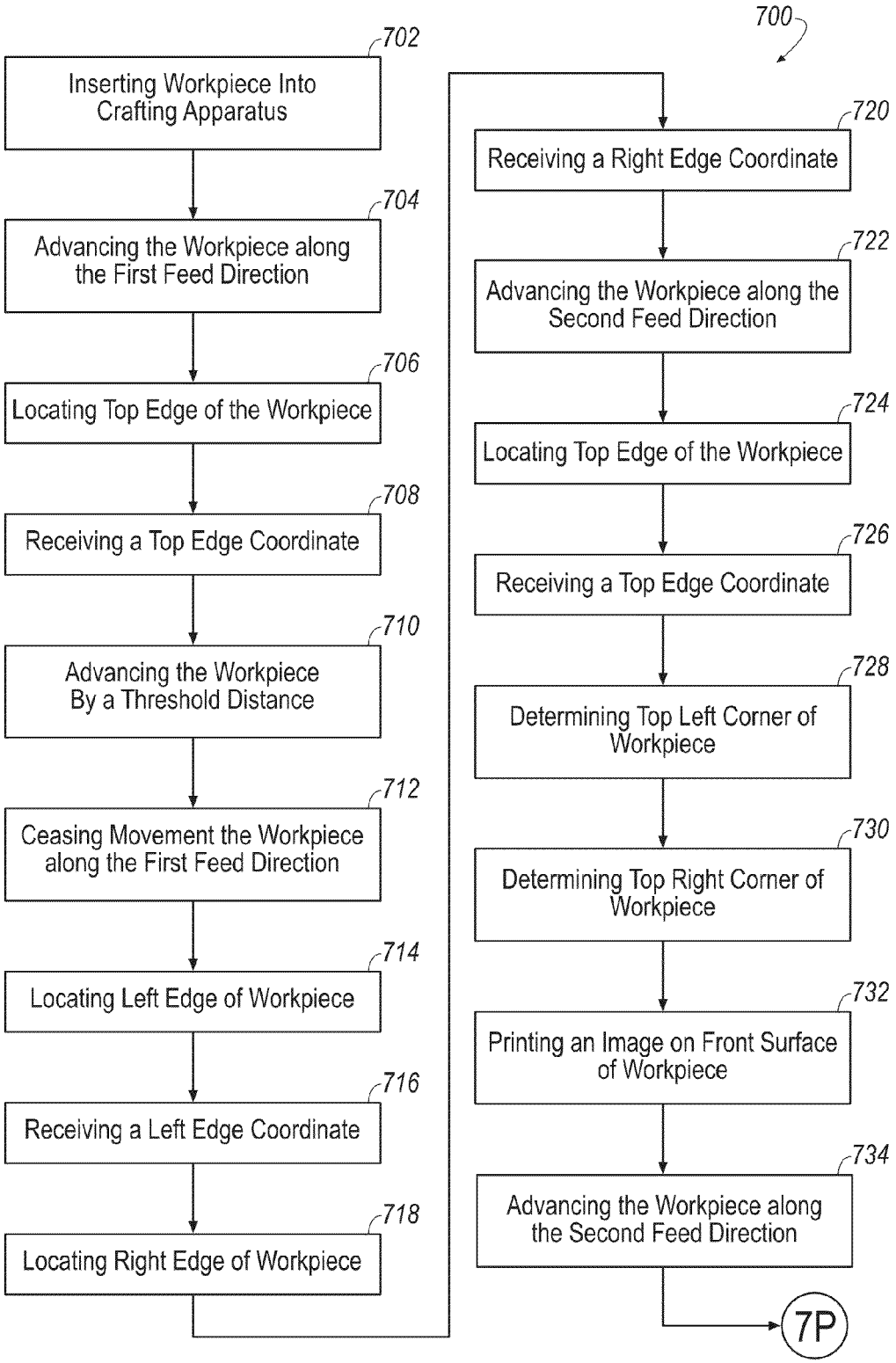
Figure 7P:
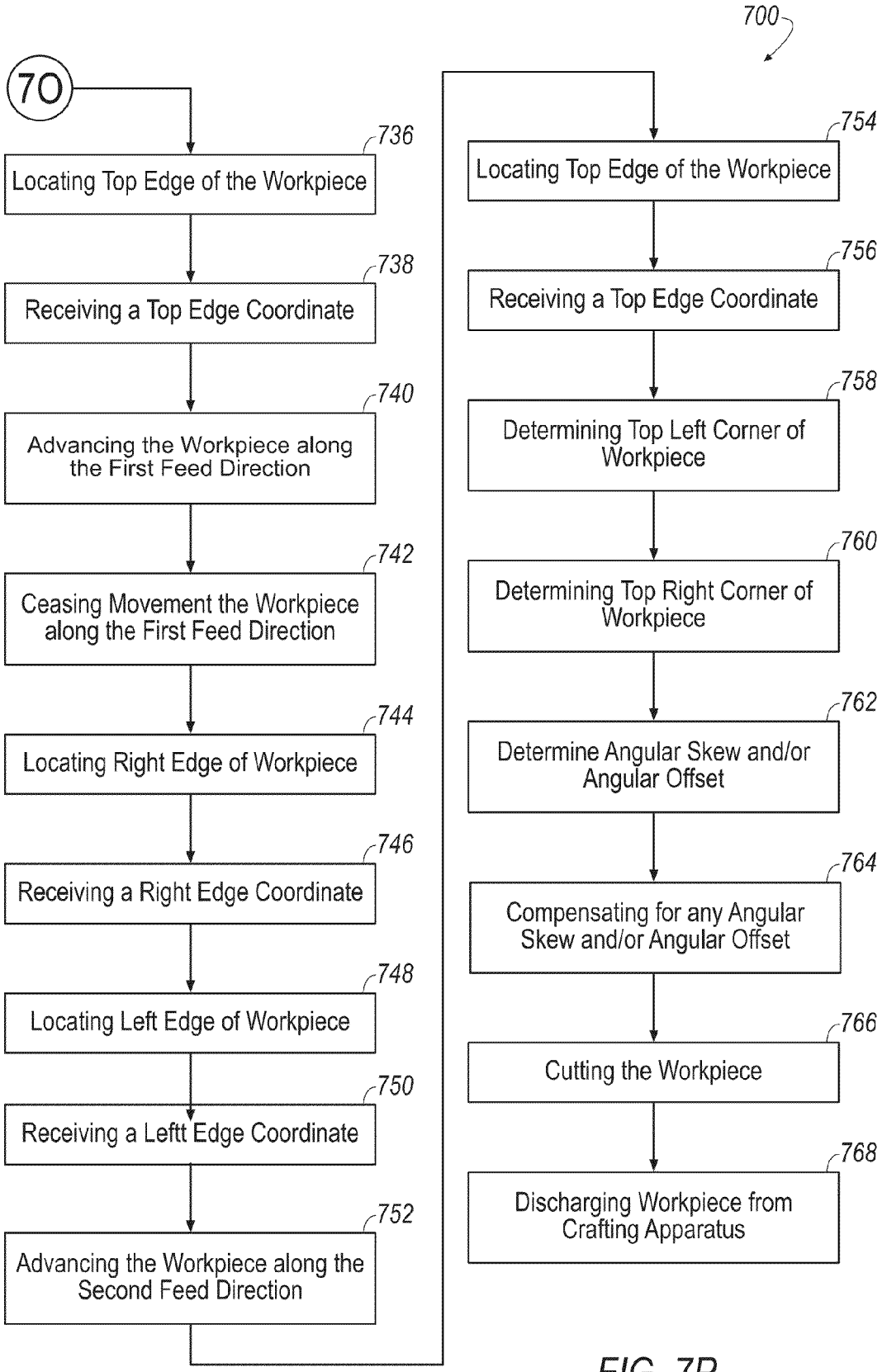

FIGS. 7O and 7P provide an exemplary arrangement 700 of operations for obtaining reference coordinate data for determining one or more of an angular skew θ and a lateral offset LO of the workpiece W. Referring also to FIG. 7A, the operations include inserting 702 the workpiece W, which may or may not include the mat 36 disposed adjacently thereto, through the passage 22 of the crafting apparatus 10 along the first feed direction X. The workpiece W may bypass the first pair of rollers 44*a* and, as such, the first, upper roller 44*a*' is shown in phantom due to the workpiece W being positioned over and obscuring the first, upper roller 44*a*'. However, the workpiece W and mat 36 may be inserted through/between the first pair of rollers 44*a*, if, for example, the first pair of rollers 44*a* are arranged in an expanded, disengaged orientation. Further, once the workpiece W is interfaced with the second pair of rollers 44*b*, the second pair of rollers 44*b* may move the workpiece W along the feed path along the first feed direction X.

Referring to FIG. 7B, the operation further include advancing 704 the workpiece W along the first feed direction X and locating or sensing 706 the top edge $W_{TE}$ of the workpiece W with the second sensor 102*b*. Once the second sensor 102*b* locates top edge $W_{TE}$ of the workpiece W, the operations further include the processor 104 receiving 708 top edge coordinate, such as a first Y reference coordinate $Y_{R1}$, from the second sensor 102*b*. The operations further include advancing 710 the workpiece W along the first feed direction X by a threshold or fixed distance $D_{F1}$ (see FIG. 7C) after the second sensor 102*b* locates the top edge $W_{TE}$ of the workpiece W.

Referring to FIG. 7C, once the workpiece W is advanced to the fixed distance $D_{F1}$, the operations further include ceasing 712 movement of the workpiece W along the first feed direction X. The operations include locating 714 the left edge $W_{LE}$ of the workpiece W by laterally moving the second sensor 102*b* along the track 106*b* in a first lateral move direction Y'.

Referring to FIG. 7D, once the second sensor 102*b* locates the left edge, $W_{LE}$, of the workpiece W, the operations may further include the processor 104 receiving a left edge coordinate, such as a first X reference coordinate $X_{R1}$, from the second sensor 102*b*. The operations may include locating 716 the right edge $W_{RE}$ of the workpiece W by laterally moving the second sensor 102*b* along the track 106*b* in a second lateral move direction Y, which is opposite to the first lateral move direction Y'.

Referring to FIG. 7E, once the second sensor 102*b* locates the right edge $W_{RE}$ of the workpiece W, the operations may include the processor 104 receiving 718 a right edge coordinate, such as a second X reference coordinate $X_{R2}$, from the second sensor 102*b*. The second sensor 102*b* may then be moved along the first lateral direction Y' by a fixed distance $D_{F2}$ after the second sensor 102*b* locates the right edge $W_{RE}$ of the workpiece W. Referring to FIG. 7F, the operations may further include advancing 722 the workpiece W along the second feed direction X', which is substantially opposite to the first feed direction X, and locating 724 via the second sensor 102*b* the top edge $W_{TE}$ of the workpiece W.

Referring to FIG. 7G, once the second sensor 102*b* locates top edge $W_{TE}$ of the workpiece W, the operations may include the processor 104 receiving 726 a top edge coordinate, such as a second Y reference coordinate $Y_{R2}$, from the second sensor 102*b*. Once the four reference coordinates are received by the processor 104, the processor 104 may use the first X&Y reference coordinates, $X_{R1}$, $Y_{R1}$, for determining 728 a coordinate for the top-left corner $W_{TLC}$ of the workpiece W and, the processor 104 may use the second X&Y reference coordinates, $X_{R2}$, $Y_{R2}$, for calculating 730 a coordinate for the top-right corner $W_{TRC}$ of the workpiece W. Further, as seen in FIG. 7H, since the crafting apparatus 10 has advanced the workpiece W along the second feed direction X', the first, upper roller 44*a*' is not shown in phantom (when compared to the view of FIG. 7A) due to the workpiece W not being located relative the first pair of rollers 44*a* in a bypassed orientation; as such, when the workpiece W is advanced along the second feed direction X', the workpiece W may be said to be at least partially interfaced with the first pair of rollers 44*a*.

As seen in FIG. 7H, once the top-left and top-right coordinates, $W_{TLC}$, $W_{TRC}$, of the workpiece W are calculated, the operations may include printing 732 (e.g., via the printing head 18*b*) an image I on the front surface $W_F$ of the workpiece W. The work conducted by the printing head 18*b* of the crafting apparatus 10 may be considered to be the first part of a "print then cut" operation. In some implementations, the image I may be created by the printing head 18*b* prior to the above-described operations with reference to FIGS. 7A-7G.

Referring to FIG. 7H, the operations may include advancing 734 the workpiece W along the second feed direction X', such that the workpiece W is moved away from the print head 18*b* and toward the cutting head 18*a*. In some implementations, at least the first pair of rollers 44*a* advances the workpiece W along the second feed direction X', such that the first sensor 102*a* may subsequently sense the top edge, $W_{TE}$, of the workpiece W as seen in FIG. 7I. The operations further include locating 736 (e.g., via the first sensor 102*a*) the top edge $W_{TE}$ of the workpiece W and the processor 104 receiving 738 a top edge coordinate, such as a first Y reference coordinate $Y_{R1}'$, from the first sensor 102*a*. The operations may further include advancing 740 the workpiece W along the first feed direction X by a fixed distance $D_{F3}$. Although the foregoing disclosure includes a description relating to the sensing of the top edge $W_{TE}$ of the workpiece W, once the workpiece W is moved to the cutting head 18*a*, in some implementations, the first sensor 102*a* may be utilized to locate a bottom edge (not shown) of the workpiece W in addition to or in lieu of locating the top edge $W_{TE}$ of the workpiece W.

Referring to FIG. 7J, once the workpiece W is advanced to the fixed distance $D_{F3}$, the operations include ceasing 742 movement of the workpiece W along the first feed direction X and locating 744 the right edge $W_{RE}$ of the workpiece W. The first sensor 102*a* may be moved laterally along the track 106*a* along the second lateral direction Y, for locating the right edge, $W_{RE}$, of the workpiece W.

Referring to FIG. 7K, once the first sensor 102*a* locates the right edge, $W_{RE}$, of the workpiece W, the operations may further include the processor 104 receiving 746 a right edge coordinate, such as a first X reference coordinate $X_{R1}'$, from the first sensor 102*a*. The operations further include locating 748 the left edge $W_{LE}$ of the workpiece W, as by moving the first sensor 102*a* laterally along the track 106*a* along the first lateral direction Y', which is opposite to the second lateral direction Y.

Referring to FIG. 7L, once the first sensor 102*a* locates left edge $W_{LE}$ of the workpiece W, the operations may include the processor 104 receiving 750 a left edge coordinate, such as a second X reference coordinate $X_{R2}'$, from the first sensor 102*a*. Referring to FIG. 7M, the operations may further include advancing 752 the workpiece W along the second feed direction X' and locating 754 the top edge $W_{TE}$ of the workpiece W. In some implementations, the operations include moving the first sensor 102*a* along the second lateral direction Y by a fixed distance $D_{F4}$, after the first sensor 102*a* locates the left edge $W_{LE}$ of the workpiece W, for locating the top edge $W_{TE}$ of the workpiece W.

Referring to FIG. 7N, once the first sensor 102*a* locates top edge $W_{TE}$ of the workpiece W, the operations may include the processor 104 receiving 756 a top edge coordinate, such as a second Y reference coordinate $Y_{R2}'$, from the first sensor 102*a*. Once the processor 104 receives the four reference coordinates, the processor 104 utilizes the first X&Y reference coordinates, $X_{R1}'$, $Y_{R1}'$, for determining 758 a coordinate for the top-left corner $W_{TLC}'$ of the workpiece W and, the processor 104 utilizes the second X&Y reference coordinates $X_{R2}'$, $Y_{R2}'$ for determining 760 a coordinate for the top-right corner $W_{TRC}$, of the workpiece W.

Once the top-left and top-right coordinates $W_{TLC}'$, $W_{TRC}'$ of the workpiece W are calculated, the processor 104 determines 762 if the workpiece W includes one or more of an angular skew θ and a lateral offset LO (e.g., by translating the top-left coordinates $W_{TLC}$, $W_{TLC}'$ and the top-right coordinates $W_{TRC}$, $W_{TRC}'$) which may have been imparted during the movement of the workpiece W from the printing head 18*b* to the cutting head 18*a* along the feed path FP in the second feed direction X'. Accordingly, the operations may include compensating 764 for any angular skew θ and/or lateral offset LO of the workpiece W. In some implementations, the processor 104 sends a compensation instruction to the cutting head 18*a* to compensate for one or more of the angular skew θ and lateral offset LO during a cutting operation C. The operations include cutting 766 the workpiece W (e.g., along one or more cut paths corresponding to a design).

Figure 7Q:
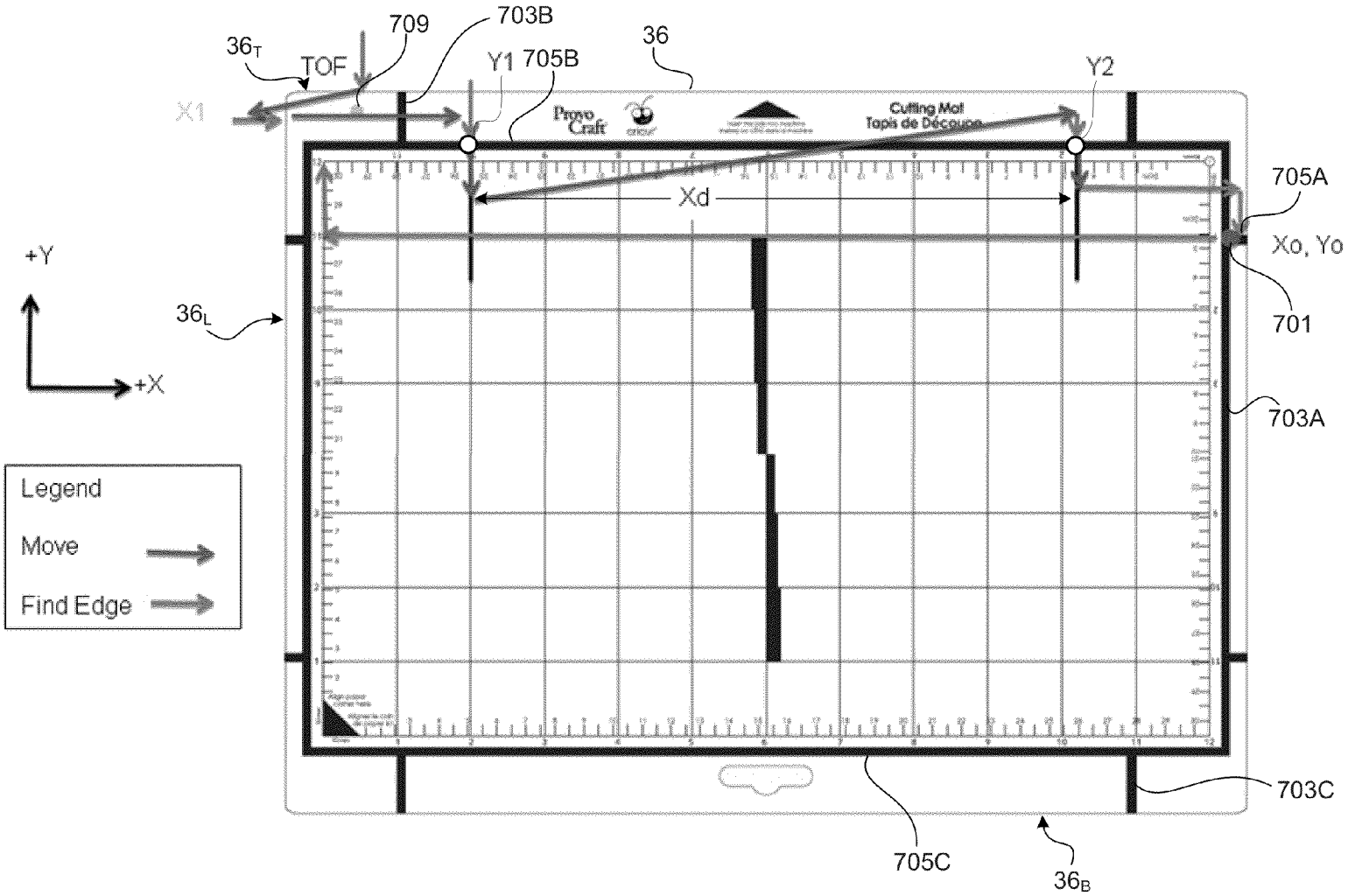
Figure 7R:
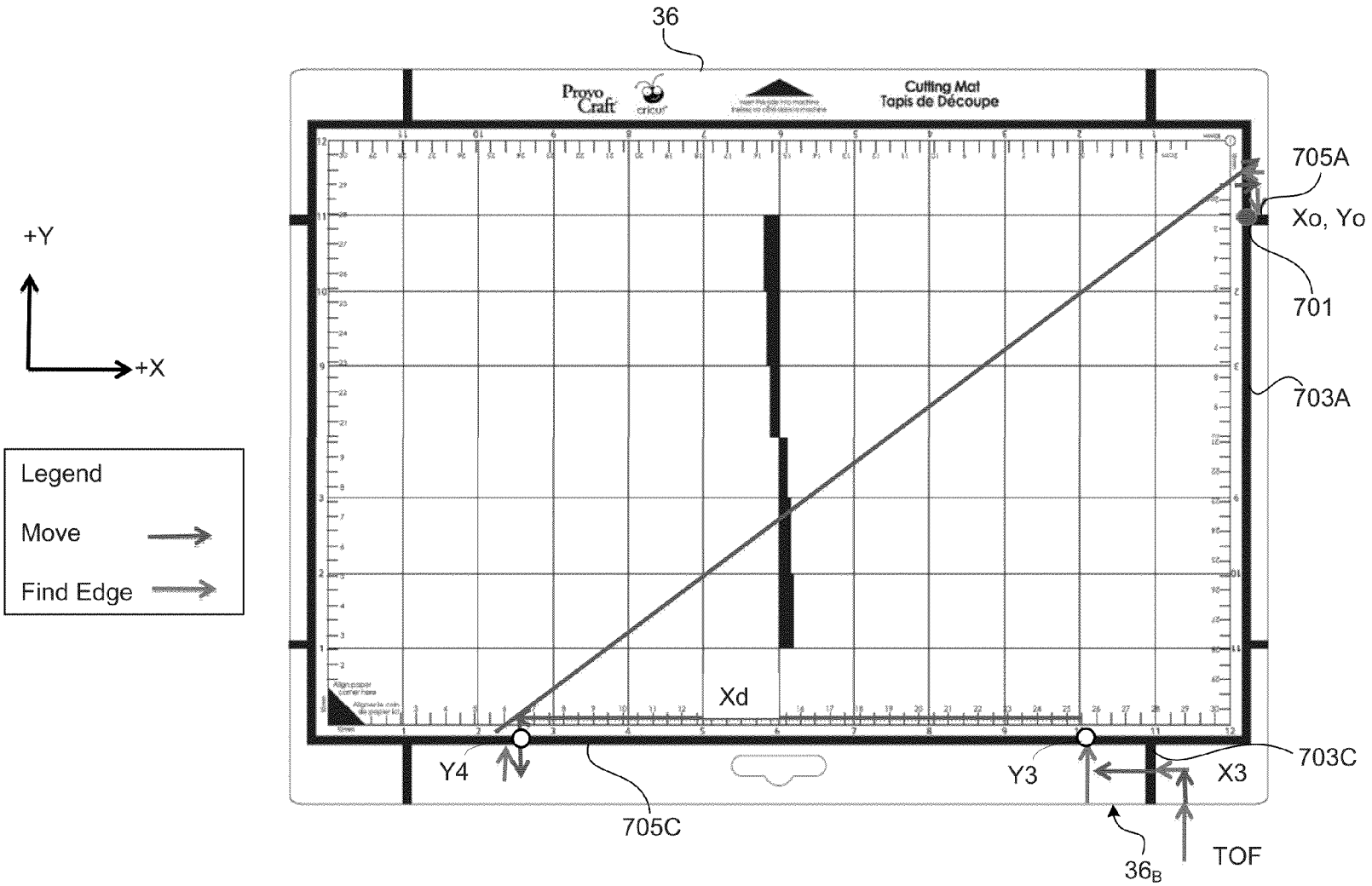

Referring to FIGS. 7Q and 7R, in some implementations, the crafting apparatus 10 executes an alignment routine or process with respect to a received mat 36. The mat 36 includes printed fiducials in the form of lines, such as first, second, and third vertical lines 703A, 703B, 703C (i.e. lines extending in a Y direction) as well as first, second, and third horizontal lines 705A, 705B, 705C (i.e. lines extending in an X direction orthogonal to the Y direction). The crafting apparatus 10 locates (e.g., via a sensor) an intersection of the first vertical line 703A with the first horizontal line 705A and determines an origin 701 of the mat 36. The origin has coordinates Xo, Yo of a coordinate system for the mat 36. By locating two points on the second horizontal line 705B having Y coordinates $Y_1$ and $Y_2$ with an X coordinate difference of $X_d$, the crafting apparatus 10 (e.g., using a processor) can determine a skew of the mat 36. The skew of the mat 36 can be determined using the following relationship: $\mathrm{Tan}(\theta)=(Y_2-Y_1)/X_d$.

In alternative method for determining mat skew, the crafting apparatus 10 may locate an intersection of the second vertical line 703B with the second horizontal line 705B near a localized spot 709 (e.g., using a sensor) to define another mat origin at coordinates $(X_1, Y_1)$.

In some examples, an alignment process includes locating a top edge $\mathbf{36}_T$ of the mat 36 (e.g., by moving in the −Y direction), locating a left edge $\mathbf{36}_T$, of the mat 36 (e.g., by moving in the +X direction), locating an intersection between the second vertical line 703B and the second horizontal line 705B, locating two points on the second horizontal line 705B having Y coordinates $Y_1$ and $Y_2$ with an X coordinate difference of $X_d$, locating an intersection between the first vertical line 703A and the first horizontal line 705A, and determining the origin Xo,Yo. Another alignment process or routine may include locating a bottom edge $\mathbf{36}_B$ of the mat 36, locating the third vertical line 703C, locating the third horizontal line 705C at two different locations $Y_3$ and $Y_4$ with an X coordinate difference of $X_d$, locating the first vertical line 703A, locating the first horizontal line 703A, and determining the origin Xo,Yo.

Figure 7S:
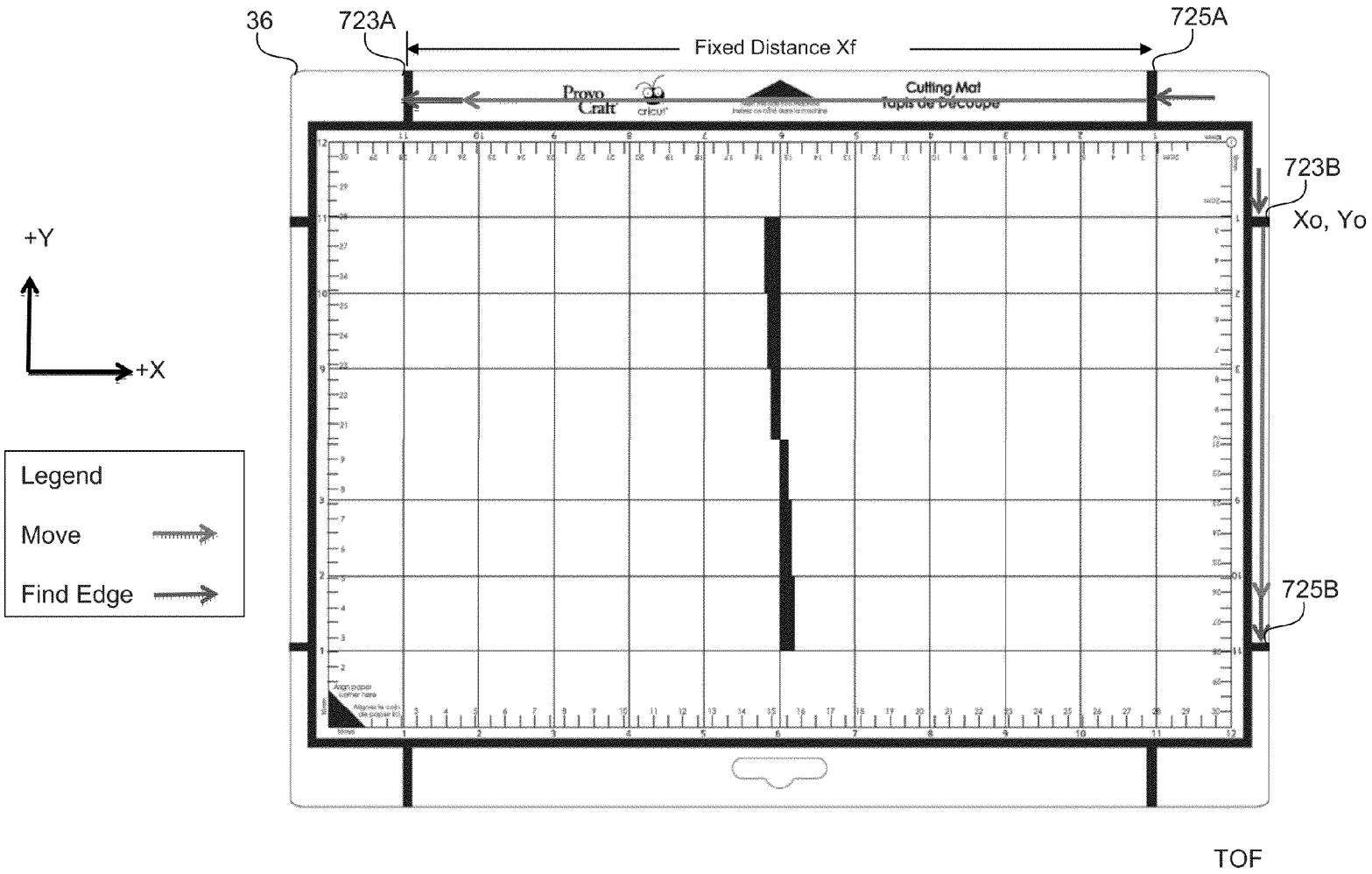
Figure 7T:
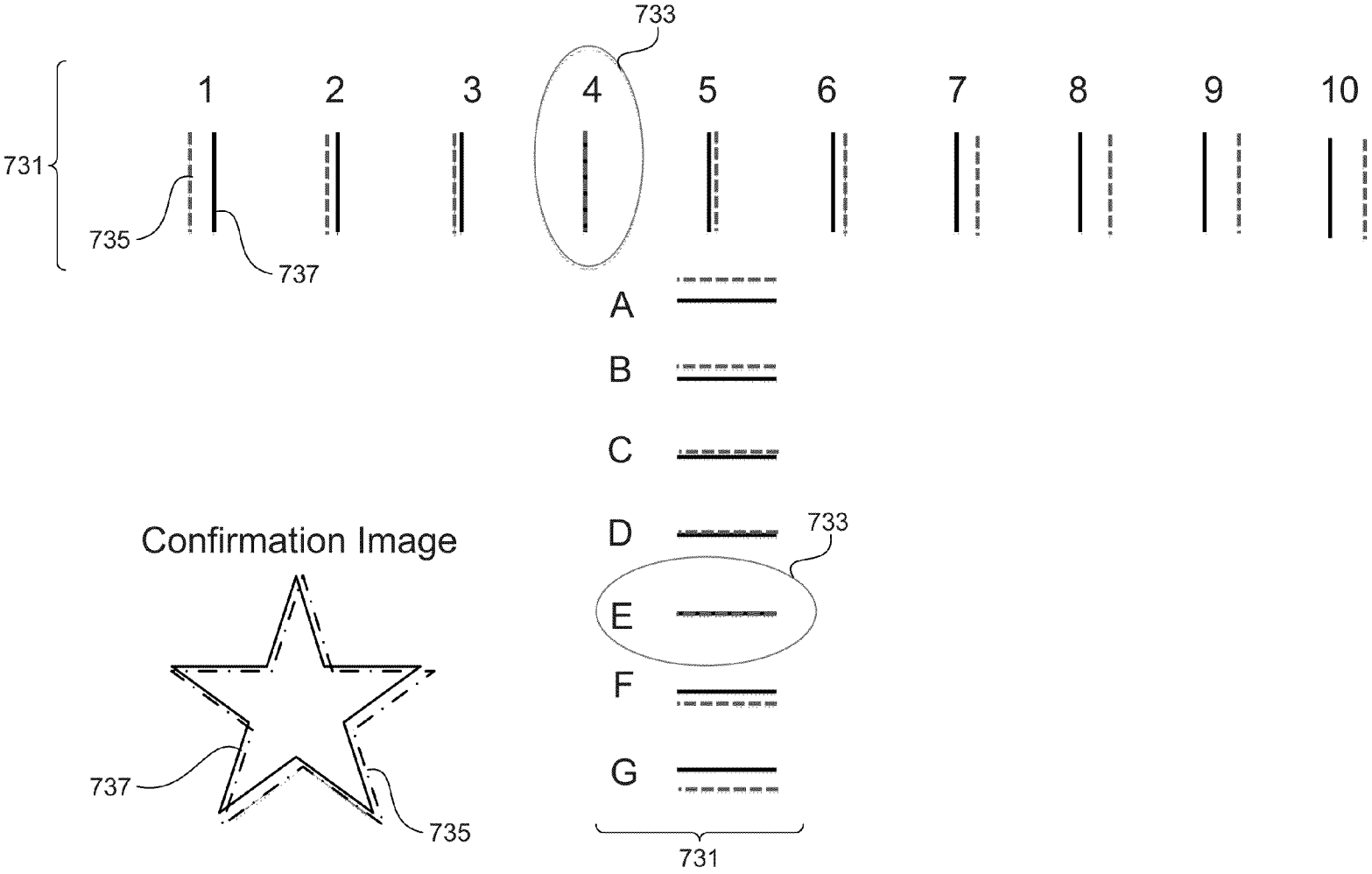
Figure 7U:
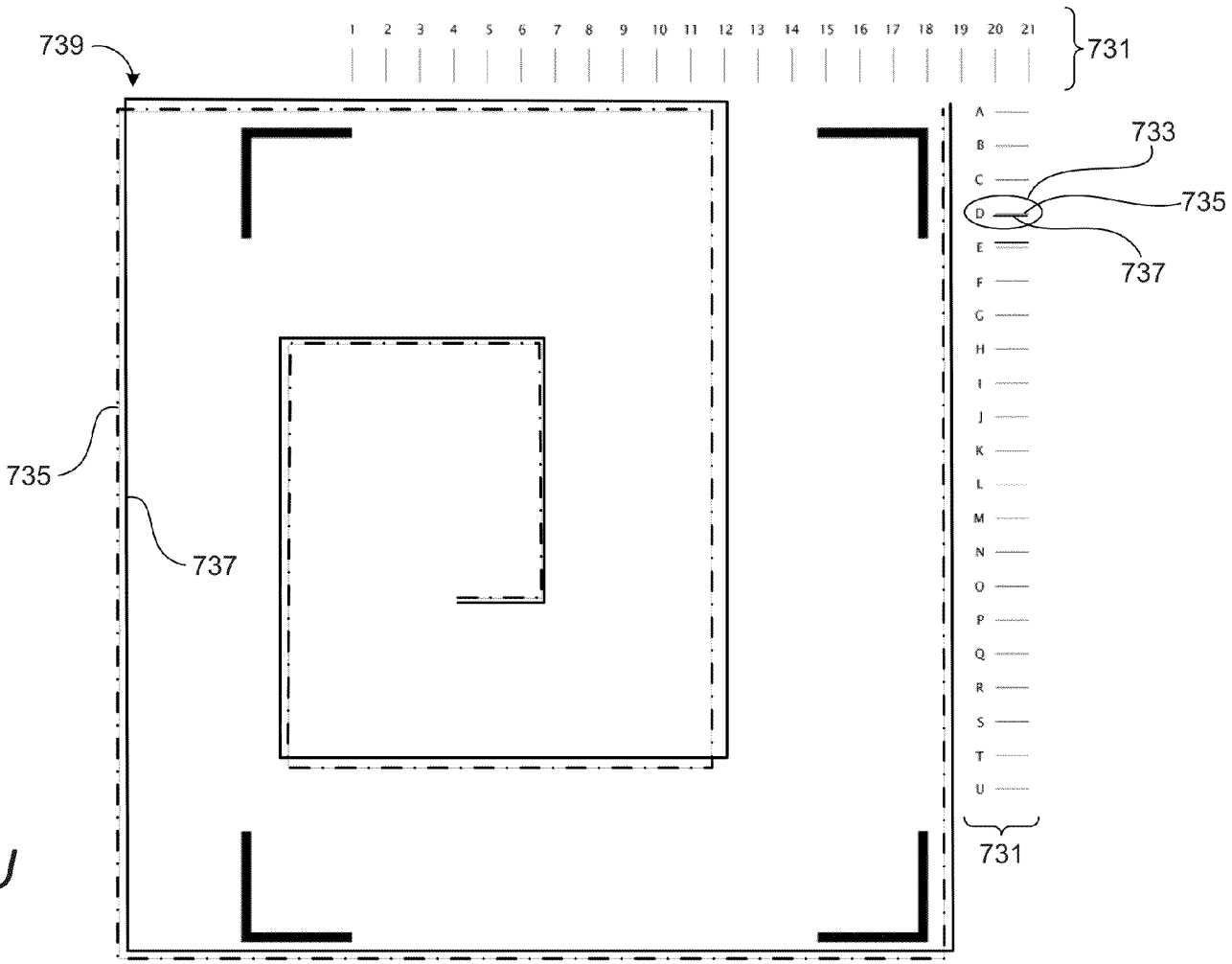

Referring to FIG. 7S-7U, in some implementations, the crafting apparatus 10 (via processor 104) executes a calibration routine to align the cutting head 18*a* to an image printed by the printing head 18*b*. This allows the cutting head 18*a* to cut the workpiece W in a coordinated manner with the printing head 18*b*. The crafting apparatus 10 calibrates the cutting head 18*a* by calculating the steps per inch (e.g., stepper motor steps per inch) to move certain distance in the X and/or Y directions across the mat 36. For example, the crafting apparatus 10 counts the number of steps (e.g., stepper motor steps) to move the cutting head 18*a* over a known distance and divides the steps taken by that known distance. In the example shown, the known distance is a distance between a first printed line or fiducial 723A, 723B and second printed line or fiducial 725A, 725B on the mat 36, in at least on of the X and Y directions. The printed lines or fiducials 723A, 723B, 725A, 725B may be recognized by a sensor or vision system on the cutting head 18*a* or some other portion of the crafting apparatus 10. The crafting apparatus 10 may print on a workpiece W supported by the mat 36 a test image 731 (e.g., 10 (or more) horizontal and vertical lines and/or images 735) and then cuts the test image 731 with a known offset (e.g., incremental offsets for each line). The user selects one or more calibration cut images 733 where the printed line 735 is coincident with the cut line 737, illustrating that the cutting head 18*a* and the printing head 18*b* are aligned with each other. The calibration cut images 733 may be pairs horizontal and/or vertical printed and cut lines with incremental offsets from each other. The crafting apparatus 10 receives the user's selection of calibration cut images 733 (e.g., images with coincident printed and cut lines) and adjusts the cutting head 18*a* and/or printing head 18*b* accordingly. The new offset may be used to print and cut a confirmation image 739. In the example shown in FIG. 7T, the confirmation image 739 is in the shape of a star, while in the example shown in FIG. 7U, the confirmation image 739 is in the shape of a spiral (e.g., rounded or squared). If it is not good enough the user can re-run the calibration process.

Thus, as seen in FIG. 10A, the cutting portion of the "print then cut" operation may be conducted such that the cutting head 18*a* performs a cutting operation C on the workpiece W that corresponds to an outer perimeter/border B of a printed image M. Once the cutting operation C is completed, the operations include discharging 768 the workpiece W and/or the mat 36 from the crafting apparatus 10. In some implementations, the first pair of rollers 44*a* move one or more of the workpiece W and the mat 36 along the second feed direction X' for discharging the workpiece W and/or the mat 36 from the crafting apparatus 10.

Figure 12:
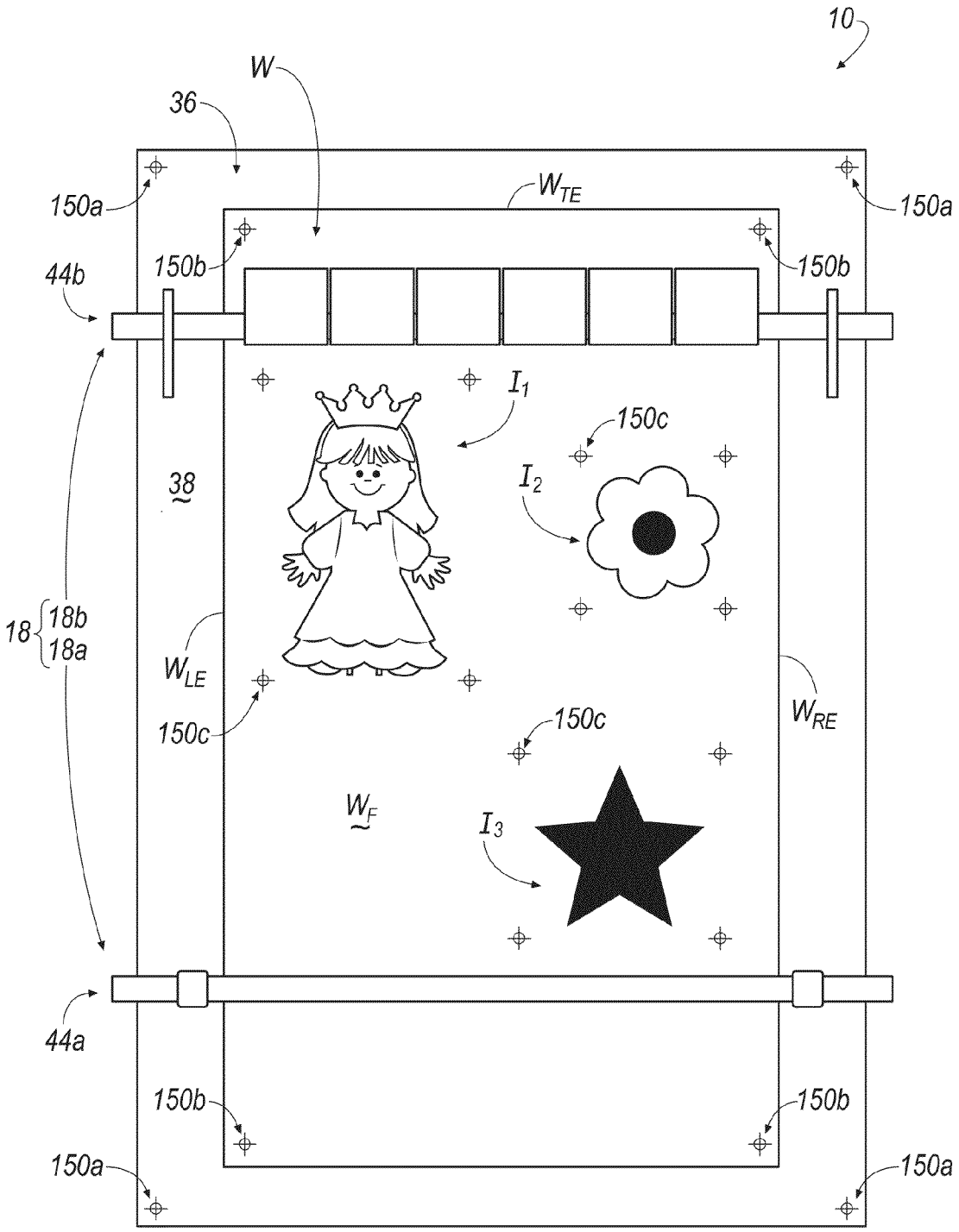
FIG. 12 illustrates a top view of an exemplary workpiece, mat and a partial, top view of a crafting apparatus.

FIG. 12 provides an example of a mat 36 supporting a workpiece W. In some implementations, the crafting apparatus 10 prints and/or detects fiducials 150*a*-150*c* on one or more of the mat 36 and workpiece W to compensate for skew θ and/or offset LO of one or more of the workpiece W and mat 36. The sensors 102*a*, 102*b* may scan for and detect the fiducials 150*a*-150*c* in a substantially similar manner as detection of the edges $W_{TE}$, $W_{LE}$, $W_{RE}$ of the workpiece W, for example, as by permitting movement of the sensors 102*a*, 102*b* relative the workpiece W and/or movement of the workpiece W relative the sensors 102*a*, 102*b*. FIGS. 7A-7N illustrate such similar movements. Moreover, in addition to fiducial detection, the sensors 102*a*, 102*b* may also detect the edges $W_{TE}$, $W_{LE}$, $W_{RE}$ of the workpiece W in order to compensate for skew θ and a lateral offset LO or offset of the workpiece W.

As seen in FIG. 12, the fiducials 150*a*-150*c* may be provided on the front surface $W_F$ of the workpiece W and/or the upper support surface 38 of the mat 36. In some examples, the fiducials 150*a*-150*c* are pre-printed on one or more of the front surface $W_F$ of the workpiece W and the upper support surface 38 of the mat 36. In additional examples, the fiducials 150*a*-150*c* may be printed substantially co-incidentally with one or more printed images $I_1$-$I_3$. Moreover, the fiducials 150*a*-150*c* may be printed after the one or more images $I_1$-$I_3$, have been printed.

In some implementations, the fiducials 150*a*, 150*b* are arranged on the front surface $W_F$ of the workpiece W and/or the upper support surface 38 of the mat 36 in any desirable manner. Accordingly, the fiducials 150*a* may be arranged proximate one or more of the edges and/or corners of the upper support surface 38 of the mat 36. Furthermore, the fiducials 150*b* may be arranged proximate one or more of the edges and/or corners of the front surface $W_F$ of the workpiece W.

The fiducials 150*c* can be arranged about each of the one or more printed images $I_1$-$I_3$. When arranged about the one or more printed images $I_1$-$I_3$, the fiducials 150*c* may be referred to as one or more "image-centric fiducials." In use, image-centric fiducials 150*c* may assist the crafting apparatus 10 in identifying a particular printed image of the one or more images $I_1$-$I_3$. For example, a user may decide to print-then-cut the printed image $I_1$ while deciding to not cut the printed images $I_2$-$I_3$. As a result, the image-centric fiducials 150*c* may be utilized to perform more than one or more functions by, for example, identifying a location of a particular printed image of more than one printed images $I_1$-$I_3$ and/or compensating for skew θ and/or offset LO of one or more of the mat 36 and workpiece W.

In some instances, fiducials 150*a*-150*c* are prepared in a group of four. For example, if the mat 36 and/or workpiece W includes four sides, the fiducials 150*a*, 150*b* may be arranged at the corners of the mat 36/workpiece W. Moreover, the fiducials 150*c* may be prepared in a group of four. For example, the fiducials 150*c* may be arranged relative the printed image $I_1$-$I_3$ in a manner such that the fiducials 150*c* "box in"/form a square-/rectangular-/parallelogram-shaped perimeter about the printed image $I_1$-$I_3$. Although the above-described implementations are directed to fiducials 150*a*-150*c* arranged in groups of four, the grouping of four fiducials is exemplary and other implementations may include more or less than four fiducials.

Figure 13:
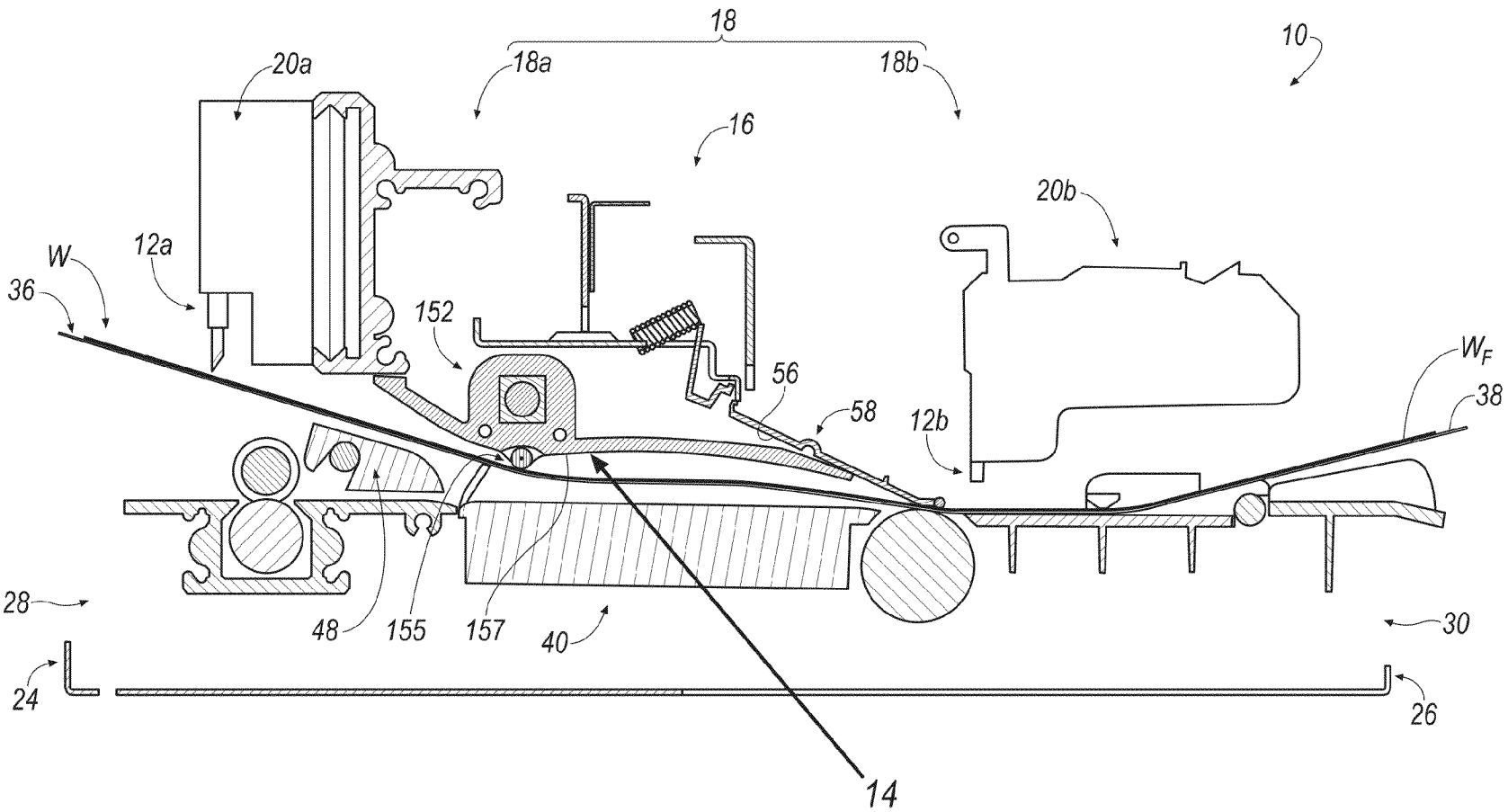
FIG. 13 illustrates a partial, cross-sectional view of an exemplary crafting apparatus.

Referring now to FIG. 13, a print head roller actuator toggle member 152 may function substantially similarly to that of the print head roller actuator toggle member 52 relative the toggle member 48 and one or more carriers 56 as shown and described with reference to FIGS. 3A-3D. In some implementations, the print head roller actuator toggle member 152 differs from the print head roller actuator toggle member 52 by including a roller 155 located proximate a lower surface 157 of the print head roller actuator toggle member 152. In some examples, the roller 155 is formed to include a material (e.g., TEFLON®, polyoxymethylene (POM) or the like) having very high lubricity value in order to deter adhesion of the exposed adhesive on the surface 38 to the lower surface 157 of the print head roller actuator toggle member 152.

Figure 14:
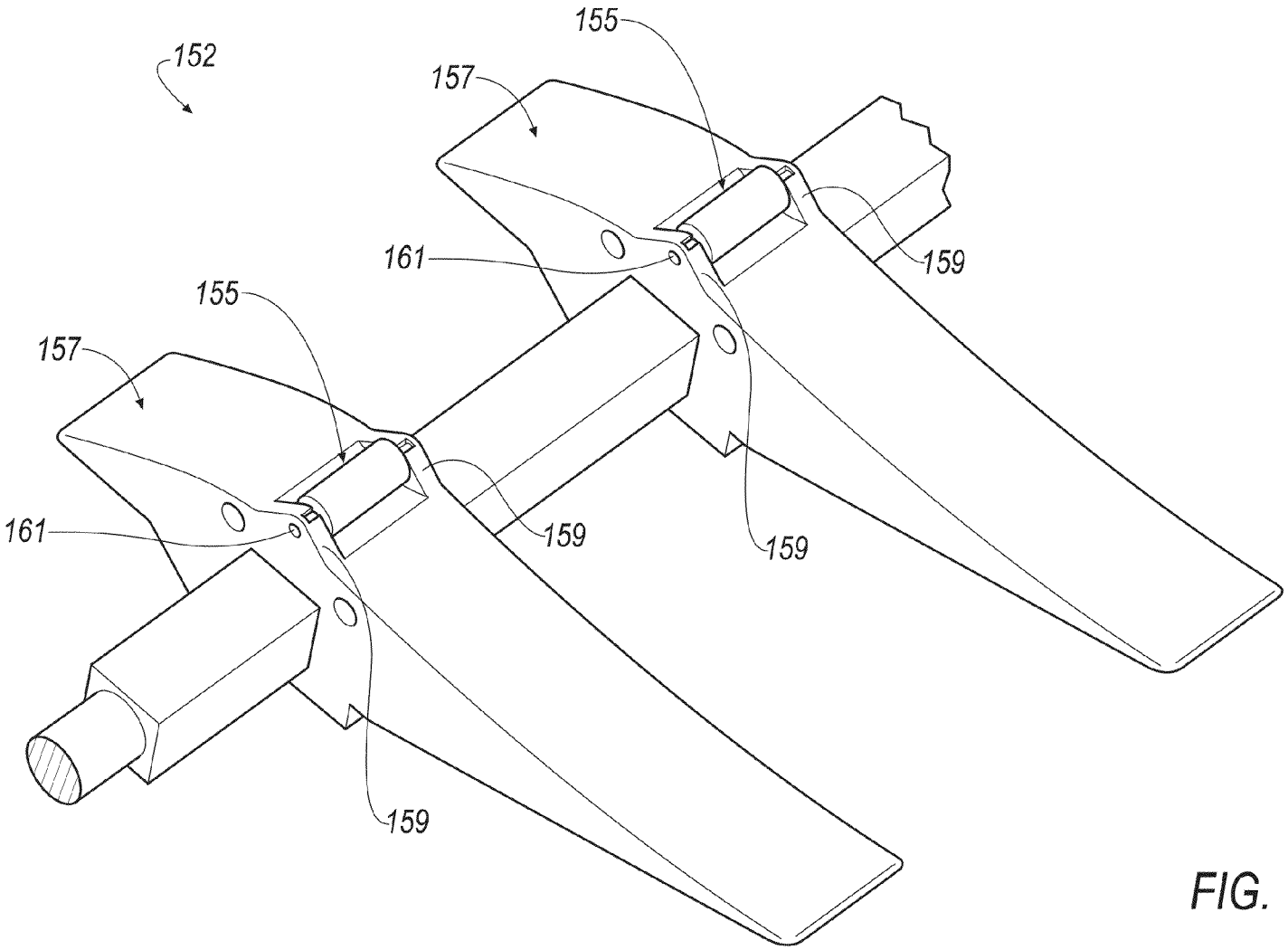
FIG. 14 illustrates a perspective view of an exemplary component of the crafting apparatus in reference to line 14 of FIG. 13.

FIG. 14 provides a view of the lower surface 157 of the print head roller actuator toggle member 152. In some implementations, the roller 155 is secured to the print head roller actuator toggle member 152 in a substantially similar manner as the first, upper roller 44*b*' and one or more carriers 58 as shown and described in FIGS. 5A-5B. The roller actuator toggle member 152 may include a pair of flanges 159 and a pin 161. In some examples, the roller 155 is arranged between the pair of flanges 159 such that the pin 161 is permitted to be inserted through each of the pair of flanges 159 and the roller 155 for rotatably-joining the roller 155 to the print head roller actuator toggle member 152.

The roller 155 may be formed substantially similarly to the first, upper roller 44*b*' by including one or more of a cylindrical sleeve 62 and core cylinder 64. Furthermore, the roller 155 may be formed in a substantially similar manner as that of the first, upper roller 44*b*' as shown in FIGS. 6A-6D.

Figure 15:
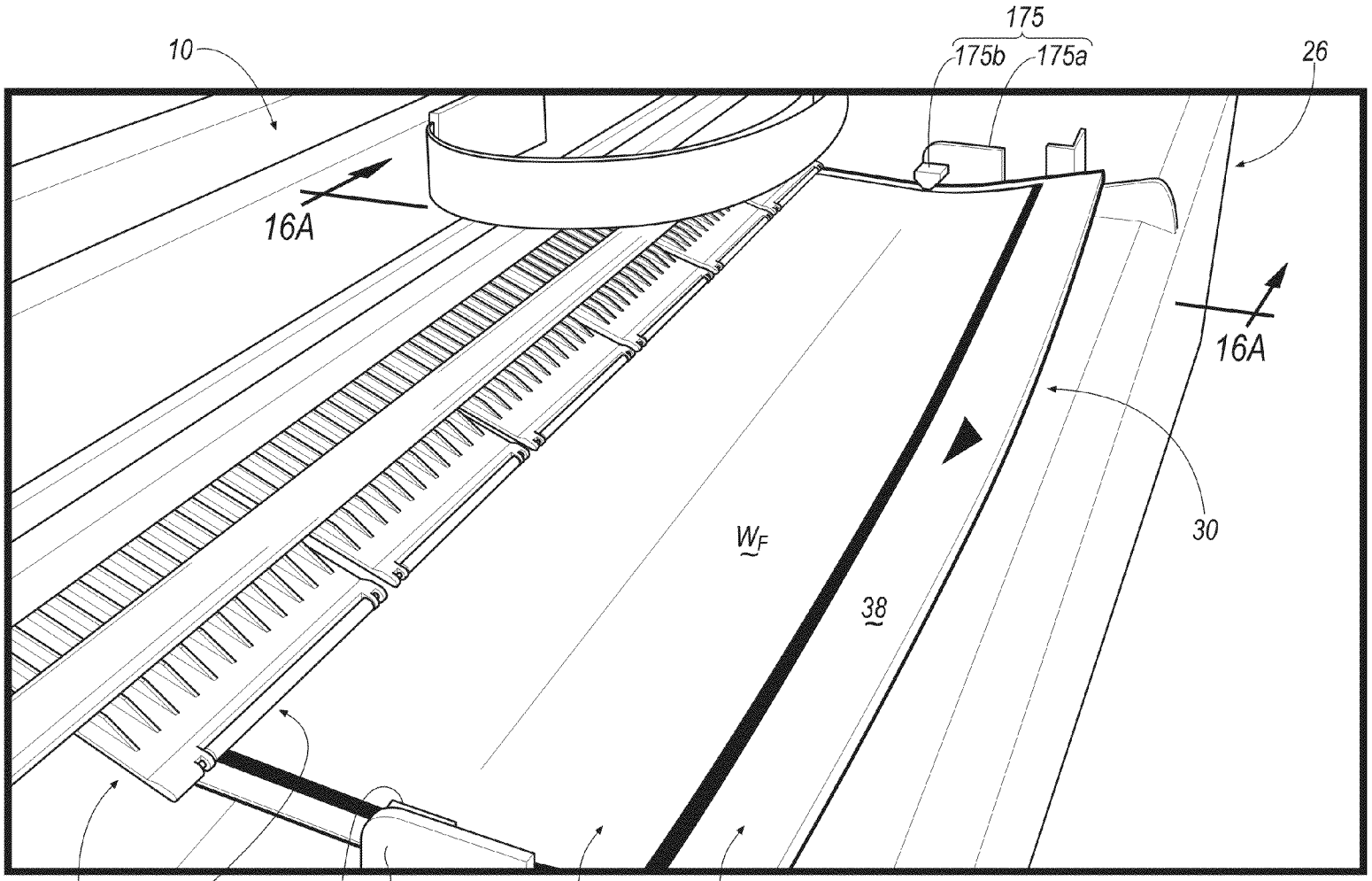
FIG. 15 illustrates a partial perspective view of an exemplary crafting apparatus.

FIG. 15 provides a partial perspective view of the rear side 26 of the crafting apparatus 10 forming the second opening 30. The crafting apparatus 10 may further include one or more guides 175 connected or located proximate the support assembly 40. In some implementations, the one or more guides 175 are formed by a lateral mat/workpiece guide portion 175*a* and an upper surface mat/workpiece guide portion 175*b*. Further, as seen in FIG. 15, one or more carriers 58 including first, upper rollers 44*b*' contact one or more of the front surface $W_F$ of the workpiece W and/or the upper support surface 38 of the mat 36.

Figure 16A:
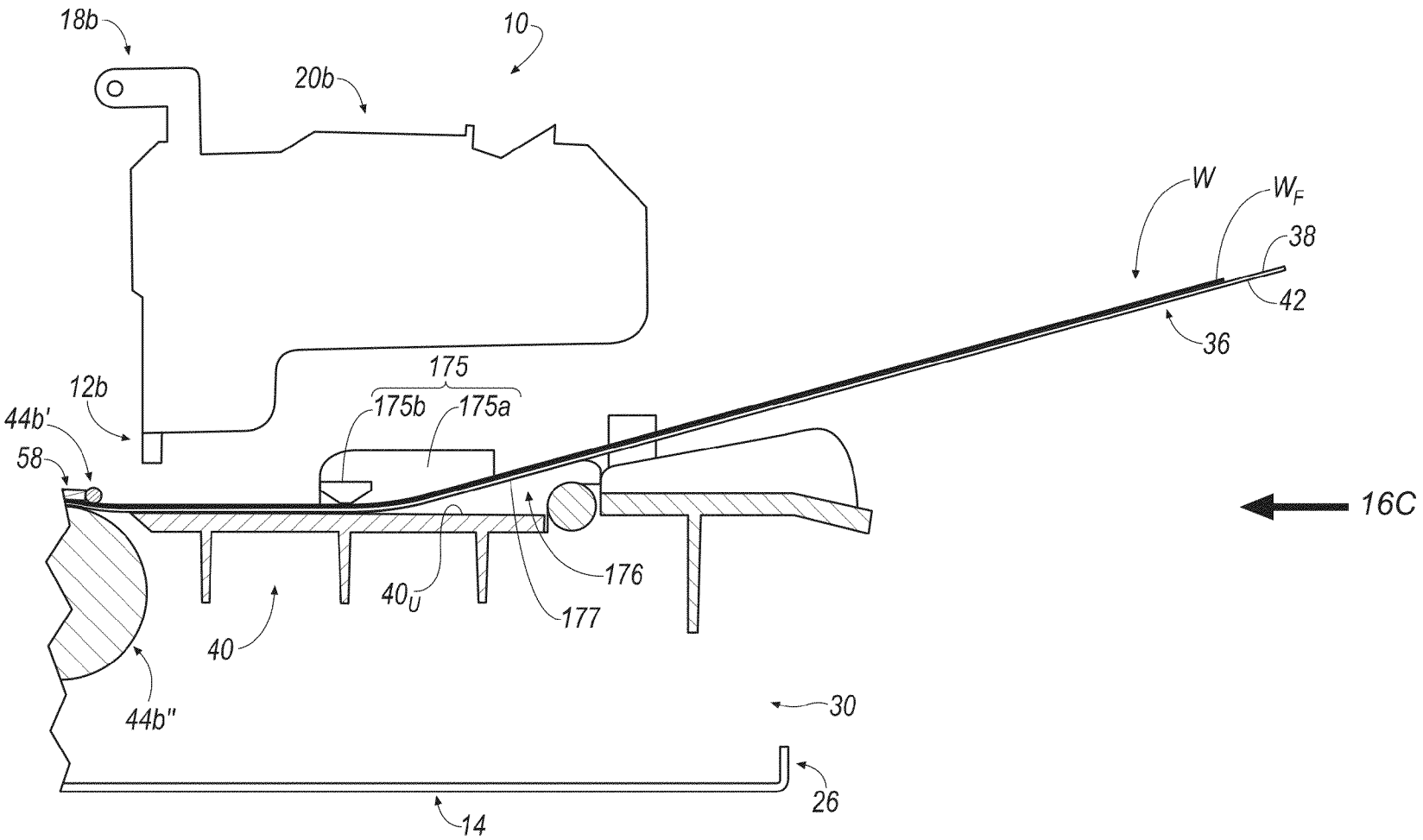
FIG. 16A illustrates a cross-sectional view of the crafting of apparatus as referenced from line 16A-16A of FIG. 15.

FIG. 16A provides a view of an orientation of the mat 36 and workpiece W relative the crafting apparatus 10. A ramp portion 176 may be connected to or located proximate one or more of support assembly 40 and the one or more guides 175. In some implementations, the ramp portion 176 is connected to or located proximate the lateral mat/workpiece guide portion 175*a* and the upper surface mat/workpiece guide portion 175*b* of the one or more guides 175. The lower support surface 42 of the mat 36 may be located substantially adjacent one or more of a ramp surface 177 of the ramp portion 176 and the upper support surface $\mathbf{40}_U$ of the support assembly 40. Referring to FIG. 16C, the ramp surface 177 of the ramp portion 176 may be curved or formed to include an arcuate, concave-up geometry.

Figure 16B:
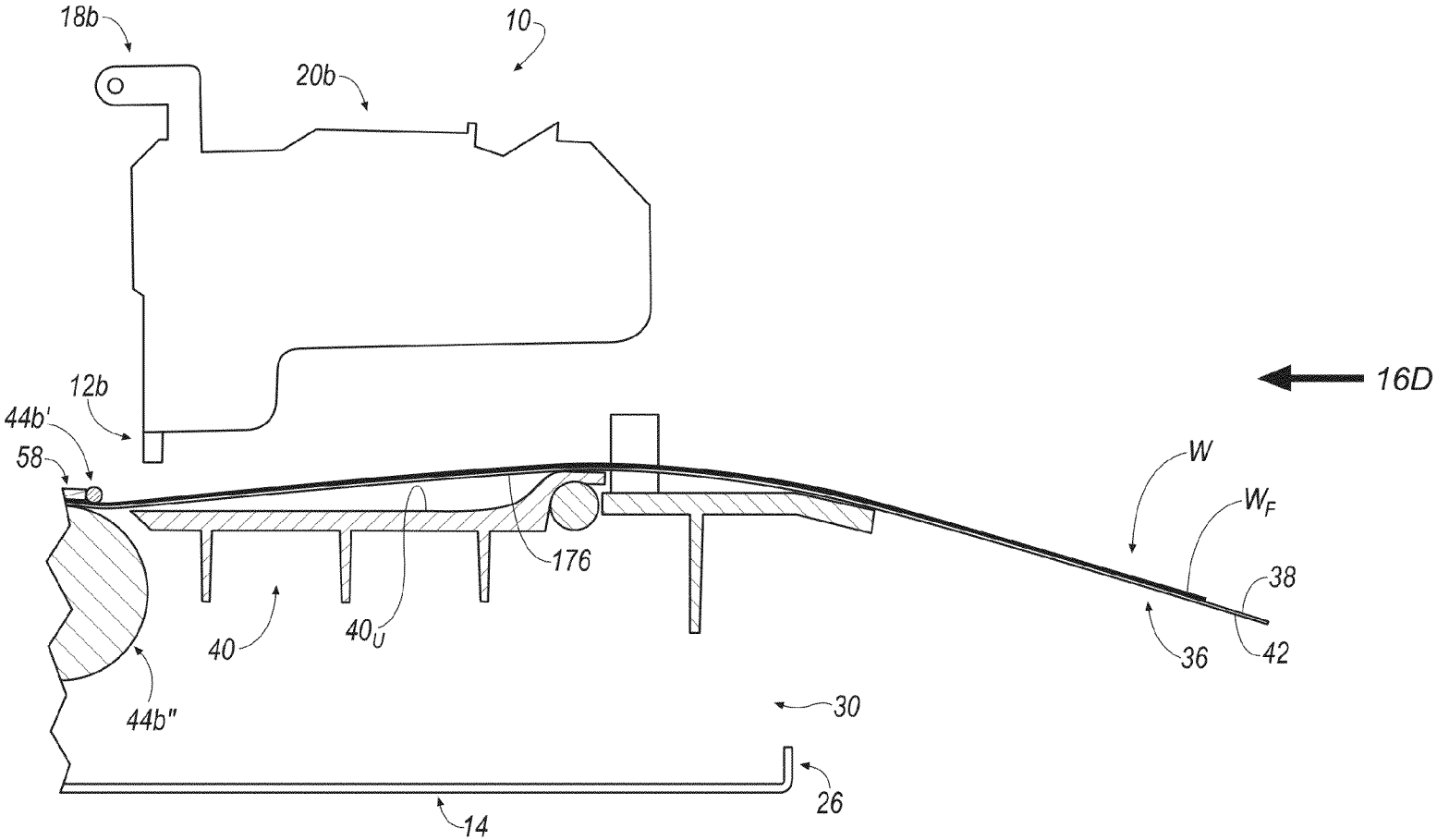
FIG. 16B illustrates a cross-sectional view of a crafting of apparatus in reference to line 16A-16A of FIG. 15.
Figure 16C:
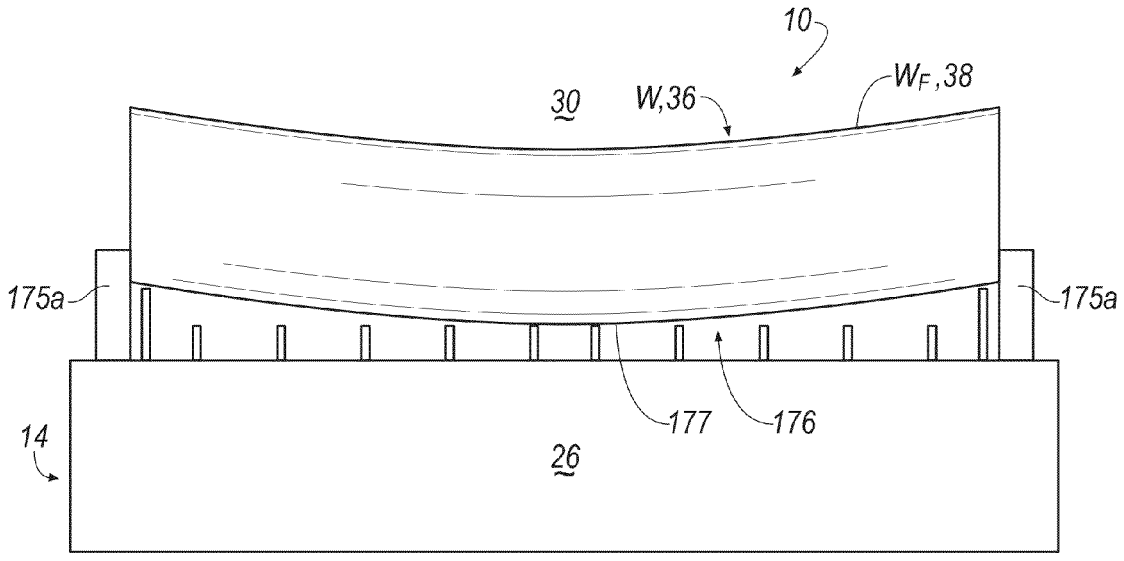
FIG. 16C illustrates a rear view of the crafting apparatus in reference to line 16C of FIG. 16A.

Referring to FIGS. 16A and 16C, contact of one or more of the mat 36 and workpiece W adjacent one or more of the lateral mat/workpiece guide portion 175*a*, the upper surface mat/workpiece guide portion 175*b* and the arcuate, concave-up ramp surface 177 may result in the rigidification of one or more of the mat 36 and the workpiece W (i.e., comparatively, as seen in FIG. 16A, the mat 36 and workpiece W is erect and projects upwardly from the upper support surface $\mathbf{40}_U$ whereas in FIG. 16B, the mat 36 and workpiece W is limp and hangs downwardly). Further, in addition to the resulting rigidification, the upper surface mat/workpiece guide portion 175*b* may assist in retaining one or more of the mat 36 and workpiece W substantially adjacent the upper support surface $\mathbf{40}_U$ of the support assembly 40 (i.e., comparatively, as seen in FIG. 16A, at least a portion of the mat 36 and workpiece W is substantially adjacent the upper support surface $\mathbf{40}_U$ whereas in FIG. 16B, at least a portion of the mat 36 and workpiece W may be substantially adjacent the upper support surface $\mathbf{40}_U$ as other portions of the mat 36 and workpiece W may be bowed/"wavy"/buckle such that at least a portion of the mat 36 and workpiece W may not be adjacent the upper support surface $\mathbf{40}_U$).

Figure 16D:
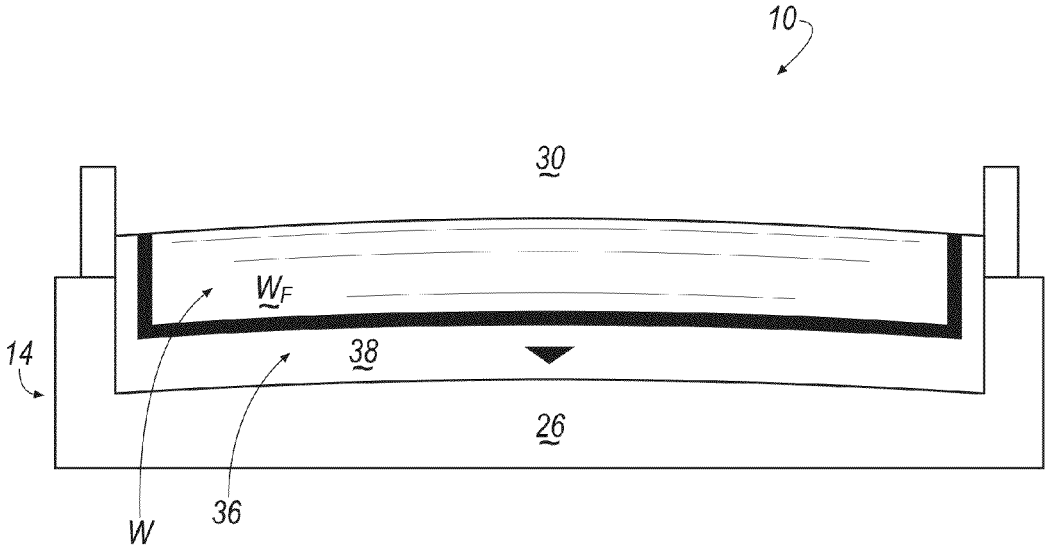
FIG. 16D illustrates a rear view of the crafting apparatus in reference to line 16D of FIG. 16B.

Thus, as a result of the inclusion of one or more of the one or more guides 175 and the ramp portion 176, at least a portion of the workpiece W that is located proximate the nozzle 12*b* of the printing head 18*b* may be retained in a substantially perpendicular orientation and in a consistently spaced-apart relationship relative to a printing/ink-depositing direction of the nozzle 12*b*. Conversely, referring to FIGS. 16B and 16D, without the inclusion of one or more of the one or more guides 175 and the ramp portion 176, one or more of the mat 36 and workpiece W may not be consistently presented to the nozzle 12*b* such that at least a portion of the workpiece W proximate the nozzle 12*b* of the printing head 18*b* may permitted to deviate in a manner that is closer to the nozzle 12*b* such that one or more of the mat 36 and workpiece W may not be retained in an expected, consistently spaced-apart orientation or relationship relative to the printing/ink-depositing direction of the nozzle 12*b*. If, for example, one or more of the mat 36 and workpiece W is permitted to bow/bend toward the nozzle 12*b*, an inconsistent/unacceptable deposit of ink/printing upon the front surface $W_F$ of the workpiece W may occur.

Referring to FIGS. 17A-17H, in some implementations, the crafting apparatus 10 is a printing and cutting system that includes a cutting engine 18*a* and a print engine 18*b* capable of cutting and printing various classifications of artwork (such as glyphs, images, or shapes), respectively. Each engine 18*a*, 18*b* may provide separate functionality or they may be merged in whole or in part, or controlled in whole or in part by a common processor/control system. FIGS. 17A and 17 B each provide a schematic view of an exemplary matrix of different classifications of artwork that may be used on the crafting apparatus 10. This artwork may be generally discussed herein as artwork, content, or both. The content may be stored as digital information in files for permanent, semi-permanent, and/or temporary storage. The digital information may be stored, for example, in FLASH memory, RAM, or on a disk that is part of a cartridge 120 and/or the crafting apparatus 10. Moreover, the digital content may be transferred using networks (e.g., the Internet), processors (e.g., via a computer or embedded processor), and/or local connections (e.g., such as USB).

Vector art (VA) may describe a path. The path may be a line or a curve. This path may be used as a cut path when used by a cutting engine. The vector path may also be used to describe an outline for a printing operation, such as a flood fill. Moreover, the vector path may be manipulated, such as by scaling, to change the overall size of the vector path. The vector art may be generally used for describing the outline and interior features of artwork.

Vector raster art (VRA) describes vector art that is correlated with raster art (RA) (e.g., a bitmap (BMP), PNG, JPEG, or other formats of raster oriented art). The vector art and raster art may be used separately or together to create a tangible result (e.g., through cutting and/or printing on a medium). For example, a circle having an outline may be described by the vector art. The circle may also have a colorful pattern associated with the interior of the circle which may be described by the raster. When the raster art is used individually, the raster art may be printed on a page, without performing cutting operations. Alternatively, the raster art may be used with some other vector art, for example, as a texture. When used together, the raster art and vector art may be used to create the printed patterned circle example, that then has a cut outer border to form a separate circle piece from the substrate.

Digitally layered art (DLA) may comprise a base image, which may be configured as the image as designed by the artist and as delivered to the user for consumption. The content may include a home location, which is the location of the vector path that, when all the images are in the home location, gives the user the base image. In some examples, the content includes a composite image, which is an image that has all of its various vectorized components overlapping, and/or a semi-composite image, which is an image that has a mix of overlapping and not overlapping vector paths. The content may include an exploded image, which is an image that has had its various vectorized components separated so that they do not overlap. The content may enable flood fill, shade filling, and/or texture filling actions. Flooding filling includes painting a single color inside the boundary created by a vector path. Shade filling includes altering the color of raster art to make it a different color while maintaining the shading of the raster art. Texture filling includes removing the raster art from inside a vector border and replacing it with a pattern. The content may define a vector region, which is an area created by the boundary of a vector path.

Digitally layered art is also described in detail with respect to U.S. Provisional Patent Application No. 61/178,074, to Strong, filed May 14, 2009, and entitled "PAPER LAYERING", the entirety of which is incorporated by reference herein.

FIGS. 17C and 17D each provide a schematic view of an exemplary use-case matrix for various types of artwork. In general, vector art, vector raster art, and digitally layered art may be used alone or together and each of the use-cases may be mixed and matched. However, certain systems providing print and cut, print only, or cut only functions may limit the usefulness of certain features of vector art, vector raster art, and digitally layered art.

FIGS. 17E and 17F each provide a schematic view of an exemplary use-case matrix for vector art, vector raster art, and digitally layered art. Enhanced designs using vector art, vector raster art, and digitally layered art can be shared via cartridges 120.

FIGS. 17G and 17H each provide a schematic view of exemplary use rules that may apply to vector art, vector raster art, and digitally layered art. For example, with vector art (VA), vector raster art (VRA), and digitally layered art (DLA), any vector path can be cut and/or printed. Moreover, any area enclosed by vector loop can be flood filled and printed. Attributes of the content can be shown with other content. For vector raster art and digitally layered art, shapes and paper pallets can be mixed between content. Digitally layered art can be exploded or used as a composite image.

Figure 18A:
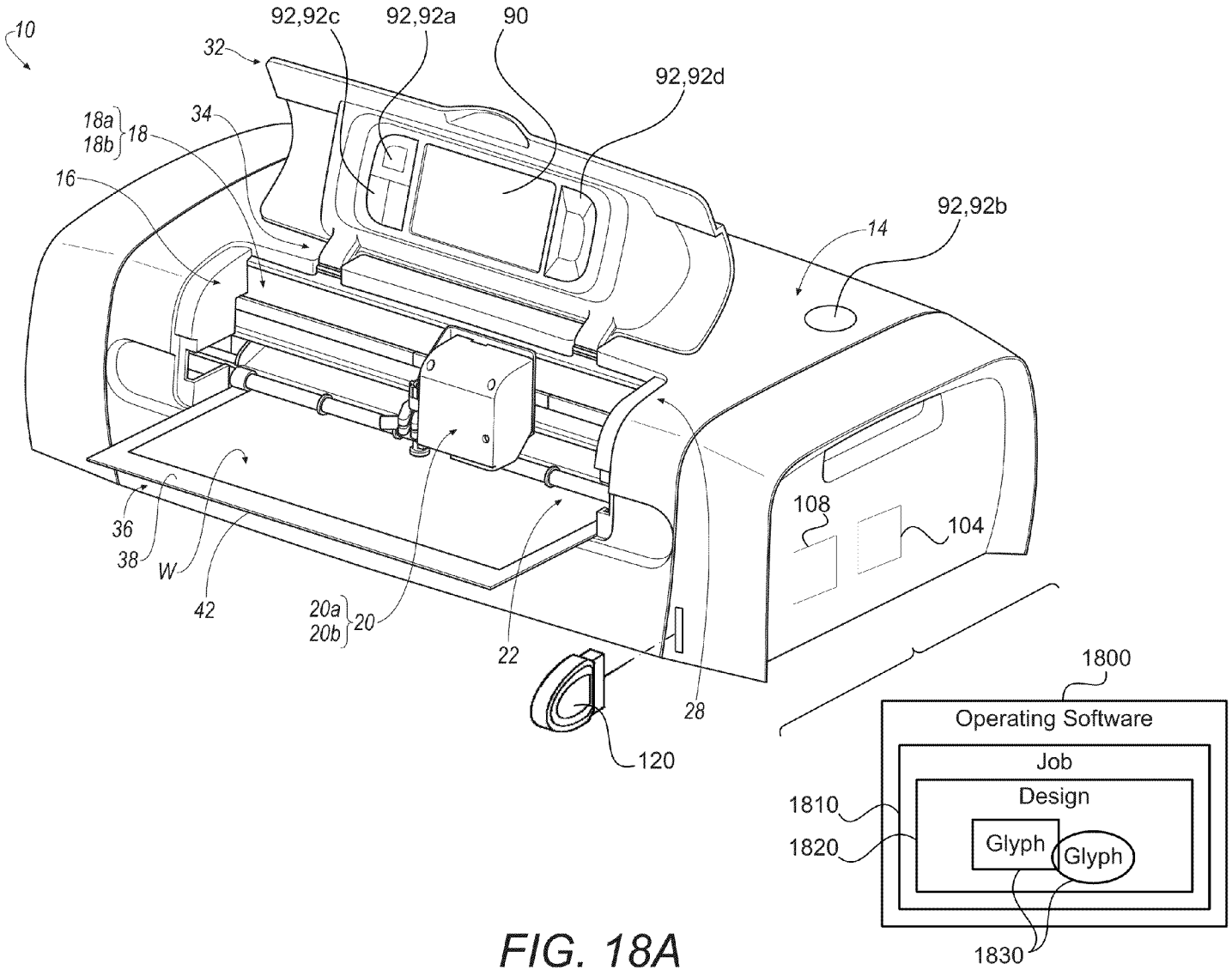
FIG. 18A provides a perspective view of an exemplary crafting apparatus executing operating software.
Figure 18B:
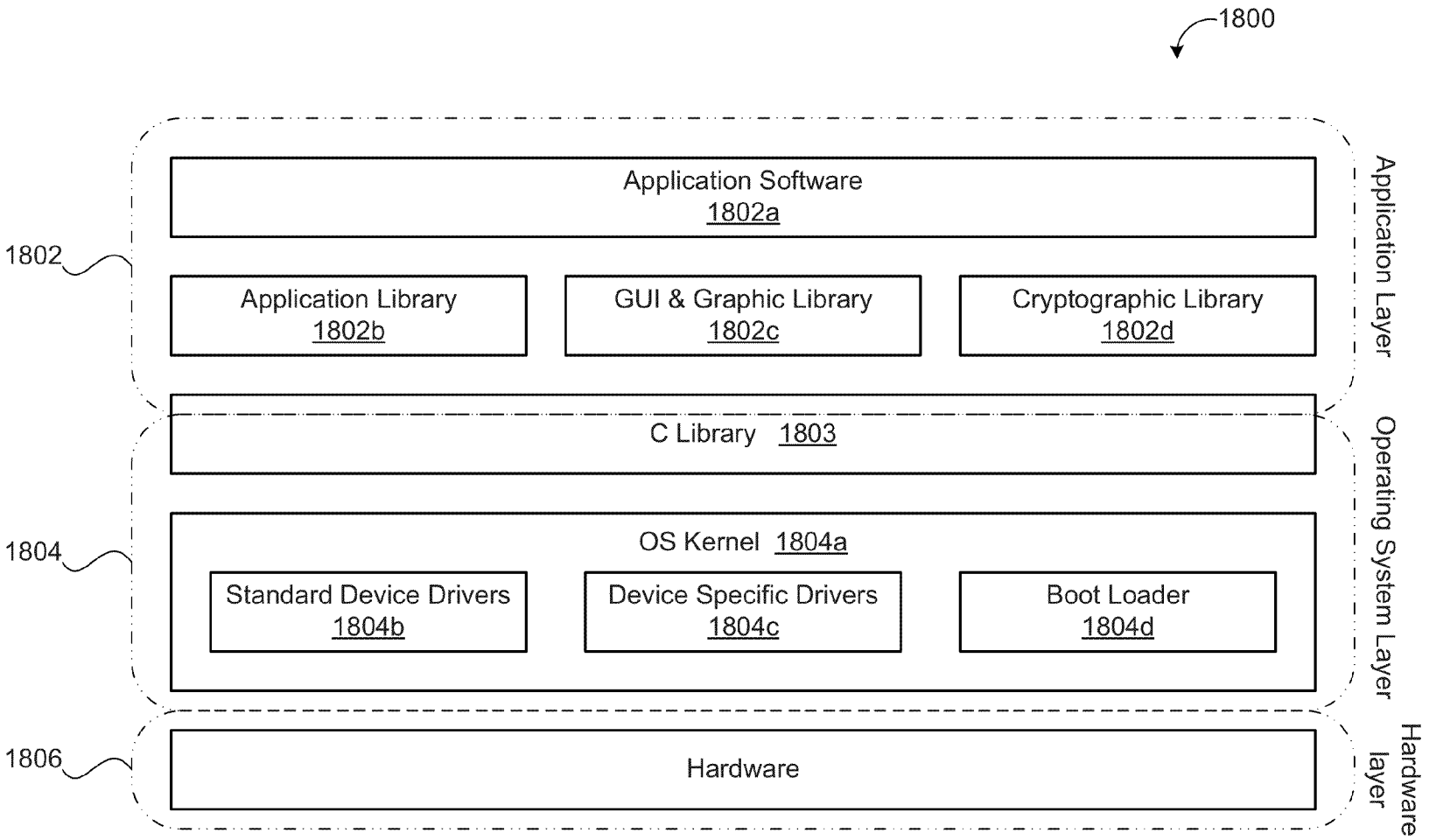
FIG. 18B provides a schematic view of an exemplary software architecture for a crafting apparatus.

Referring to FIGS. 18A and 18B, the crafting apparatus 10 (also referred to as an electronic printer/cutter device or a machine) includes operating software 1800 that may be stored in memory 108 and executable on a process 104 in communication with the memory 108. In some implementations, the operating software 1800 includes an application layer 1802 for allowing communication with a user and an operating system layer 1804 for communication with hardware 1806 of the crafting apparatus 10. The application layer 1802 may include an application software module 1802*a* that provides use capabilities through a graphical user interface (GUI). The application software module 1802*a* may communicate with an application library 1802*b* to support the use capabilities, a GUI & graphics library 1802*c* to support the GUI, a cryptographic library 1802*d* for providing security (e.g., secure login, file encryption, etc.), and a C language library 1803. The application layer 1802 can communicate with the operating system layer 1804, which includes an operating system (OS) kernel 1804*a* in communication with the C library 1803. The OS kernel 1804*a* may include standard device drivers 1804*b* and/or device specific drives 1804*c* as well as a boot loader 1804*d*. The OS layer 1804 communicates with hardware (e.g., controller board(s), motors, etc.) of the crafting apparatus 10. A hardware abstraction layer 1806 may provide an interface with hardware of the crafting apparatus 10.

The operating software 1800 may be displayed (e.g., via a GUI of the application software module 1802*a*) and accessed for use on a display 90 (e.g., touch screen) of the crafting apparatus 10. The operating software 1800 allows a user to create a project or job 1810 having at least one design 1820 and then execute the job 1810 on the crafting apparatus 10. The job 1810 may be used in different machine modes that include printing and cutting the design 1820, just printing the design 1820, and/or just cutting the design 1820. In creating or editing an existing project or job 1810, the user can access content (e.g., glyphs 1830) associated with one or more cartridges 120 in communication with the crafting apparatus 10. In addition to creating and/or managing content, the operating software 1800 may be used for interacting with the crafting apparatus 10 and managing operating parameters and states of the crafting apparatus 10. The operating software 1800 may interface with the crafting apparatus 10 to realize designs 1820 by printing and/or cutting out the constituent components of the designs 1820, such as paper cutouts. Additionally, the digital content accessed in the operating software 1800 to create the designs 1820 can be compatible with other devices, such as printers, stamping machines, other machines configured to realize designs 1820 in tangible form, or other software packages configured for using or further manipulating the design. In some implementations, the operating software 1800 provides access to digital content in a secure manner so as to allow for unfettered use by the owner while providing security against unauthorized duplication.

Figure 18C:
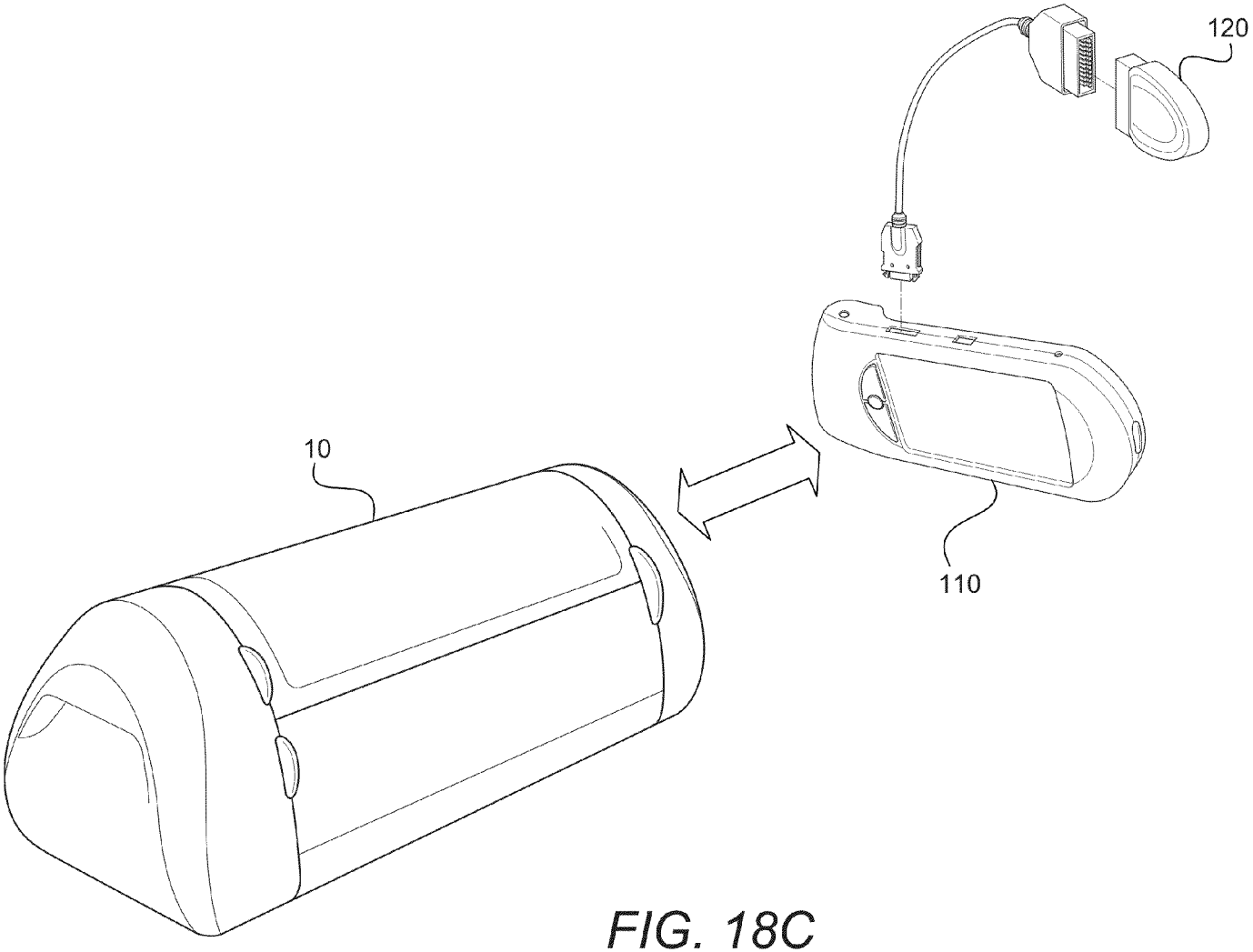
FIG. 18C provides a perspective view of an exemplary hand-held controller of a crafting apparatus communicating with a cartridge.

In some implementations, the user may access content for use with the operating software 1800 through one or more cartridges 120, which may be in communication with the crafting apparatus 10, as shown in FIG. 18A, or a hand held controller 110, as shown in FIG. 18C. In further examples, the hand held controller 110 may access the content of a cartridge 120 connected (e.g. via a universal serial bus (USB)) to the crafting apparatus 10. In that example, the hand held controller 110 may communicate with the crafting apparatus through a wire or wireless connection. The cartridge 120 may store content in memory of the cartridge 120 and/or content associated with the cartridge 120 may be stored on the crafting apparatus 10 in memory 108 accessible by the operating software 1800. The cartridge(s) 120 may be used to provide access to the stored content (e.g., via software and/or an encryption key) and/or provide usage rights of the content on the crafting apparatus 10 when a user wishes to realize a design in a tangible form. In some examples, the user may access and design with content not otherwise owned by the user; however, when the user executes a printing and/or cutting operation on the crafting apparatus 10, the user may be required to verify ownership of any content used in an executed design 1820. Ownership of content can be verified by establishing communication of any respective cartridges 120 with the operating software 1800 (e.g., via the hand held controller 110) and/or the crafting apparatus 10. Moreover, the user may be prompted to purchase any content not owned by the user before allowing execution of the cutting operation on the crafting apparatus 10.

In some implementations, the cartridge 120 and/or the hand-held controller 110 stores the following for each glyph 1830: glyph data, fills (e.g., colors or vector graphics), images (e.g., vector art, vector raster art, and/or digitally layered art), software, firmware updates, and/or certificates. Exemplary glyph data includes a glyph name, a glyph reference, a cut path, child glyphs (e.g., position and corresponding glyph reference), and fill data (e.g., bleed, clipped to cutting path plus an offset). For glyphs 1830 comprising composite images 1860, the glyph data may include child glyph data for each component image 1862, which may include corresponding glyph data and a glyph position (e.g., absolute and/or relative position with respect to a parent image). The fill data may include a position, a scale, a rotation, mirroring, and a fill reference. The glyph data may include key binding (e.g., for fonts), keywords for searching to find the glyph 1830, and recommended cutting tools (e.g., a tool type, a cutting speed ratio, a cutting pressure ratio, etc.) for cutting the glyph 1830. The stored images may include preview images (e.g., prerendered images) of the glyph 1830 and any child glyphs 1830 in various sizes and resolutions, as well as fill images.

The software may include print and/or cut instructions, print and/or cut restrictions, regional information, and security measures. Additional information stored for each glyph 1830 may include user-changed properties, such as a scale, position, rotation, fill, etc.

As used herein, the term "design object" refers to something that is or can be selected by the user for manipulation, such as by executing a user initiated command. A design object 1850 may be a glyph 1830 or part of a glyph 1830 (e.g., a subset of a glyph). For example, a command can be executed on a region of a multi region glyph 1830. Referring to FIG. 18E, an exemplary single region glyph 1830*a* is a circle, while an exemplary multi region glyph 1830*b* is a figure-eight. A glyph 1830 having multiple closed vector loops (such as the figure-eight glyph 1830*b*) will have multiple glyph regions 1832 defined by those vector loops. Each of these glyph regions 1832 can be selected by the user. For example, when executing a flood filling command, the user first selects the glyph 1830 and then a region of the glyph 1832 that is to be filled.

Figure 18D:
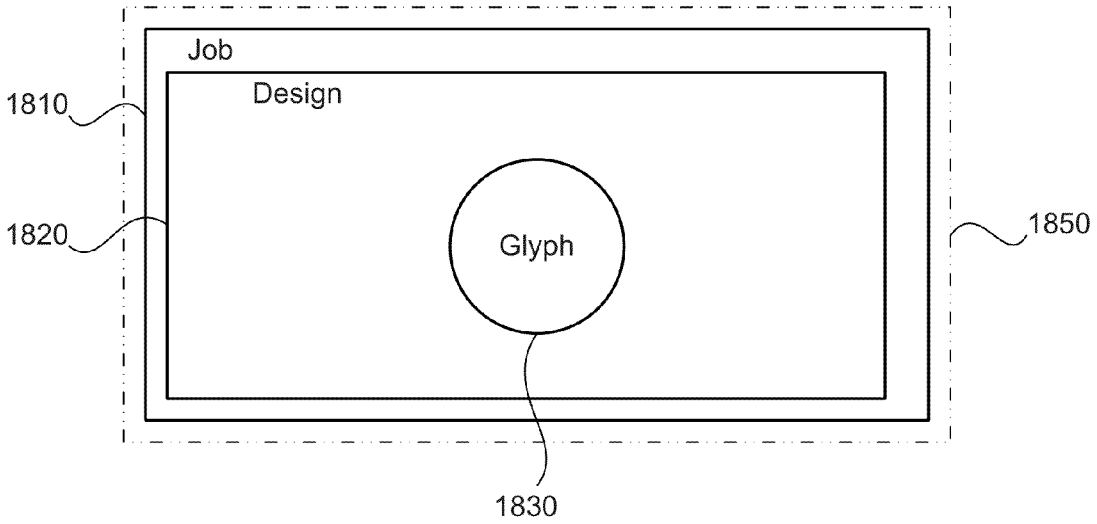
FIG. 18D provides a schematic view of an exemplary single glyph job.
Figure 18E:
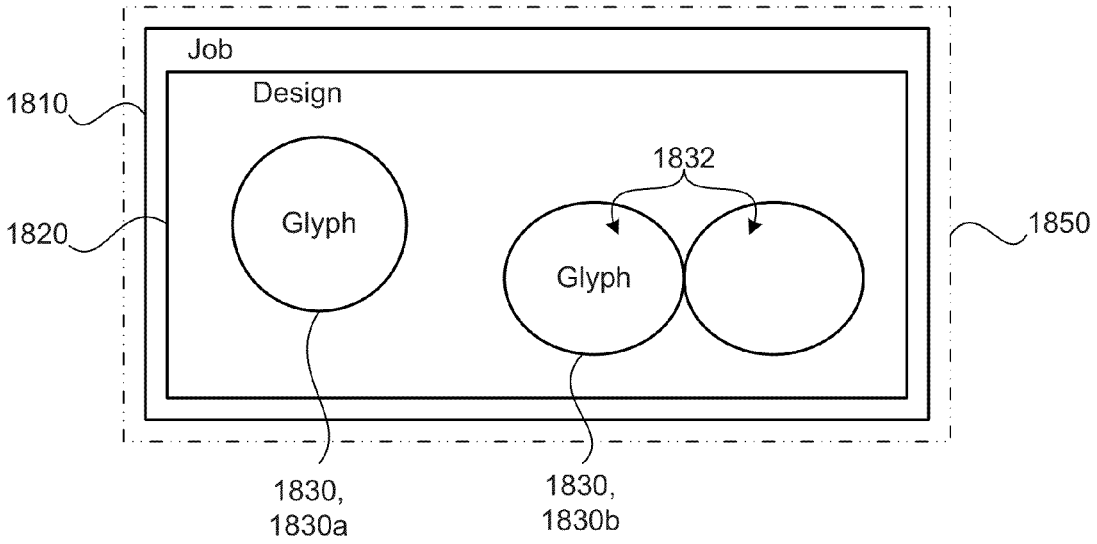
FIG. 18E provides a schematic view of an exemplary multi-glyph job.
Figure 18F:
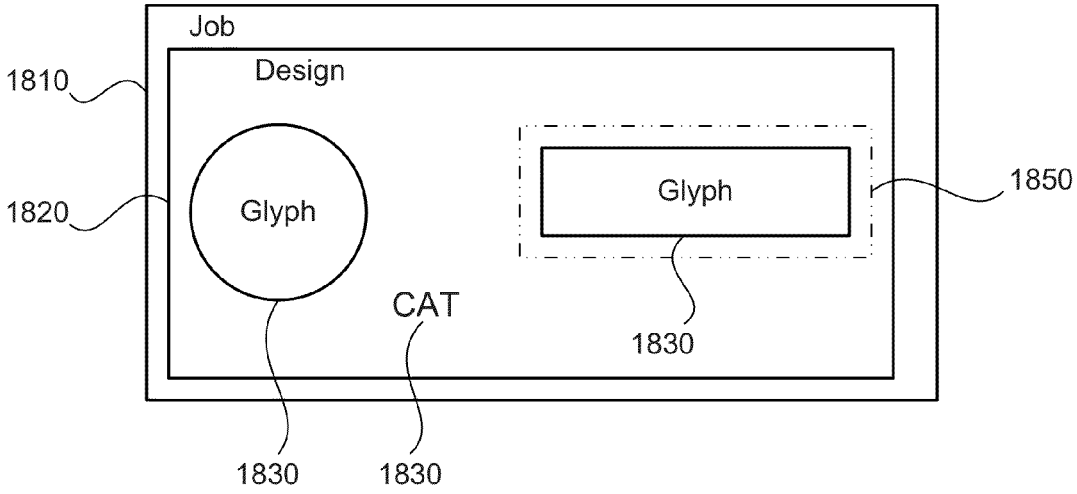
FIG. 18F provides a schematic view of an exemplary multi-glyph job with a single glyph selected as an exemplary design object.
Figure 18G:
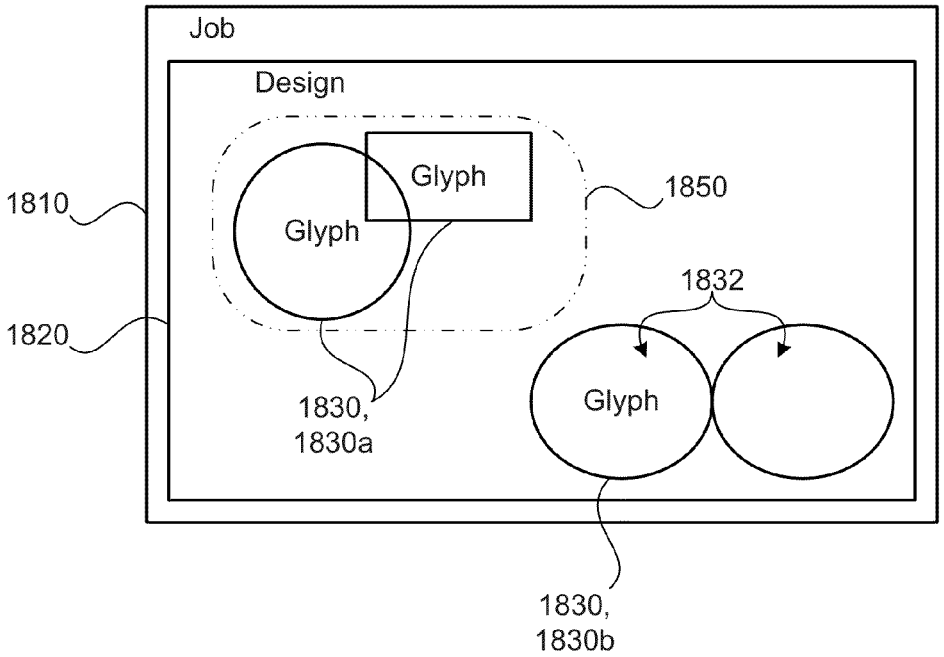
FIG. 18G provides a schematic view of an exemplary multi-glyph job with multiple glyphs selected as an exemplary design object.

A design object 1850 may be a single glyph job as an entire job 1810, as illustrated by the example shown in FIG. 18D, where the design 1820 of the job 1810 includes only a single glyph 1830. For example, a job 1810 may include data for color and/or palette information, but as long as only one glyph 1830 is in the job or project 1810, then the job 1810 may be considered single glyph 1830. A design object 1850 may also be a multi-glyph job as an entire job 1810, as illustrated by the example shown in FIG. 18E, where the design 1820 of the job 1810 includes two or more glyphs 1830. In some examples, a design object 1850 is a single glyph 1830 of a multi-glyph job 1810, as shown in FIG. 18F. For example, the user can select a single glyph 1830 from among multiple glyphs 1830 in a job 1810 and execute a command or operation on the selected glyph 1830. Moreover, in some examples, the user can select multiple glyphs 1830 of a multi-glyph job 1810 (e.g., a subset of a job) as a design object 1850, as shown in FIG. 18G, and execute a command on the selected glyphs 1830. The user may execute operations on a selected design object 1850 such as, but not limited to, cut, coy, paste, flood fill, raster, order (e.g., for layers), group (e.g., combine several glyphs 1830 together as one glyph 1830), ungroup (e.g., sever a glyph 1830 into component glyphs 1830), composite, and explode. For example, any vector path can be cut and/or printed, any area bound by a vector loop can be filled or altered, and digitally layered art can be exploded or made as a composite. Additional exemplary operations are provide in Table 1.

Figure 18H:
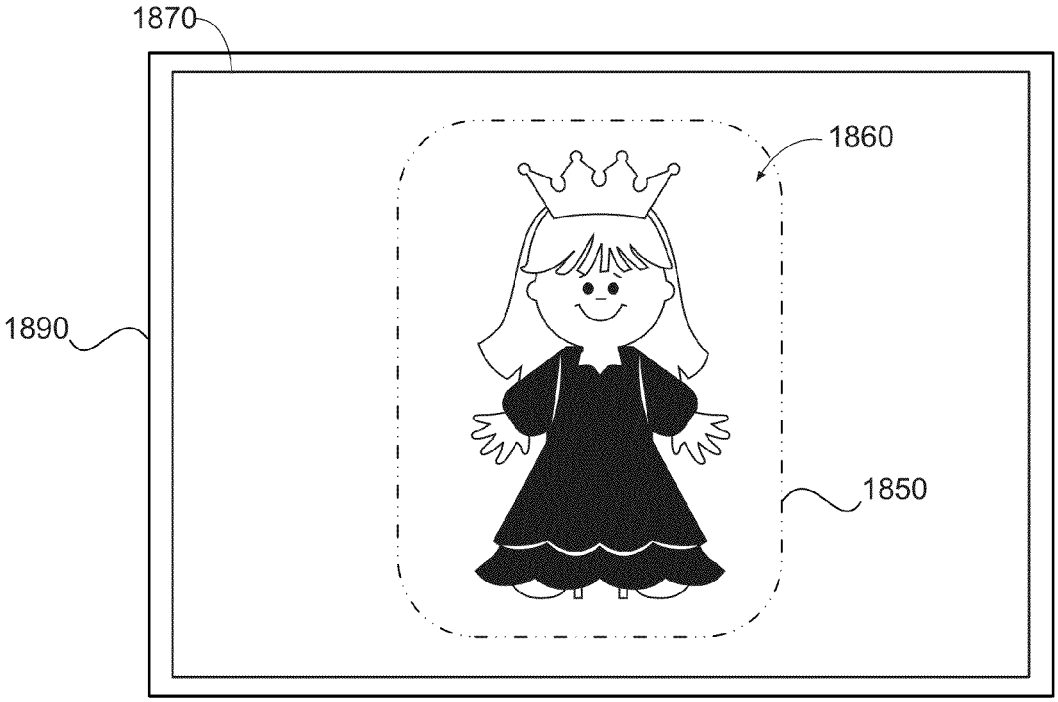
FIG. 18H provides a schematic view of a composite image as an exemplary design object.
Figure 18I:
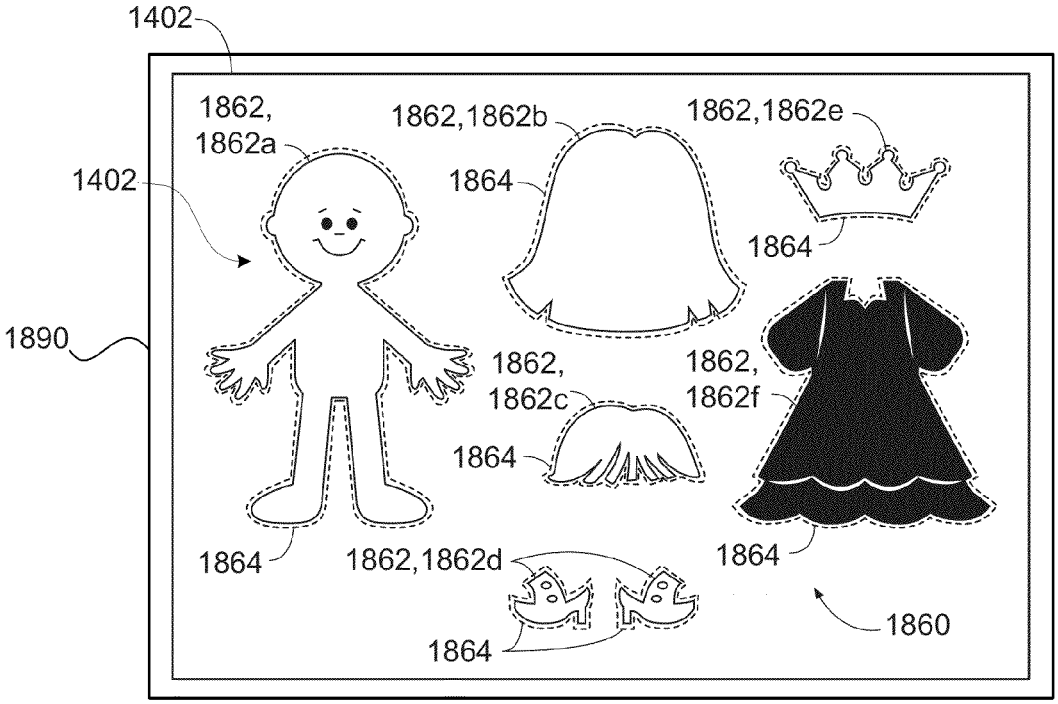
FIG. 18I provides a schematic view of an exemplary composite image exploded in to component images, each residing on separate layers.

Referring to FIGS. 18H and 18I, the design object 1850 may be a composite image 1860 comprising one or more layers 1870, as shown in FIG. 18H, a single exploded layer 1870, which can be a layer that is no longer part of a composite image 1860, or multiple layers 1870 of a composite image 1860. A composite image 1860 that has been exploded into multiple layers 1870, may have each layer 1870 treated as an individual glyph 1830, and hence an individual design object 1850. In the example shown in FIG. 18I, each component image 1862 of the composite image 1860 may reside on a separate layer 1870.

Figure 18J:
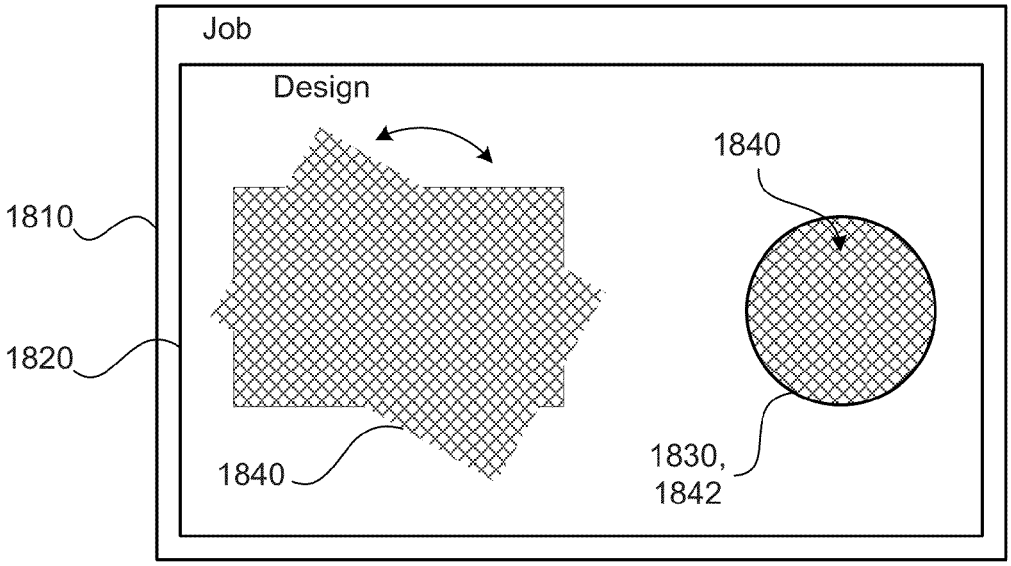
FIG. 18J provides a schematic view of a palette swatch as an exemplary design object.

Referring to FIG. 18J, a non-nested paper palette swatch 1840 may be a design object 1850, such as a swatch 1840 that is independent of anything else. An example of how a user might interact with a swatch 1840 that is not nested (independent of any glyph 1830 or other data) includes selecting the swatch and then changing its orientation from landscape to portrait without changing the orientation of a glyph 1830 that uses that swatch 1840. Moreover, a nested paper palette swatch 1842, such as a swatch 1840 nested inside of a glyph 1830, can also be a design object 1850. An example of how a user might interact with a swatch 1840 nested inside of a glyph 1830 includes changing the orientation of a glyph 1830 that contains a swatch 1840. The swatch 1840 changes orientation with the glyph 1830 in which it is nested.

Table 1 provides a chart listing a number of commands that may be provided by the operating software 1800 for operation of the crafting apparatus 10 and/or to manage and manipulate design objects 1850. The commands can be categorized in the following categories: design (print and cut), design (cut-only), color, edit, settings, modes, hard action buttons, and soft action buttons. Other categories are possible as well.

TABLE 1

| Category | Command | Description |
|---|---|---|
| Design | Size | Change the size of the object. |
| | Port/Land | Change the orientation of the object form 0° to 90°. |
| | Fit to Page | Size the object to fit the entire page while maintaining the aspect ratio. |
| | Fit to Length | Size the object to fit a user defined length. |
| | Auto Fill | Fill the page with as many of a given object as will fit on the page. |
| | Quantity | Fill the page with as many of a given object as defined by the user. |
| | True/Relative Size | Control the height of the key height character or the active object or the actual height of the object. |
| | Multi-cut | Repeat the cut of an object a user defined number of times. |
| | Shadow | Offset the "border" cut paths of the selected object by a user defined distance. |
| | Blackout | Cut only the "border" cut paths of the selected object. |
| | Flip Side | Flip the object about a vertical line. |
| | Flip Top | Flip the object about a horizontal line. |
| | Explode/Composite | Print/Cut an object exploded or composite. |
| Design (Cut Only) | Center Cut | When the object is cut its locating will be centered around the current location of the cutter. |
| Color | Outline Print | Print the "border" cut path(s) of an object. |
| | Detail Print | Print the "webbing" cut path(s) of an object. |
| | Flood Fill | Fill the region(s) inside the cut path(s) of an object with a solid color. |
| | Pattern Fill | Fill the region(s) inside the cut path(s) of an object with a pattern. |

TABLE 1-continued

| Category | Command | Description |
|---|---|---|
| | Shuffle | Shuffle the colors in the region(s) inside the cut path(s) of an object using available colors and palettes. |
| | Color Effects | Change the coloring of an object by shifting the colors (i.e. sepia, black and white, hue shift) |
| | Border Control | Add a border to an object (both colored and uncolored). |
| | Edge Effects | Change the color in the region(s) inside the cut path(s) of an object by applying vector based effects. |
| Edit | Backspace | Delete the active object or the object that proceeds the cursor if no object is active. |
| | Space | Insert a space before, after or in-between two objects. |
| | Line Return | End the current line and start a new line before after or in-between two objects. |
| | Undo | Undo any action taken by the user on an object (e.g., 10 command history). |
| | Redo | Redo any undone action taken by the user on an object (e.g., 10 command history). |
| | Clear All | Clear the screen of all objects. |
| | Reset Color | Return the colors of an object to their default state. |
| | Clear Color | Clear the colors of an object. |
| | Repeat Job | Repeat the same job just cut/printed using the same objects and settings as the previous job. |
| | Preview | Preview the location of the objects on a simplified mat. |
| | Duplicate | Make a copy of the currently selected object and place it immediately after the currently selected object. |
| | Select | Select an object or a button. |
| | Detail Edit | Display a detailed view of the object for the purposes of editing the details (e.g., flood filling). |
| Settings | Cut Speed | Adjust the speed at which the cutter cuts (this has no bearing on the print speed). |
| | Cut Pressure | Adjust the downward pressure applied to the blade housing during cutting. |
| | Print Mode | Select the desired print mode (draft or best). |
| | Units | Select the display units and the step size used in FSA4 (¼ inches, 1/10 inches, cm, mm). |
| | Mat Size | Select the size of the mat being used. |
| | Paper Size | Enter the size of the paper on the mat. |
| | Sound On/Off | Turn the programmed audible sounds on and off. |
| | Paper Type | Select a type of paper. |
| Modes | Print | This mode allows users to print an object while ignoring all cut commands. |
| | Cut | This mode allows the user to cut an object while ignoring all print commands. |
| | Print and Cut | This mode allows the user to print and cut an object. |
| | Crop Photos | This mode allows a user to crop a preprinted photo with any object. |
| | Print Paper | This mode allows the user to print whole sheets of paper. |
| Hard Action Buttons | Power | Turn the machine on and off. |
| | eStop | Stop all machine motion in the case of an emergency. |
| | Go | Start a cut/print job. |
| | Menu | Display the menu screen. |
| | SW1 | Zoom |
| | SW2 | Pan |
| Soft Action Buttons | Load Last | Load the mat (the machine will prevent any part of the paper that was print/cut in the previous job from being used). |
| | Load Paper | Load the mat. |
| | Unload Paper | Unload the mat. |
| | Direction | Manually position the cutter. |

Referring to Table 1, the design category may include commands generally used for designing or creating a job 1810. The design category can include commands such as size, orientation, fit-to-page, fit-to-length, auto-fill, quantity, true/relative size, multi-cut, shadow, blackout, flip side, flip top, and/or explode/composite. For one or more (or all) of the commands in the each category, the display 90 of the crafting apparatus 10 can provide visual feedback of the executed command by indicating which command is executing, by showing the selected design object 1850 change or alter as a result of the executed command. Moreover, the operating software 1800 can show on the display 90 how much available paper W (workpiece) has be used or occupied as a result of the executed command. The workable area of a workpiece W may be represented as a page 1880.

The operating software 1800 may allow a user to select a design object 1850 and set a size of the design object 1850. For example, a user may execute the size command to scale a selected design object 1850, such as one or more glyphs 1830 and all nested attributes (e.g., patterns from a paper palette). If a palette swatch 1840 has already been scaled, the size command may add to the scaling of the individual swatch 1840 previously scaled.

In some implementations, the operating software 1800 allows a user to select a design object 1850 and set an orientation of the design object 1850 (e.g., landscape or portrait, or change the orientation of the object by an angle, such as 0°, 45°, 90°, 180°, etc.). For example, the user may select glyphs 1830 and all respective nested attributes (i.e., patterns from a paper palette) and change their orientation. If a palette swatch 1840 has already been rotated, the change orientation command is added to the existing orientation of the individual swatch 1840. The display 90 can provide visual feedback of the executed command by showing the design object 1850 change orientation with respect to a previous orientation and/or by showing how much available paper W has be used or occupied as a result of the executed command.

The operating software 1800 may allow a user to execute the fit-to-page command, which scales every element or design object 1850 of the job 1810 to fit the page 1880 (or job size) while maintaining an aspect ratio. If a palette swatch 1840 was previously scaled, the fit-to-page command adds the scaling of the individual swatch 1840 to the scaling required to fit all of the job elements to the page. The operating software 1800 may provide visual feedback of the executed command on the display 90 by showing the job 1810 fit to the page, how much of the available paper W has been used by the executed command, and that the fit-to-page command was selected. The operating software 1800 may also indicate that a job size setting that could be used to achieve the same result as the fit-to-page command. The job size may correspond to a size of a workpiece W presented to the crafting apparatus 10 or to a number of workpieces W of a particular size that have been or will be presented to the crafting apparatus 10 (e.g., in succession). In some examples, the operating software 1800 allows the user to execute the fit-to-length command, which receives a length entered by the user. The fit-to-length command scales every element of the job 1810 to fit the entered length while maintaining the aspect ratio. For example, if a palette swatch 1840 has already been scaled, the fit-to-length command adds its scaling to the pre-existing scaling of the individual swatch 1840. If a user types the letters to the word "CAT" and sets a height of 2 inches tall, the user may have no control over the length of the word "CAT". Sometimes the user may wish to fit a word into a space that is, for example, 4 inches wide. The fit-to-length command a word or object length (e.g., 4 inches or some other desired length) set by the user and then alters the length of the word or object to equal the set length. The operating software 1800 may adjust the height of the design object 1850, in this example the letters C-A-T, so as to maintain an aspect ratio or some other constraint or relationship. In addition to providing visual feedback of the executed command (e.g., by showing the design object change length), the operating software 1800 may indicate a job size setting that could be used to achieve the same result as the fit-to-length command.

Figure 18K:
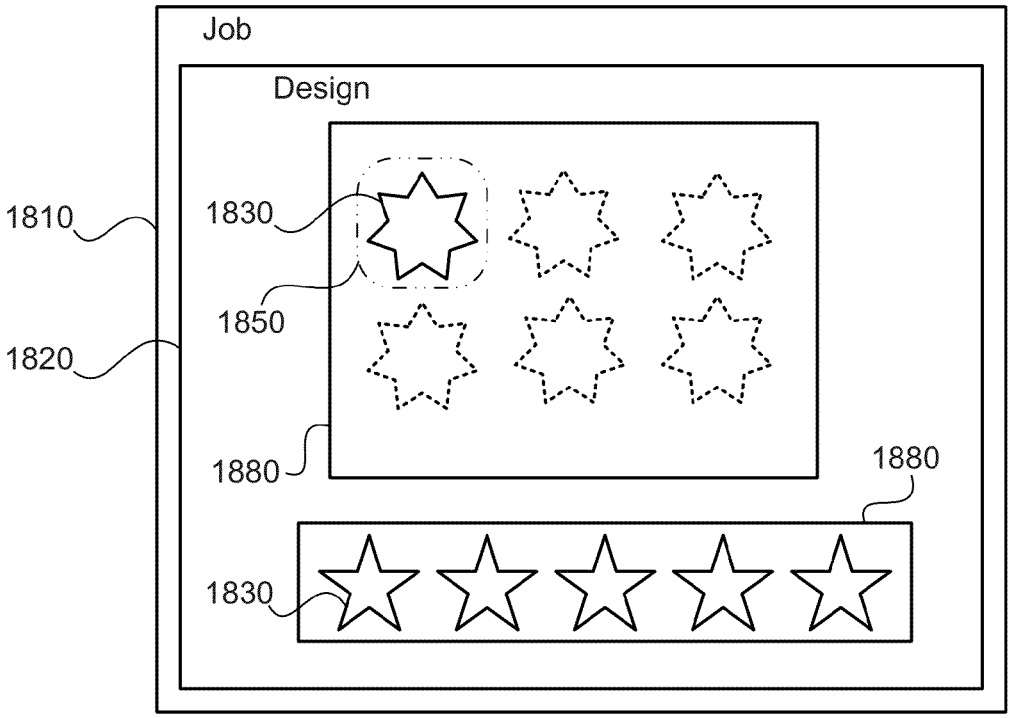
FIG. 18K provides a schematic view of a first exemplary design object auto-filled on a first page and a second exemplary design object quantity-filled on a second page.

Referring to FIG. 18K, in some implementations, the operating software 1800 allows a user to select a design object 1850 and execute the auto-fill command, which duplicates the selected design object 1850 in a grid pattern to fill the page 1880 (e.g., a representation of the workable area of the workpiece W). In the example shown, the user selects a 7-pointed star glyph 1830 and executes the auto-fill command, the operating software 1800 duplicates the star as many times as possible to fill the page 1880 with non-overlapping star glyphs 1830 for cutting on the crafting apparatus 10. In this example, the operating software 1800 duplicates the 7-pointed star glyph 1830 five times for a total quantity of six star glyphs 1830. Moreover, if the user had select a star glyph 1830 and a square glyph 1830 and executed the auto-fill command, the operating software 1800 would have duplicated as many star and square pairs as will fit on the page 1880. Visually, the operating software 1800 can indicate (e.g., on the display 90) that the auto-fill command is on or has been selected and/or by showing the number of times that the design object 1850 can be repeated (e.g., by visually repeating the design object 1850 on the page 1880 and/or indicating a repetition number). The operating software 1800 can also show how much of the paper W is occupied by the repeated design object 1850. In some implementations, the user can set properties of the auto-fill command that include a fill pattern (e.g., grid, circle, shape, etc.), object spacing, center on page, etc.

The quantity command can be similar to the auto-fill command, except rather than filling the page 1880 with as many design object repeats that will fit, the quantity command repeats the selected design object 1850 (or the entire job 1810) by a specified quantity received by the operating software 1800. The operating software 1800 may repeat the selected design object 1850 in a grid pattern or some other pattern (e.g. a default pattern, a pattern set by the user, or otherwise established) by the received quantity. In some implementations, the quantity may refer to the number of pages 1880 that will be cut or the number of jobs 1810 that will be cut. In the example shown, the user may select a design object 1850 (in this case, a 5-pointed star) and execute the quantity command with a quantity of four, the crafting apparatus 10 cuts four 5-pointed stars. In another example (not shown), if the user has a 3 inch apple and a 3 inch banana and executes the quantity command with a quantity of 12, the crafting apparatus 10 will cut 12 apple and banana pairs. If the quantity command requires more than one sheet of paper 1880 to cut the received quantity, the user may be informed of the number of pages 1880 needed to complete the entire quantity. The operating software 1800 may provide visual feedback to the user by indicating that the quantity command is on or has been select, by showing the quantity entered by the user, by showing how much available paper 1880 has been used by the repeated design, and/or by showing how many pages 1880 it will take to fill the quantity.

A user may wish to create a design 1820 using true size (e.g., the actual size that will be cut) or relative size (e.g., the size of one design object 1850 relative to another or to some reference). The operating software 1800 may provide a command that allows the user to toggle between true size and relative size for a selected design object 1850 or an entire job 1810. For example, with true size selected, every design object 1850 (e.g., glyph 1830) in the job 1810 may be cut on the crafting apparatus 10 using the true size of each glyph 1830 (e.g., the height from the top of the glyph 1830 to the bottom of the glyph 1830), while with relative size selected, every design object 1850 in the job 1810 may be cut using a key height character as a reference for each glyph 1830. The operating software 1800 may indicate (e.g., visually on the display) that either true or relative size is turned on and/or how much of the available paper 1880 has been used by the design object(s) 1850.

The multi-cut command allows the user to set a number of cuts for a selected design object 1850 or the entire job 1810. When the cut operation is performed, the crafting apparatus 10 cuts and then re-cuts the design object 1850 or the entire job 1810 receiving the multi-cut command until the number of cuts has been satisfied. In the case of a job 1810 that includes multiple glyphs 1830, each glyph 1830 may be cut the number of times designated by the user before moving to the next glyph 1830 in the job 1810. Moreover, if the quantity command is on or has been executed, and the job 1810 will take more than one page 1880 to cut, the crafting apparatus 10 may complete a whole page 1880 of multi-cuts before moving on to an additional page 1880. The operating software 1800 may indicate (e.g., visually on the display) that the multi-cut command has been selected and/or how many cuts will be performed.

Figure 18L:
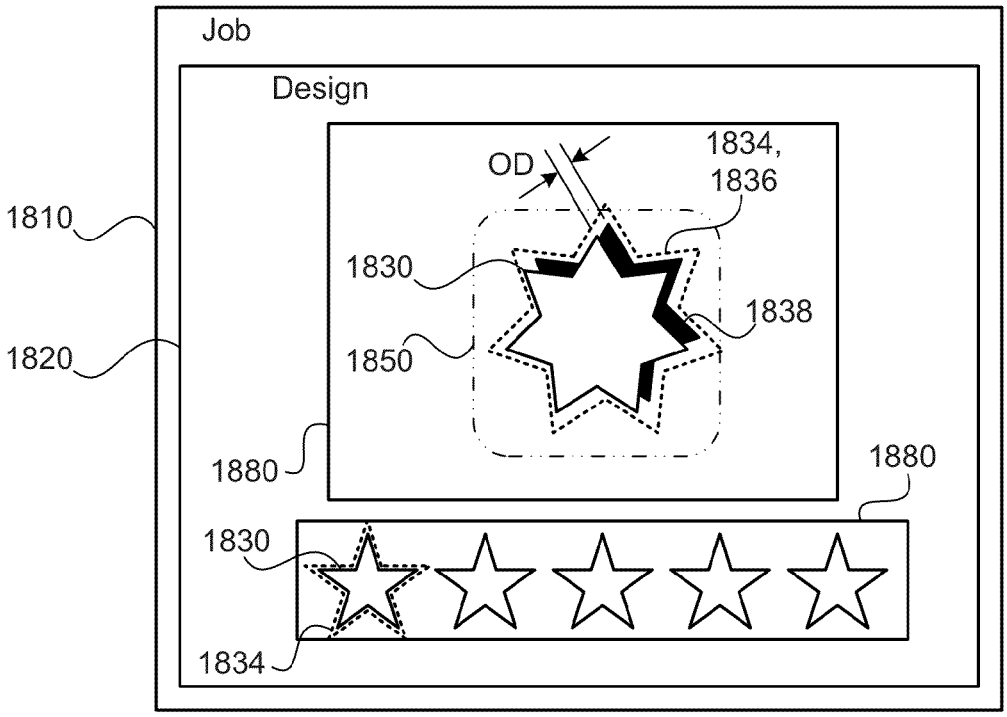
FIG. 18L provides a schematic view of an exemplary design object receiving a shadow operation.

Referring to FIG. 18L, in some implementations, the shadow command offsets border cut paths 1836 of the selected design object 1850 by an offset distance OD defined by the user. In some examples, the user selects a design object 1850, selects the shadow command, and enters an offset distance OD. The operating software 1800 determines an outline 1834 of the selected design object 1850, which may include all internal closed vectors, for cutting by the crafting apparatus 10. In some examples, the outline 1834 does not including any webbings and the cut path 1836 follows the outline. The operating software 1800 offsets the outline 1834 by the offset distance OD from the selected design object 1850 in a direction that adds area to the selected design object 1850 (e.g., glyph 1830) or in a direction specified by the user. The display 90 may indicate that the shadow command has been selected and/or the offset distance OD (graphically and/or numerically). In some implementations, in addition to setting an offset distance OD, the user also selects a shadow color for the region 1838 defined between the outline 1834 and the cut path 1836. In this case, an offset glyph 1838 (e.g., as the region) provided by the operating software 1800 is flood filled with the selected color. Black may be used as a default color. In additional implementations, the user can define a shadow color and/or shadow pattern, in which case, the operating software flood and/or pattern fills the offset glyph 1838 respectively.

In executing the blackout command, the operating software 1800 determines the outline 1834 of a selected design object 1850 and assigns a cut path 1836 substantially along the outline 1834 for cutting by the crafting apparatus 10. While executing the blackout command, the crafting apparatus 10 does not cut any webbings, but rather only the outline of the selected design object 1850, for example. In some implementations, the user may select a blackout color and/or pattern when executing the blackout command and the operating software 1800 flood fills and/or pattern fills the design object 1850 (e.g., an image) with the blackout color. The operating software 1800 may provide a default blackout color and/or pattern. The operating software 1800 may indicate (e.g., visually on the display) that the blackout command has been selected and/or which blackout color and/or pattern has been selected.

Figure 18M:
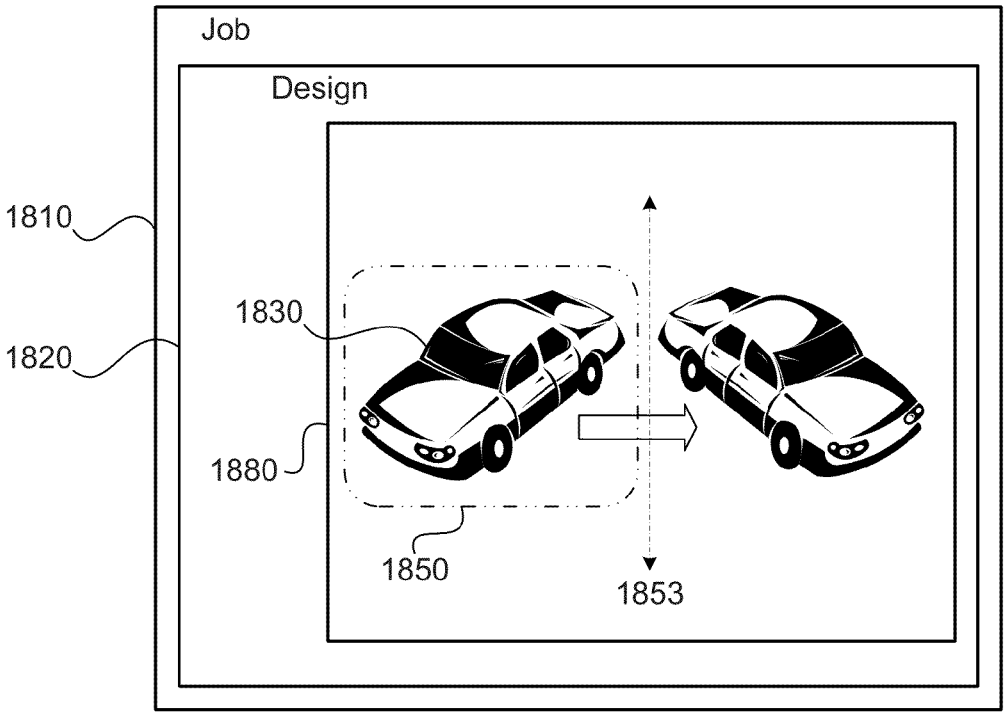
FIG. 18M provides a schematic view of an exemplary design object flipped about an axis on a page.

Referring to FIG. 18M, the operating software 1800 may provide one or more flip commands that allow a user to flip a selected design object 1850 about a designated axis 1853 (e.g., vertical, horizontal, etc.). The operating software 1850 can flip any glyph 1830, image, or palette data associated with selected design object 1850 as well. Visually, the operating software 1800 may show the selected design object 1850 flipping or flipped upon execution of the flip command. In the example of a flip side command, the operating software 1800 allows the user to flip the selected design object 1850 about a vertical axis 1853 (e.g., as shown in FIG. 18M). In the example of a flip top command, the operating software 1800 allows the user to flip the selected design object 1850 about a horizontal axis.

Referring again to FIGS. 18H and 18I, the operating software 1800 may provide an exploded/composite command that allows a user to toggle between printing and/or cutting a job 1810 in an exploded view (e.g., FIG. 18I) or a composite view (e.g., FIG. 18H). For example, when the user selects the exploded/composite command and the selected design object 1850 is in a composite state (e.g., FIG. 18H), the operating software 1800 moves all layers 1870 of the design object 1850 so as to not overlap in any way. This results in each layer 1870 being cut/printed separate from one another. All of the layers 1870 can be nested tightly together to conserve paper. If the design object 1850 is in an exploded state (e.g., FIG. 18I) when the user selects the exploded/composite command, the operating software 1800 moves all layers 1870 of the design object 1850 to their respective home (e.g., un-exploded) positions (e.g., FIG. 18H). This allows the design object 1850 to be cut/printed as a composite (e.g., with overlapping layers 1870). The operating software 1800 may visually show (e.g., on the display 90) movement of elements of the design object 1850 and/or the composite or exploded states. Moreover, the operating software 1800 may visually show how much of the available paper has been used by the executed command.

Table 1 provides a center cut command in the design cut-only category. The center cut command centers all cuts about a current location of the blade 12*a* (cutting head). For example, if the blade location is (1,1) and the crafting apparatus 10 receives a command to cut a circle with a 1 inch radius, as the center cut command (e.g., is turned on), the crafting apparatus 10 cuts a circle centered about (1,1) and goes from 0 to 2 on the x axis and from 0 to 2 on the y axis. If the center cut command was not received (e.g., center cut is off), the point defined by a horizontal tine tangent to the bottom of the circle intersecting with a vertical line tangent to the side of the circle is located at (1,1) and the crafting apparatus 10 proceeds to cut from 1 to 3 on the x axis and from 1 to 3 on the y axis. In some implementations, the center cut command is only available in a photo or image crop mode.

Figure 18N:
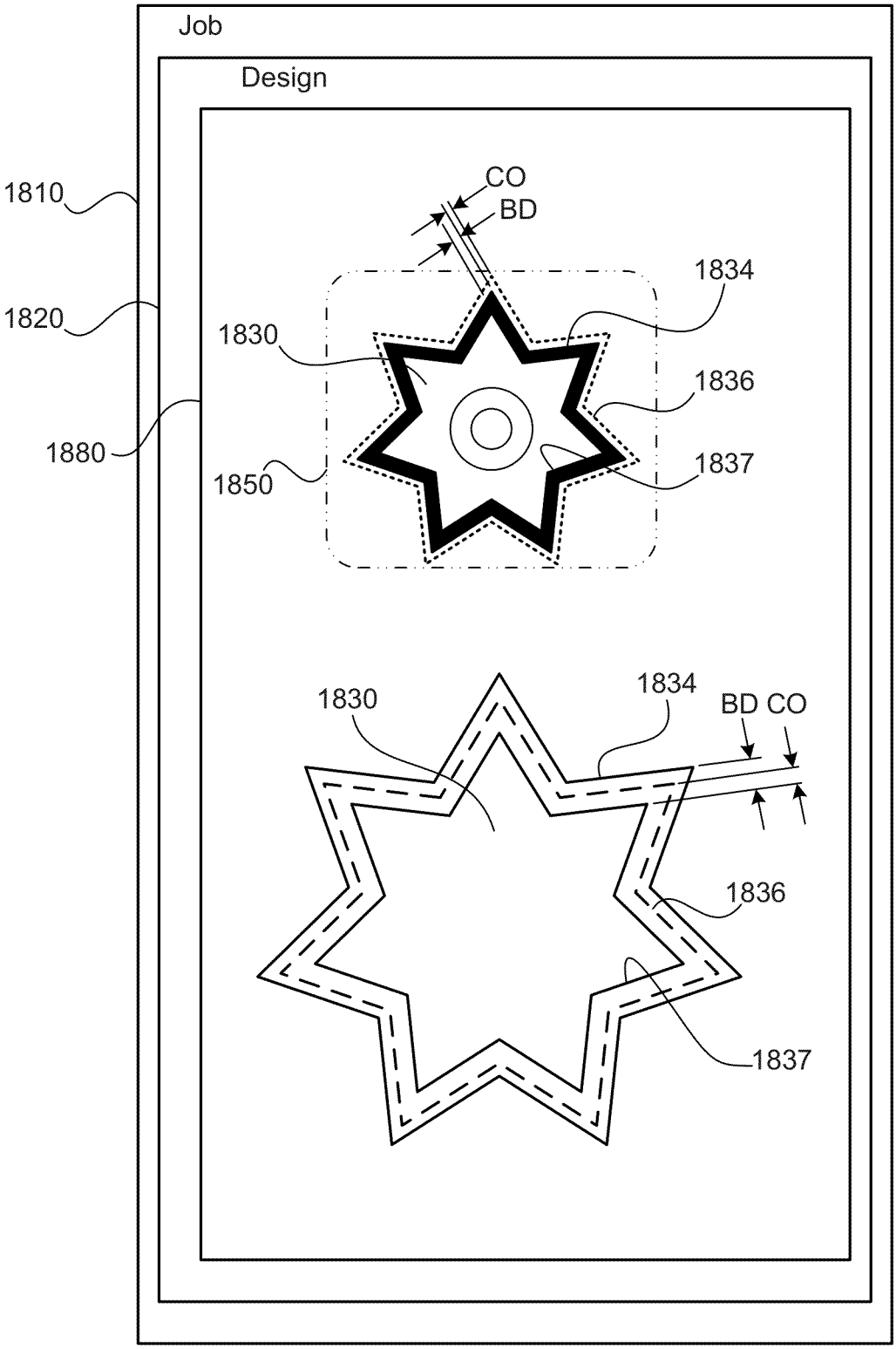
FIG. 18N provides a schematic view of an exemplary design object receiving an outline print operation.

Referring again to Table 1, the color category may include commands such as outline print, detail print, flood fill, pattern fill, shuffle, color effects, border control, and/or edge effects. Outline print allows a user to print border cut path(s) of a design object 1850. For example, referring to FIG. 18N, in executing the outline print command, the user may select a design object 1850, select an outline color and/or outline line thickness, and execute the outline print command. The operating software 1800 may instruct the crafting apparatus 10 to print all vector loops that are not considered webbing in the selected outline color and line thickness as the outline 1834. The cut path 1836 may be disposed in the border outline 1834 or just outside of the border outline 1834. Moreover, all vector data that is considered webbing may be unaffected by executed outline print command. Similarly, for the detail print command, the user may select a design object, select a detail color and/or detail line thickness, and execute the detail print command. The operating software 1800 may instruct the crafting apparatus 10 to print all vector loops that are considered webbing in the selected outline color and line thickness. Moreover, all vector data that is not considered webbing may be unaffected by executed detail print command. Visually, the operating software 1800 may show (e.g., on the display 90) the selected outline or detail color and/or outline or detail line thickness, any affected lines on the design object 1850 (e.g., glyph 1830), and/or any affected glyph(s) 1830.

Figure 18O:
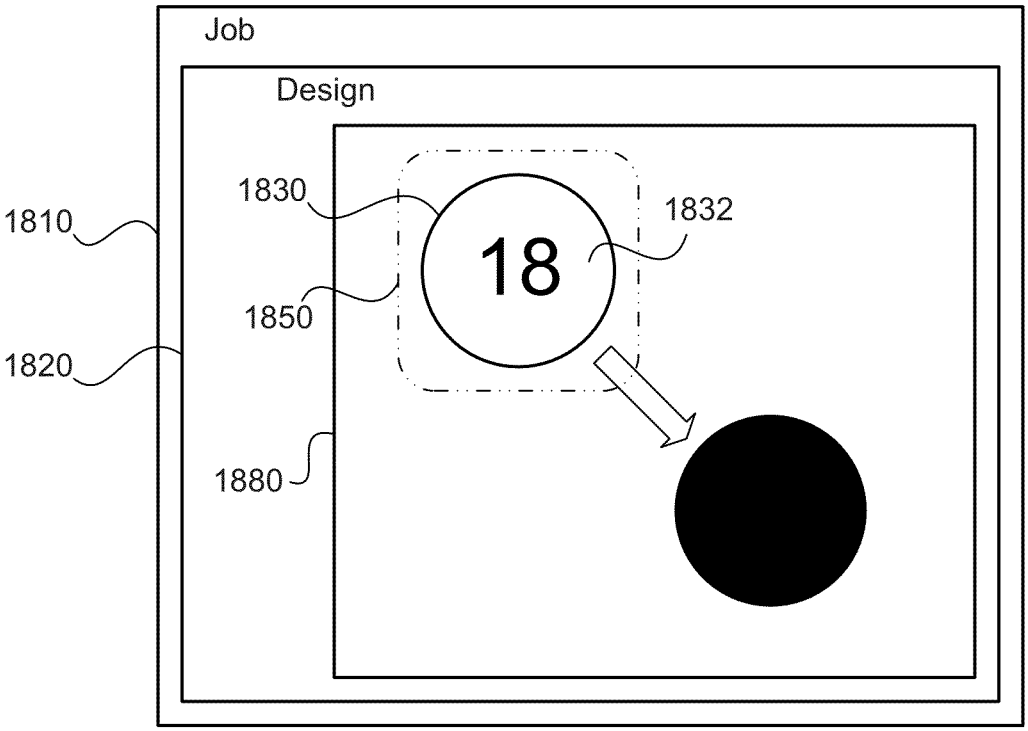
FIG. 18O provides a schematic view of an exemplary design object receiving a flood fill operation.

Referring to FIG. 18O, the operating software 1800 may include a flood fill command for filling one or more regions inside the cut path(s) of a design object 1850 with a solid color. The user selects a design object 1850, a fill region (e.g., glyph region 1832) of the design object 1850, and a fill color (e.g., from a cartridge 120 or paper palette), and executes the flood fill command to fill the selected fill region with the selected fill color. Visually, the operating software 1800 may show (e.g., on the display 90) the selected fill color, the selected fill region 1832 on the glyph 1830, and/or the affected glyph 1830. In addition, the operating software 1800 may include a pattern fill command for filling one or more regions inside the cut path(s) of a design object 1850 with a pattern. The user selects a design object 1850, a fill region (e.g., glyph region 1832) of the design object 1850, and a fill pattern (e.g., from a cartridge or paper palette), and executes the pattern fill command to fill the selected fill region with the selected fill color. In some examples, the user may select a pattern scale, a pattern orientation, and/or a starting location of a first pattern tile. The operating software fills the selected design object/region with the size, rotation and position of the fill pattern chosen by the user and can instruct the crafting apparatus 10 to print and/or cut the selected design object/region. Visually, the operating software may show (e.g., on the display) the selected fill pattern, scale, location, the selected fill region on the glyph, and/or the affected glyph.

In some implementations, the operating software 1800 includes a shuffle command for shuffling the colors of region(s) inside the cut path(s) of a design object 1850 (e.g., using available colors and palettes). For example, when the user executes the shuffle command and selects a shuffle color, color palette, and/or paper palette for a design object 1850, all layers 1870 and vector regions defined by cuttable vectors (e.g., glyph data) within the design object 1850 are filled with colors/patterns randomly chosen from the selected shuffle color, color palette, and/or paper palette. Visually, the operating software 1800 may show (e.g., on the display 90) the selected shuffle color, color palette, and/or paper palette, and/or the affected glyph(s) 1830. The color effect command allows the user to change the coloring of a design object 1850 by shifting the colors (e.g., sepia, black and white, hue shift).

Referring again to FIG. 18N, in some examples, in executing a cut operation, the crafting apparatus 10 may not follow the edges of the design object 1850 or job 1810 perfectly, thus leaving extra paper past some edges of the design (white edges). The border control command allows a user to add a border outline 1834 to a design object 1850 (e.g., both colored and uncolored borders). This provides a larger tolerance for a cut path of the crafting apparatus 10 to cut a job 1810, such that the crafting apparatus 10 cuts the paper 1880 within or outside of the border outline 1834. For example, the user may select a design object 1850 and the border control command for execution thereon. The user also selects a border type (e.g., none, clear or color). For the "none" border type, the operating software 1800 bleeds or extends the color on the outside edge(s) of the design object 1850 (e.g., any pixels touching the cut path) radially away from the image or glyph 1830 by a bleed distance BD to ensure the blade cuts through the print. The user can set the bleed distance BD in some examples. For the "clear" border type, the operating software 1800 offsets the cut path of the design object 1850 away from the center of the glyph 130 by a cut offset distance CO to ensure that the blade does not cut through the print. In some examples, the cut offset distance CO is equal to the thickness BD of the border outline 1834, cut path 136, or a feature of the design object 1850. The user may also provide the cut offset distance CO. For the "color" border type, the user may select a border thickness when executing the command. The operating software 1800 may offset the cut path 1836 of the design object 1850 away from the center of the glyph 1830 by a cut offset distance CO plus the border thickness BD in which is printed the selected border color.

In some examples, the border control command determines the cut offset distance CO as a threshold print-to-cut alignment tolerance (or a fraction, such as ½, thereof) and offsets or moves the cut path 1836 outward from a nominal cut path 1837 (i.e., a non-offset cut path, aligned with a perimeter of the glyph 1830) by the cut offset distance CO and fills the border outline 1834, in this case a region bound between the offset cut path 1836 and the nominal cut path 1837, such that the border thickness BD equals the cut offset thickness CO. The fill may be a solid color, a pattern, or a raster/vector fill (default or user defined), which can be tiled to fill the entire border outline 1834. In a subsequent cut operation, the crafting apparatus 10 cuts the workpiece W along the cut path 1836. In additional examples, the border control command sets the border thickness BD equal to (1) a user defined thickness plus the threshold print-to-cut alignment tolerance (or a fraction, such as ½, thereof), or (2) the cut offset thickness CO plus the threshold print-to-cut alignment tolerance (or a fraction, such as ½, thereof). In this case, the cut path 1836 is within the border outline 1834, such that execution of a cut operation will result in a border outline 1834 of partial thickness with no unprinted portions of the workpiece W left along the outer perimeter of the workpiece W (e.g., no white portions of paper remain about the perimeter of a paper workpiece due to any cutting inaccuracies or tolerances).

In some implementations, the edge effect command allows the user to change the color of a region(s) inside the cut path(s) of a design object 1850 by applying vector based effects. For example, the user selects a design object 1850 and an edge effect (e.g., 3D effects, shadows, and jewel effects) for application to the selected design object 1850 upon execution of the edge effect command. The edge effects may be applied along vector lines. For example, an effect can be added along a vector loop to make the edge look like it has been distressed.

Referring again to Table 1, the edit category may include commands such as backspace, space, line return, undo, redo, clear all, reset color, clear color, repeat job, preview, duplicate, select, and/or detail edit. In some implementations, when executing the backspace command, the operating software 1800 deletes the selected or active design object 1850 (if one is active). If no design object 1850 is active, then the operating software 1800 deletes the design object 1850 that is to the left of the cursor. In executing the space command, the operating software 1800 inserts a space to the left of the active design object 1850. If no design object 1850 is active, a space is inserted to the left of a current location of the cursor. In a similar manner, a new line is created to the left of the active object 1850 upon execution of the line return command. If no design object 1850 is active, a new line is created to at the current location of the cursor.

The user may execute the undo command to undo or cancel one or more previous actions or commands. The actions may be undone in reverse chronology. The user may also redo or re-execute actions or commands that have been undone. The operating software 1800 may implement a glyph queue, which may be a stack that stores glyphs 1830 (or pointers to glyphs 1830) used in a particular design 1820 and/or job 1810. Each action on or placement of a particular glyph 1830 can be stored in the glyph queue and/or the glyph 1830 itself. For example, each glyph 1830 added to a design 1820 and/or job 1810 can be added to the glyph queue (e.g., pushed onto the stack) and each glyph 1830 removed from the design 1820 and/or job 1810 can be removed from the glyph queue (e.g., popped off the stack) and optionally added to a redo stack. Each glyph 1830 can have associated data that may include user-changed properties, such as scale (X & Y), position (x, y, sheet #), rotation (e.g., 0 or 90 degrees), and fill. Each glyph property alteration can be tracked (e.g., stored in a stack) for implementing undo/redo. Undo and redo stacks may be used to track actions on glyphs 1830 and/or any other aspect of a job 1810. The clear all command clears the entire job 1810 (e.g., from memory 108 and/or the display 90). The operating software 1800 may indicate that the clear all command has been selected or executed and may offer a confirmation screen to confirm the user's action to clear the entire job 1810. A revert command can revert the design 1820 and/or job 1810 back to a previously saved state (e.g., by reloading the design 1820 and/or job 1810 from a saved file). The reset color command returns the color(s) of a design object 1850 to its default state or color. If no default color has been assigned, the color is cleared from the design object 1850. Moreover, all color and edge effects are also removed. The clear color command clears all colors from a selected or active design object 1850. All color and edge effects may be removed for the clear color command as well. Repeat the same job you just cut/printed using the same objects and settings as the previous job 1810. The repeat job command allows the user to repeat the same job 1810 just cut/printed using the same design objects 1850 and settings as the previous job 1810. For example, after completing a job 1810, the user may select repeat job or repeat last n number of jobs 1810. The operating software 1800 re-executes the exact same job or jobs 1810 that were just completed (including quantities, color settings, multi cut, etc.). The user may be prompted to load the same size/type of paper, etc. required to complete the job(s) 1810.

The preview command displays (e.g., on the display 90) a virtual mat 1890 containing simplified graphics in locations where they will be printed, cut, or both printed and cut. Pre-rendered images can be associated with each glyph 1830 for display on the virtual mat 1890. Glyphs 1830 may be dynamically rendered as well, for example, for use in any of the following: in a glyph queue, an assembled composite image 1860 of glyphs 1830, child glyphs 1830 used in a editor, for preview on a virtual mat 1890, etc. Operations for rendering a glyph 1830 may include sizing an image buffer, setting a position in the image buffer to 0,0, setting a scale to size the glyph to the image buffer (e.g., while preserving an aspect ratio), filling the image buffer to fully-transparent, and applying a fill that is clipped to a cut path (e.g., outside edge). A fill offset (border) may be applied to an outside perimeter of the glyph 1830 to accommodate for a cut path stroke thickness. The fill may be executed in two parts: (1) filling an interior of the cut path, and (2) filling the cut path stroke thickness. Both fill operations may use the same fill pattern image. The fill operation(s) may provide a bleed area (e.g., area of the cut path stroke) that fits the cut path stroke thickness. The user may set the fill pattern image and cut path stroke thickness. The area outside of the cut path remains fully transparent, while the operations include setting the area inside the cut path to fully opaque. In some examples, an edge therebetween may be anti-aliased to provide a relatively smooth transition.

Top level glyphs 1830 can be rendered first, with subsequent child glyphs 1830 rendered there after in order (e.g., an order of the glyph queue). In some examples, the child glyphs 1830 are rendered into a temporary buffer (with transparency), which is then added onto the parent buffer. In other examples, the child glyphs 1830 are rendered directly onto the parent's image buffer. When rendering glyphs 1830 for preview on a virtual mat and/or printing, each glyph 1830 can be rendered according to a corresponding placement and rotation. A full print resolution can be use for print rendering. The user may elect to have only an outline of the glyph(s) 1830 rendered. For printing and/or cutting, any glyph(s) 1830 not currently owned or authorized for use by the user can be omitted from the rendering operation.

The duplicate command duplicates the selected or active design object 1850 to the right of the currently active design object 1850. The select command allows the user to select a design object 1850, which may include a region (e.g., glyph region 1832) defined by a closed cut path in a glyph 1830, a job 1810 consisting of a single glyph 1830, a job 1810 including multiple glyphs 1830, and a single glyph 1830 belonging to a job 1810 including multiple glyphs 1830. The design object 1850 upon which the select command has been executed becomes active and any executed command(s) requiring a selection for execution will proceed to execute, and any additional commands executed will execute on the selected or active design object 1850. In some implementations, not all commands can be applied to all design objects 1850 and commands having constraints for certain types of design objects 1850 will only execute on those types of design objects 1850.

The detail edit command displays a detailed view of the selected or active design object 1850 for the purposes of editing one or more properties of that design object 1850 (e.g., flood filling). In some examples, the active design object 1850 is displayed is a full screen view and the user can edit or more properties or details (e.g., color effects, edge effects, flood fill, pattern fill, etc.) of the design object 1850.

Referring again to Table 1, the settings category of the operating software 1800 may include command such as cut speed, cut pressure, print mode, units, mat size, paper size, sound on/off, and/or paper type. The cut speed command allows the user to adjust a cutting speed of the crafting apparatus 10 and this may have no bearing on a print speed. The entire job 1810 can be cut at the speed entered by the user. The cut pressure command may allow the user to set a downward pressure applied to the blade 12*a* during cutting. The entire job 1810 can be cut at the cut pressure entered by the user. The print mode command may allow the user to select a print mode (e.g., draft or best quality). For example, upon selecting print mode, the user can select from a mode from a list of available modes, and the operating software 1800 instructs the crafting apparatus 10 to print the entire job 1810 using the selected mode. The units command allows the user to select a display units type (e.g., mm, cm, inches, etc.) and a step size (e.g., ¼ inches, 1/10 inches, etc.).

The mat size command allows the user select a mat size for a mat 36 fed into the crafting apparatus 10. The crafting apparatus 10 may operate under the assumption that all mats 36 being inserted into the crafting apparatus 10 are the size specified by the user. Moreover, the crafting apparatus 10 may also use the mat size to inform the user of the maximum allowable paper size for a given mat 36. The paper size command allows the user to enter a paper size of the paper W (workpiece) on the mat 36. The crafting apparatus 10 may assume that all papers W being put on the mat 36 and loaded into the crafting apparatus 10 are of the size specified by the user. Furthermore, the crafting apparatus 10 may check to make sure that the paper size is not too large for the mat 36, and if so, provide an error message.

The sound on/off command allows the user to turn audible sounds of the crafting apparatus 10 on and off. The paper type command allows the user to select a type of paper W (e.g., paper weight, etc.) for use on the crafting apparatus 10. The crafting apparatus 10 may assume that all prints will be executed on paper W of the specified type placed on mat(s) 36 and loaded into the crafting apparatus 10.

Referring again to Table 1, the modes category may include commands such as print, cut, print and cut, crop photos, and print paper. The print command allows the user to print a design object 1850 while ignoring any cut commands. The cut command allows the user to cut a design object 1850 while ignoring all print commands. The print and cut command allows the user to print and cut a design object 1850.

Figure 18P:
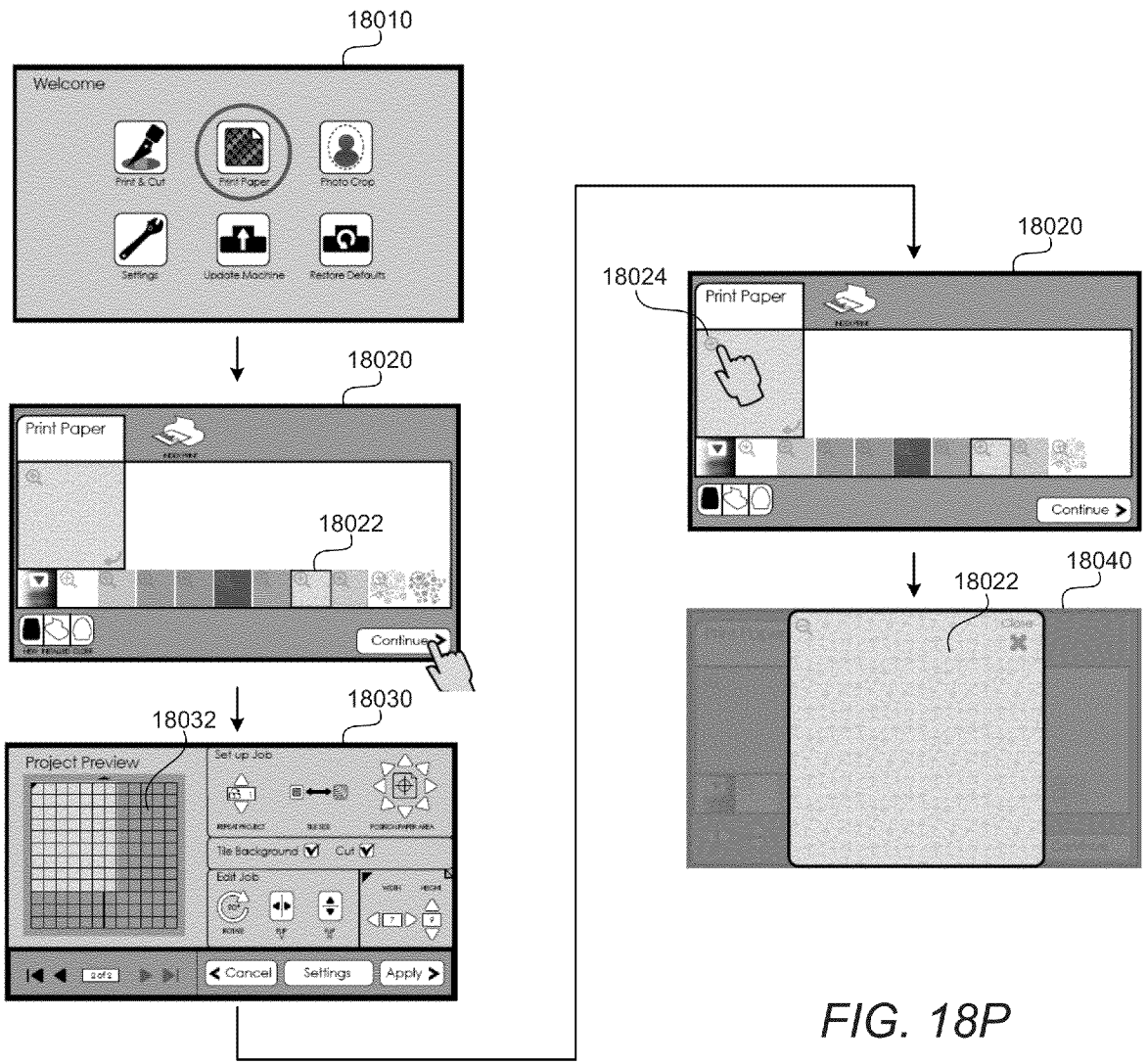
FIG. 18P provides a schematic view of exemplary screen views displayable on a crafting apparatus for executing a print command.

FIG. 18P provides a schematic view of exemplary screen views displayed for execution of a print operation. In some implementations, the operating software 1800 displays a welcome view 18010 on the display 90 of the crafting apparatus 10. The welcome view 18010 may provide access to a number of operations, one of which can be the print operation. In the example shown, the welcome view 18010 allows a print paper operation for printing paper having a design object 1850, such as a paper background color or pattern. Upon selection of the print paper operation, the operating software 1800 displays a paper background selection view 18020, which allows the user to select a paper background 18022 (e.g., paper color or pattern) and then advance to a preview view 18030. The preview view 18030 displays the job 1810, in this case the selected paper 18022, on a virtual mat 18032 and may provide printer settings, image manipulation, and other settings or tools. For example, the user may rotate, flip, and/or size the job 1810. Moreover, the user may elect to repeat the job 1810, repeat or auto-fill glyphs 1830 in the job 1810, fit the job 1810 to a paper size, and/or assign a true or relative size of the job 1810. After applying any settings, the operating software 1800 returns to the paper background selection view 18020. The user may select an enlarged view command 18024 to view an enlarged view 18040 of the selected paper background 18022. The user may select and execute the print operation to have the crafting apparatus 10 print the selected paper background 18022 on paper.

The print paper command allows the user to print whole sheets of paper W of a specified color, pattern, etc. For example, the user can select a paper palette, tile size, tile orientation, and output paper size, and execute the print paper command. If the output paper is the same size as the physical paper W, the crafting apparatus 10 prints the paper W without cutting the paper W. If the output paper is a larger size than the physical paper W, the crafting apparatus 10 issues an error (e.g., displays an error message or code). Selecting the print and cut command causes the operating software 1800 to direct the crafting apparatus 10 to cut the paper to a selected size and/or shape (e.g., based on the design object 1850 and/or a paper size selected in the preview view 18030). If the output of the paper is smaller than the physical paper W, the crafting apparatus 10 prints the paper W and then cuts the paper W to the selected size.

Figure 18Q:
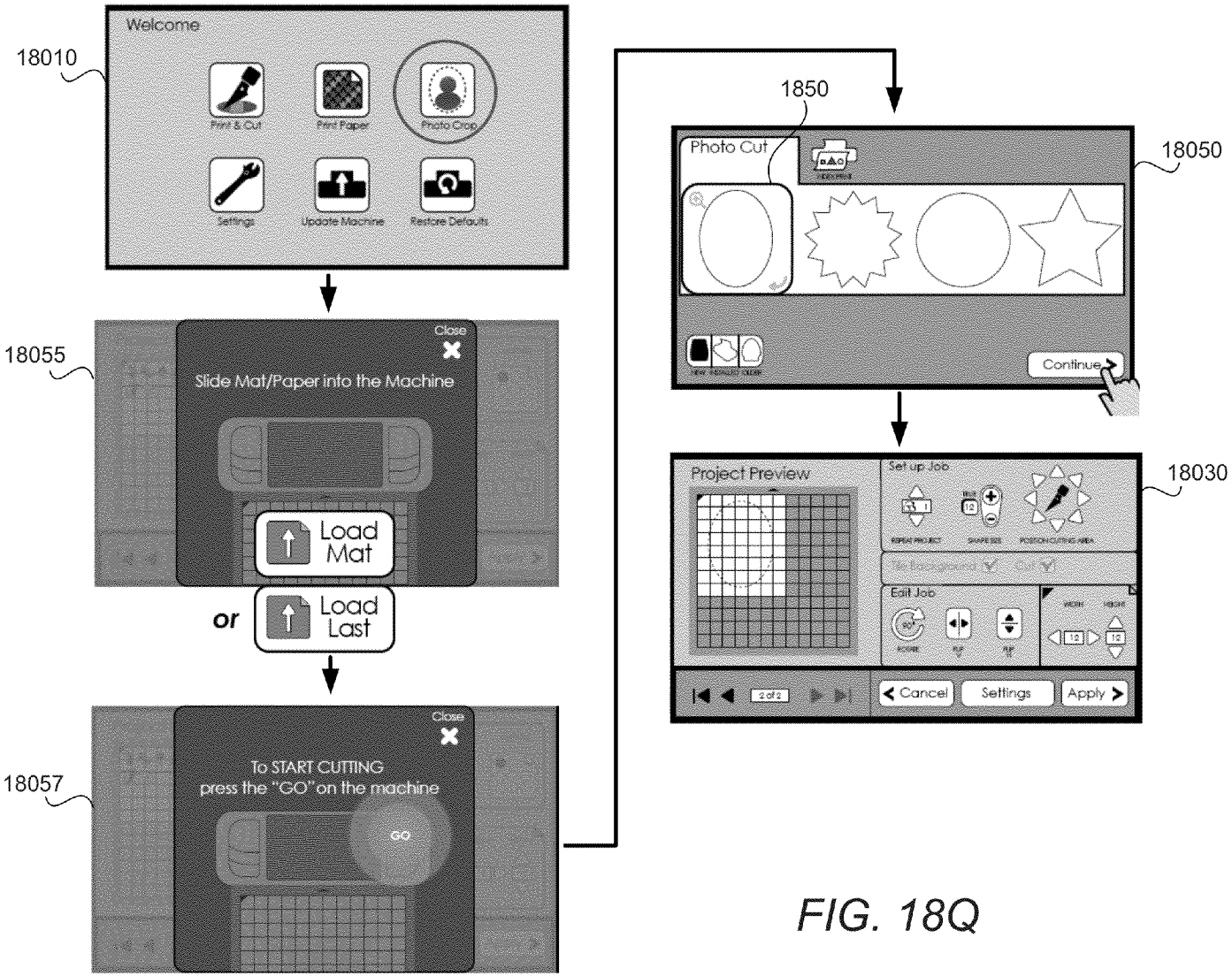
FIG. 18Q provides a schematic view of exemplary screen views displayable on a crafting apparatus for executing a cut command.

The crop photo command allows the user to crop a preprinted photo with a design object 1850. Referring to the example shown in FIG. 18Q, the user selects the photo crop operation from the welcome view 18010, places a photo on the mat 36, loads the mat 36 on the crafting apparatus 10 as prompted by a load mat view 18055, positions the blade 12*a* over the center of the photo, and executes the crop photo command by selecting "Go" in a run job view 18057. The user selects a glyph 1830 or design object 1850 to cut in a shape selection view 18050, and previews the selected design object 1850 in the preview view 18030. The user may apply various settings to the photo crop operation, such as size, rotation, etc. There is no printing in the crop photo mode, just cutting. Moreover, the glyph 1830 may be cut using the location of the blade 12*a* as the center point for the glyph 1830.

Referring again to FIG. 18A, in some implementations, the crafting apparatus 10 includes hard action buttons 92 (e.g., physical inputs, such as buttons, in electrical communication with the controller or processor 104 of the crafting apparatus 10). The hard action buttons 92 may be used to execute commands such as power on/off 92*a*, e-stop 92*b*(emergency stop), go 92*c* (e.g., execute a selected command), and/or menu 92*d*. The power command can be executed by pressing the power button 92*a*, which turns the crafting apparatus 10 on and off. The e-stop command, executed by the e-stop button 92*b*, immediately stops all actions or commands on the crafting apparatus 10 even if that means the job 1810 cannot be restarted. The go command, executed by the go button 92*c*, execute a selected command. In some examples, the crafting apparatus 10 prepares the job 1810 for output, provides the user a summary of the job 1810 that is about to be processed, and presents the user with the ability to abort or cancel the job 1810 (e.g., to continue to change settings). In executing the menu command by pressing the menu button 92*d*, the operating software 1800 may display a menu dialog box or menu screen (e.g., on the display 90 of the crafting apparatus 10). The menu may provide crafting apparatus 10 settings and/or maintenance functions of the crafting apparatus 10. Additional buttons 92 may be provided on the crafting apparatus 10 for user defined commands or upgrade/subscription related commands. Examples of additional commands for additional buttons include zoom and pan for zooming and panning a design object 1850 or job 1810.

In some implementations, the crafting apparatus 10 includes soft action buttons (e.g., inputs, such as buttons, displayed by the operating software 1800 on the display 90, such as a touch screen). The soft action buttons may be used to execute commands such as load last, load paper, unload paper, and/or direction. The load last command allows the user to load the mat 36 with the last piece of paper W used in the previous job 1810 as a paper saving feature. The operating software 1800 remembers what portions of the paper W were used in the previous job 1810 and makes them unavailable for any new jobs 1810, so as to prevent any part of the paper W that was print/cut in any previous job 1810 from being used. The operating software 1800 may display (e.g., on the display 90) the unusable portions of the paper W. The user can execute the load paper command to load paper W into the crafting apparatus 10. The user positions a mat 36 carrying a paper W up to the crafting apparatus 10 for loading and the crafting apparatus 10 loads the mat 36 and carried paper W (e.g., receives and holds the mat 36 for use). The unload paper command causes the crafting apparatus 10 to unload or discharge the mat 36 from the crafting apparatus 10. The direction command allows the user to manually position the blade 12*a* (cutting head). For example, the user may select one or more direction arrow (e.g., displayed on the screen 90) to move the blade 12*a* or the mat 36 in the corresponding direction. The blade 12*a* or the mat 36 may move by a step size (e.g., a step or some fraction thereof of a stepper motor), which may be set by the user. The operating software 1800 may display the location of the blade 12*a* on the display 90. In some implementations, this command or feature is only available for the photo crop mode.

Figure 18R:
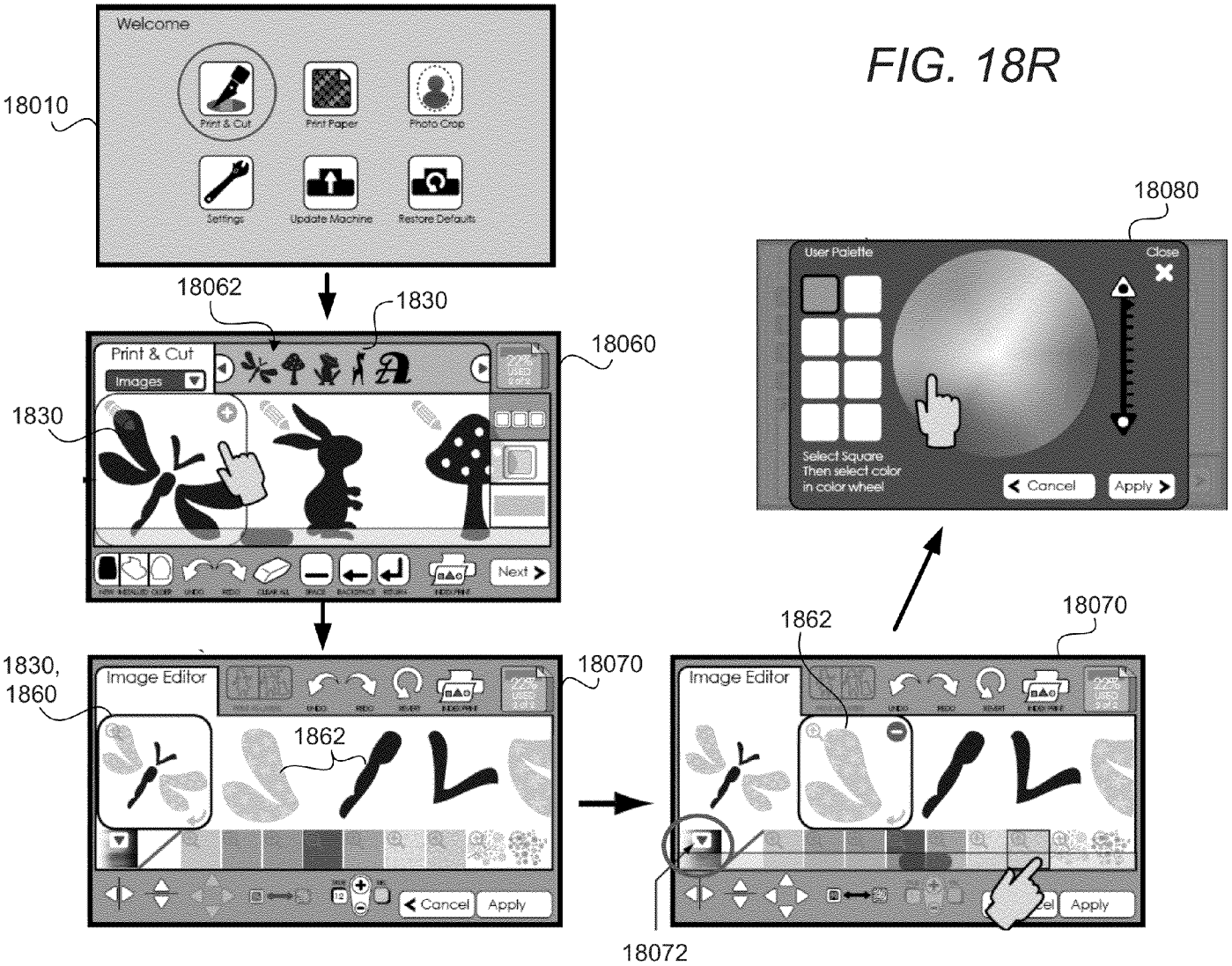
FIG. 18R provides a schematic view of exemplary screen views displayable on a crafting apparatus for viewing and editing glyphs.

Referring to FIG. 18R, which illustrates some exemplary operations of a print and cut operation, the operating software 1800 may display an image gallery view 18060 that allows the user to scroll through and view glyphs 1830 (e.g., stored on a particular cartridge 120 or library). The user may select a glyph 1830 for editing in an image editor view 18070 and/or place the selected glyph 1830 in a glyph queue 18062 for use in a design 1820. In the image editor view 18070, for composite images 1860, the user can select and manipulate each component image 1862. In the example shown, the user can select a color chooser 18072 to view a color selection view 18080 for selecting and assigning a color to the selected component image 1862.

Figure 18S:
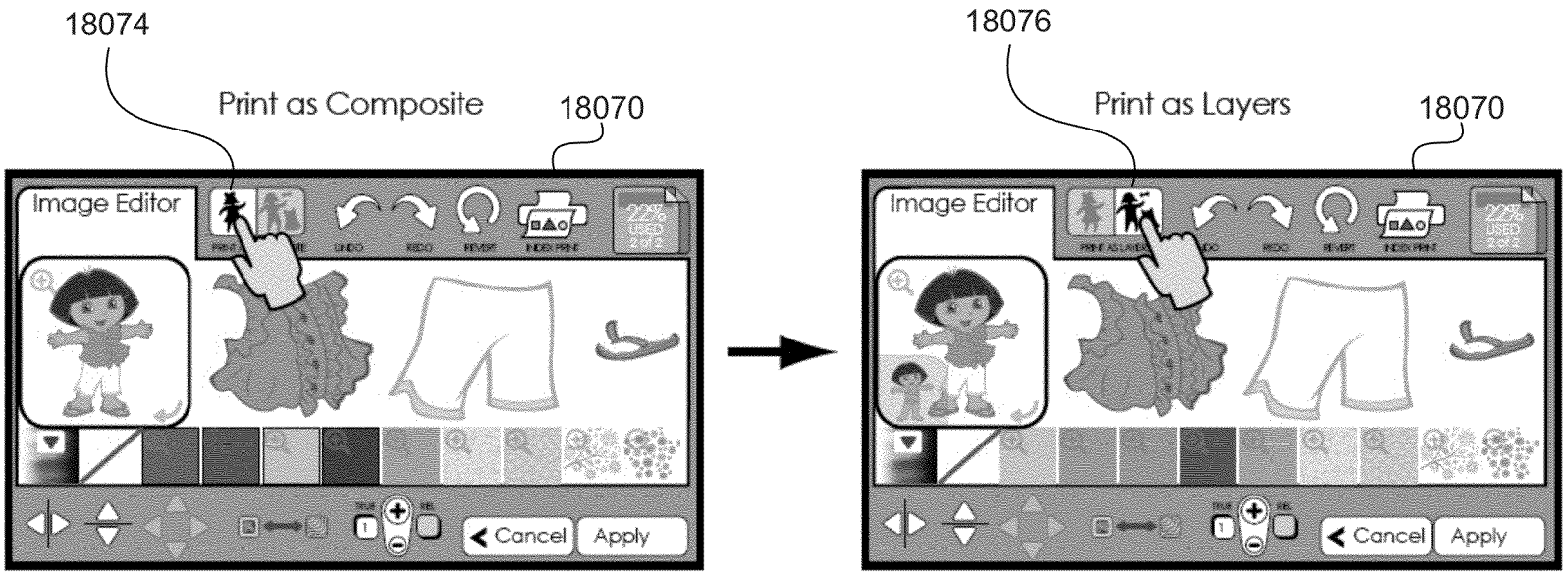
FIG. 18S provides a schematic view of exemplary screen views displayable on a crafting apparatus for a printing a glyph as a composite image or as component images.

Referring to FIG. 18S, the user may select a "print as composite" option 18074 for printing the selected glyph 1830 as a composite image 1860 or a "print as layers" option 18076 for printing the component images 1862 of the selected glyph 1830 on different layers 1870. For print and cut operations, the separate component images 1862 can be printed and cut for manual assembly by the user.

Figure 18T:
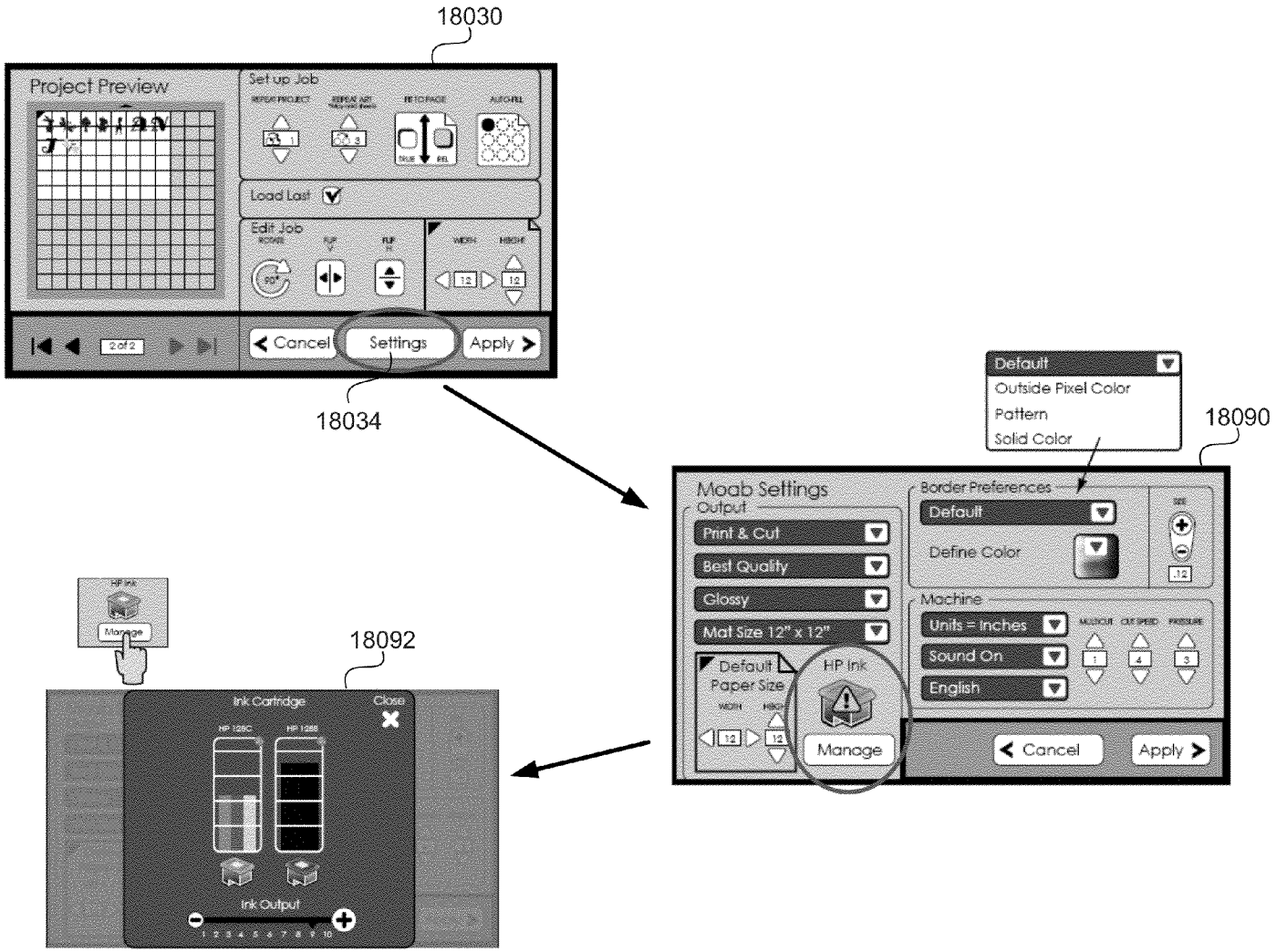
FIG. 18T provides a schematic view of exemplary screen views displayable on a crafting apparatus for adjusting settings of a glyph and/or job.

Referring to FIG. 18T, in the preview view 18030, the user may select a settings button 18034 to access a settings view 18090. The settings view 18090 allows the user to select an output, such as print only, print and cut, or cut only, as well a print quality, print finish (e.g., glossy), and/or a mat size. The user may select a border for the job 1810 as well as a border size and color. In some examples, the user can set a print-to-cut-tolerance, which may be used by the operating software 1800 in determining a size of the border outline 1834. The user may select a unit of measure (e.g., inches, cm, mm, etc.), language (e.g., English), sounds, cut speed, multi-cut (e.g., number of cut passes), and a cut pressure of the crafting apparatus 10. In some examples, the user can manage the printer ink in an ink view 18092, which may provide ink levels by color or an estimated life of an ink cartridge.

Figure 18U:
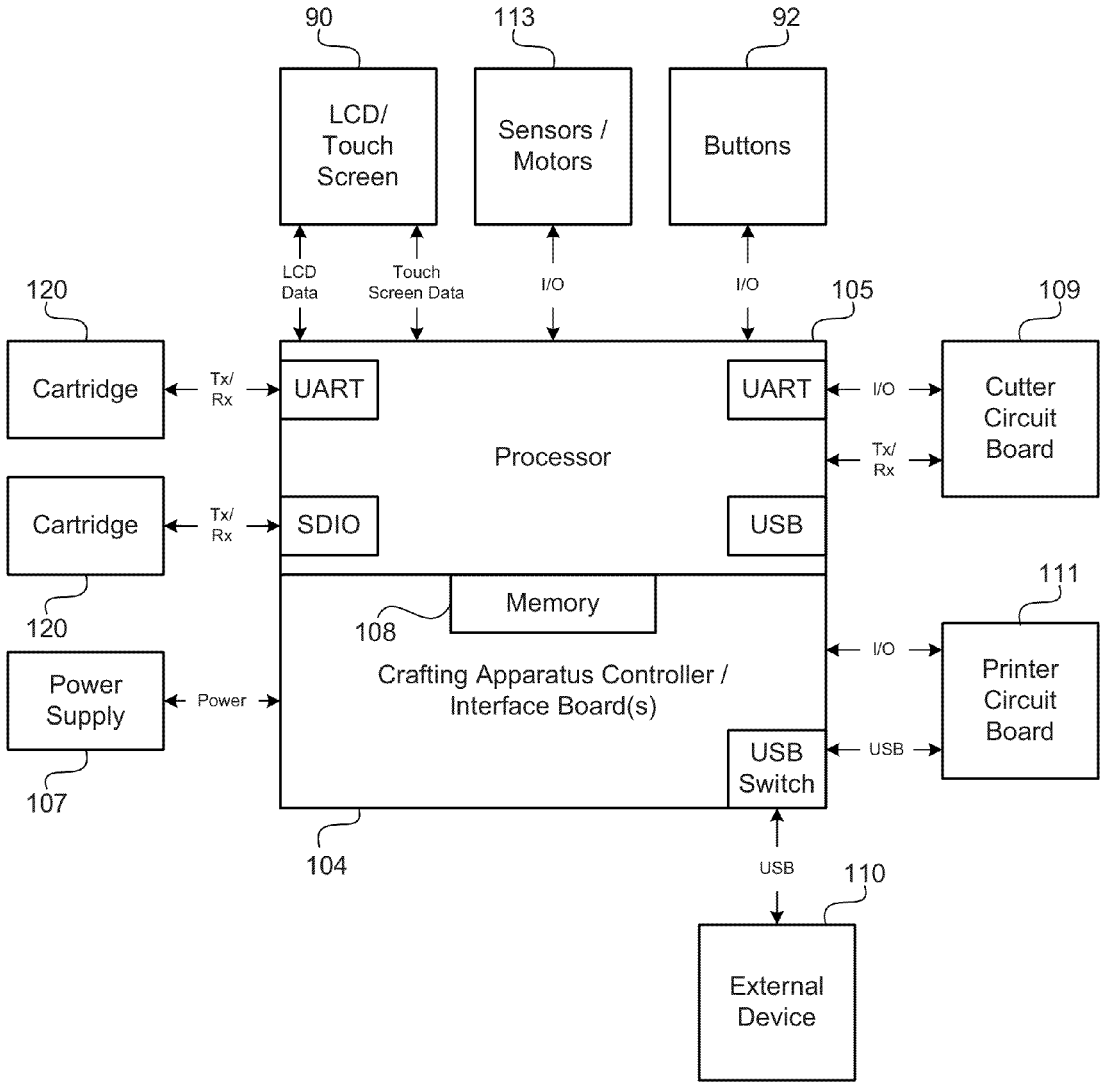
FIG. 18U is a schematic view of an exemplary electronics for a crafting apparatus.

FIG. 18U provides a schematic view of an exemplary crafting apparatus 10. In some implementations, the crafting apparatus 10 includes a controller 104 (e.g., with interface board(s)) in communication with a processor 105 and memory 108. The processor 105 may execute the operating software 1800, which may be stored in the memory 108. The processor 105 and/or the controller 104 may have one or more of a universal asynchronous receiver/transmitter (UART), a universal serial bus (USB), secure digital input/output (SDIO), and serial or parallel communications. The controller 104 and/or processor 105 may communicate with cartridges 120 and/or an external device, such as the hand-held controller 110, to receive content (e.g., glyphs 1830) and/or other data. The controller 104 and/or processor 105 may also communicate with a power supply 107 to receive power, a cutter circuit 109 for controlling cutting operations and a printer circuit 111 for controlling printing operations. Moreover, the controller 104 and/or processor 105 may communicate with the display 90 for displaying views of the operating software 1800, the buttons 92 for receiving user inputs, and device I/O 113 (e.g., sensor and motors) for controlling operation of the crafting apparatus 10.

Figure 19:
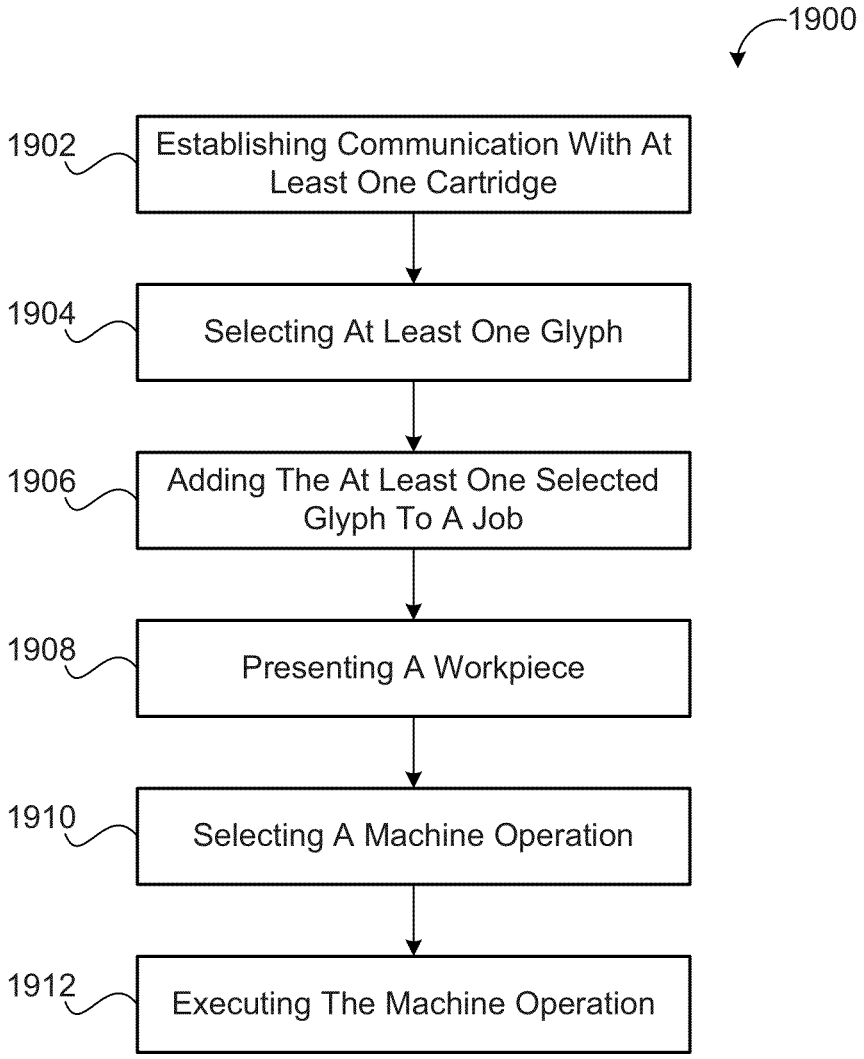
FIGS. 19 and 20 each provide an exemplary arrangement of operations for operating a crafting apparatus.

FIG. 19 provides an exemplary arrangement 1900 of operations for operating the crafting apparatus 10. Operations include establishing 1902 communication between at least one cartridge 120 and the processor 104 of the crafting apparatus 10, selecting 1904 at least one displayed glyph 1830, and adding 1906 the at least one selected glyph 1830 to a job 1810. The operations further include presenting 1908 a workpiece W to the crafting apparatus 10, selecting 1910 a machine operation, and executing 1912 the machine operation. The machine operation includes at least one of printing at least a portion of the job 1810 on the workpiece W and cutting the workpiece W with respect to at least a portion of the job 1810. For example, the machine operation could include a printing operation consisting of only printing at least a portion of the at least one selected glyph 1830 on the workpiece W. In other examples, the machine operation may include a print-and-cut operation comprising printing at least a portion of the at least one selected glyph 1830 on the workpiece W and cutting the workpiece W with respect to at least a portion of the at least one selected glyph 1830. In yet additional examples, the machine operation may include a cutting operation consisting of only cutting the workpiece W with respect to at least a portion of the at least one selected glyph 1830.

Figure 20:
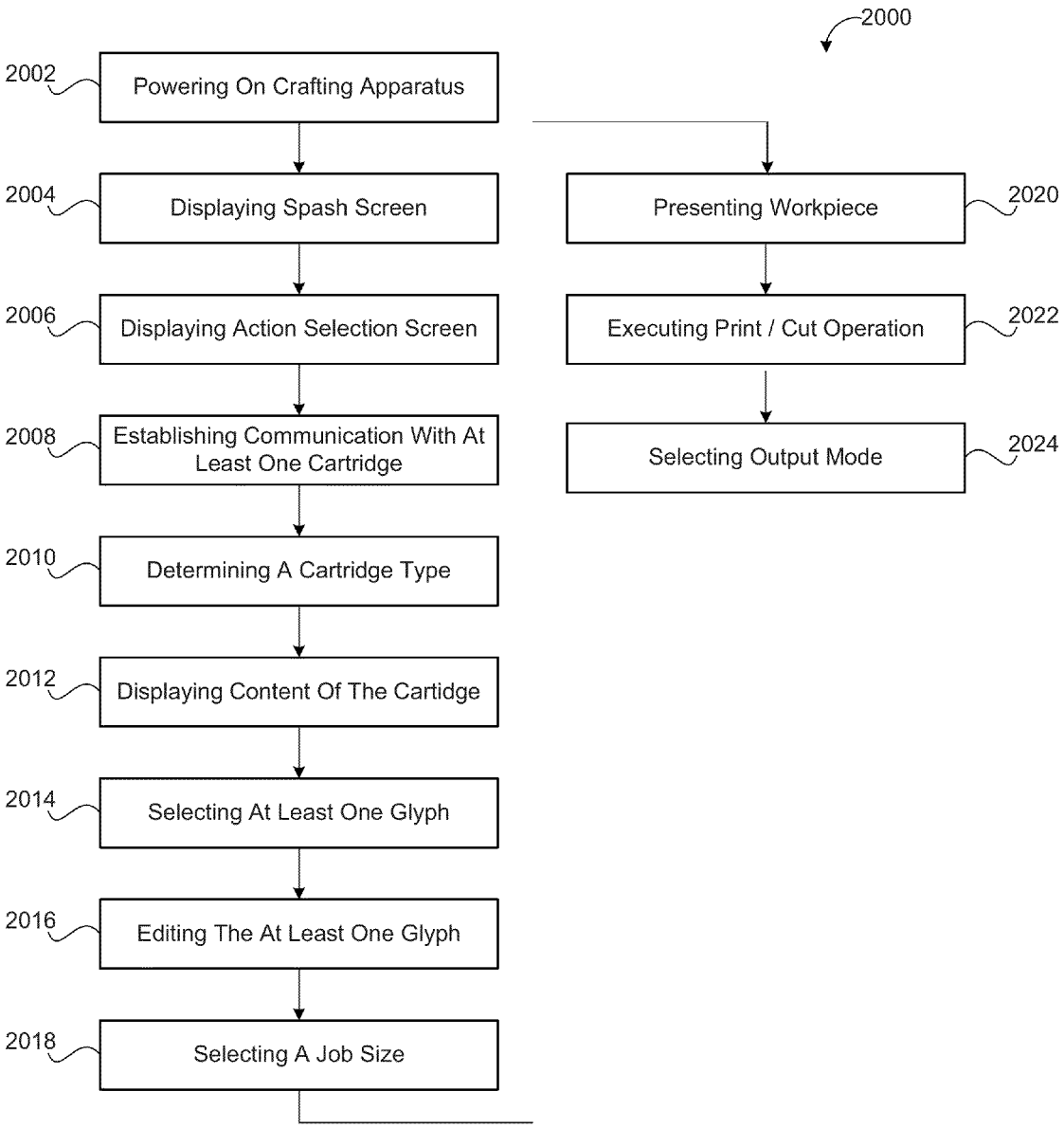

FIG. 20 provides an exemplary arrangement 2000 of operations for operating the crafting apparatus 10. Operations include powering on 2002 the crafting apparatus 10, displaying 2004 a splash, loading, and/or welcome screen(s), and displaying 2006 an action selection screen or prompting the user for an action. The action selection screen or prompt allows the user to select between at least a print-and-cut operation, a print operation, and an image crop operation.

Upon selecting the print-and-cut operation, operations for operating the crafting apparatus 10 include establishing 2008 electrical communication between at least one cartridge 120 and the crafting apparatus 10 (e.g., by inserting a cartridge 120 into a cartridge slot of the crafting apparatus 10). Upon receiving a cartridge 120, operations include determining 2010 a cartridge type and displaying 2012 content of the cartridge 120. In some examples, the cartridge 120 is an image type, a font type, or a combination thereof. For an image type cartridge 120, operations include displaying a gallery or list view of glyphs 1830 stored in memory on the cartridge 120. For a font type cartridge 120, operations include displaying a keypad view (e.g., where the keys can be displayed in a font in memory on the cartridge 120). Operations for operating the crafting apparatus 10 may further include selecting 2014 one or more glyphs 1830 for addition or removal from a user design 1820, editing 2016 the selected glyph(s) 1830 (e.g., size, color, etc.), and selecting 2018 a job size. Operations further include presenting a workpiece W (e.g., paper) and executing 2022 a print-cut operation. If the print-cut operation is canceled, the user may proceed to continue editing the user design 1820 or change out the cartridge(s) 120 and start over with the current user design 1820 or start a new user design 1820. Upon executing the print-cut operation, the operation may further include selecting 1824 an output mode, which includes a print-and-cut command, a print-only command, and cut-only command. The crafting apparatus 10 then proceeds to execute the command accordingly.

Figure 21:
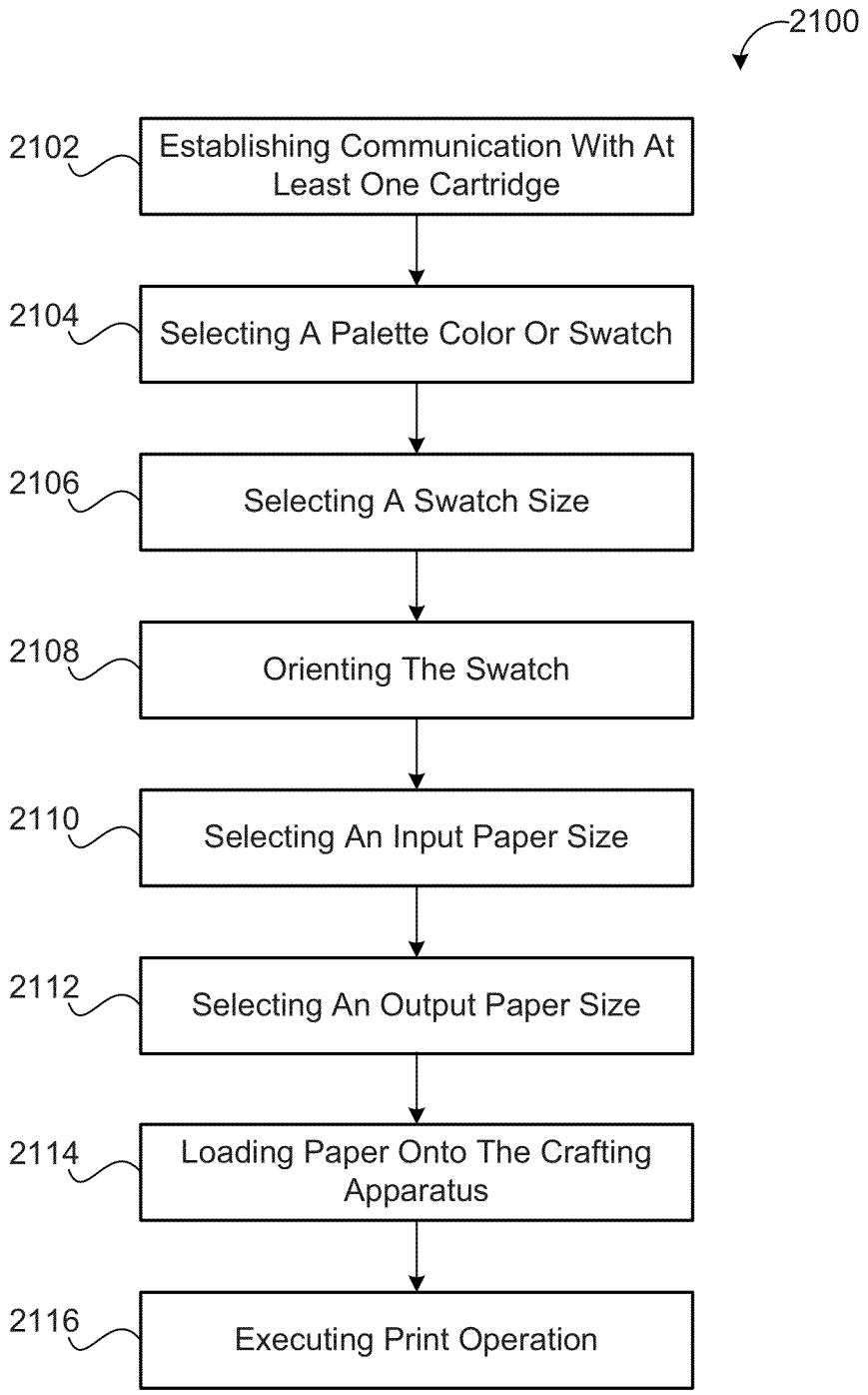
FIG. 21 provides an exemplary arrangement of operations for operating a crafting apparatus in a print mode.

FIG. 21 provides an exemplary arrangement 2100 of operations for operating the crafting apparatus 10 upon selecting the print operation. The operations for operating the crafting apparatus 10 include establishing 2102 electrical communication between at least one cartridge 120 and the crafting apparatus 10 (e.g., by inserting a cartridge 120 into a cartridge slot of the crafting apparatus 10). Upon receiving a cartridge 120, operations may include selecting 2104 a palette color or swatch, selecting 2106 a swatch size, orienting 2108 the swatch, selecting 2110 an input paper size, and/or selecting 2112 an output paper size. Operations may further include loading 2114 paper W onto the crafting apparatus 10 and executing 2116 the print operation. In executing the print operation, operations may include determining a size relationship between the input paper size and the output paper size. If the input paper size is smaller than the output paper size, operations include indicating an error (e.g., by displaying an error message and/or error code). If the input paper size is larger than the output paper size, operations include cutting the input paper to the output paper size and printing the design on the paper. If the input paper size is the same size as the output paper size, operations include printing the design on the paper.

Figure 22:
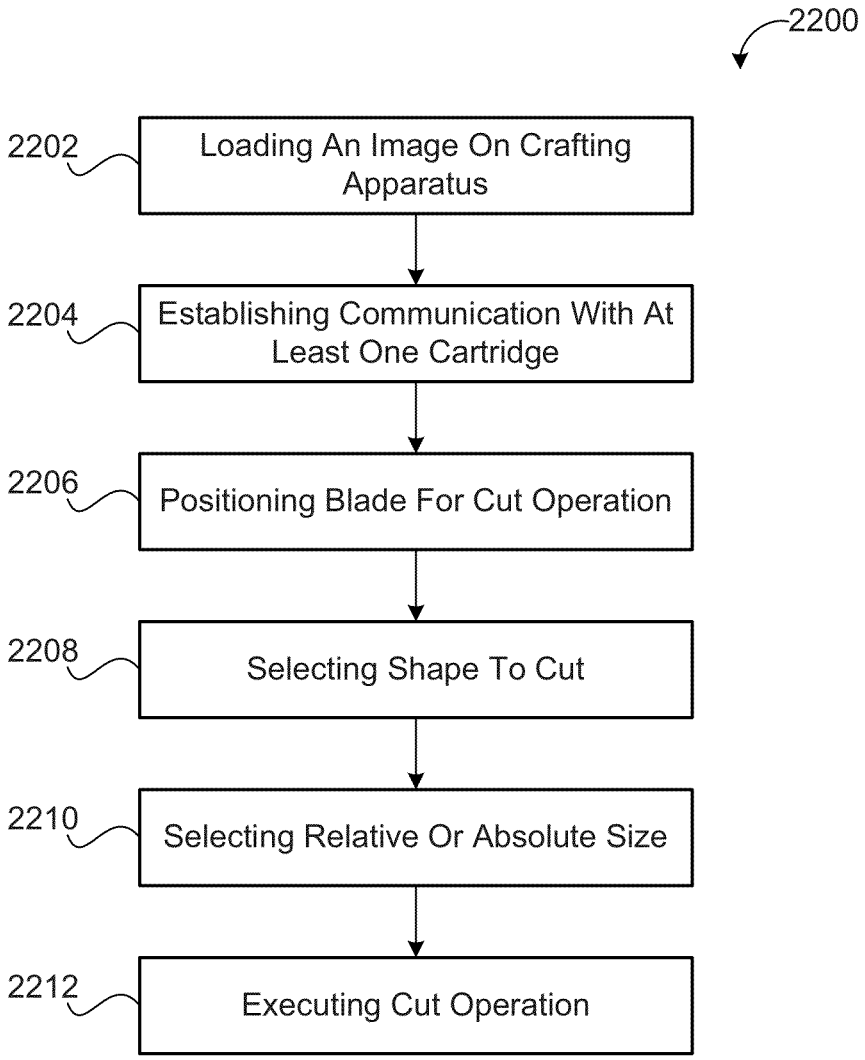
FIG. 22 provides an exemplary arrangement of operations for operating a crafting apparatus in an image crop mode.

FIG. 22 provides an exemplary arrangement 2200 of operations for operating the crafting apparatus 10 upon selecting the image crop operation. The operations for operating the crafting apparatus 10 include loading 2202 an image (e.g., paper with image) on the crafting apparatus 10 and establishing 2204 electrical communication between at least one cartridge 120 and the crafting apparatus 10. Upon receiving a cartridge 120 (which may enable use of the crafting apparatus 10), operations may include positioning 2206 the blade 12*a* for a cut operation and selecting 2208 a shape (e.g., from the connected cartridge(s)) to cut. Operations may further include selecting 2210 a size (e.g., relative size or absolute size) and executing 2212 the cut operation.

Figure 23:
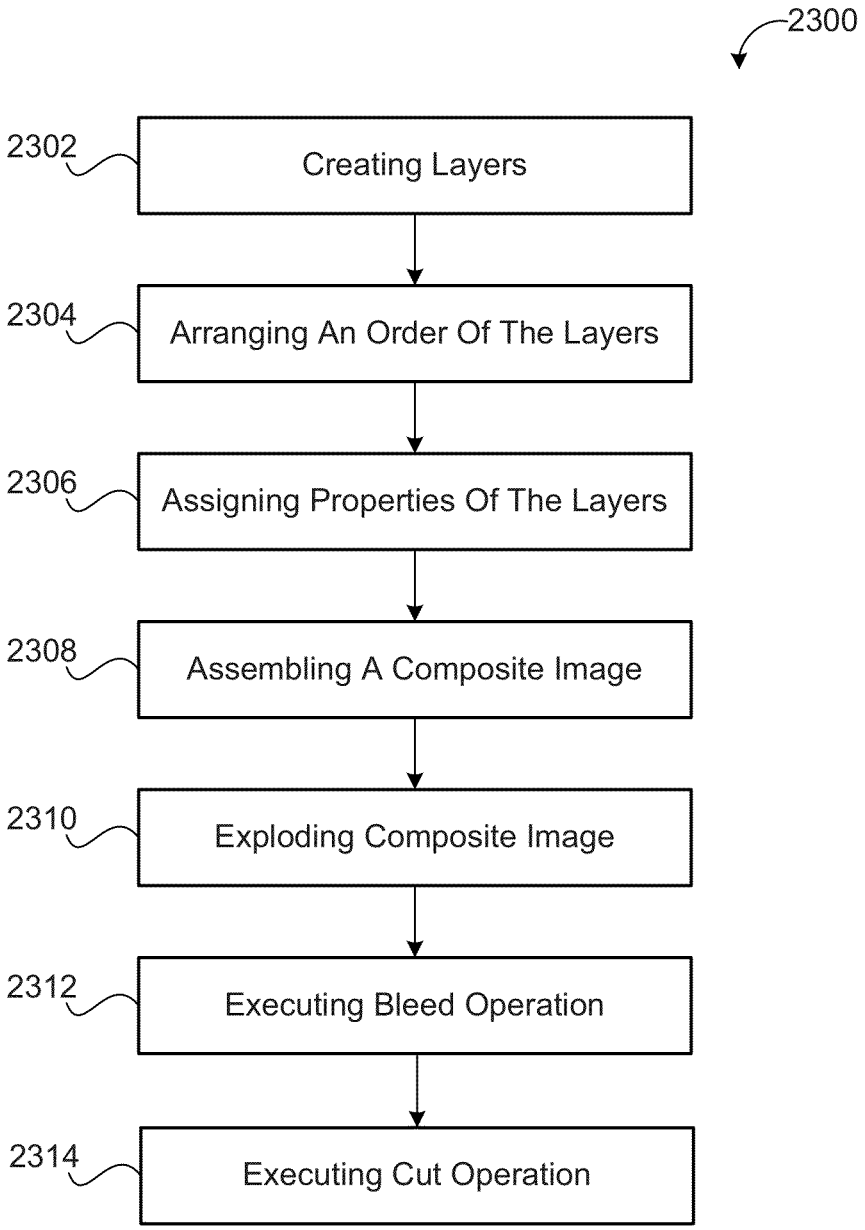
FIG. 23 provides an exemplary arrangement of operations for operating a crafting apparatus.

FIG. 23 provides an exemplary arrangement 2300 of operations for operating the crafting apparatus 10. Referring again to FIGS. 18G and 18H as well as to FIG. 23, in some implementations, additional operations for using the operating software 1800 include creating 2302 layers 1870 within a project or job 1810 (e.g., as by using the layers palette), for managing and/or organizing the creation of the job 1810. In the example shown, the user may create a design or composite image 1860 on a virtual mat 1890 (e.g., a digital representation of the actual mat 36) comprised of layers 1870 that collectively provide the composite image 1860 visually, and also mechanically during physical assembly of component images 1862 (e.g., as layers 1870) cut from a material on the crafting apparatus 10. The usage of a collection of component images 1862 to form a composite image 1860, digitally and/or physically is referred to herein as image layering and digital paper layering. Additional operations may include arranging 2304 an order of the layers 1870 (e.g., from front to back) and/or assigning 2306 one or more parameters or properties of each layer 1870, when creating the layer 1870. For example, the user may select a paper type, set a multi-cut command, a pressure command, and/or a paper size. In some examples, the operations include assembling 2308 a composite image 1860 on the virtual mat 1890 or select a pre-made composite image 1860. The composite image 1860 may be configured or designed by an artist and provided to the user for consumption (e.g., via a cartridge 120 or the Internet). The composite image 1860 may include a home location, which is the location of a vector path that, when all the vectorized component images 1862 arranged in the home location, provides the user the composite image 1860, as shown in FIG. 18G.

When a user initiates a cutting operation 2314 or executes an exploded view operation 2310, the composite image 1860 is exploded into the non-overlapping component images 1862 for cutting and later assembly, as shown in FIG. 18H. In some implementations, separate component image files corresponding to each component image 1862 are used for providing the exploded view, while in other implementations, the component images 1862 are created or extrapolated from the composite image 1860 (e.g., via segmenting the image). In the example shown, the composite image 1860 is assembled from a body component image 1862*a*, a first hair component image 1862*b*, a second hair component image 1862*c*, a shoes component image 1862*d*, a crown component image 1862*e*, and a dress component image 1862*f*. Each component image 1862 can be on a separate layer 1870. If the composite image 1860 is cropped, the corresponding component images 1862 may be cropped accordingly. A semi-composite state of the composite image 1860 may be provided where the component images 1860 can be arranged with overlapping and non-overlapping vector paths. Moreover, the user may specify where a layer 1870 is cut, print, or print and cut layer (e.g., via layer attribute(s))

In some examples, the user may recolor, flood fill, paint, shade, texture, other otherwise alter all or parts of the composite image 1860, layer 1870, and/or any of the corresponding component images 1862 so as to customize the look of the image(s) 1860, 1862. In shading, for example, the user may altering the color of raster art to make it a different color while maintaining the shading of the raster art. In texture filling, the user may remove the raster art from inside a vector border and replacing it with a pattern.

Referring again to FIG. 18H, each component image 1862 may have a vector region, which is an area created by the boundary of a vector path. In some implementations, a buffer region 1864 is disposed around the perimeter or boundary of the vector path of the component image 1862. For example, the operating software 1800 may automatically provide the buffer region 1864 around each component image 1862 upon execution of a cut operation 2314 or the user may execute a bleed boundary operation 2312 to create the buffer region 1864 around the component image(s) 1862 of a selected layer 710. The buffer region 1864 allows cutting the component image 1862 along its perimeter while maintaining any coloration (e.g., via printing) of component image 1862 completely up to the cut perimeter. The buffer region 1864 may have a threshold thickness that stays constant or is not exceeded (e.g., maximum or minimum) when the component image 1862 is scaled or altered. In some implementations, the buffer region 1864 is created by extrapolating colors outwardly beyond the image perimeter. For example, pixel colors may be propagated a threshold number of pixels outwardly form the image perimeter and overlapping colors mixed appropriately (e.g., according to a mixing criteria, such red+blue=purple).

Table 2 provides example use cases that illustrate various operations that can be performed on composite images 1860 (full and semi-composite state of the composite image 1860) and/or component images 1862. Other uses are possible as well. In some examples, the user may wish to execute a machine operation, such a print operation, a cut operation, or a print and cut operation from the design software 100 to realize a design in physical form. The user may also execute one or more image manipulation operations on the composite images 1860 (full and semi-composite state of the composite image 1860) and/or component images 1862 before executing the machine operation.

TABLE 2

| | Composite | Semi-Composite | Exploded |
|---|---|---|---|
| Print and Cut | Alter the image, print and cut, peel and use.<br>Alter the image, flood fill some/all vector regions, print and cut, peel and use.<br>Alter the image, shade fill some/all vector regions, print and cut, peel and use.<br>Alter the image, texture fill some/all vector regions, print and cut, peel and use. | Alter the image, move some/all vector regions, print and cut, peel, layer if desired and use.<br>Alter the image, move some/all vector regions, flood fill some/all vector regions, print and cut, peel, layer if desired and use.<br>Alter the image, move some/all vector regions, shade fill some/all vector regions, print and cut, peel, layer if desired and use.<br>Alter the image, move some/all vector regions, texture fill some/all vector regions, print and cut, peel, layer if desired and use.<br>Additionally - vector regions could be deleted. | Alter the image, explode the image, print and cut, peel, layer if desired and use.<br>Alter the image, explode the image, flood fill some/all vector regions, print and cut, peel, layer if desired and use.<br>Alter the image, explode the image, shade fill some/all vector regions, print and cut, peel, layer if desired and use.<br>Alter the image, explode the image, texture fill some/all vector regions, print and cut, peel, layer if desired and use.<br>Additionally - vector regions could be deleted. |

TABLE 2-continued

| | Composite | Semi-Composite | Exploded |
|---|---|---|---|
| Print | Alter the image, print, peel and use. Alter the image, flood fill some/all vector regions, print, peel and use. Alter the image, shade fill some/all vector regions, print, peel and use. Alter the image, texture fill some/all vector regions, print, peel and use. | Alter the image, move some/all vector regions, print, peel, layer if desired and use. Alter the image, move some/all vector regions, flood fill some/all vector regions, print, pea, layer if desired and use. Alter the image, move some/all vector regions, shade fill some/all vector regions, print, peel, layer if desired and use. Alter the image, move some/all vector regions, texture fill some/all vector regions, print, peel, layer if desired and use. Additionally - vector regions could be deleted. | Alter the image, explode the image, print, peel, layer if desired and use. Alter the image, explode the image, flood fill some/all vector regions, print, peel, layer if desired and use. Alter the image, explode the image, shade fill some/all vector regions, print, peel, layer if desired and use. Alter the image, explode the image, texture fill some/all vector regions, print, peel, layer if desired and use. Additionally - vector regions could be deleted. |
| Cut | Alter the image, select the paper, cut, peel and use. | Alter the image, move some/all vector regions, select the paper, cut, peel, layer if desired and use. | Alter the image, explode the image, select the paper, cut, peel, layer if desired and use. |

The user may alter or manipulate the image in any number of ways, including, but not limited to: sizing, flipping, rotating, shading, filling, painting, skewing, patterning, etc.

Additional details on image layering and other features combinable with this disclosure can be found in U.S. Provisional Patent Application Ser. No. 61/178,074, filed on May 14, 2009 and as well as U.S. Provisional Patent Application Ser. No. 61/237,218, filed on Aug. 26, 2009. The disclosures of these prior applications are considered part of the disclosure of this application and are hereby incorporated by reference in their entireties.

Figure 24A:
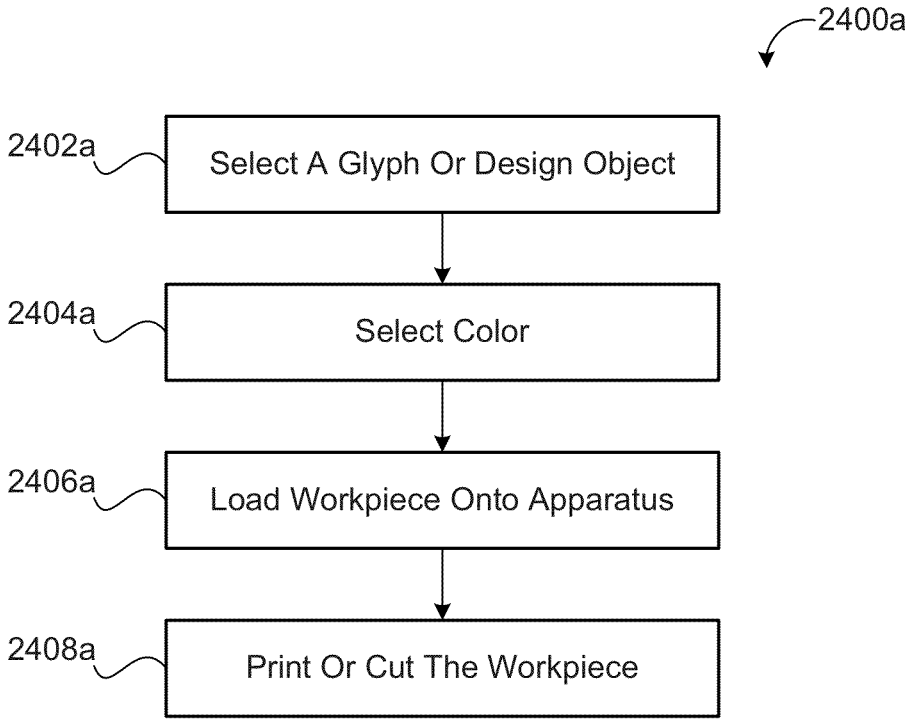
FIG. 24A provides a schematic view of an exemplary arrangement of operations for operating a crafting apparatus to perform an un-layered printing or cutting operation.

FIG. 24A provides an exemplary arrangement 2400*a* of operations for operating the crafting apparatus 10 to perform an un-layered printing or cutting operation of a glyph 1830 or design object 1850. The operations include selecting 2402*a* a glyph 1830 or design object 1850, selecting 2404*a* a color of the workpiece W (e.g., paper), loading 2406*a* the workpiece W on the crafting apparatus 10, and printing or cutting 2408*a* the workpiece W according to the selected glyph 1830 or design object 1850. For printing operations, the glyph 1830 or design object 1850 may be vector art or raster art.

Figure 24B:
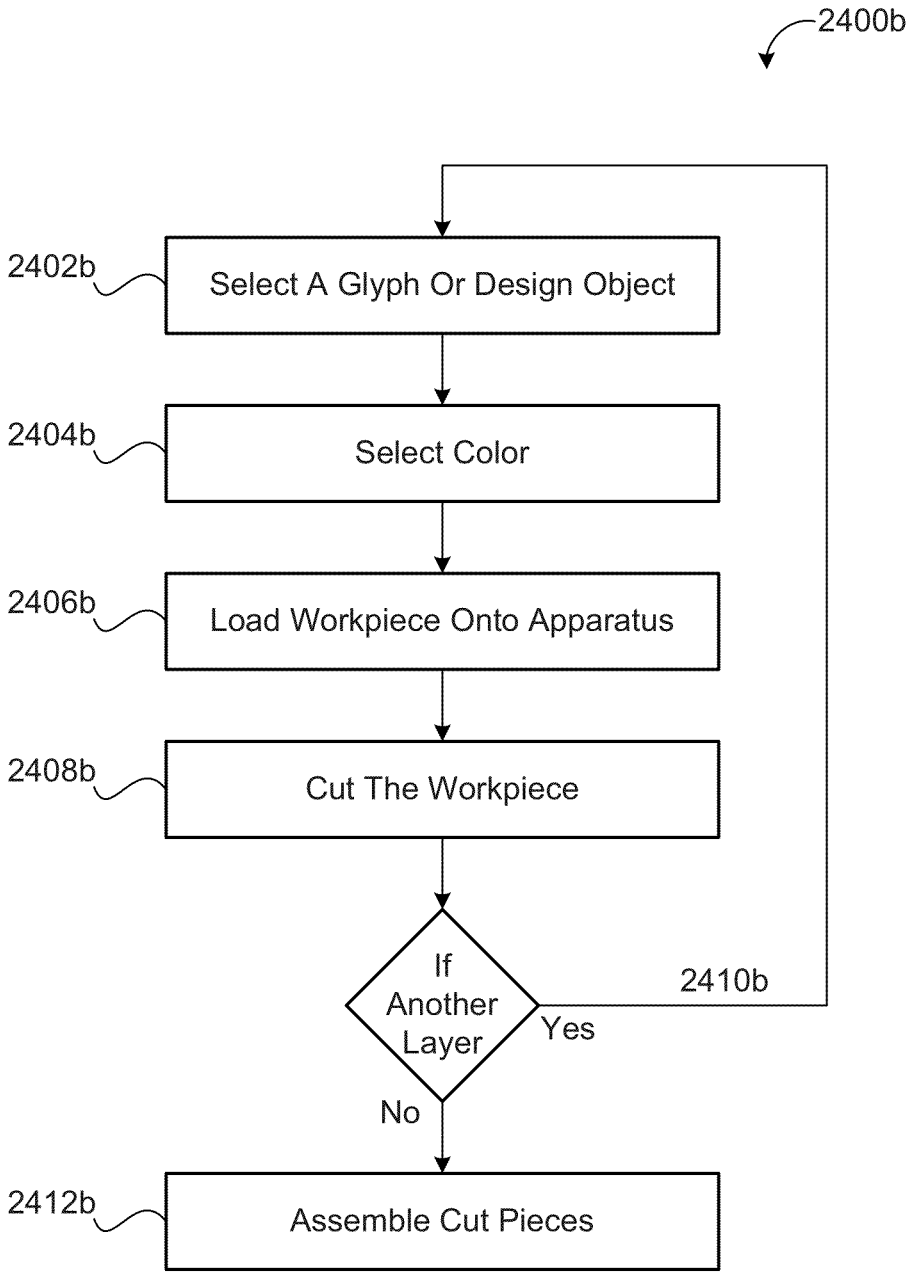
FIG. 24B provides a schematic view of an exemplary arrangement of operations for operating a crafting apparatus to perform a layered cutting operation.

FIG. 24B provides an exemplary arrangement 2400*b* of operations for operating the crafting apparatus 10 to perform a layered cutting operation of a glyph 1830 or design object 1850. The operations include selecting 2402*a* a glyph 1830 or design object 1850, selecting 2404*a* a color of the workpiece W (e.g., paper), loading 2406*a* the workpiece W on the crafting apparatus 10, and cutting 2408*a* the workpiece W according to the selected glyph 1830 or design object 1850. The operations further include repeating 2410*b* steps 2402*b*-2408*b* for each layer 1870, and optionally assembling 2412*b* each cut layer 1870 together or in a collage.

Figure 24C:
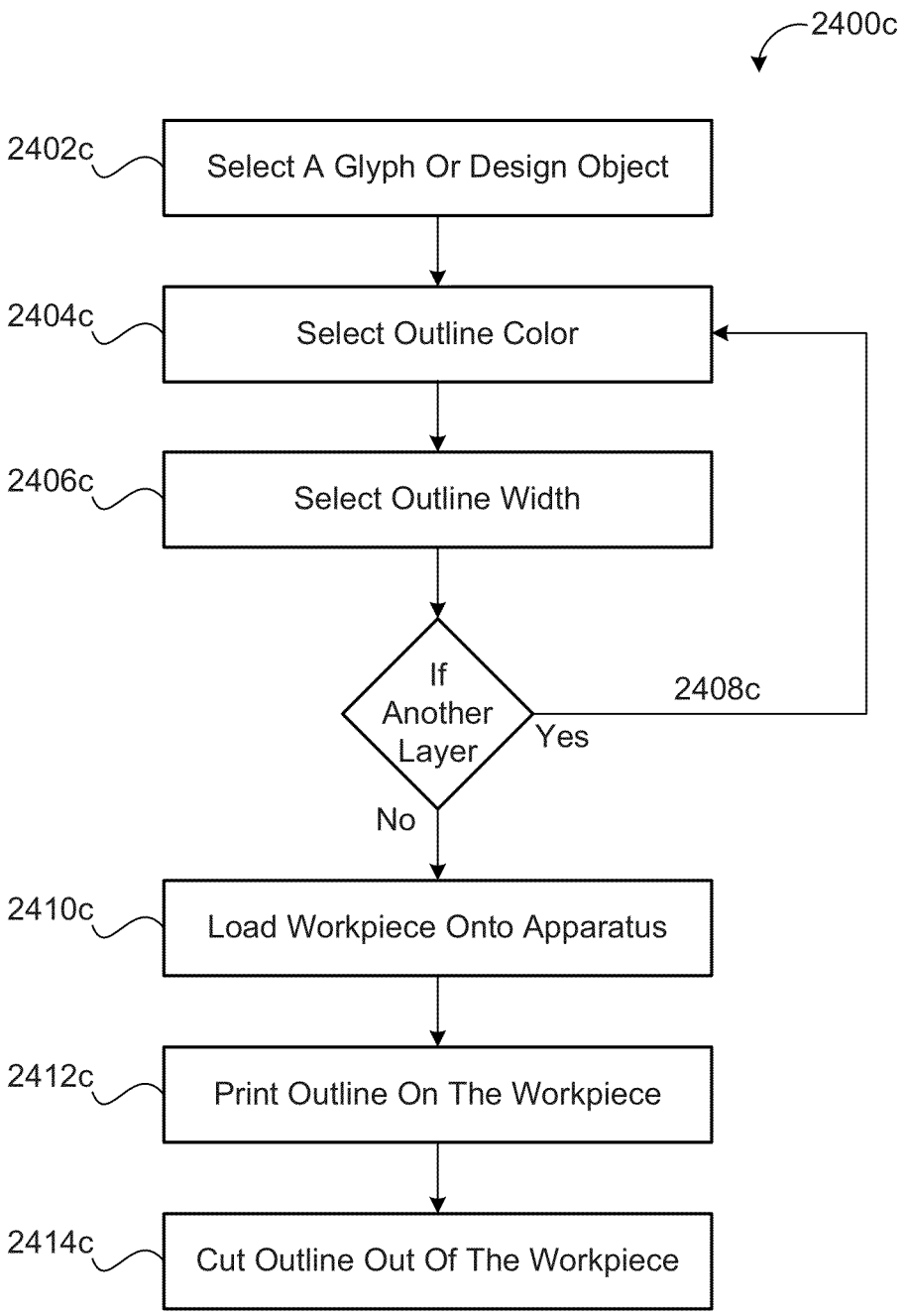
FIG. 24C provides a schematic view of an exemplary arrangement of operations for operating a crafting apparatus to perform layered and un-layered outline printing and cutting operations.

FIG. 24C provides an exemplary arrangement 2400*c* of operations for operating the crafting apparatus 10 to perform layered and un-layered outline printing and cutting operations of a glyph 1830 or design object 1850. The operations include selecting 2402*c* a glyph 1830 or design object 1850, selecting 2404*c* an outline color and selecting 2406*c* an outline width. For a layered glyph 1830 or design object 1850, the operations include repeating 2408*c* selecting 2404*c* an outline color and selecting 2406*c* an outline width for each layer. The operations include loading 24010*c* the workpiece W on the crafting apparatus 10, printing 2412*c* an outline of the selected glyph 1830 or design object 1850 on the workpiece W, and cutting 2414*c* the printed outlines out of the workpiece W.

Figure 24D:
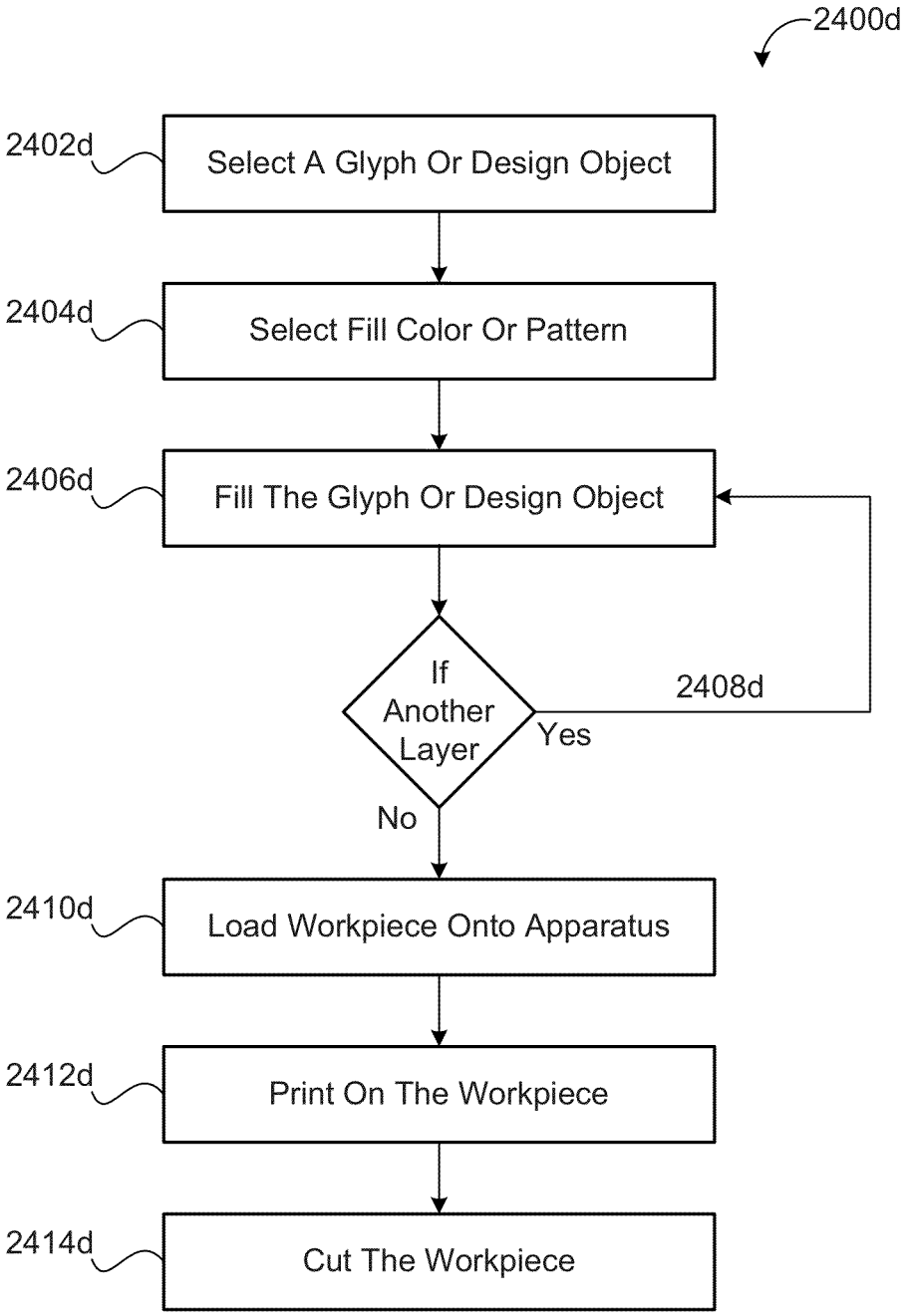
FIG. 24D provides a schematic view of an exemplary arrangement of operations for operating a crafting apparatus to perform layered and un-layered flood fill operations.

FIG. 24D provides an exemplary arrangement 2400*d* of operations for operating the crafting apparatus 10 to perform layered and un-layered flood fill operations on a glyph 1830 or design object 1850. The operations include selecting 2402*d* a glyph 1830 or design object 1850, selecting 2404*d* a fill color or pattern and filling 2406*d* the selected glyph 1830 or design object 1850. For a layered glyph 1830 or design object 1850, the operations include repeating 2408*d* selecting 2404*d* a fill color or pattern and filling 2406*d* the selected glyph 1830 or design object 1850 for each layer. The operations include loading 2410*d* the workpiece W on the crafting apparatus 10, printing 2412*d* the filled glyph 1830 or design object 1850 on the workpiece W, and cutting 2414*d* the glyph 1830 or design object 1850 out of the workpiece W.

Figure 24E:
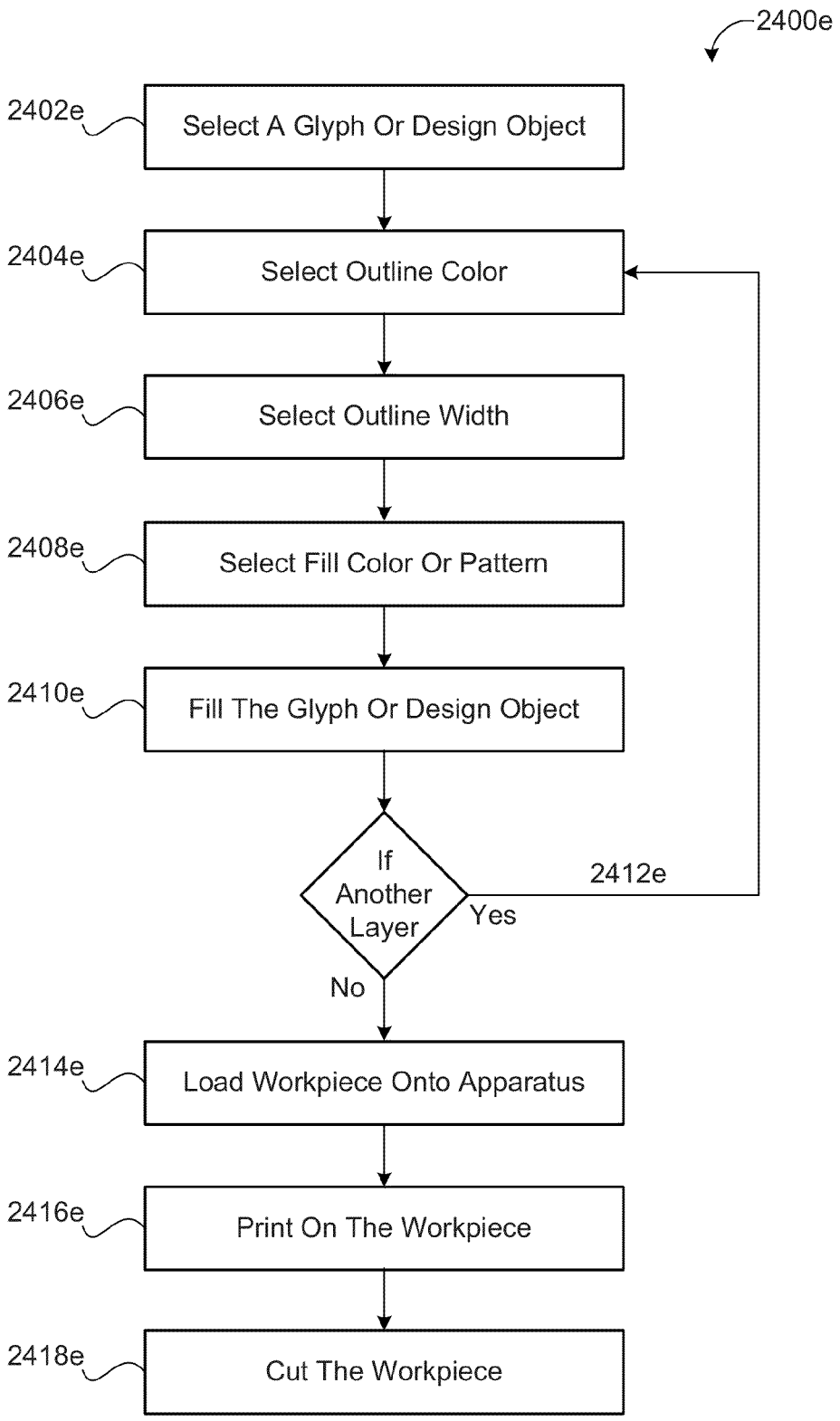
FIG. 24E provides a schematic view of an exemplary arrangement of operations for operating a crafting apparatus to perform an un-layered flood fill and outline printing and cutting operation.

FIG. 24E provides an exemplary arrangement 2400*e* of operations for operating the crafting apparatus 10 to perform an un-layered flood fill and outline printing and cutting operations on a glyph 1830 or design object 1850. The operations include selecting 2402*e* a glyph 1830 or design object 1850, selecting 2404*e* an outline color, selecting 2406*e* an outline width, selecting 2408*e* a fill color or pattern, and filling 2410*e* the selected glyph 1830 or design object 1850. For a layered glyph 1830 or design object 1850, the operations include repeating 2412*e* operations 2404*e* to 2410*e*. The operations further include loading 2414*e* the workpiece W on the crafting apparatus 10, printing 2416*e* the outlined and filled glyph 1830 or design object 1850 on the workpiece W, and cutting 2418*e* the outlined and filled glyph 1830 or design object 1850 out of the workpiece W.

Figure 24F:
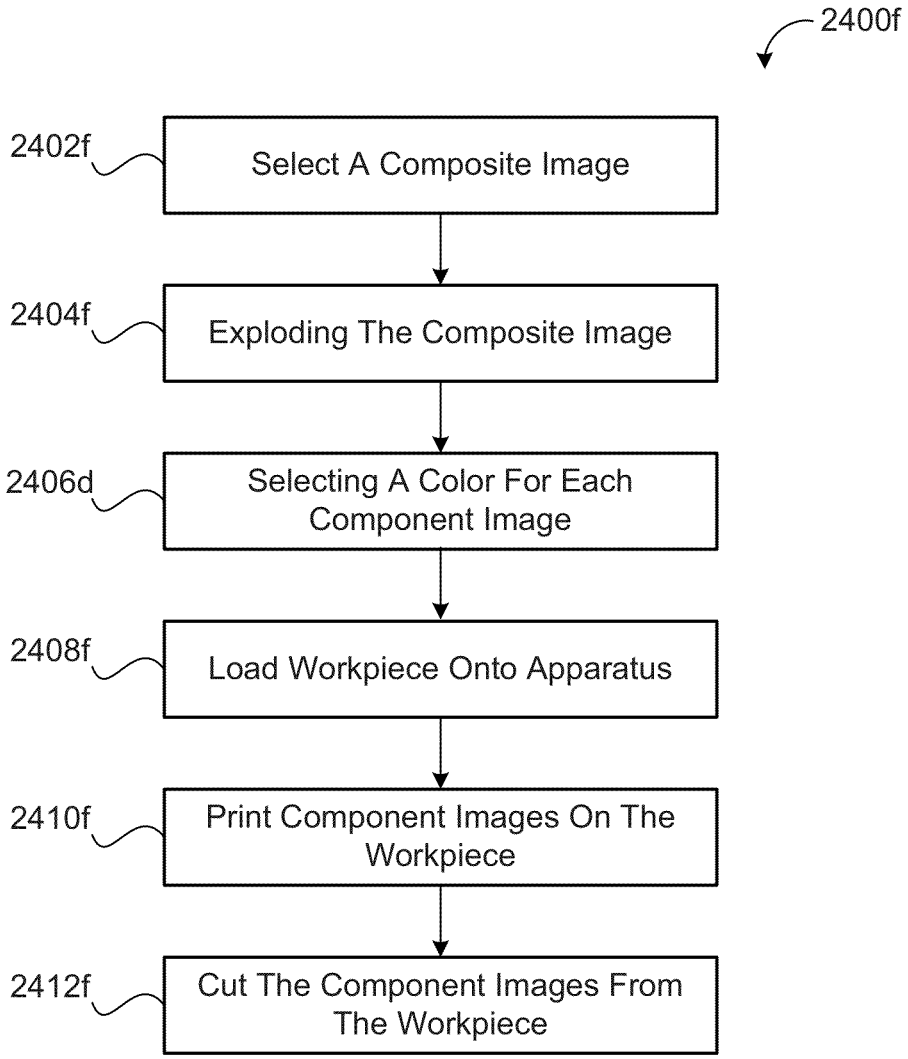
FIG. 24F provides a schematic view of an exemplary arrangement of operations for operating the crafting apparatus to perform an exploded-layered print and/or cut operation.

For digitally layered art, each layer can be printed and/or cut separately and then arranged together or in a collage. FIG. 24F provides an exemplary arrangement 2400*f* of operations for operating the crafting apparatus 10 to perform an exploded-layered print and/or cut operation on a glyph 1830 or design object 1850. The operations include selecting 2402*f* a composite image 1860 (e.g., digitally layered art), exploding 2404*f* the composite image 1860 into its component images 1862, selecting 2406*f* a color for each component image 1862, loading 2408*f* a workpiece W on the crafting apparatus 10, printing 2410*f* the component images 1862 on the workpiece W, and cutting 2412*f* the printed component images 1862 out of the workpiece W.

In some implementations, the operations may include one or more of the following: printing paper, photo cropping, printing only, cutting only, and printing and cutting. Each of these operations may include one or more of the following sub-operations: outline printing, flood filling, outline printing and flood filling, and default style printing. In some examples, each of these sub-operations can include layered and/or unlayered design objects and/or digitally layered design objects, such as exploded or composite images. The printing paper operation can be used to print a stock sheet of white paper a certain color or with a certain background pattern. The print only operation can be used to print a glyph on a sheet of paper. Although programmatically the printing paper and printing only operations may be executed differently, they both use just the printing system without cutting the workpiece (the paper).

Referring to FIGS. 25A-25G, in some implementations, a crafting apparatus 2500 includes a body 2510 having front and rear openings 2512, 2514 with a passageway therebetween 2516. A front cover 2520 pivotally attached to the body 2510 moves between a closed position that covers the front opening 2512 and an open position that allows passage of a workpiece W into the front opening 2512 and the passageway 2516. Similarly, a rear cover 2530 pivotally attached to the body 2510 moves between a closed position that at least partially covers the rear opening 2514 and an open position. In some examples, the rear cover 2530 allows passage of a workpiece W out of the passageway 2516 and out of the rear opening 2516 (at least partially, but not necessarily fully covered) while in its closed position. The crafting apparatus 2500 may include a pull-out shelf 2540 slidably attached to the body 2510 adjacent the front opening 2512 for supporting the workpiece W as it is received into the crafting apparatus 2500.

Figure 25A:
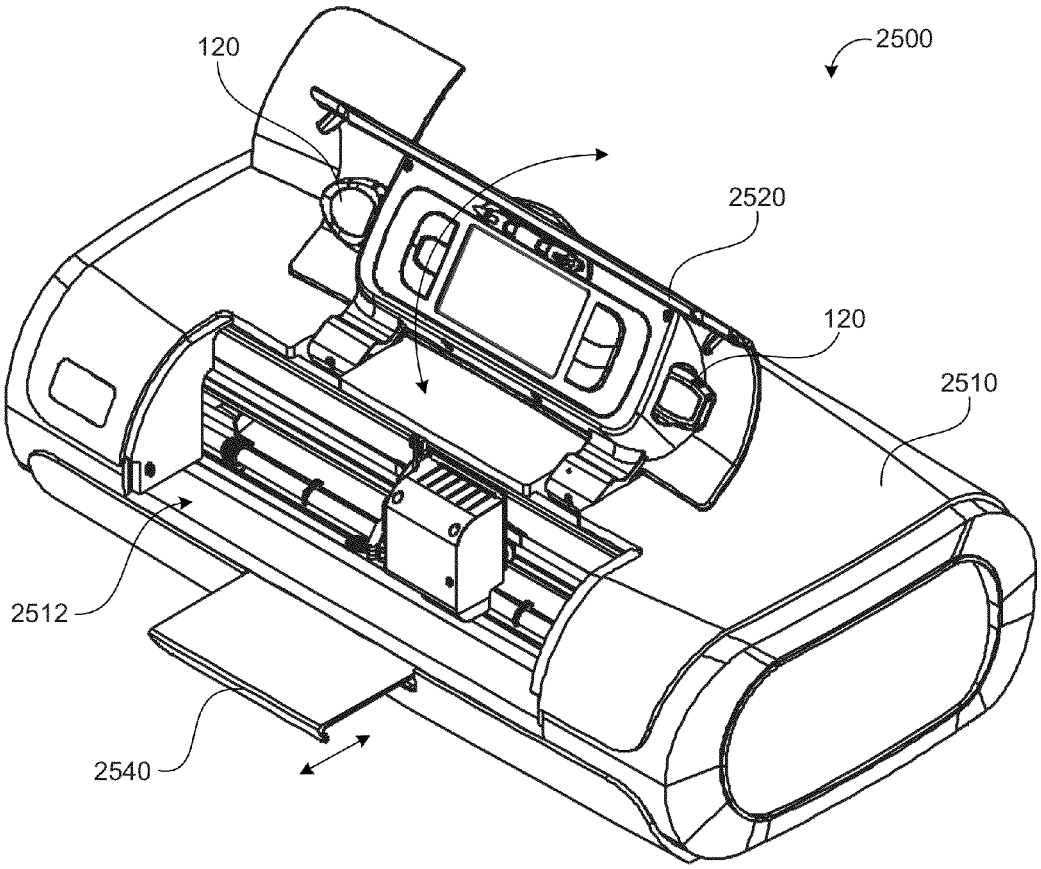
FIG. 25A is a front perspective view of an exemplary crafting apparatus.
Figure 25B:
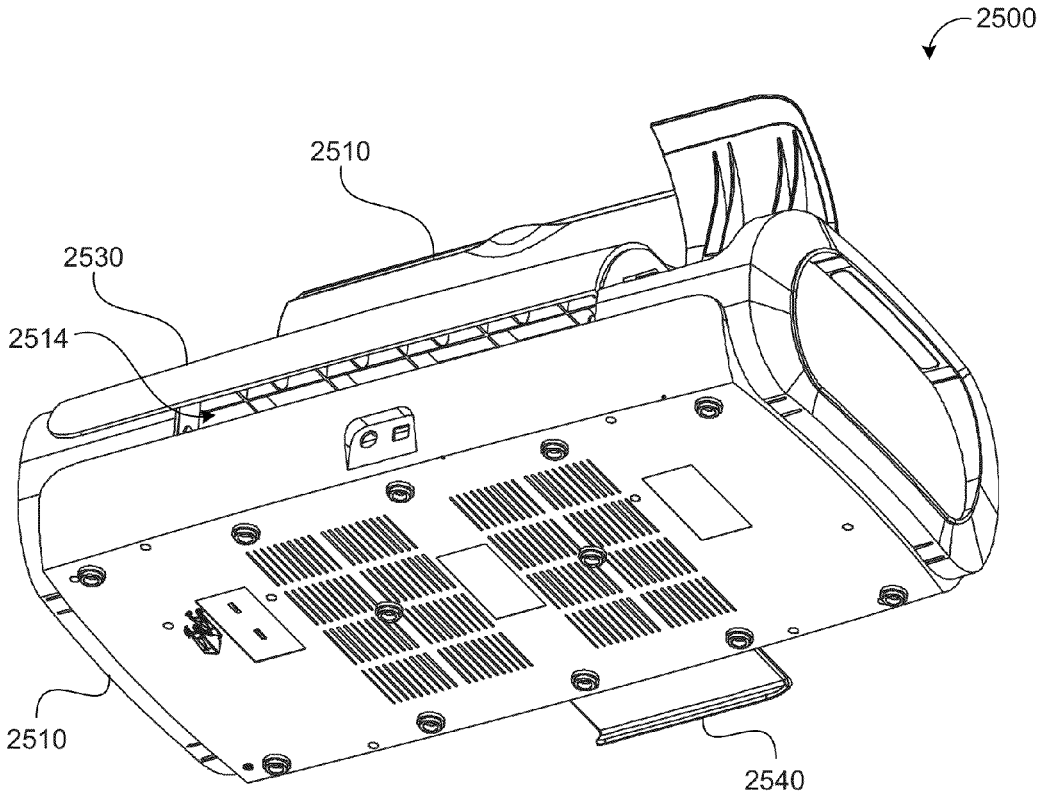
FIG. 25B is a rear perspective view of the crafting apparatus shown in FIG. 25A.
Figure 25C:
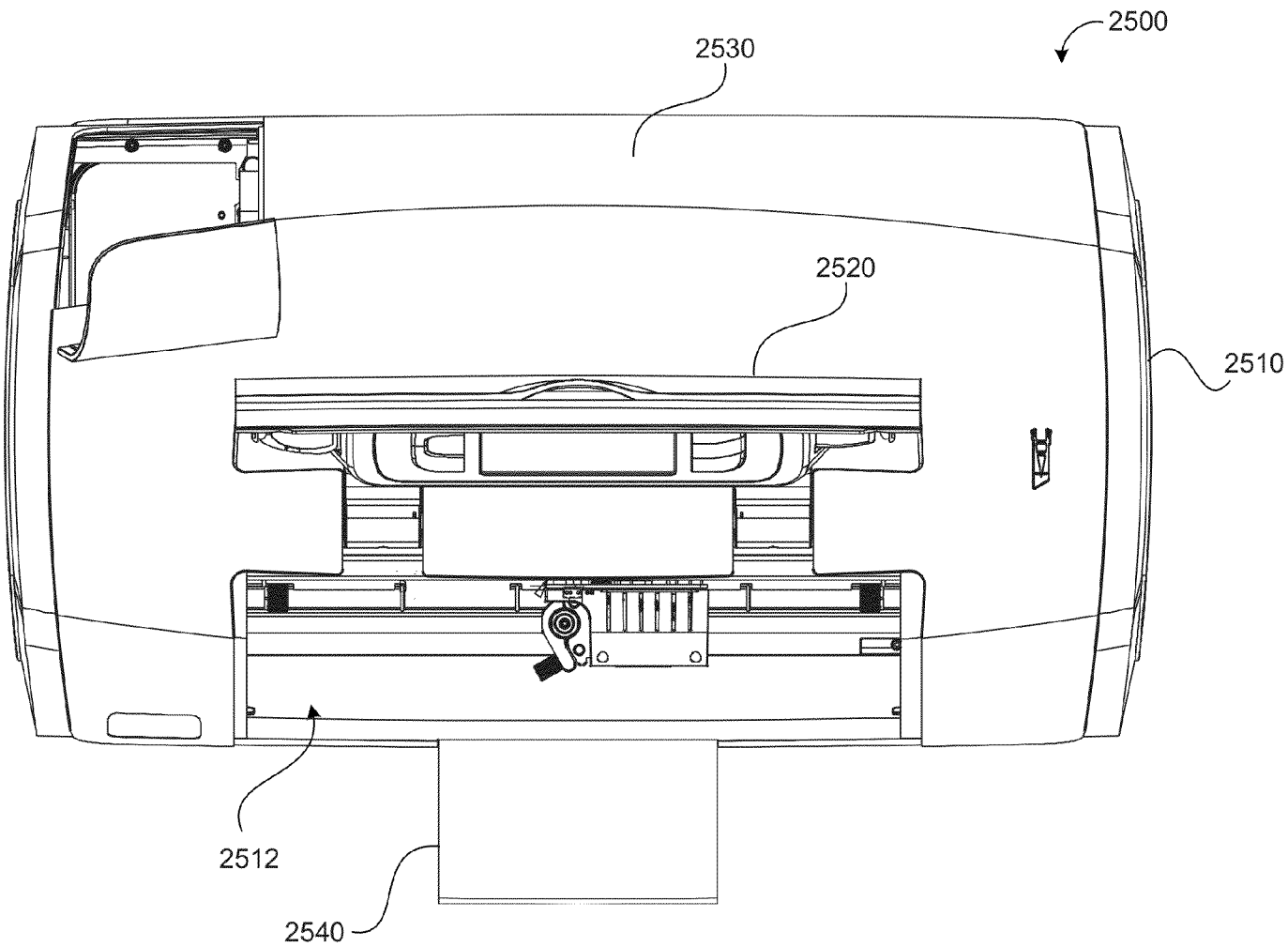
FIG. 25C is a top view of the crafting apparatus shown in FIG. 25A.
Figure 25D:
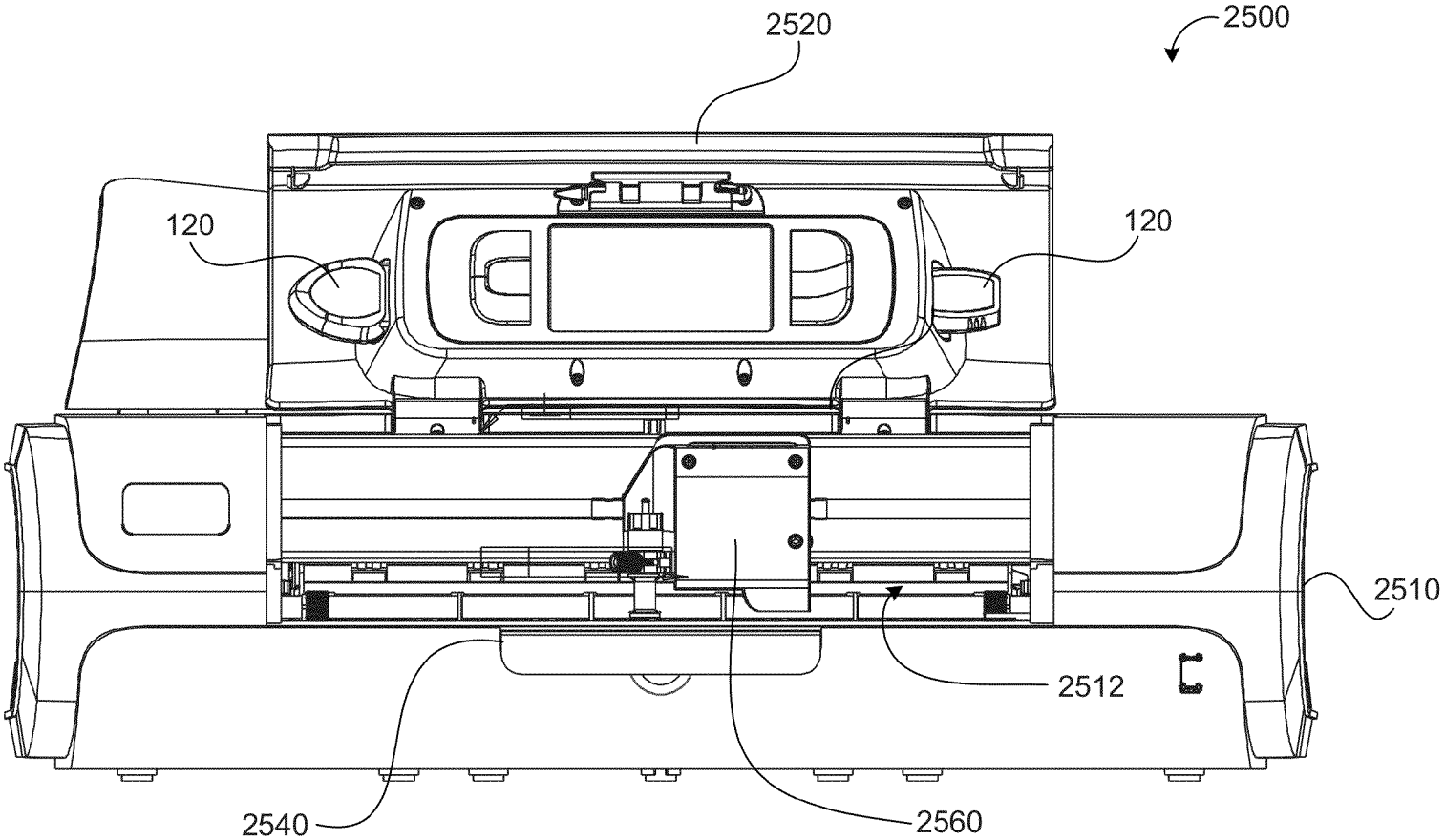
FIG. 25D is a front view of the crafting apparatus shown in FIG. 25A.
Figure 25E:
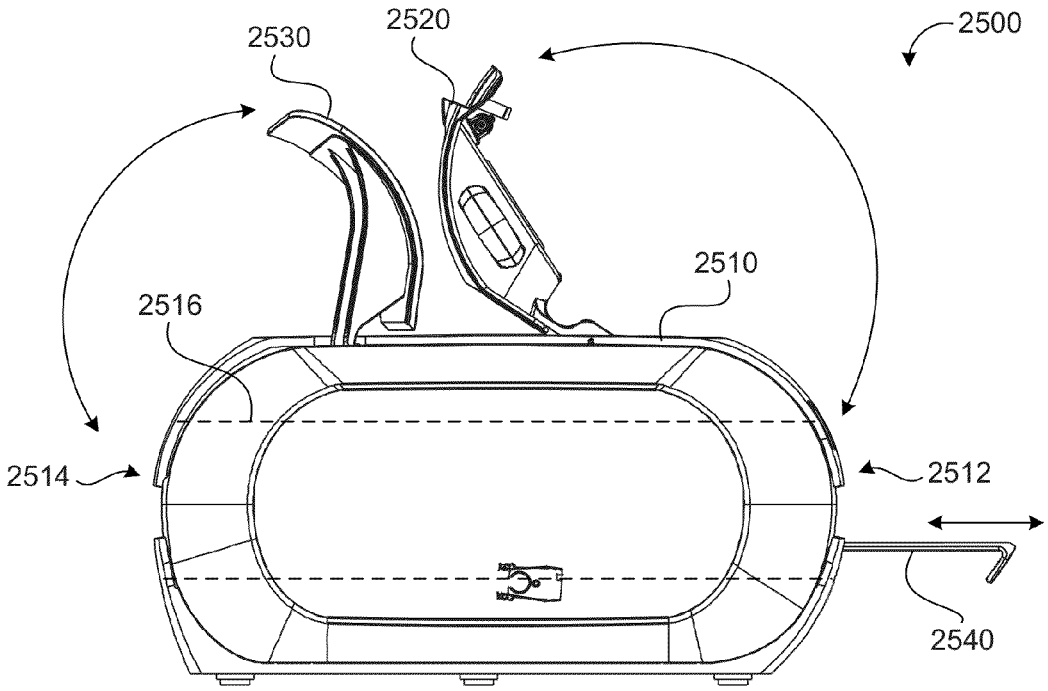
FIGS. 25E and 25F are side views of the crafting apparatus shown in FIG. 25A.
Figure 25F:
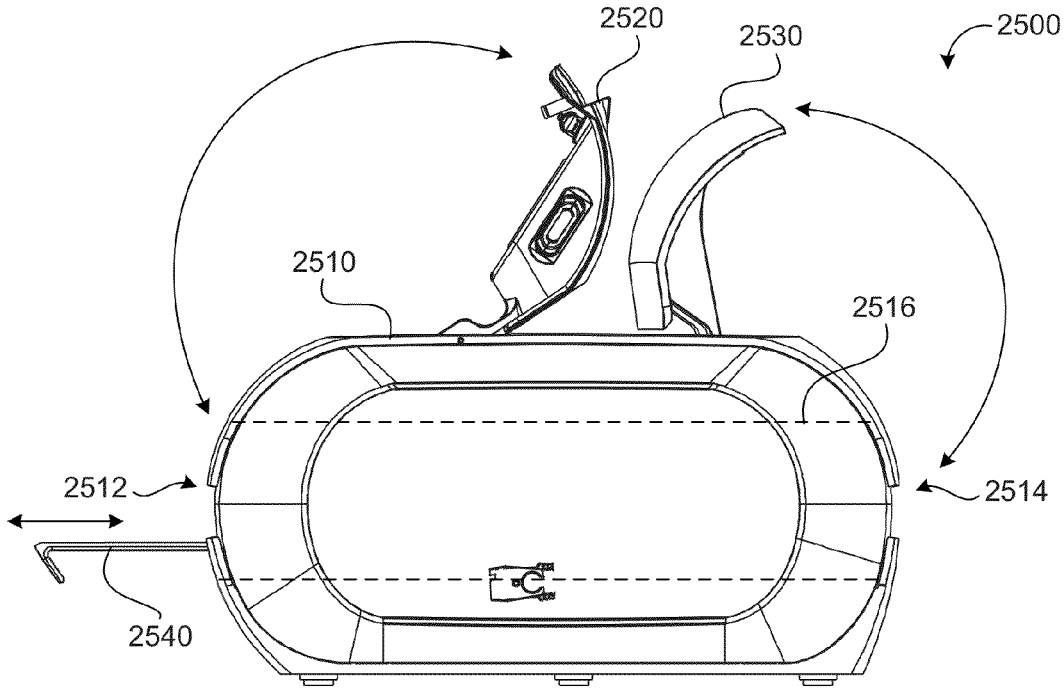
Figure 25G:
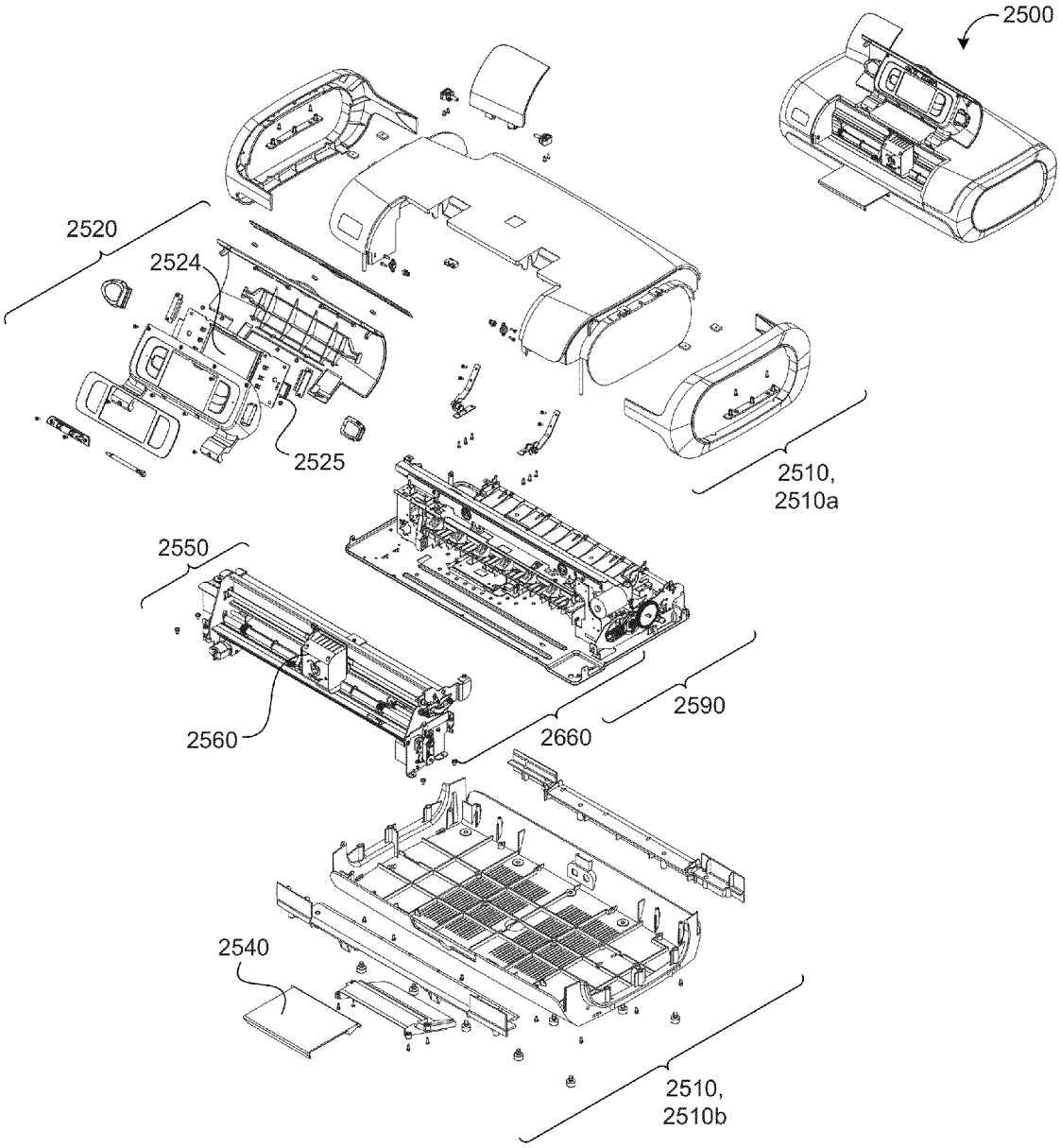
FIG. 25G is an exploded view of an exemplary crafting apparatus.
Figure 25H:
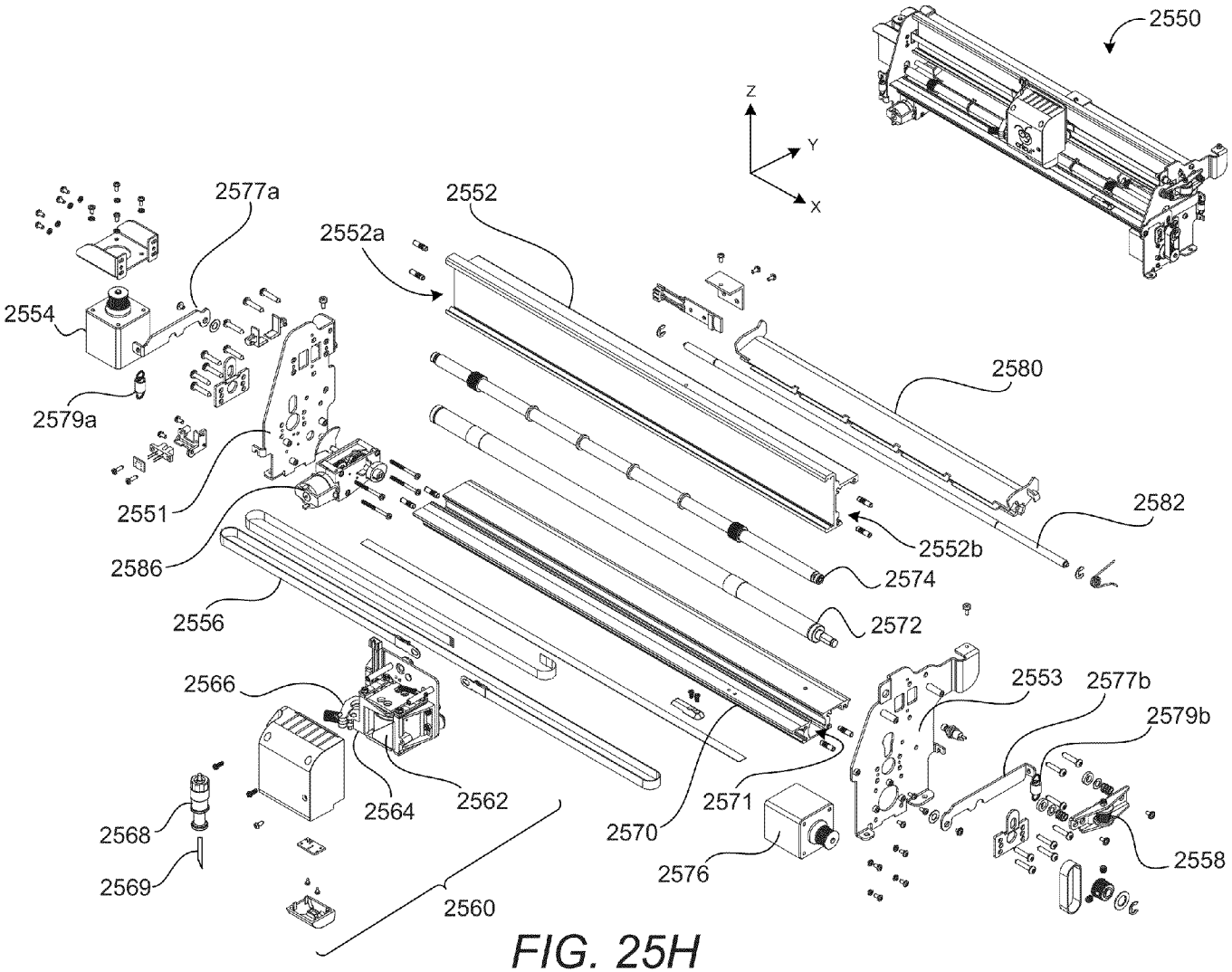
FIG. 25H is an exploded view of an exemplary cutter assembly for a crafting apparatus.
Figure 25I:
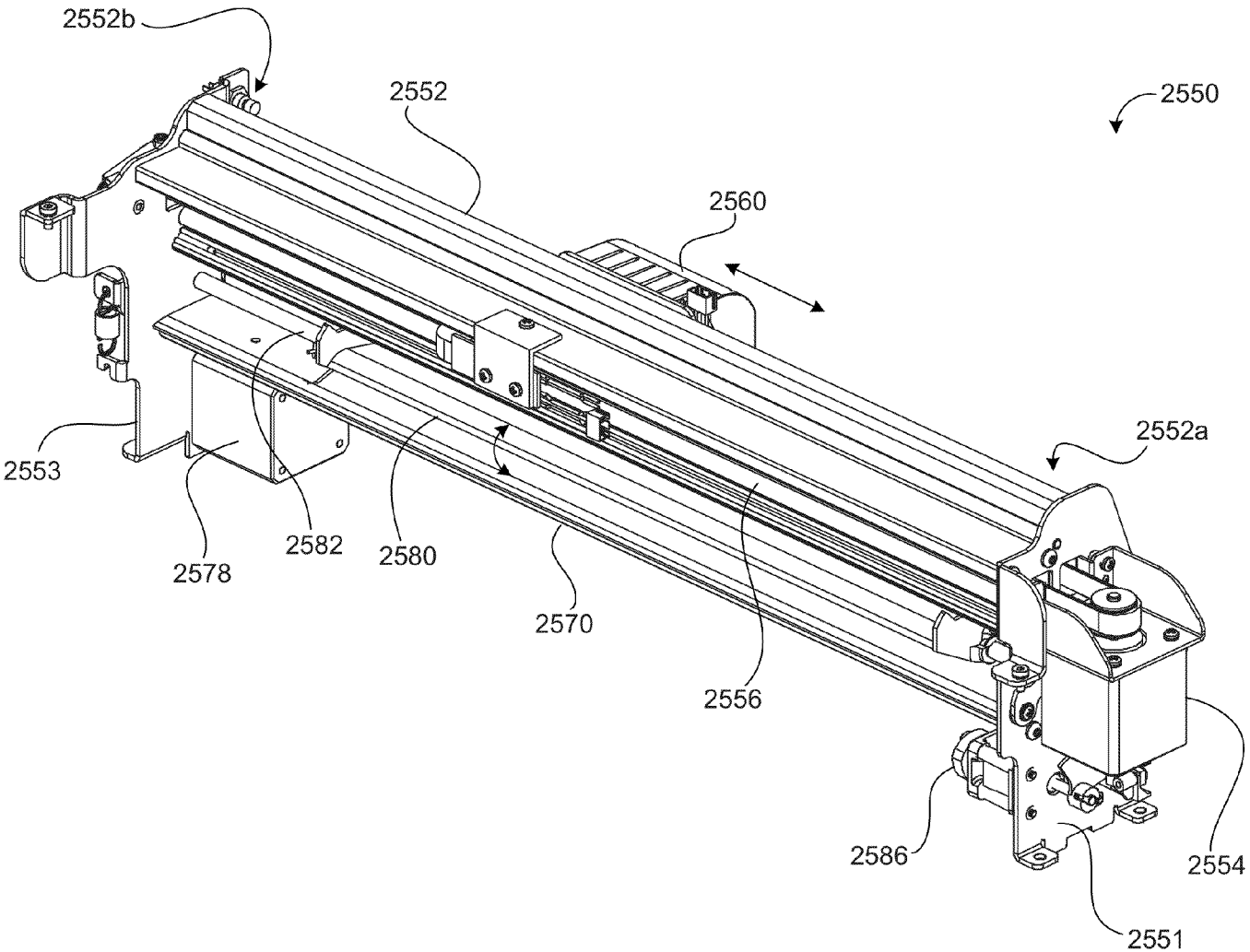
FIG. 25I is a rear perspective view of an exemplary cutter assembly for a crafting apparatus.

Referring to FIG. 25G, the crafting apparatus 2500 includes a cutter assembly 2550 and a printer assembly 2590 each disposed in the body 2510 along the passageway 2516 and in communication with a controller 2525. The body 2510 may have upper and lower portions 2510*a*, 2510*b* connected together to support the cutter and printer assemblies 2550, 2590. In the example shown, the controller 2525 is disposed on the front cover 2520, but may be located elsewhere on or external to the crafting apparatus 2500.

Referring to FIGS. 25G-25M, the cutter assembly 2550 includes an X-guide 2552 having first and second ends 2552*a*, 2552*b* and a cutter head 2560 slidably disposed on the X-guide 2552. The X-guide 2552 guides movement of the cutter head 2560 in an X direction. An X-motor 2554 mounted near one of the guide ends 2552*a*, 2552*b* (at the first guide end 2552*a*, in the example shown) drives a motion translator 2556 (e.g., a belt, chain, cord, etc.) coupled to the cutter head 2560 and trained about an idler 2558 mounted near the opposite end 2552*a*, 2552*b* of the guide 2552 (at the second guide end 2552*b*, in the example shown). The driven motion translator 2556 moves the cutter head 2560 along the X-guide 2552.

The cutter assembly 2550 includes first and second rollers 2572, 2574 rotatably mounted opposite each other and forming a nip 2575 for receiving and selectively controlling movement of the workpiece W therebetween during cutting operations. First and second end plates 2551, 2553 attached to the respective first and second guide ends 2552*a*, 2552*b* may support end portions of the corresponding first and second rollers 2572, 2574. Moreover, the first end plate 2551 may support the X-motor 2554. The first roller 2572 may be received by a channel 2571 defined by a base 2570 disposed between the first and second end plates 1551, 1553 for supporting the received workpiece W. A Y-motor 2576 coupled to the first roller 2574 (e.g., via a belt or chain) and supported by the second end plate 2553 drives the first roller 2572 in a first rotational direction. The second roller 2574 rotates in a second rotational direction opposite to the first rotation direction as the workpiece W moves through the nip 2575 in a Y direction, orthogonal to the X and Z directions. In some examples, the second roller 2574 can move in the Z-direction with respect the first roller 2572 to provide a variable gap height in the nip 2575. In the example shown, first and second ends 2574*a*, 2574*b* of the second roller 2574 are biased toward the first roller 2572 by respective first and second levers 2577*a*, 2577*b*, each attached to respective springs 2579*a*, 2579*b*. Each lever 2577*a*, 2577*b* pivots about one end and receives a biasing force at an opposite end from the attached respective spring 2579*a*, 2579*b*.

Referring to FIGS. 25N-25R, the cutter head 2560 includes a cutter carriage 2561 (e.g., plate(s)), a Z-mover 2562 (e.g., solenoid, actuator, etc.) disposed on the cutter carriage 2561, and a cutter arm 2564 disposed on the Z-mover 2562. The Z-mover 2562 moves the cutter arm 2564 in the Z direction and optionally the X and/or Y directions. In the example shown, the cutter arm 2564 includes a wedged shaped head 2655 that engages a surface of the cutter carriage 2561. As the Z-mover 2562 moves the cutter arm 2564 in the Z-direction, the wedged shaped head 2665 moves the cutter arm 2564 in the X direction. The cutter arm 2564 may include a clamp or fastener 2566 for releasably holding a cutter holder 2568, which can releasably retain a cutter 2569 (e.g., a knife) via a magnet, set screw, clamp, etc., for example. In some implementations, the cutter arm 2564 moves between an engaged position, placing the cutter 2569 in contact with a workpiece W, and a disengaged position, moving the cutter 2569 away from the workpiece W and/or any paths of movement of the workpiece W through the crafting apparatus 2500. The cutter head 2560 may include wheels 2563 rotatably attached to the cutter carriage 2561 for rolling along the X-guide 2552. In the example shown, the cutter head 2560 includes three wheels 2563, one of which is biased for releasable engagement against the X-guide 2552.

Referring to FIGS. 25S-25V, in some implementations, the printer assembly 2590 is supported by a base 2690 (e.g., a plate), which also supports the cutter assembly 2560. The common base 2690 between the two assemblies 2560, 2590 allows for a common feed path FP between the two assemblies 2560, 2590. The printer assembly 2590 includes an X-guide 2592 (e.g., a channel and/or shaft) having first and second ends 2592*a*, 252*b* and a printer head 2650 slidably disposed on the X-guide 2592. The X-guide 2592 guides movement of the printer head 2650 in an X direction. An X-motor 2594 mounted near one of the guide ends 2592*a*, 2592*b* (at the second guide end 2592*b*, in the example shown) may drive a motion translator (e.g., a belt, chain, cord, etc.) coupled to the printer head 2595 and trained about an idler (e.g., pulley, gear, etc.) mounted near the opposite end 2592*a*, 2592*b* of the X-guide 2592 (at the first guide end 2592*a*, in the example shown). The driven motion translator moves the printer head 2650 along the X-guide 2592. A workpiece supporter 2591 (e.g., a plate) having first and second ends 2591*a*, 2591*b* can be disposed below the X-guide 2592 for supporting a workpiece W moving through the printer assembly 2590. The workpiece supporter 2591 may include first and second guides 2593*a*, 2593*b* disposed at or near the respective first and second ends 2591*a*, 2591*b* of the workpiece supporter 2591 for guiding the received workpiece W.

The printer assembly 2590 includes first and second pinch rollers 2596, 2598 rotatably mounted opposite each other and forming a nip 2597 for receiving and selectively controlling movement of the workpiece W therebetween during printing operations. The rolling surface of the first pinch roller 2596 may be treated with a non-stick coating, such as Polytetrafluoroethylene (e.g., to prevent accumulation of debris thereon). In the example shown, the first pinch roller 2596 is rotatably disposed on a pivoting carrier arm 2599. The pivoting carrier arm 2599 may extend substantially the length of the X-guide 2592 and support multiple first rollers 2596. The carrier arm 2599 is arranged for pivoting the first pinch roller 2596 away from the second pinch roller 2598 to allow for various thicknesses of the workpiece W to pass through the nip 2597. A Y-motor 2595 coupled to the first pinch roller 2596 (e.g., via a belt, chain, gear, etc.) drives the first pinch roller 2596 in a first rotational direction. The second pinch roller 2598 rotates in a second rotational direction opposite to the first rotation direction as the workpiece W moves through the nip 2597 in a Y direction, orthogonal to the X and Z directions.

Referring to FIGS. 25G-25L and 25S-25V, in some implementations, the crafting apparatus 2500 includes a feed path bypass assembly 2660 disposed along the passageway 2516 between the cutter assembly 2550 and the printer assembly 2590. The feed path bypass assembly 2660 alters a feed path FP of the workpiece W through the passageway 2516. In some implementations, the feed path bypass assembly 2660 moves between a first position for printing operations and a second position for cutting operations. The first position directs movement of the workpiece W along a first feed path $FP_1$ (FIG. 25V) that bypasses the first pair of rollers 2572, 2574 (of the cutter assembly 2550), and the second position directs movement of the workpiece W along a second feed path $FP_2$ between the first pair of rollers 2572, 2574. The feed path bypass assembly 2660 may allow the workpiece W to move along the first feed path $FP_1$ in a first direction X and along the second feed path $FP_2$ in a second direction X' substantially opposite to the first direction X. In some examples, the second pair of rollers 2596, 2598 (of the printer assembly 2590) move between an engaged position for engaging and moving the workpiece W therebetween during printing operations and a disengaged position for allowing free movement of the workpiece W therebetween during cutting operations. Movement of the feed path bypass assembly 2660 to its first position may cause movement of the second pair of rollers 2596, 2598 to its engaged position, and movement of the feed path bypass assembly 2660 to its second position may cause movement of the second pair of rollers 2596, 2598 to its disengaged position.

The feed path bypass assembly 2660 includes a passage guide 2580 disposed on the cutter assembly 2550 for guiding the workpiece W (e.g., a mat supporting a piece of paper) received between the first and second rollers 2572, 2574 of the cutter assembly 2550 and into the printer assembly 2590 or through the passageway 2516. The passage guide 2580 may be rotatably supported on a shaft 2582 coupled at opposite ends to the respective first and second end plates 2551, 2553. The passage guide 2580 may rotate between a cutting position and a printing or bypass position. In the cutting position, the passage guide 2580 guides the work piece W from the cutting assembly 2550 (e.g., from the first and second rollers 2572, 2574) and into the printer assembly 2590, which can be disengaged for a cutting operation. In the printing position, the passage guide 2580 guides the work piece W from the printer assembly 2590 into the cutting assembly 2550 along a path that bypasses the nip 2575 of the first and second rollers 2572, 2574. For example, the passage guide 2580 may guide or direct the work piece W along a path of movement that does not go through the nip 2575 of the first and second rollers 2572, 2574, but rather around (e.g., above or below) the first and second rollers 2572, 2574.

The feed path bypass assembly 2660 may also include a toggle member 2670 pivotally disposed along the passageway 2516 downstream of the cutter head 2560 and upstream of the printer head 2650. The toggle member 2670 pivots between a first position and a second position. Movement of the toggle member 2670 to its first position allows movement of the carrier arm 2599 to its first position allowing selective engagement of the first roller(s) 2596 of the printer assembly 2590 against the second roller(s) 2598 of the printer assembly 2590. Moreover, movement of the toggle member 2670 to its second position allows movement of the carrier arm 2599 to its second position disengaging contact between the first and second rollers 2596, 2598 of the printer assembly 2590 (e.g., be increasing the height of the nip 2597 to a size that allows free or unimpeded movement of the workpiece W therebetween).

In some implementations, cutter assembly 2550 includes a cam 2584 actuated by a cam motor 2586, which can be mounted on the first end plate 2551. The actuated cam 2584 moves one or more of the pinch rollers 2596, 2598 of the printer assembly 2590 between an engaged position for moving the workpiece into the printer assembly 2590 and a disengaged position for allowing the workpiece W to move freely in the printer assembly 2590 during a cutting operation. In the example shown the cam motor 2586 includes a flag 2587 and a pass-through sensor 2588 (e.g., optical break beam switch) for controlling an amount of cam movement by the cam motor 2586. In some examples, the cam 2584 may engage the toggle member 2670 and/or the carrier arm 2599, which separately or together move one or more of the pinch rollers 2596, 2598 of the printer assembly 2590 between their engaged and disengaged positions.

Referring again to FIGS. 25S-25U, the printer assembly 2590 may include an exit ramp 2680 for supporting and guiding the workpiece W along the feed path FP. The exit ramp 2680 may define an arcuate shape transverse to the feed path FP of the workpiece W to induce curvature in the workpiece W (e.g., cupping of the workpiece W). In the example shown, the exit ramp 2680 includes multiple ribs 2682 of varying height spaced along the exit ramp 2680 (e.g., in a concave or convex profile) for inducing a curvature in the workpiece W about a direction of movement of the workpiece W. The exit ramp 2680 also includes first and second edge holders 2684*a*, 2684*b* disposed at respective first and second ends 2680*a*, 2680*b* of the exit ramp for holding or guiding lateral edges of the workpiece W substantially against the exit ramp 2680 (at least under the edge holders 2684*a*, 2684*b*), so as to aid inducement of the curvature in the workpiece W. Moreover, the edge holders 2684*a*, 2684*b* maintain the workpiece W substantially flat upstream of the ribs 2682. The edge holders 2684*a*, 2684*b* may engage lateral edge portions $W_E$ of the workpiece W. In some examples, the ribs 2682 deflect the workpiece W upward at an angle with respect to the feed path FP under the printer head 2650 and the edge holders 2684*a*, 2684*b* maintains the workpiece W parallel to the portion of the feed path FP under the printer head 2650 at location downstream of the printer head 2650.

Figure 25J:
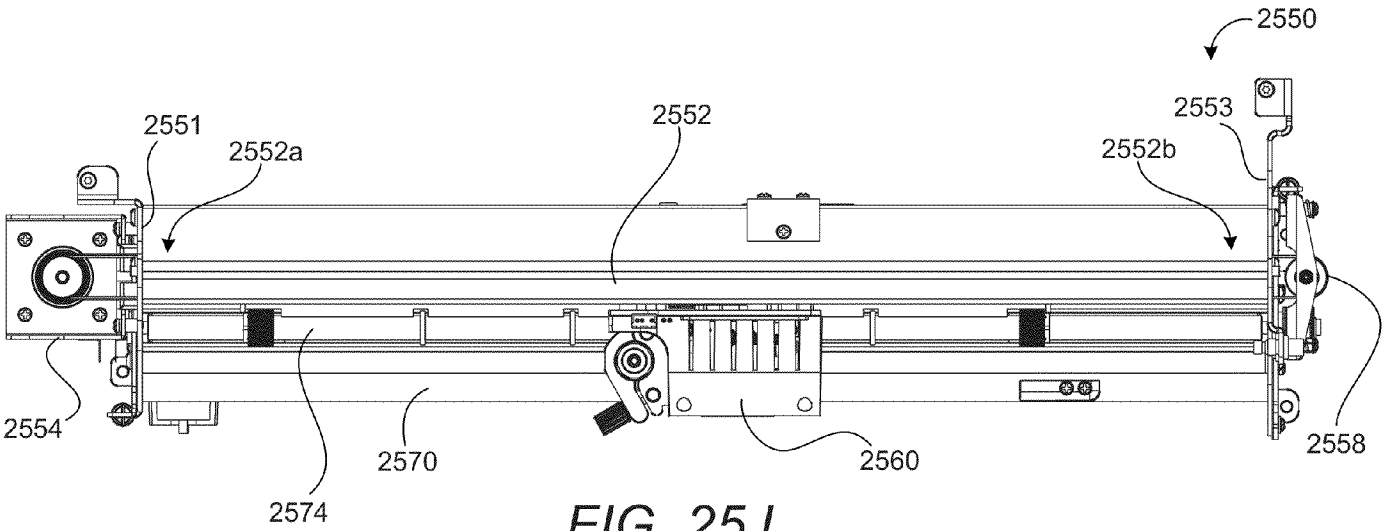
FIG. 25JK is a top view of the cutter assembly shown in FIG. 25I.
Figure 25K:
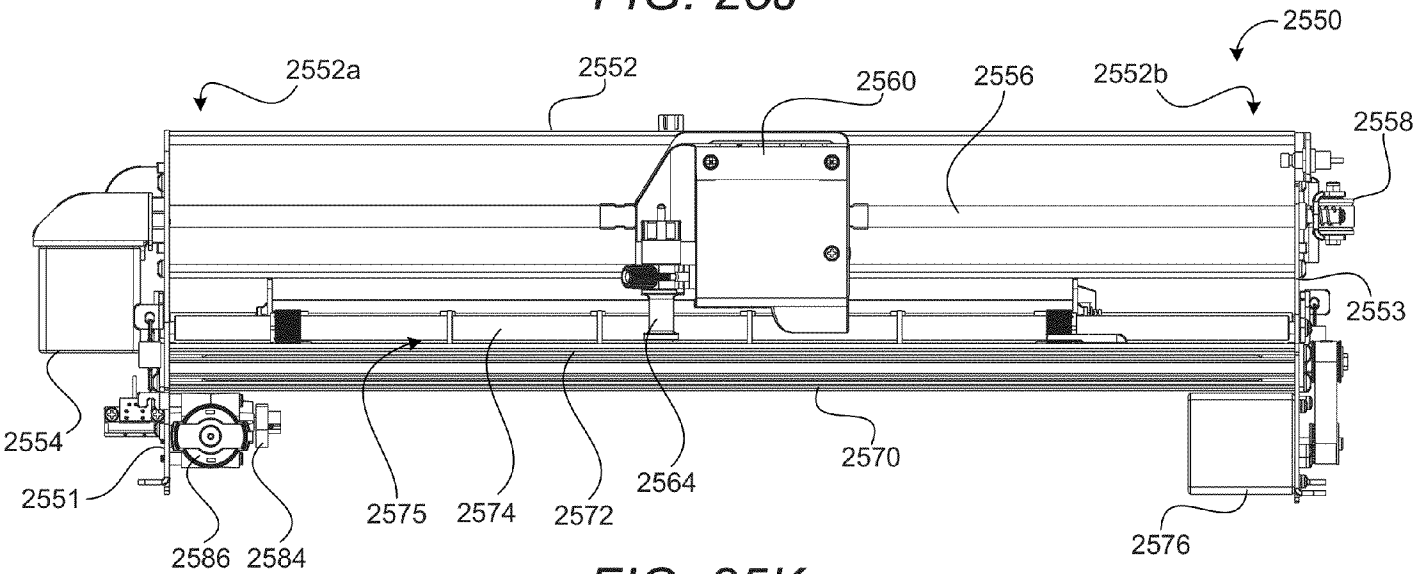
FIG. 25K is a front view of the cutter assembly shown in FIG. 25I.
Figure 25L:
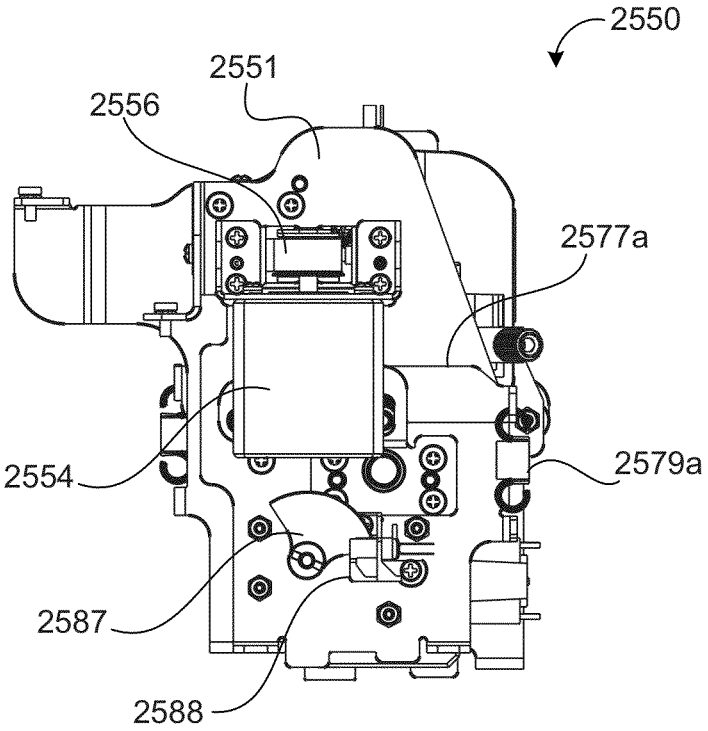
FIGS. 25L and 25M are side views of the cutter assembly shown in FIG. 25I.
Figure 25M:
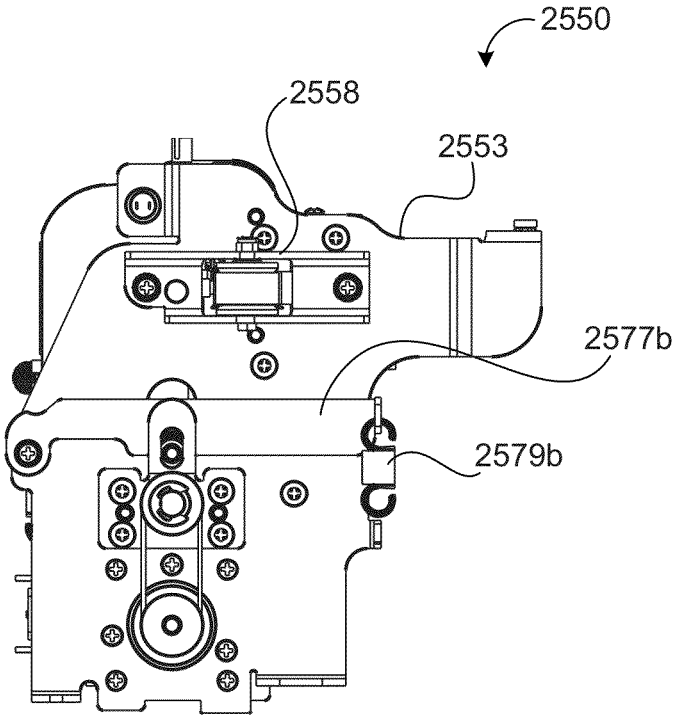
Figure 25N:
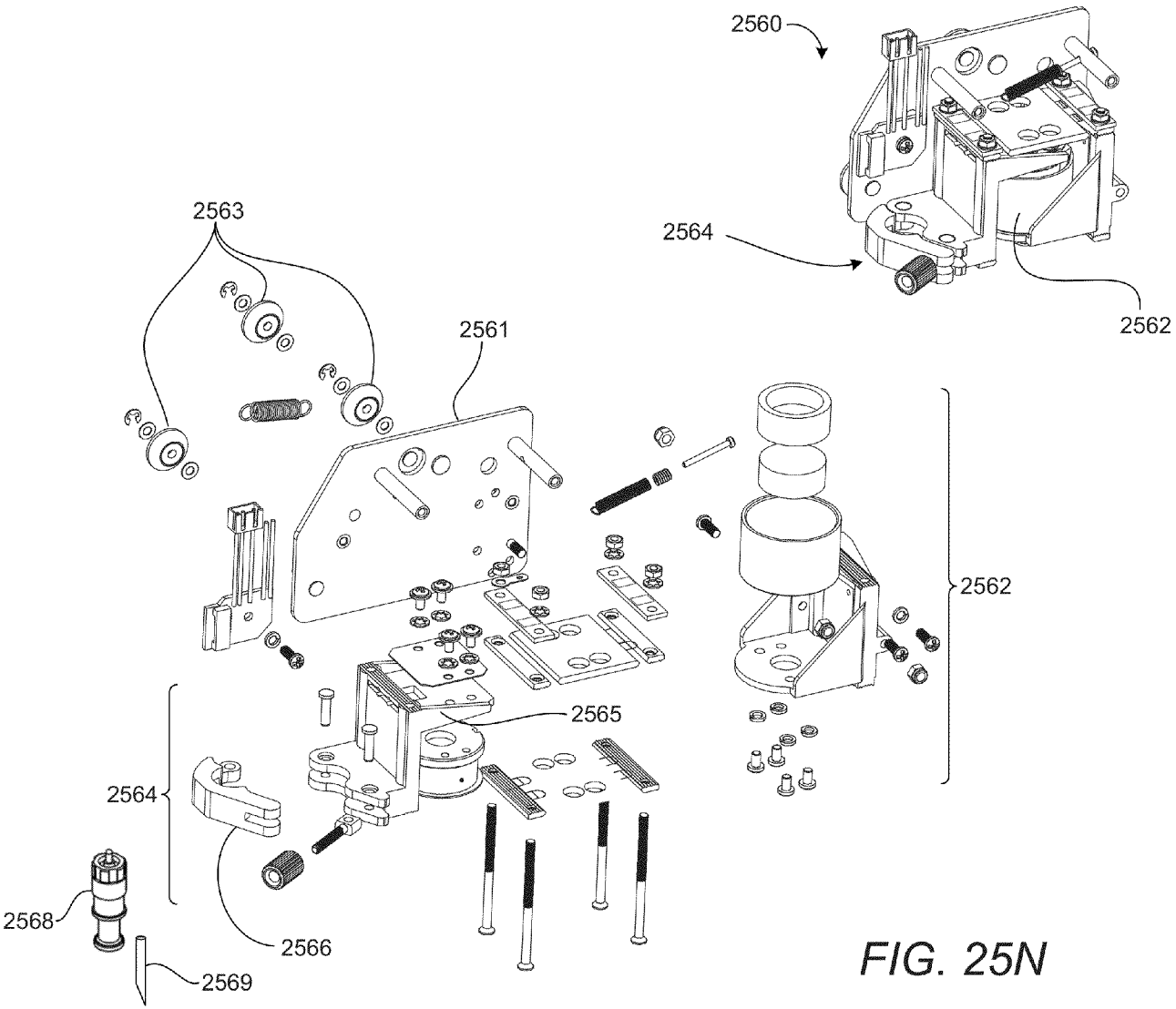
FIG. 25N is an exploded view of an exemplary cutter head for a crafting apparatus.
Figure 25O:
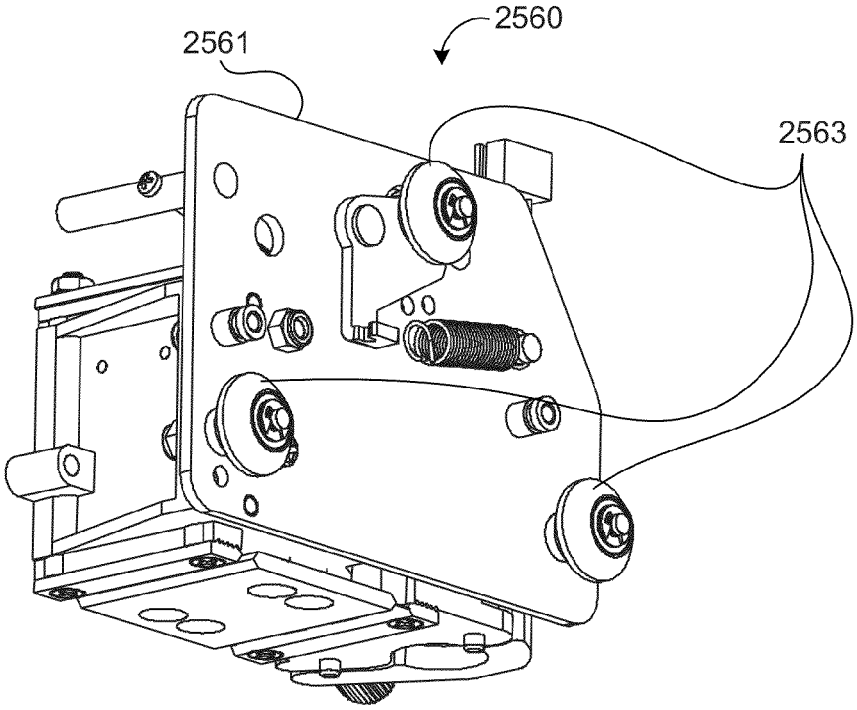
FIG. 25O is a rear perspective view of an exemplary cutter head for a crafting apparatus.
Figure 25P:
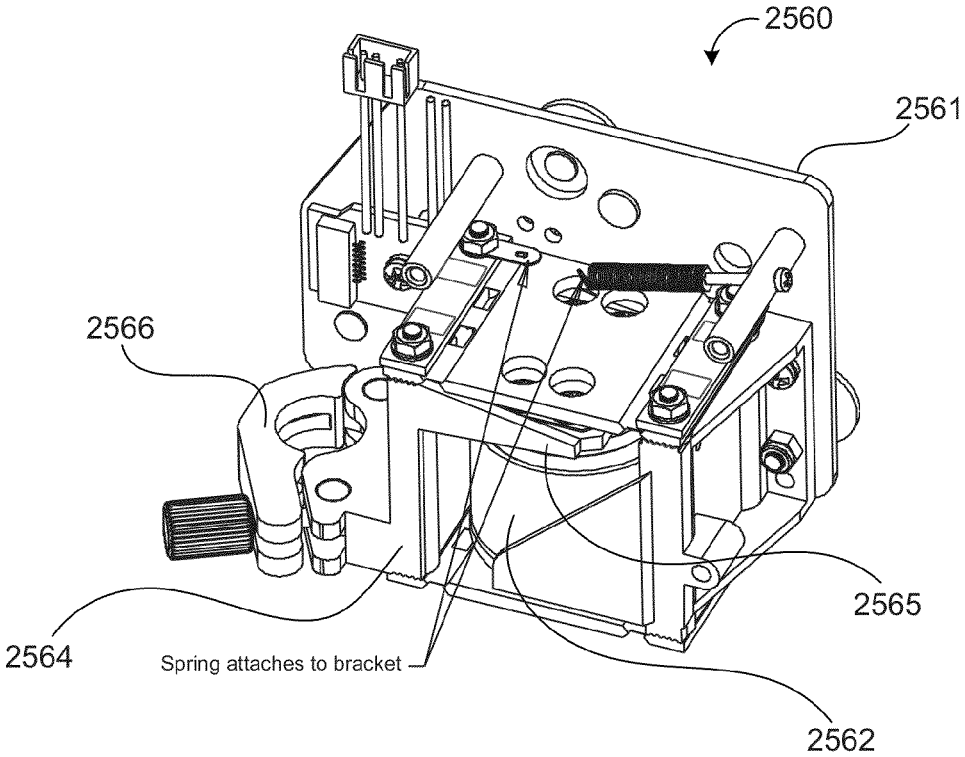
FIG. 25P is a front perspective view of the cutter head shown in FIG. 25O.
Figure 25Q:
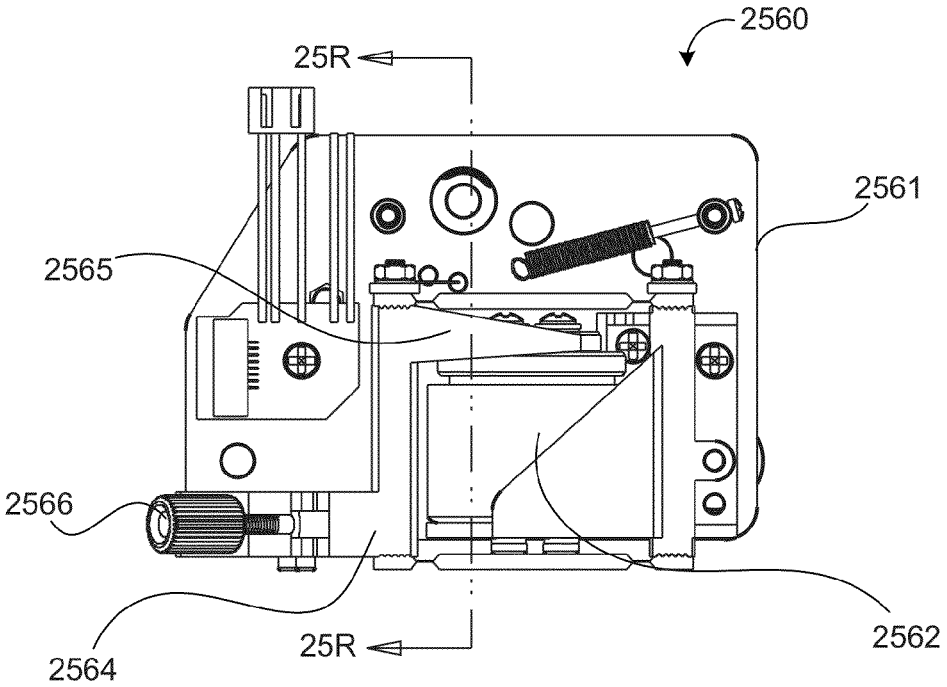
FIG. 25Q is a top view of the cutter head shown in FIG. 25O.
Figure 25R:
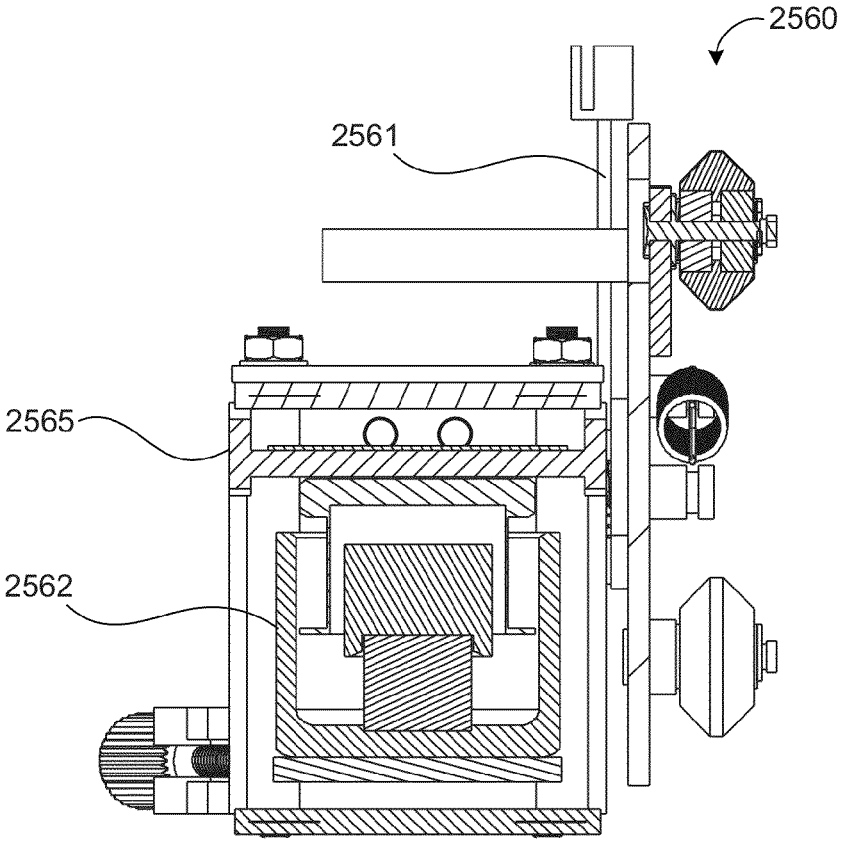
FIG. 25R is a section view of the cutter head shown in FIG. 25Q along line 25R-25R.
Figure 25S:
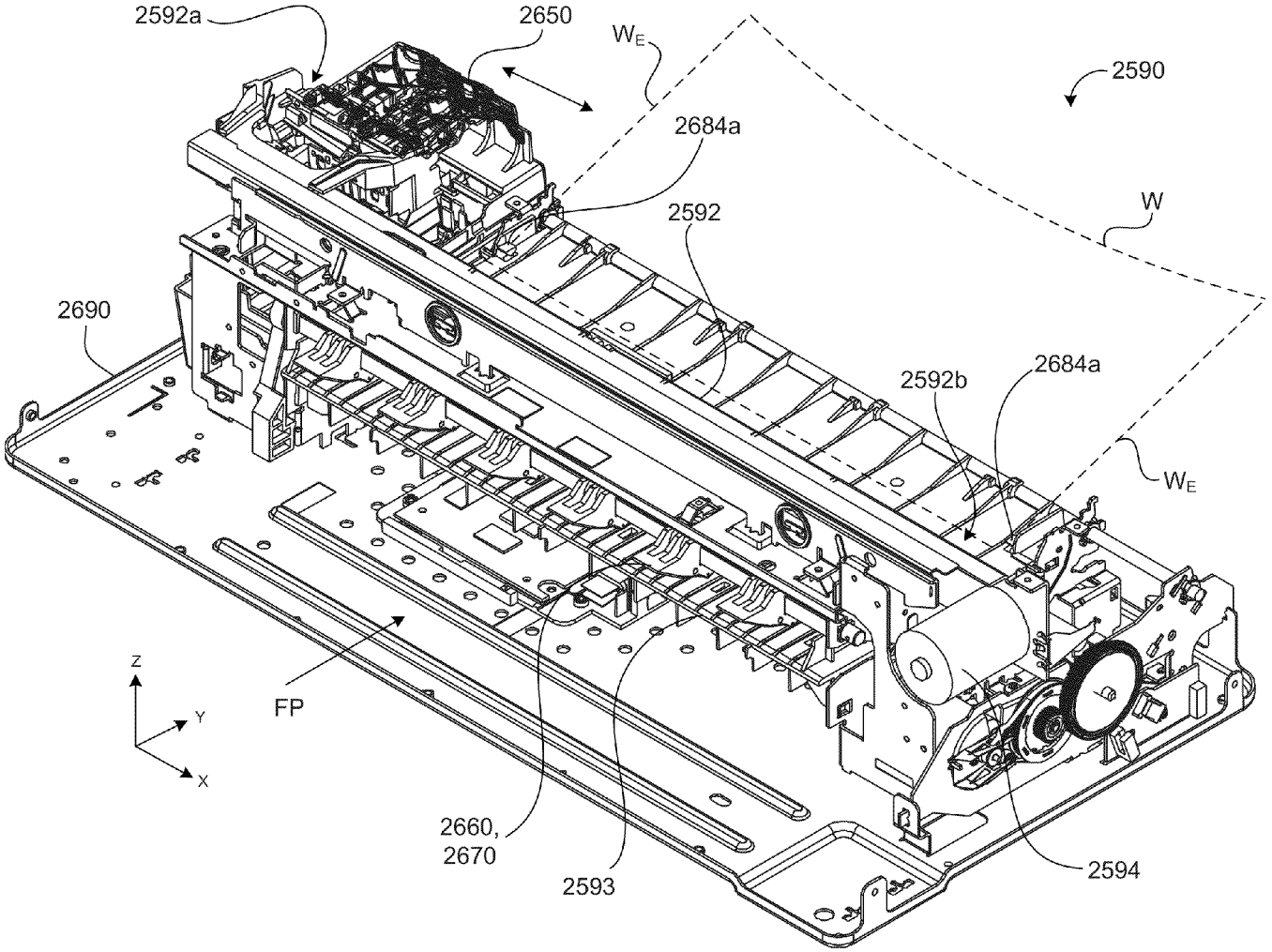
FIG. 25S is a front perspective view of an exemplary printer assembly for a crafting apparatus.
Figure 25T:
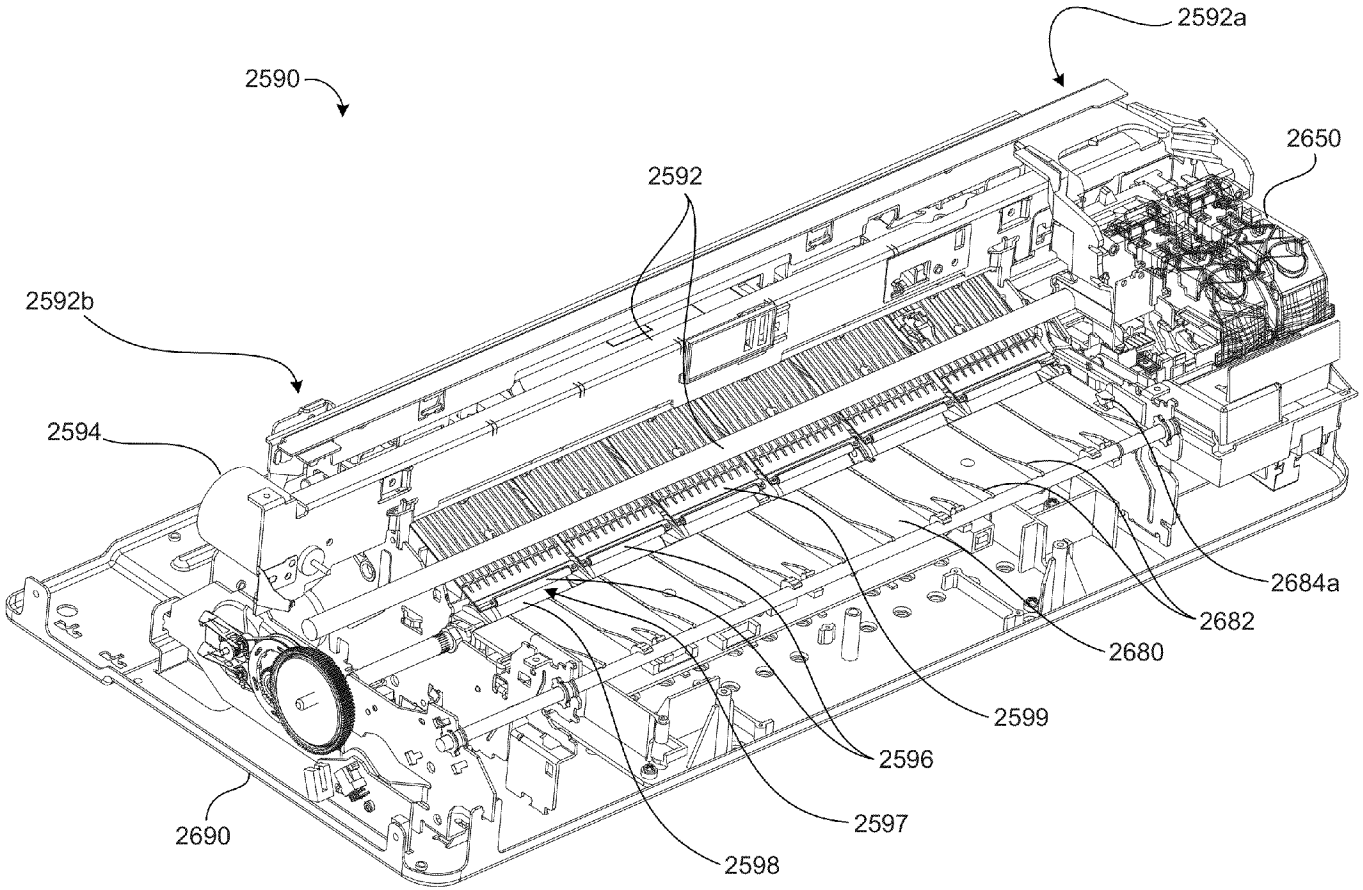
FIG. 25T is a rear perspective view of the printer assembly shown in FIG. 25S.
Figure 25U:
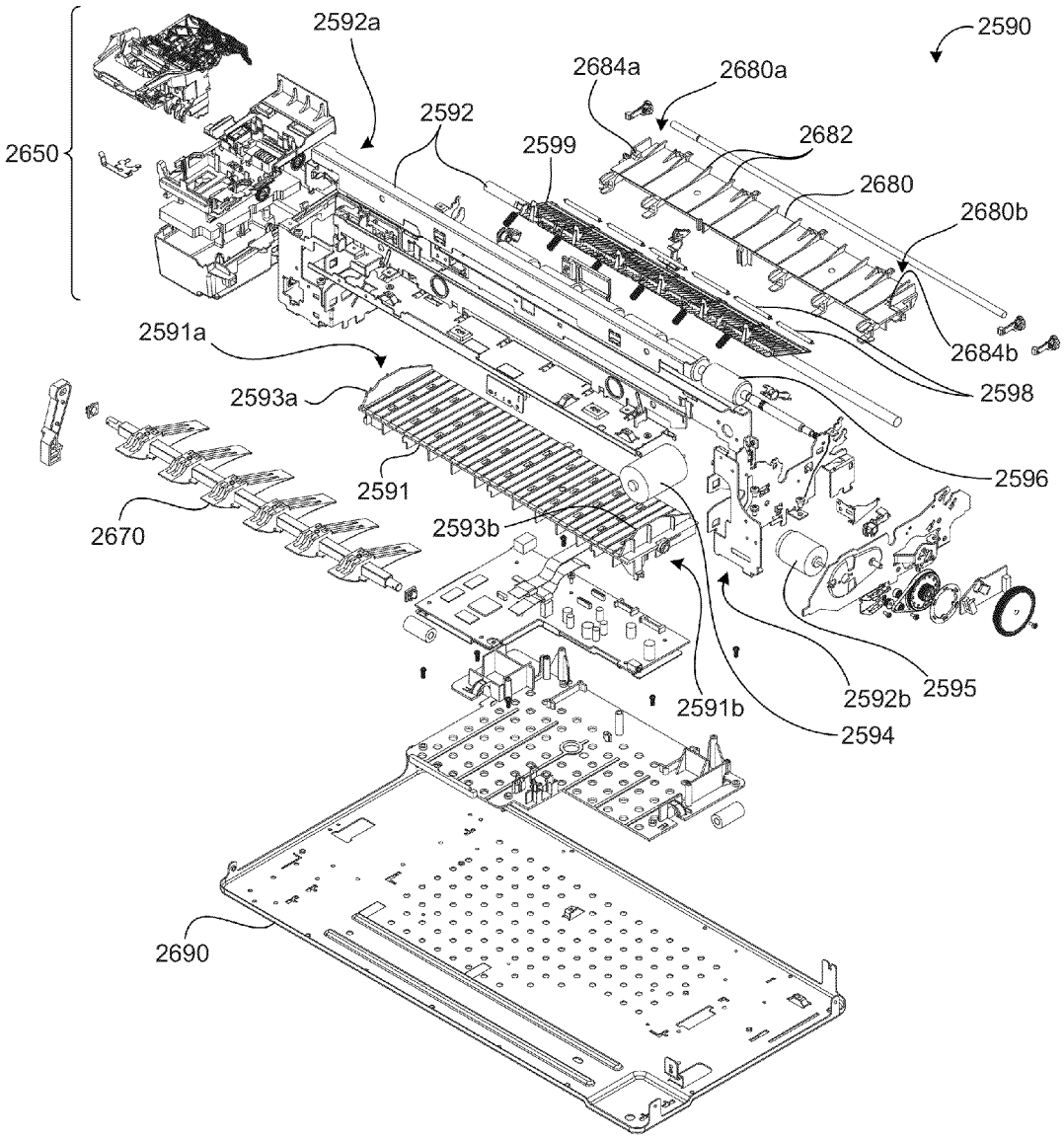
FIG. 25U is an exploded view of an exemplary printer assembly for a crafting apparatus.
Figure 25V:
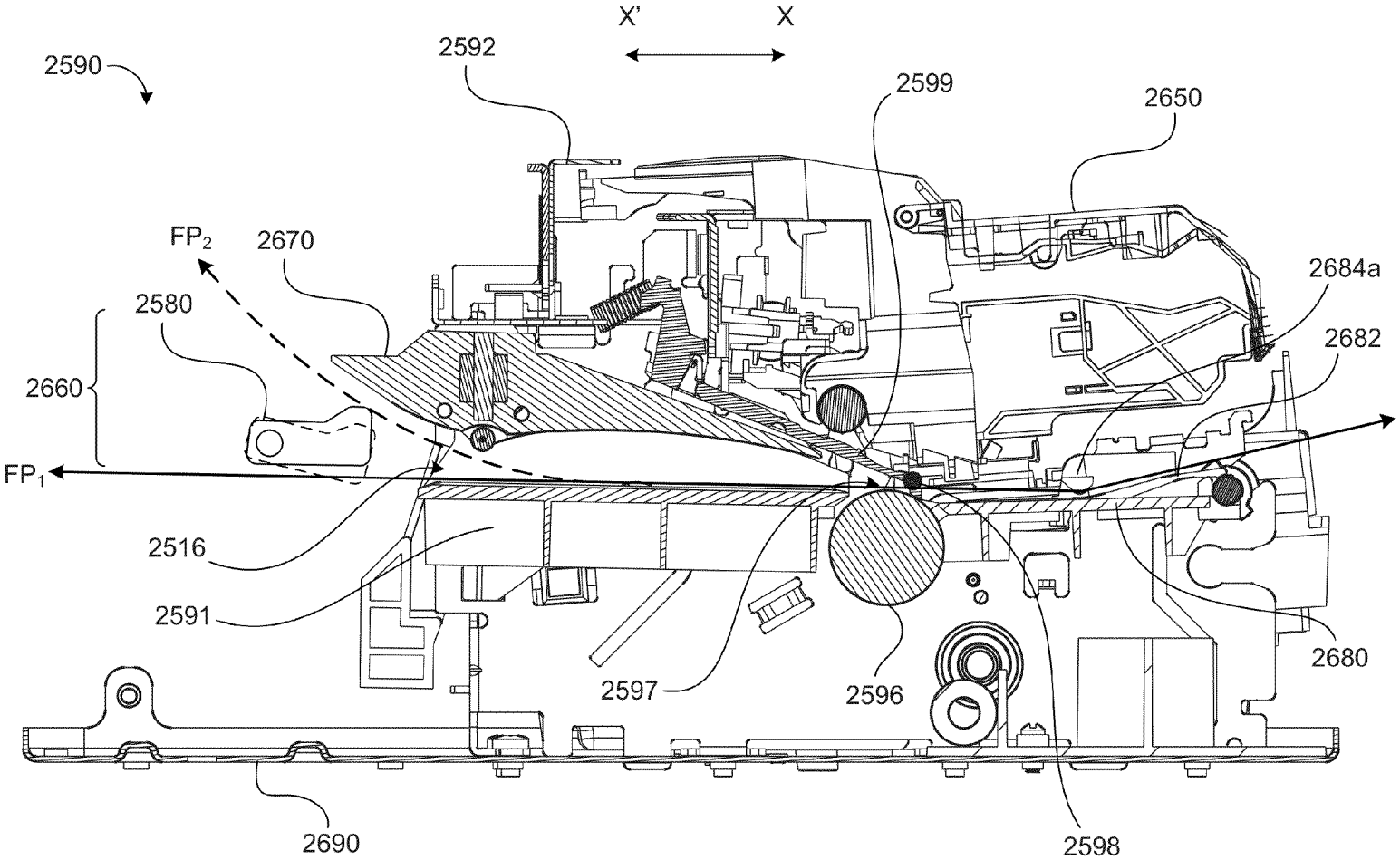
FIG. 25V is a section view of an exemplary printer assembly for a crafting apparatus.
Figure 25W:
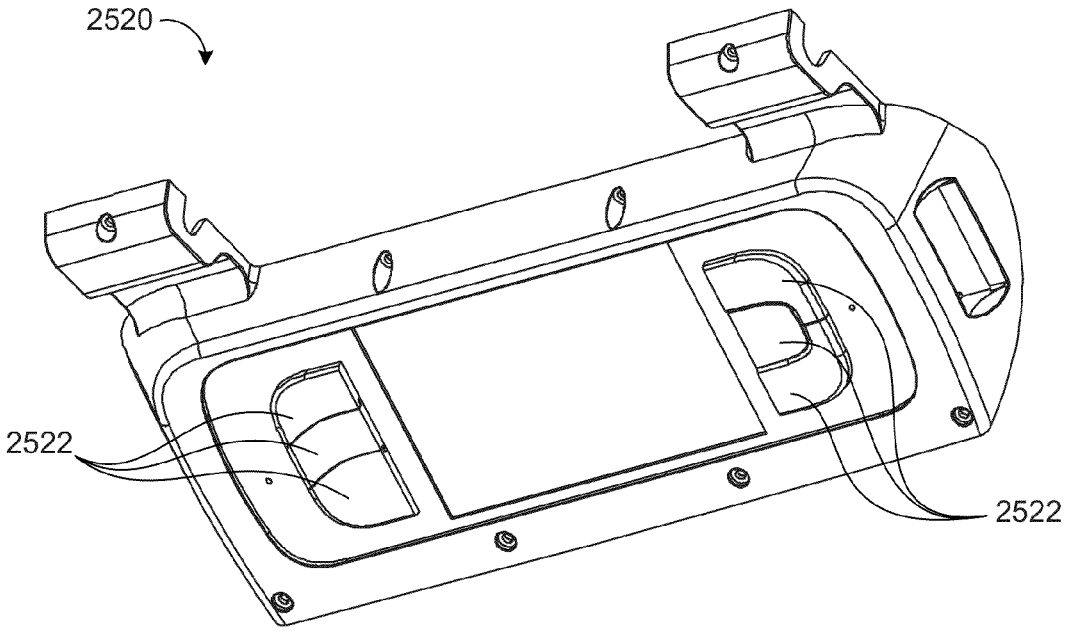
FIG. 25W is a front perspective view of an exemplary front cover for a crafting apparatus.
Figure 25X:
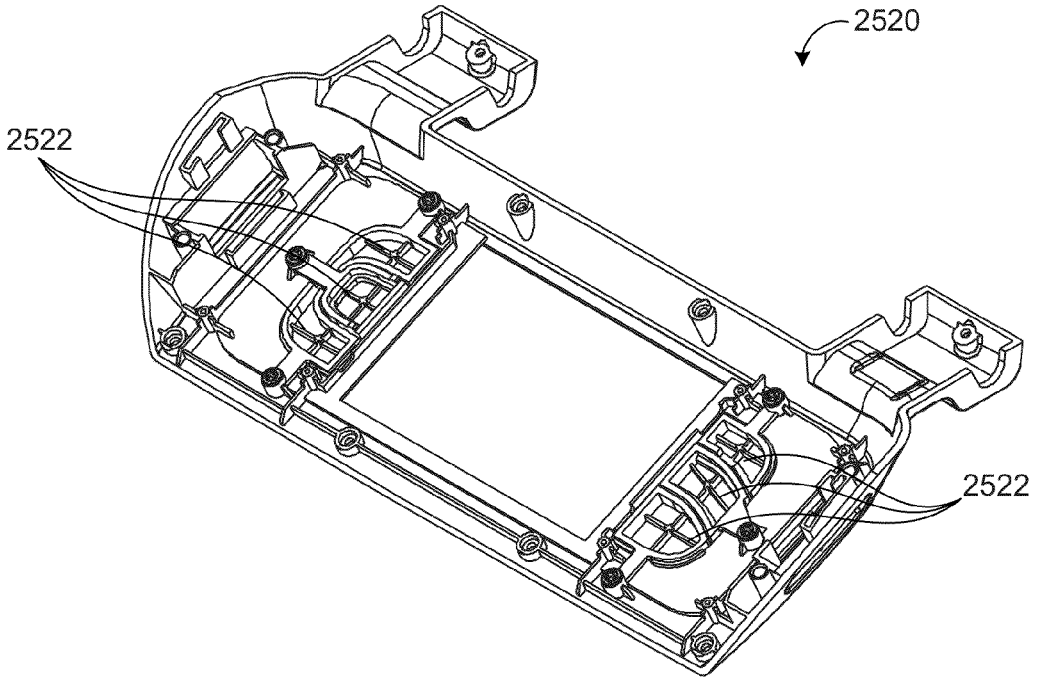
FIG. 25X is a rear perspective view of the front cover shown in FIG. 25S.
Figure 25Y:
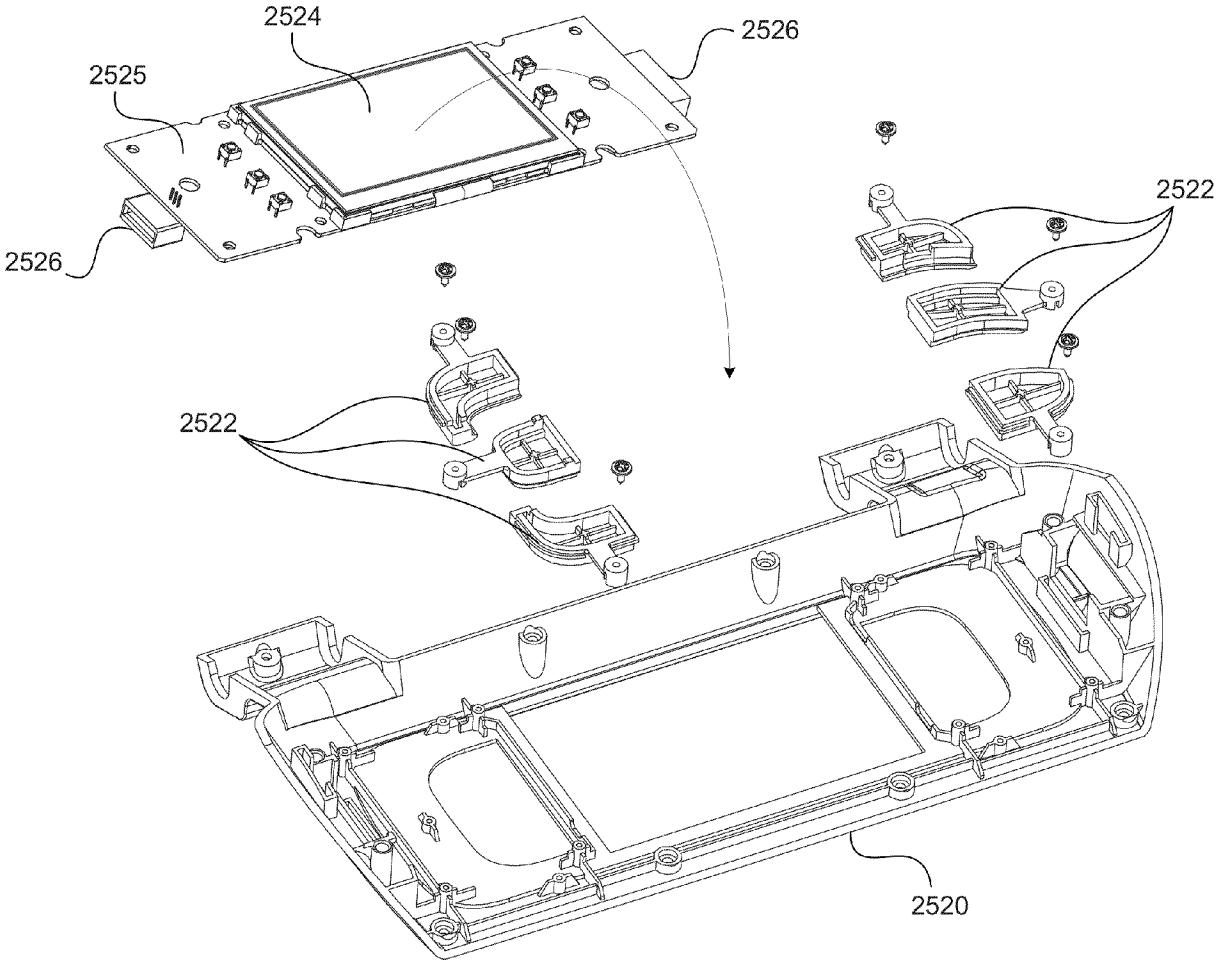
FIG. 25Y is an exploded view of an exemplary front cover for a crafting apparatus.

Referring to FIGS. 25W-25Y, in some implementations, the front cover 2520 includes one or more buttons 2522 for receiving user inputs and a display 2524 (e.g., LCD, touch screen, etc.) for displaying views of the operating software 1800. The front cover 2520 may house or support the controller 2525 (e.g., circuit board and processor) which is communication with the display 2524, the buttons 2522, the cutter assembly 2550, and the printer assembly 2560. In the example shown, the display 2524 is mounted on the controller 2525. The controller 2525 may include one or more cartridge receivers 2526 for establishing communication with cartridges 120. In the example shown, the front cover 2520 receives the cartridges 120 right and left sides of the cover 2520.

Figure 26A:
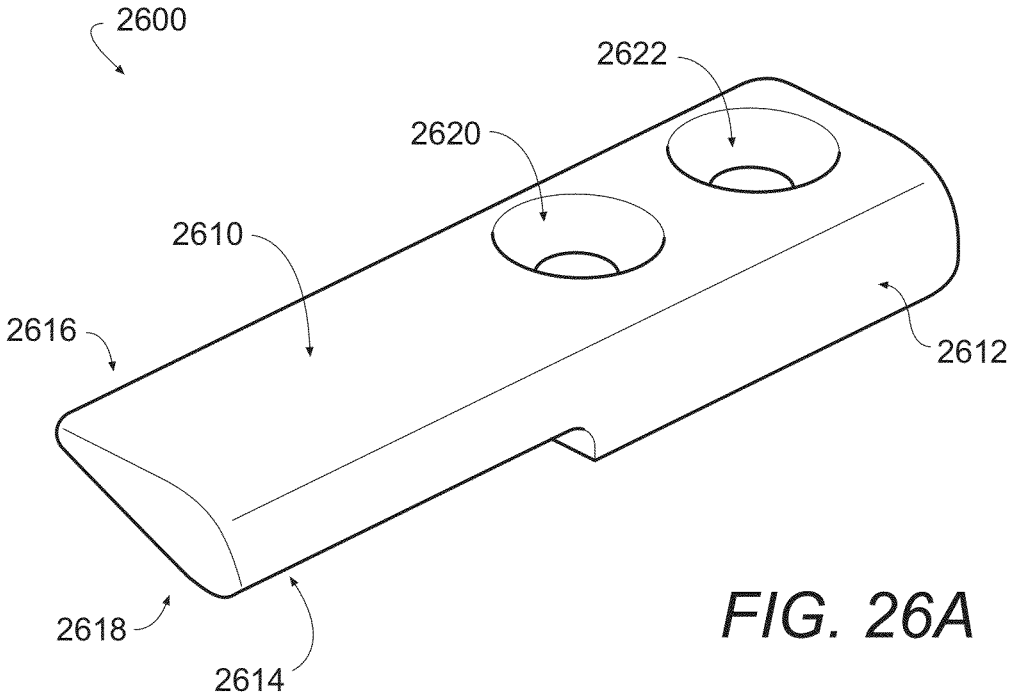
FIG. 26A is a perspective view of a workpiece hold-down for use with a crafting apparatus.

FIG. 26A is a perspective view of a workpiece hold-down 2600 for use with a crafting apparatus to keep the mat or workpiece W flat. The workpiece hold-down 2600 may be embodied as a plastic piece having a finger portion 2610 and a body portion 2612. The body portion 2612 may include at least one screw hole 2620, 2622 that provides for screws to attach the hold-down 2600 to the crafting apparatus. However, any attachment method may be used, including glue, ultrasonic welding, or the hold-down 2600 may be an integral part of the crafting apparatus or another component of the crafting apparatus. A leading edge 2614 and a trailing edge 2616 may be angled, smoothed, and/or chamfered to allow for easy entry of a workpiece W or cutting mat while in motion. A hold-down bottom 2618 may be the contact point to physically hold the workpiece down and prevent curling.

The finger portion may be used to maintain flatness of a cutting mat or the workpiece W during operation of the crafting apparatus. The hold-down 2600 may provide increased flatness of the workpiece and platen/mat to improve the accuracy of the cutting operation and/or during alignment. It may also provide increased accuracy if an alignment algorithm is used. For example, if an alignment algorithm uses printed fiducials (see, e.g., FIG. 12) on the workpiece W to compensate for skew or offset of the workpiece W, then the hold-down 2600 may increase accuracy because curl of the workpiece W is reduced and hence the position of the fiducials may be maintained more true to the expected location. Similarly, if an alignment algorithm uses edge detection of the mat or the workpiece W, then hold-down 2600 may assist in maintaining the edge at the expected location and reduce inaccuracies due to curl of the mat or workpiece W.

Figure 26B:
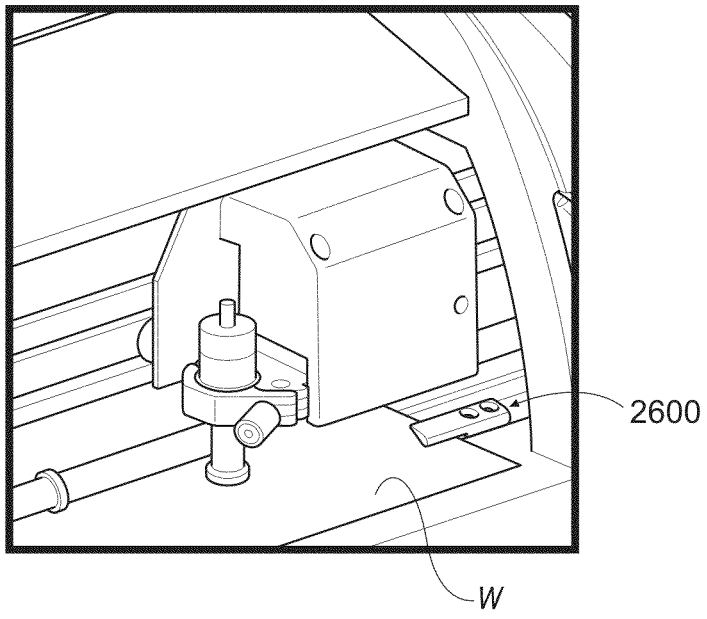
FIG. 26B is a perspective view of the workpiece hold-down of FIG. 24A in situ with the crafting apparatus.

FIG. 26B is a perspective view of the workpiece hold-down of FIG. 26A in situ with the crafting apparatus. As shown, a single hold-down 2600 is located at the edge of the workpiece W in the crafting apparatus. In an implementation, a crafting apparatus may use two (2) hold-downs 2600, with a single hold-down 2600 on each side. The two (2) hold-downs 2600 allow for both side edges of the workpiece W to be held down to avoid excessive curl. In another implementation, a single hold-down 2600 may be used where, for example, a single fiducial is used. In this example, the hold-down 2600 would reduce curl on the side where the fiducial is located.

Figure 26C:
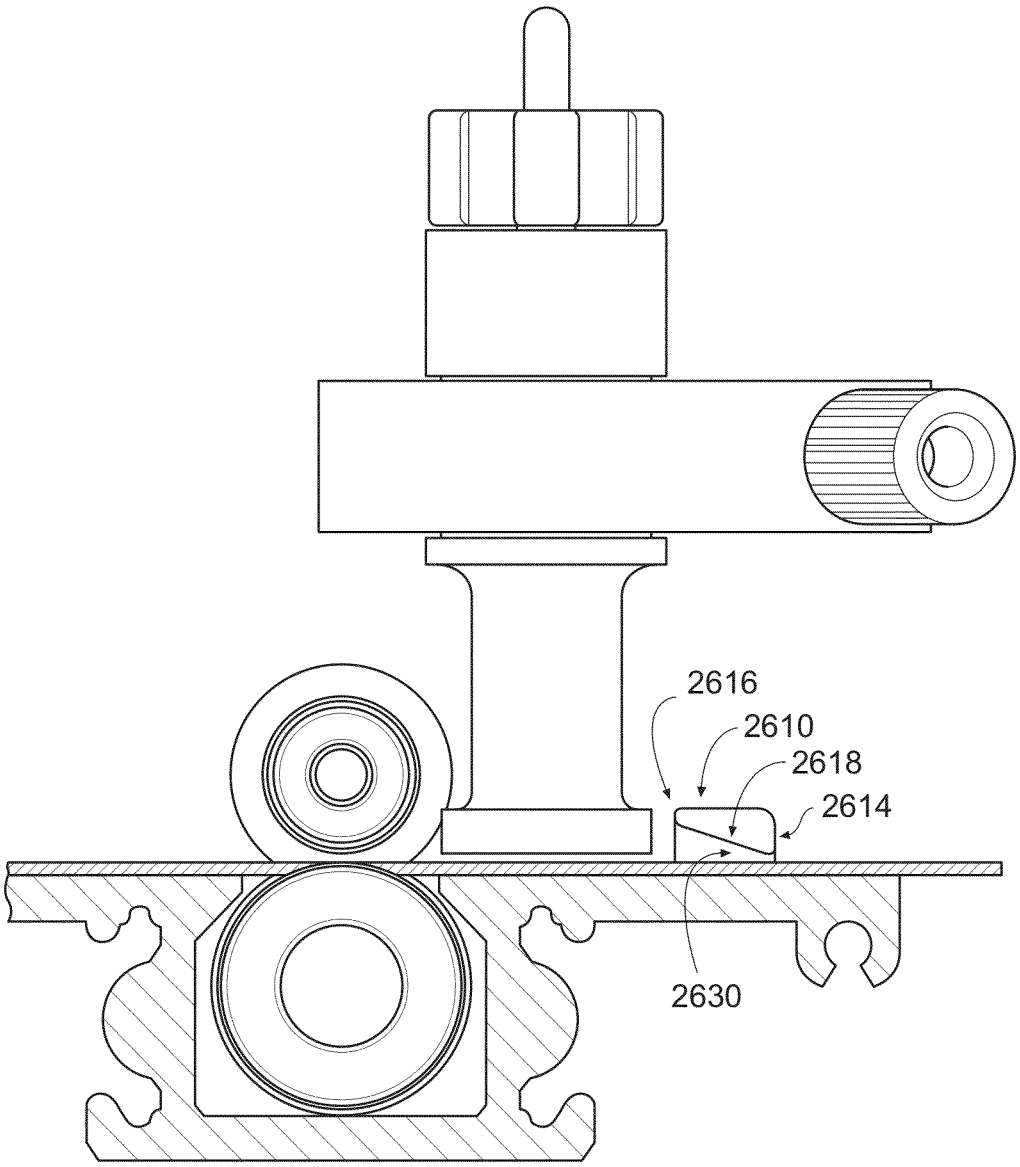
FIG. 26C is a cross-sectional view of a crafting apparatus having a workpiece hold-down.

FIG. 26C is a cross-sectional view of a crafting apparatus having a workpiece hold-down. The hold-down 2600 may have the hold-down bottom 2618 presenting a gap distance 2630. The gap distance 2630 may be configured to provide enough of a gap that the workpiece W does not bind while passing under it, but also not over sized so as to allow excessive curl.

Figure 27A:
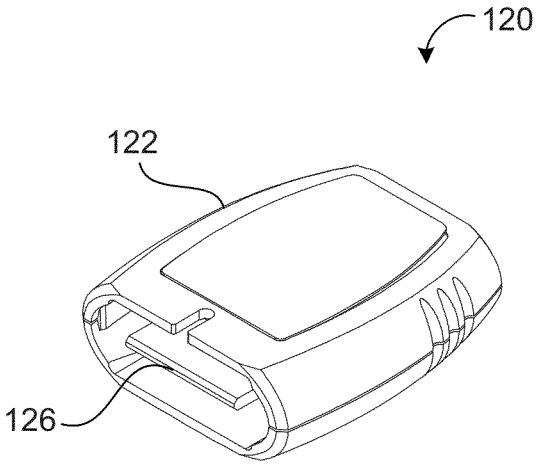
FIG. 27A is a front perspective view of an exemplary cartridge for a crafting apparatus.
Figure 27B:
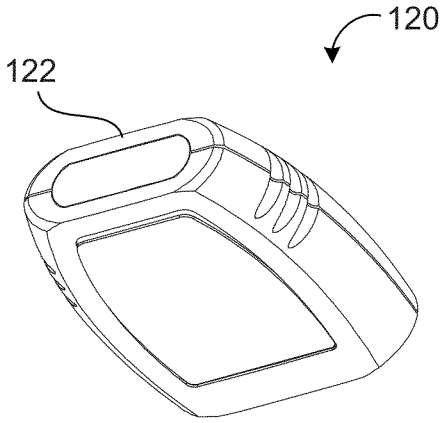
FIG. 27B is a rear perspective view of the cartridge shown in FIG. 26A.
Figure 27C:
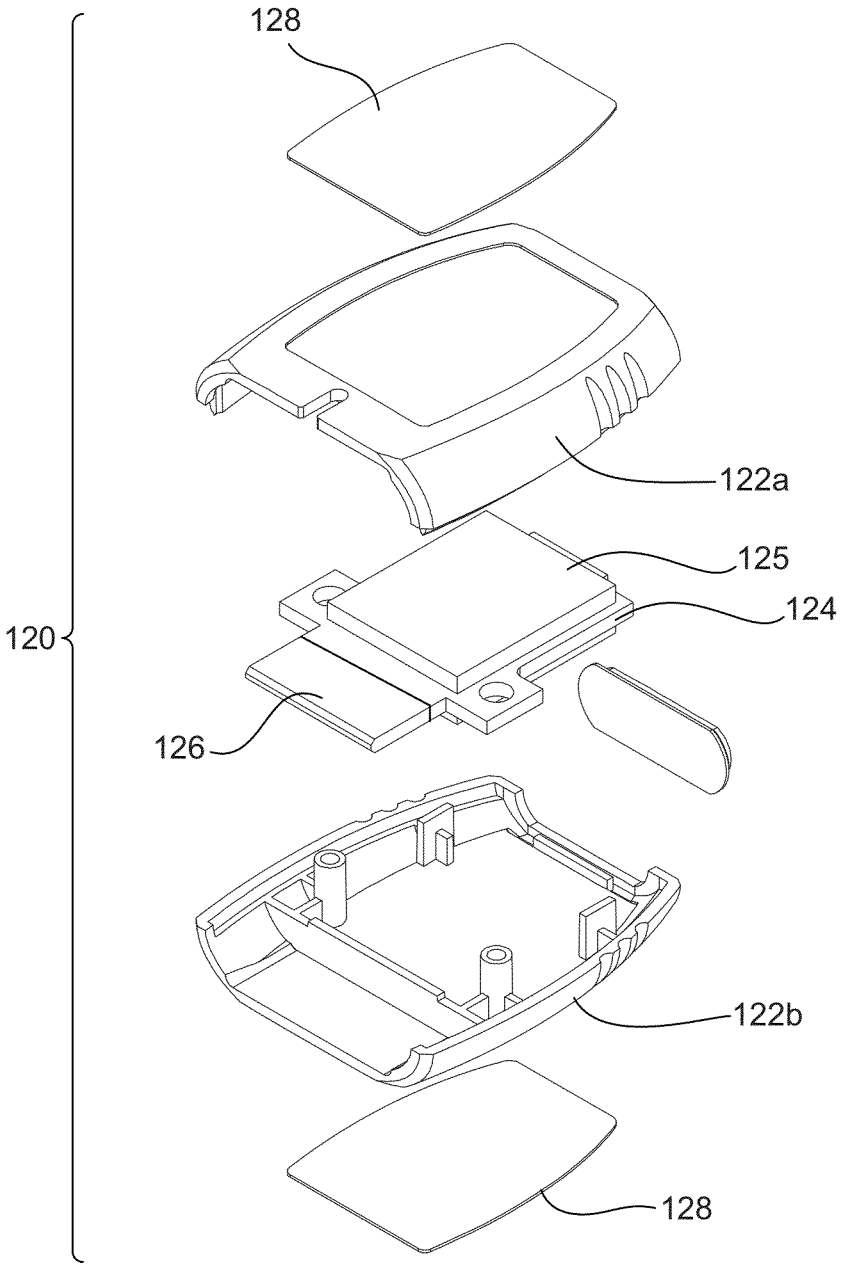
FIG. 27C is an exploded view of an exemplary cartridge for a crafting apparatus.

Referring to FIGS. 27A-27C, in some implementations, the content cartridge 120 includes a cartridge body 122 having first and second portions 122*a*, 122*b* connected together. The cartridge 120 includes a circuit board 124, which may include a processor and/or memory 125 for storing and/or executing software or data, housed by the cartridge body 122. The circuit board 124 includes a connector 126 for establishing communication with the crafting apparatus 10, 2500. The cartridge 120 may include one or more labels 128 affixed to the cartridge body 122 for identifying content stored on the cartridge, for example.

Figure 28:
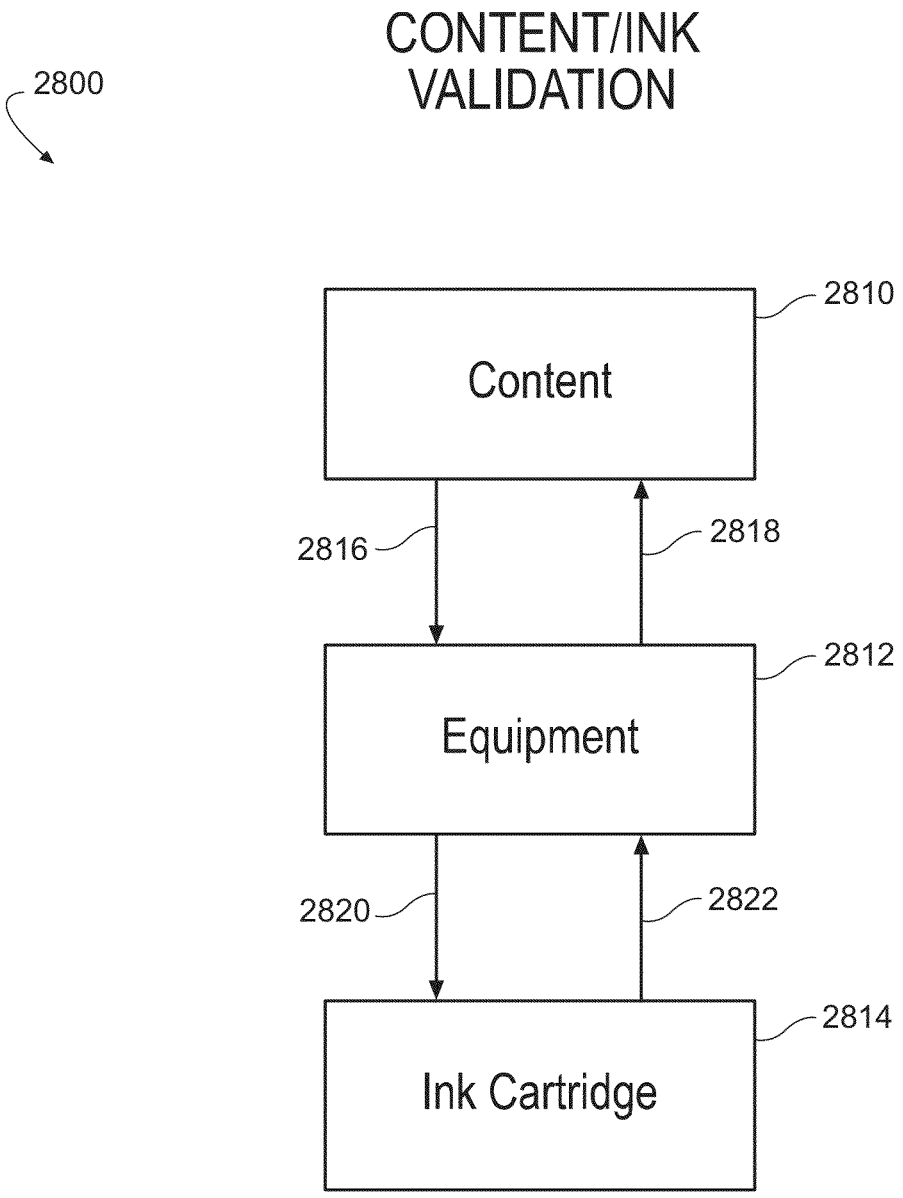
FIG. 28 is a schematic view of an exemplary system for validating an ink cartridge.

FIG. 28 provides a schematic view of an exemplary system 2800 for validating an ink cartridge 2814 based on content 2810 requirements. The content may provide ink requirements 2816 to the equipment 2812 controlling the printing engine 18*b*, 2650 (which may include the print engine itself). The equipment 2812 may inquire 2820 to the ink cartridge 2814 (e.g., where the ink cartridge 2814 has an identifier or a memory that includes the model type and/or ink types) about the specifications or type of ink that should be in the ink cartridge 2814 when manufactured. The ink cartridge 2814 may then respond 2822 to the equipment 2812 with the cartridge information and the ink information. Cartridge information may include what dots per inch (DPI) is possible, the speed of printing, the drop size, the types of substrates that may be printed on etc. The ink information may include the type of ink (e.g., by a serial number), color information about the ink (e.g., the color mapping), physical characteristics of the ink (e.g., opacity, specialized ink such as glitter or foam), etc. The equipment 2812 may then use the information provided by the content 2810 and the information provided by the ink cartridge 2814 to determine whether printing should be allowed. In an optional step, the equipment 2812 may write back 2818 to the content 2810 information such as what ink and/or the characteristics of the ink, or the number of prints being made etc. The information written back to the content 2810 may be used for tracking purposes, quality control, and licensing.

In a first example, the digital content 2810 may require a specialty ink, such as a metallic ink. In that case, the control system (e.g., the equipment 2812, such as the processor 104 of the crafting apparatus 10, 2500) may determine the content's ink requirements and query the ink cartridge 2814 (or the print system 18*b*, 2650 using the ink cartridge 2814) as to what is being used. If think ink being used does not meet the requirements of the content 2810, then any printing operations may be halted and a message may be provided to the user to use the appropriate ink.

In a second example, the content 2810 may include licensed artwork that requires a particular color or quality of ink to be used. In this case, the control system may determine the content's requirement and determine the ink provided. If the ink does not meet the content's requirements then a message may be provided to the user.

In a third example, if a refill ink cartridge 2814 is being used, detection that the ink cartridge 2814 has been refilled may disallow use of the ink cartridge 2814 because, while the ink cartridge 2814 may report as meeting the content's requirement, the refilled ink may not meet the original specifications for the ink cartridge 2814. In this case, the characteristics of the refilled ink is not known. Thus, the ink's characteristics cannot be verified against the content's requirements. In this example where the ink cartridge 2814 has been refilled, an error message may be shown to the user and the printing disallowed.

In a fourth example, the ink cartridge 2814 may be refilled by an authorized refiller. In this example, the refill ink may be of a type meeting or exceeding the specifications and requirements of the originally manufactured ink cartridge 2814. The authorized refiller may then write a code or other indicator to the ink cartridge 2814 (e.g., in EEPROM or FLASH memory associated with the ink cartridge 2814) that the cartridge is refilled by an authorized refiller. If desired, the refiller may also write what type of ink was used for the refill. Alternatively, the authorized refiller may refresh the ink cartridge's memory to an original state such that the cartridge may not be determined to be a refilled ink cartridge. Certain content may require that the ink cartridge be non-refilled. However, other content may not require that the cartridge is non-refilled, but require that the refill ink is identified and meets the specification and requirements.

FIGS. 29A-29F provide schematic views of exemplary printing and cutting systems, as well as examples of how optical sensors may be configured to perform registration and examples without optical registration. The optical sensors may be used to determine coordinate positions on the substrate to allow for correction of X/Y location, as well as rotation of the substrate relative to the print engine and the cut engine. When fiducial(s) are read by an optical sensor (that may be shared or exclusive) the registration of the print engine and/or cutting engine may be verified and/or automatically adjusted.

In a first example, the substrate may be first printed, then cut. The print engine may create at least one registration point on the substrate that may be read by an optical sensor. When the paper is passed to the cutting engine, an optical sensor may be used to compensate for the substrate's position with respect to the cutting engine.

In a second example, the substrate may be first cut, then printed. The optical sensor used by the print engine may be used to locate fiducial marks made but the cutting engine. The fiducial made by the cutting engine may include an "X" cut in at least one location. Where the optical sensor used by the cutting engine is sensitive enough, the intersection of the "X" may be found to provide a reference point. Then the legs of the "X" may be measured away from the center point to provide a rotational measurement. The processor or the print engine may then compensate the image based on the X/Y position and rotation of the "X" fiducial. In this way, the print engine may be aligned with the cut page.

Alternatively, the cutting engine may make at least two "X" marks or plunges into the paper to create at least two fiducials. The optical sensor used by print engine may then read the cut fiducials, find their centers, and determine the X/Y position and rotation of the substrate.

In a third example, the substrate may be first cut, then printed, then cut. The cutting engine may produce at least one fiducial, and pass the substrate to the print engine. The print engine may then use an optical sensor to determine the substrate's orientation, make adjustments, and perform the print job. The print engine may also provide additional fiducials on the substrate as part of the print job. The print engine may then pass the substrate back to the cutting engine where the optical sensor may provide the substrate's orientation for a secondary cut job.

In a fourth example, the substrate may be first printed, then cut, then printed. In this example, the first print job may contain the fiducial(s) and the optical sensors of the cutter engine and the print engine may align to them.

Figure 29A:
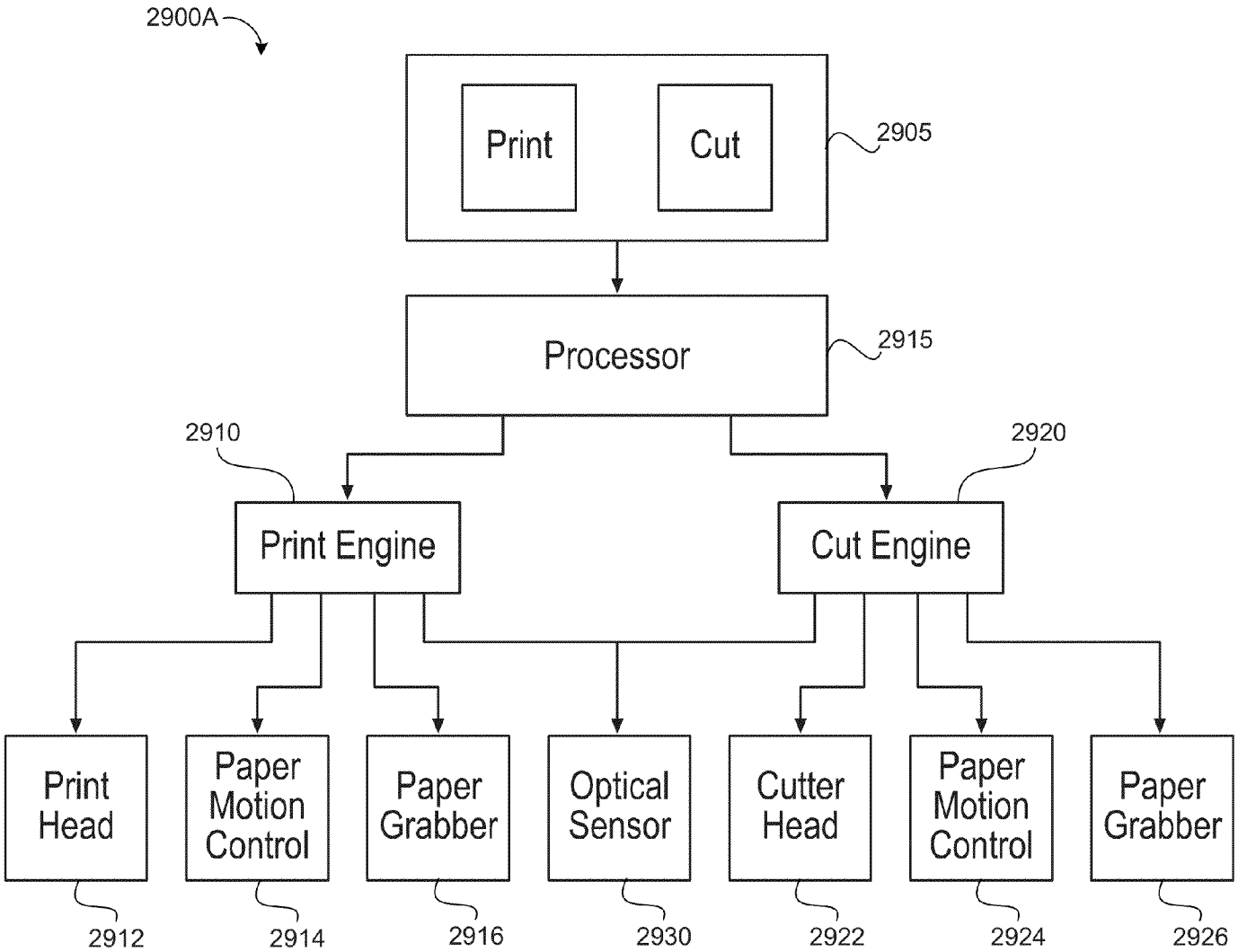
FIGS. 29A-29F is a schematic views of exemplary printing and cutting systems.

FIG. 29A provides a schematic view of an exemplary printing and cutting system 2900A including a printing engine 2910 and cutting engine 2920 both in communication with a processor 2915 (e.g., a controller) that controls printing operations, cutting operations, and passing paper between the printing and cutting engines 2910, 2920. The processor 2915 may receive a job file 2905 that includes print and/or cut instructions, data, content, etc. In the example shown, the printing engine 2910 includes a print head 2912, a paper motion controller 2914, and a paper or substrate grabber 2916 (e.g., a pair of opposing rollers than can move between an engaged position against each and a disengaged position separated from each other). The cutting engine 2920 includes a cutting head 2922, a paper motion controller 2924, and a paper or substrate grabber 2926 (e.g., a pair of opposing rollers than can move between an engaged position against each and a disengaged position separated from each other). Registration may be performed using a shared optical sensor 2930. The shared optical sensor 2930 may be mounted to on the printing and cutting system 2900 in a location where the substrate may pass under it when moved by both the printing engine 2910 and the cutting engine 2920. For example, the optical sensor 2930 may be located near the edge of the substrate and between rollers (not shown) of the print engine 2910 and rollers (not shown) of the cutting engine 2920. Where the field of view of the optical sensor 2930 can still view the fiducials when a standard amount of misalignment of the substrate occurs (e.g., when paper is passed from one roller system to another).

Figure 29B:
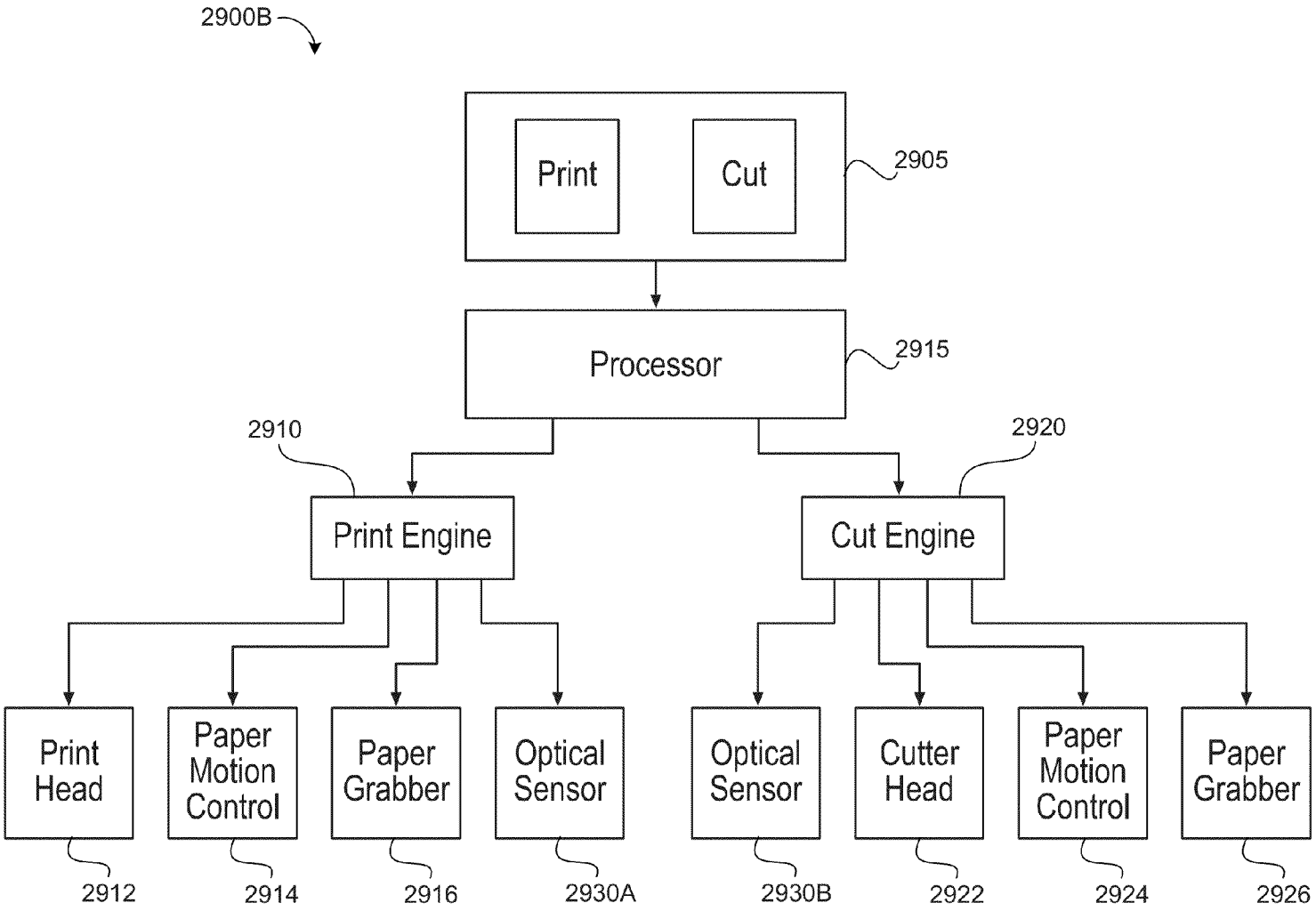

FIG. 29B provides a schematic view of an exemplary printing and cutting system 2900B where the printing engine 2910 and cutting engine 2920 pass the paper therebetween and where registration is performed using an optical sensor 2930A, 2930B on each of the printing engine 2910 and the cutting engine 2920, respectively.

Figure 29C:
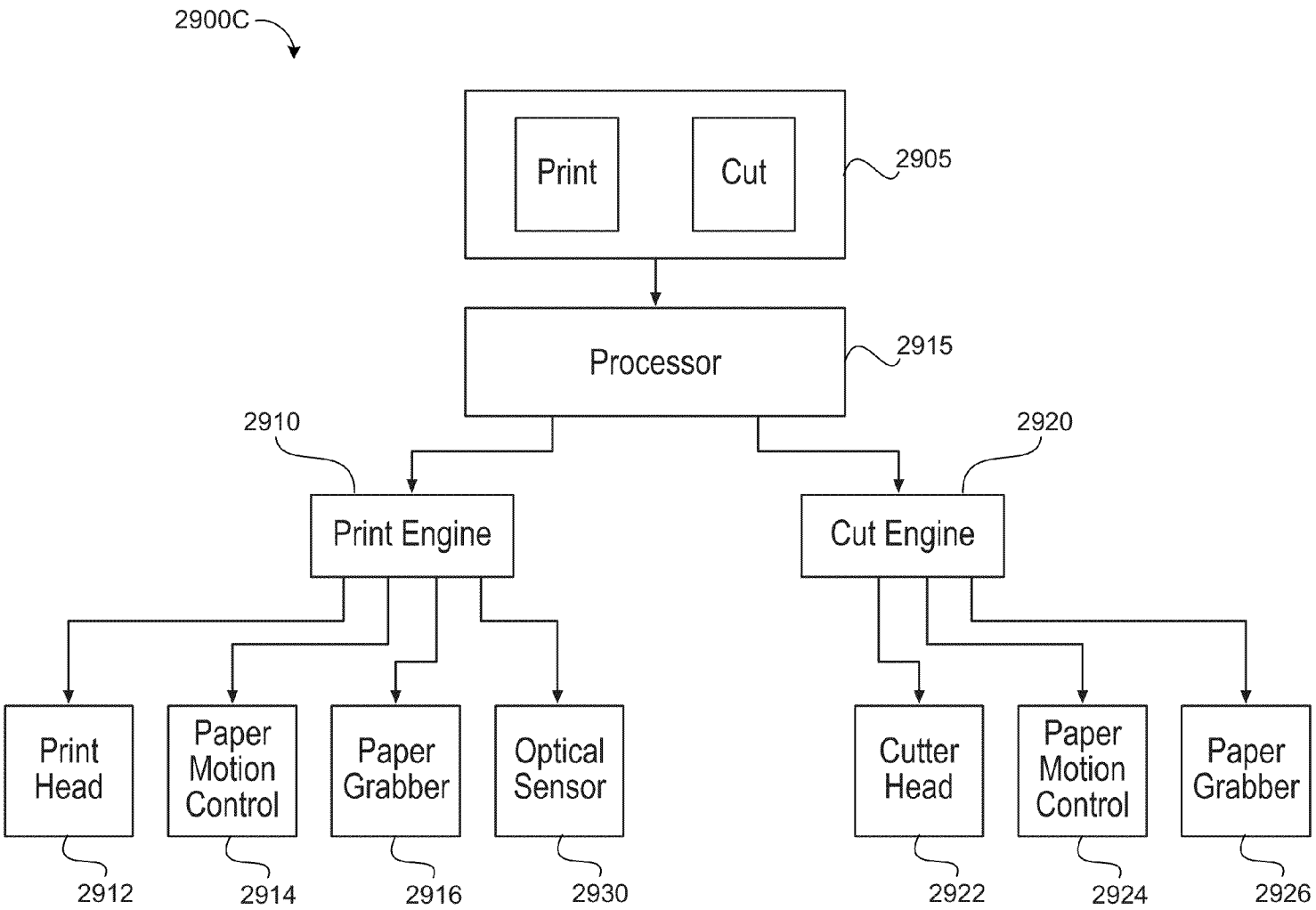

FIG. 29C provides a schematic view of an exemplary printing and cutting system 2900C where the printing engine 2910 and cutting engine 2920 pass the paper therebetween and where registration is performed using an optical sensor 2930 on the print engine 2910.

Figure 29D:
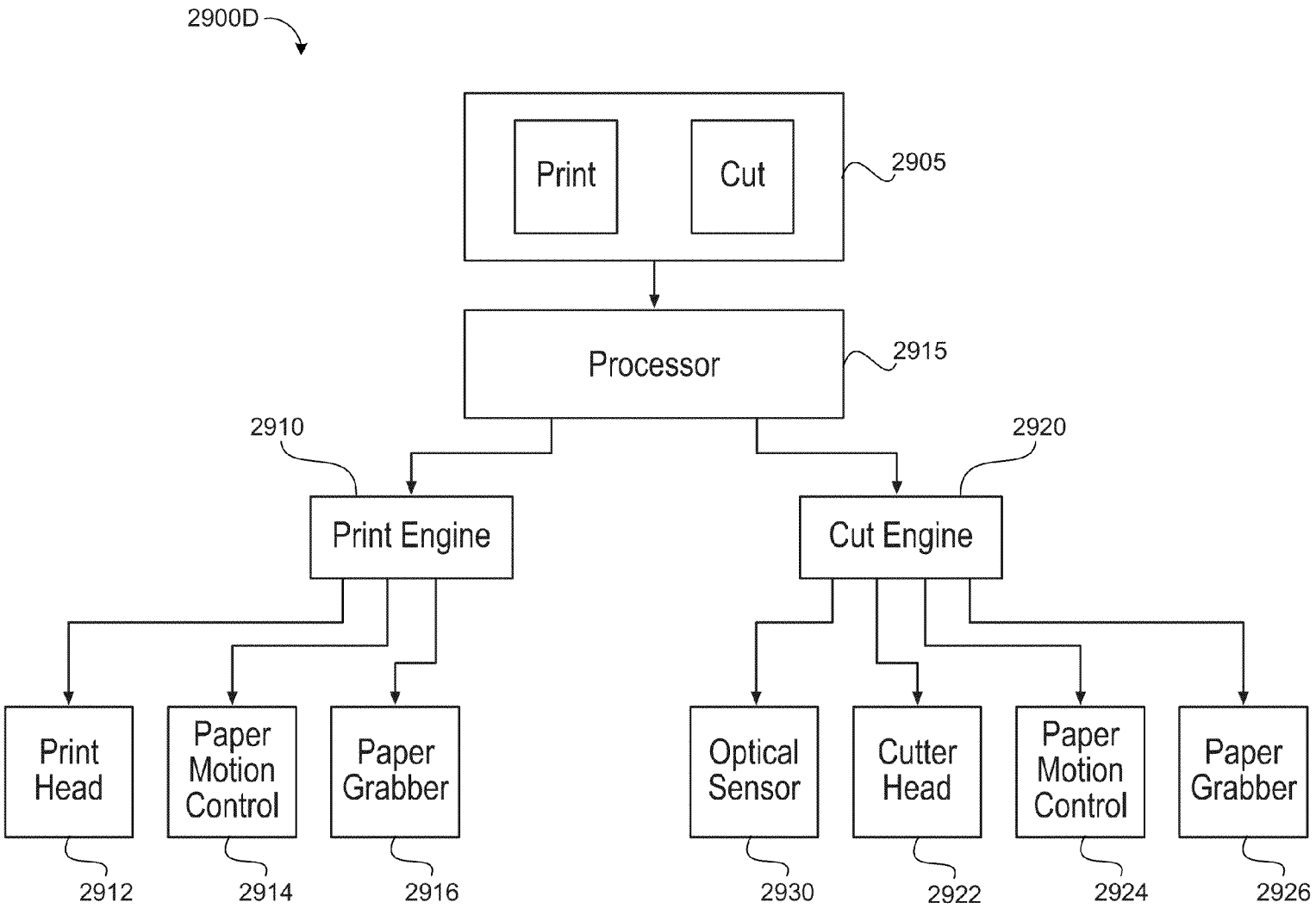

FIG. 29D provides a schematic view of an exemplary printing and cutting system 2900D where the printing engine 2910 and cutting engine 2920 pass the paper therebetween and where registration is performed using an optical sensor 2930 on the cutting engine 2920. Calibration of the printing engine 2910 and/or the cutting engine 2920 may be used to calibrate the print head 2912 and the cut head 2922. The calibration may include printing fiducials on the paper and then detecting them using the optical sensor 2930 on the cutting head 2922. The positional information provided by the cutter's optical sensor 2930 may then be used to calibrate a cutter head positioning system, or it may be used to adjust the image provided to the print engine 2910.

Figure 29E:
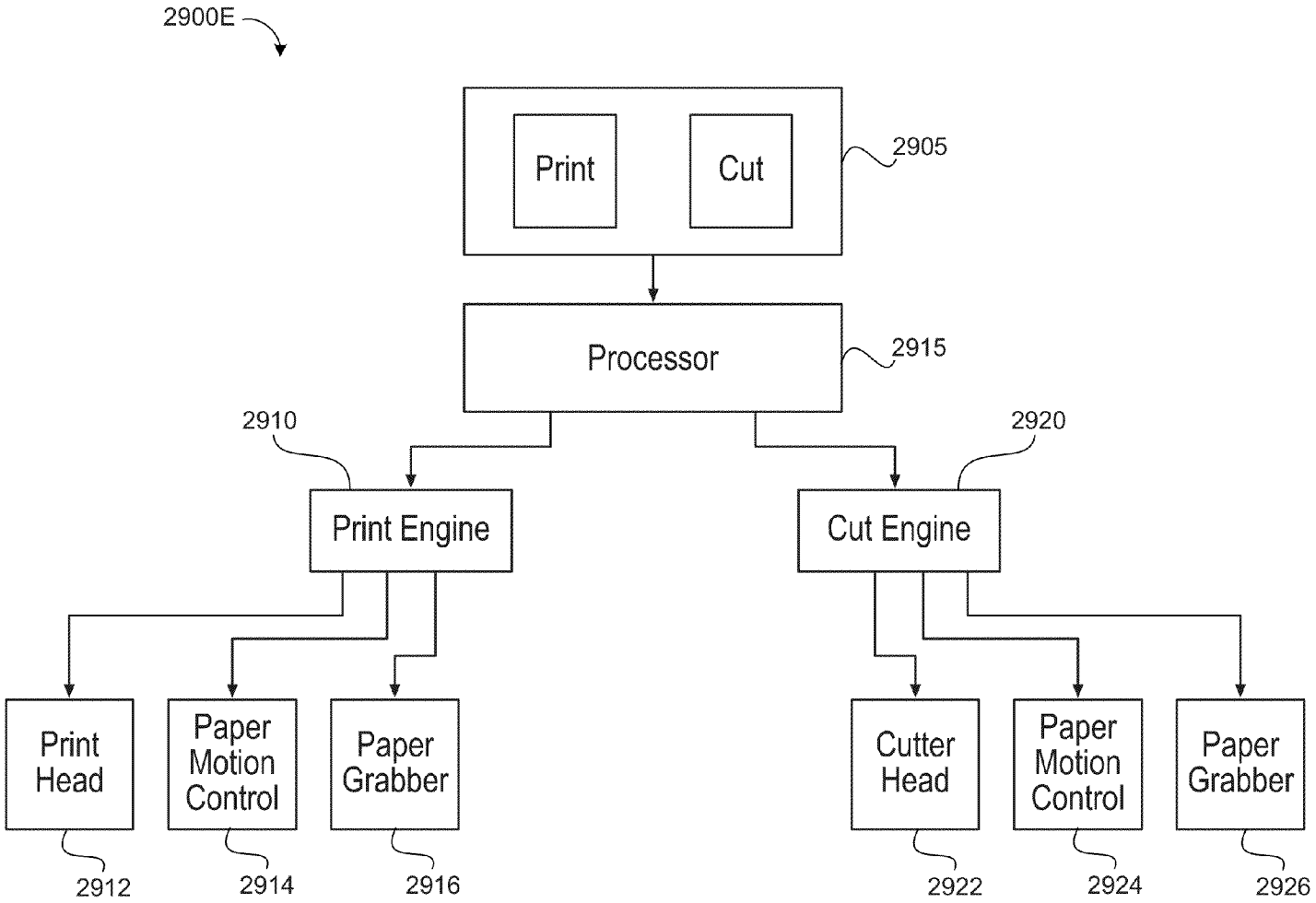

FIG. 29E provides a schematic view of an exemplary printing and cutting system 2900E where the printing engine 2910 and cutting engine 2920 pass the paper therebetween without any registration (e.g., optical-based registration). Here, the printing and cutting system 2900E may be configured to operate in an open loop fashion where the position of the paper after passing from the printing engine 2910 to the cutting engine 2920 is within desired tolerances.

Figure 29F:
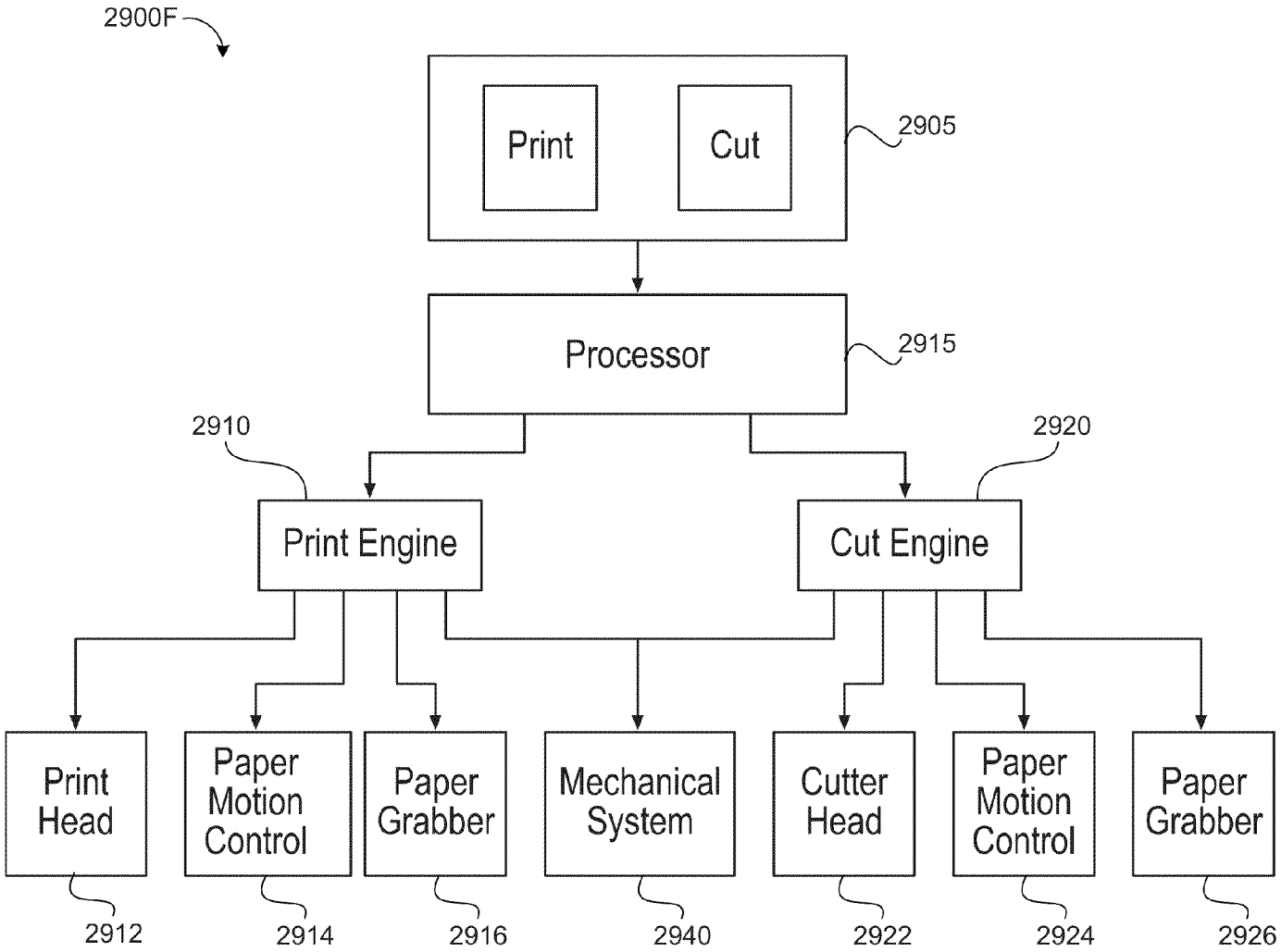

FIG. 29F provides a schematic view of an exemplary printing and cutting system 2900F where the printing engine 2910 and cutting engine 2910 pass the paper therebetween with registration being performed using a mechanical system 2940. The mechanical system 2940 may include a rigidly linked motion controller (e.g., through gears) or common motion controller for the paper. Thus, the alignment of the paper through a roller system may be provided within a desired tolerance.

The printing engine 2910 and the cutting engine 2920 may be mated back-to-back and have a shared power supply (hardware). The paper-handling may use a sticky-mat with thickness adjustability (rails). The cutting engine 2920 may be the main interface to the print and cut machine. Moreover, the cutting engine may control the print engine as if it were an off-the-shelf printer and using known commands. The cutting engine 2920 may control the cutting operation and orchestrate the handoff of paper between the cutting engine 2920 and printing engine 2910. The printing engine 2910 may be interfaced using print commands and/or standard file or image formats.

Print-and-cut files 2905 can be parsed or consumed by the cutting engine 2920, or the processor 2915 overseeing the printing and/or cutting engines 2910, 2920, with only the image portions going to the printing engine 2910. The paper may be printed first, then cut. The paper may be cut first, then printed. The paper may be cut first, then printed, the cut again. The paper may be printed first, then cut, then printed again. The paper may be transferred back-and-forth between the print engine and cut engine, print->cut->cut->print->cut.

Figures 30A, 30B, 30C:
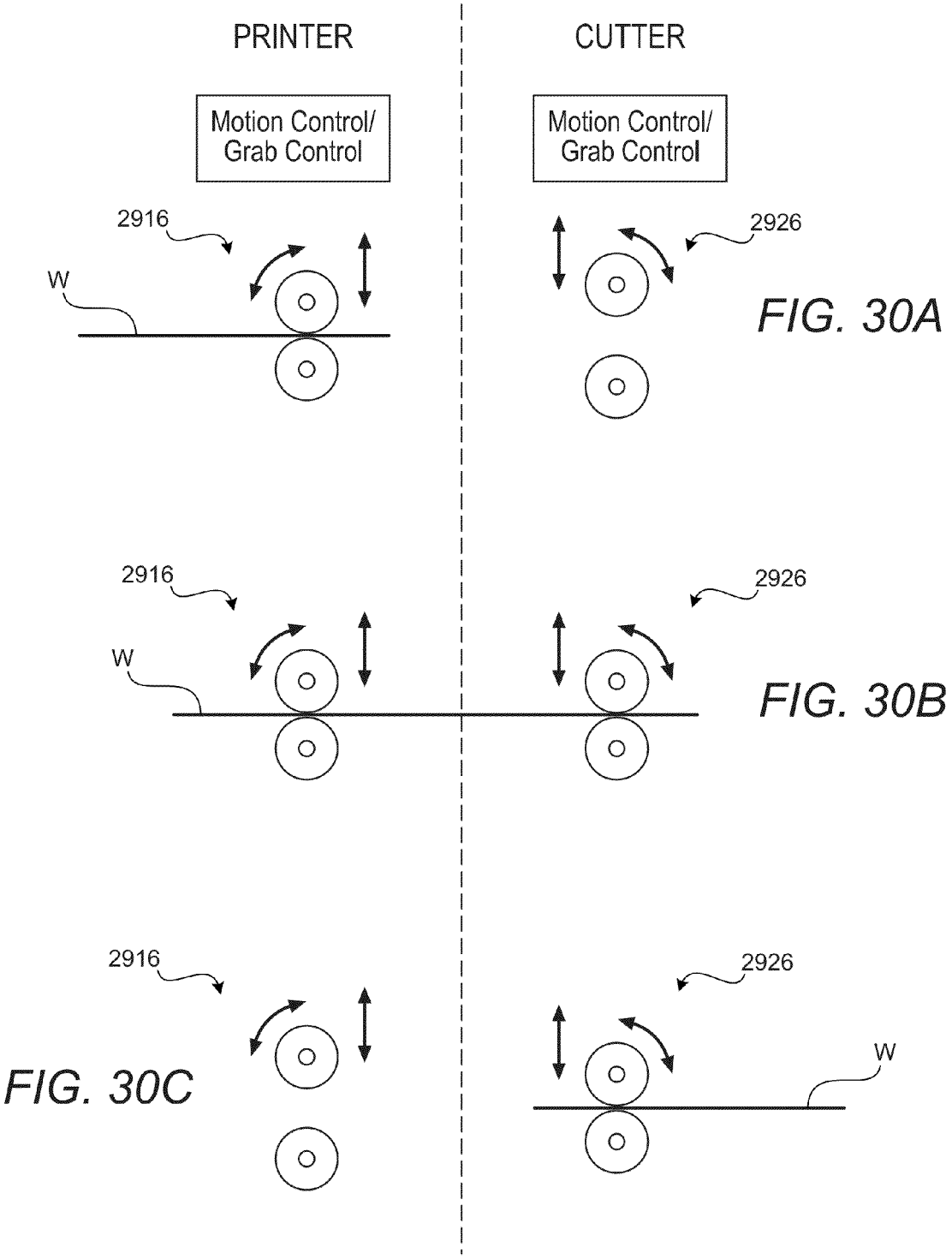
FIGS. 30A-30C is a schematic views illustrating an exemplary system for transferring substrate from a print engine motion control system to a cutting engine motion control system.

FIGS. 30A-30C generally show how a substrate or workpiece W (e.g., paper, vinyl, etc.) may be transferred from the printing engine 2910 to the cutting engine 2920. Although the transfer is shown in one direction (e.g., print to cut) the process may be reversed to transfer the substrate W in the from the cutting engine 2920 to the printing engine 2910. As shown, the printing engine 2910 may have its own motion control 2914 and grab system 2916 and the cutting engine 2920 may have its own motion control 2924 and grab system 2926. However, the system 2900 may be configured to have a common motion control/grab control system. Moreover, the system may include an addition processor 2915 that oversees the printing engine 2910 and cutting engine 2920. Alternatively, the motion control/grab control systems 2914, 2924 may communicate with each other, and the processor 2915 may communicate with the printing engine 2910 and/or the cutting engine 2920.

FIG. 30A is an example of a first step in a transfer of a substrate W from the printing engine 2910 to the cutting engine 2920. The paper grabber 2916 of the printing engine 2910 may include a pair of pinch rollers that move the substrate W toward the paper grabber 2926 (e.g., pinch rollers) of the cutting engine 2920. The cutting engine pinch rollers 2926 are in an open position.

FIG. 30B is an example of a second step in a transfer of the substrate W from the printing engine 2910 to the cutting engine 2920. After the printing engine 2910 has moved the substrate W under the open cutting engine pinch rollers 2926, the printing engine stops the motion of the substrate movement. The cutting engine 2920 then closes its pinch rollers 2926 to grab the substrate W.

FIG. 30C is an example of a third step in a transfer of the substrate W from the printing engine 2910 to the cutting engine 2920. The printing engine pinch rollers 2916 open to release the substrate W and the cutting engine pinch rollers 2926 may be rotated to move the substrate W for cutting by the cutter head 2922.

Figure 31:
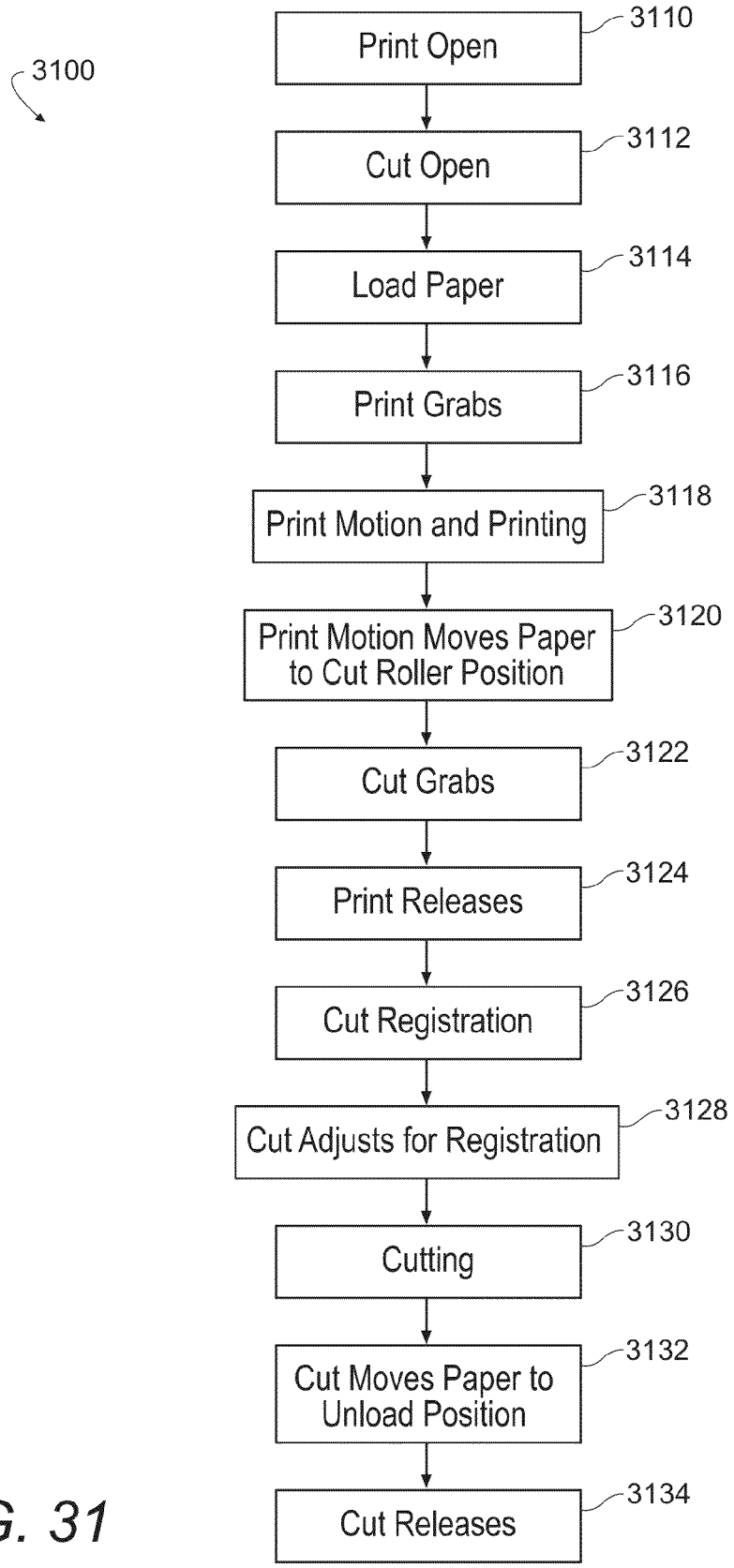
FIG. 31 is a schematic view of an exemplary arrangement of operations for operating a printing and cutting system on a substrate.

FIG. 31 provides a schematic view of an exemplary arrangement 3100 of operations for operating a printing and cutting system 2900, such as the crafting apparatus 10, 2500, on a substrate W (e.g., paper). The operations include opening 3110 substrate grabbers 2916 of the printing engine 2910, opening 3112 substrate grabbers 2926 of the cutting engine 2920, and loading 3114 the substrate W (e.g., paper) into the printing and cutting system 2900. The substrate W may be loaded manually by a user or from a bin/feeder. In this example, it is assumed that the substrate W is loaded into the printing engine 2910 initially. However, the operations may be adjusted so that the substrate W is loaded into the cutting engine 2920 initially. Alternatively, the substrate W may be loaded such that the substrate W is available to both the printing engine substrate grabbers 2916 and the cutting engine substrate grabbers 2926. The operations further include grabbing 3116 the substrate W with the printing engine substrate grabbers 2916 (see e.g., FIG. 30A), moving 3118, via the printing engine motion controller 2914, the substrate W to the appropriate location and moving the print head 2912 for the printing operation. This process may continue until printing is complete. The operations include moving 3120 the substrate W (e.g., with the printing engine substrate grabber 2916 via the printing engine motion controller 2914) to a position that is grabbable by the cutting engine 2920 (see e.g., FIG. 30B), grabbing 3122 the substrate W with the cutting engine substrate grabbers 2926 (see e.g., FIG. 22C), and releasing 3124 the substrate W from the print engine 2910 (see e.g., FIG. 30C). The operations include registering 3126 the substrate W in the cutting engine 2920 (e.g., by using the optical scanner 2930 to orient the cutting engine 2920 with the printed image(s)). This may be performed by using an optical sensor 2930 to detect one or more fiducial marks on the page and adjust for X/Y misalignment and/or rotational misalignment. The operations further include adjusting 3128 the cutting paths of the cutting engine 2920 for registration of the substrate W. For example, the registration points as detected by the optical sensor 2930 may be used to provide a correction matrix that is applied to the cutting paths. The operations include cutting 3130 the substrate W with the cutting engine 2920, moving 3132 the substrate W from the cutting engine 2920 to an unload position (e.g., a location where the user may have access to the paper, such as a bin), and releasing 3134 the substrate W from the cutting engine 2920.

Figure 32:
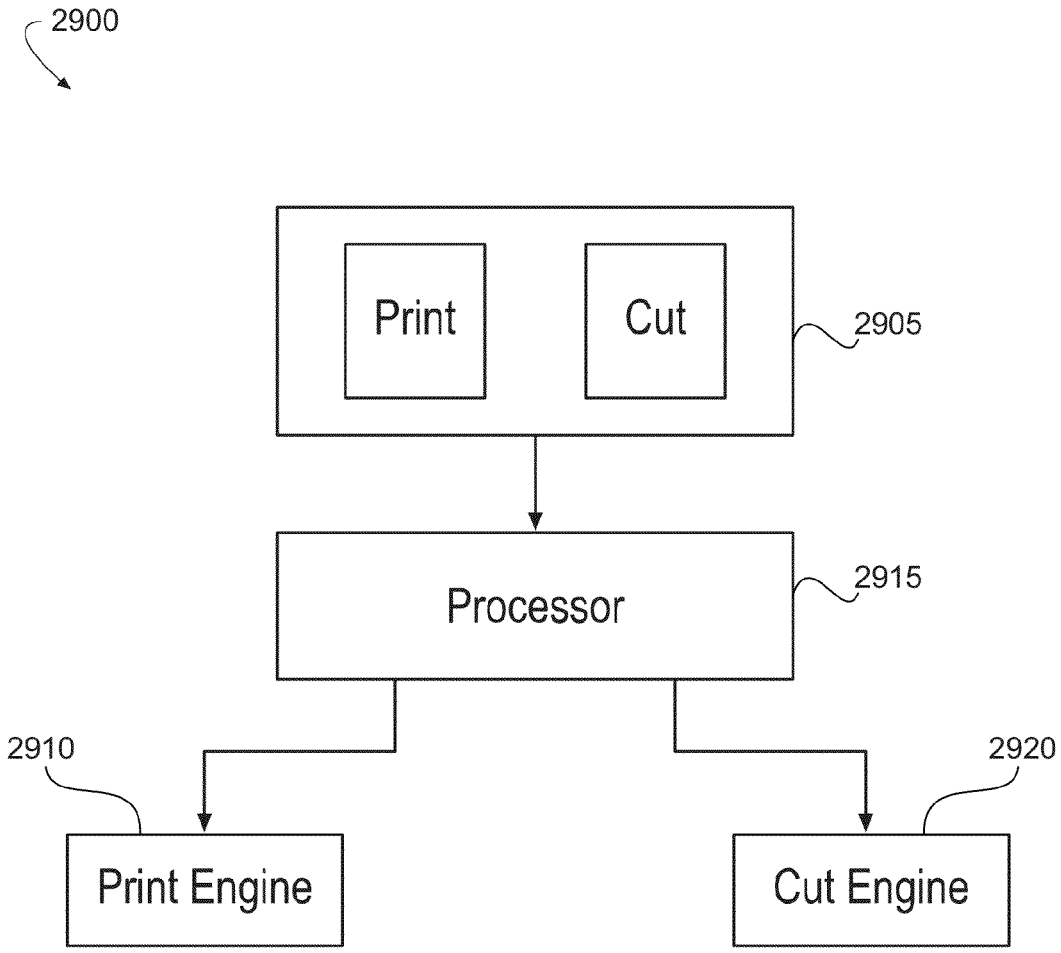
FIG. 32 is a schematic view of an exemplary print and cut file interfaced with a processor that is in communication with a print engine and a cut engine.

FIG. 32 provides a schematic view of an exemplary print and cut file 2905 being read by the processor 2915. The processor 2915 may separate out the printing and cutting instructions and data, apply embellishments or adjustments, and then send the print data to the printing engine 2910 and the cut data to the cutting engine 2920 separately.

Figure 33:
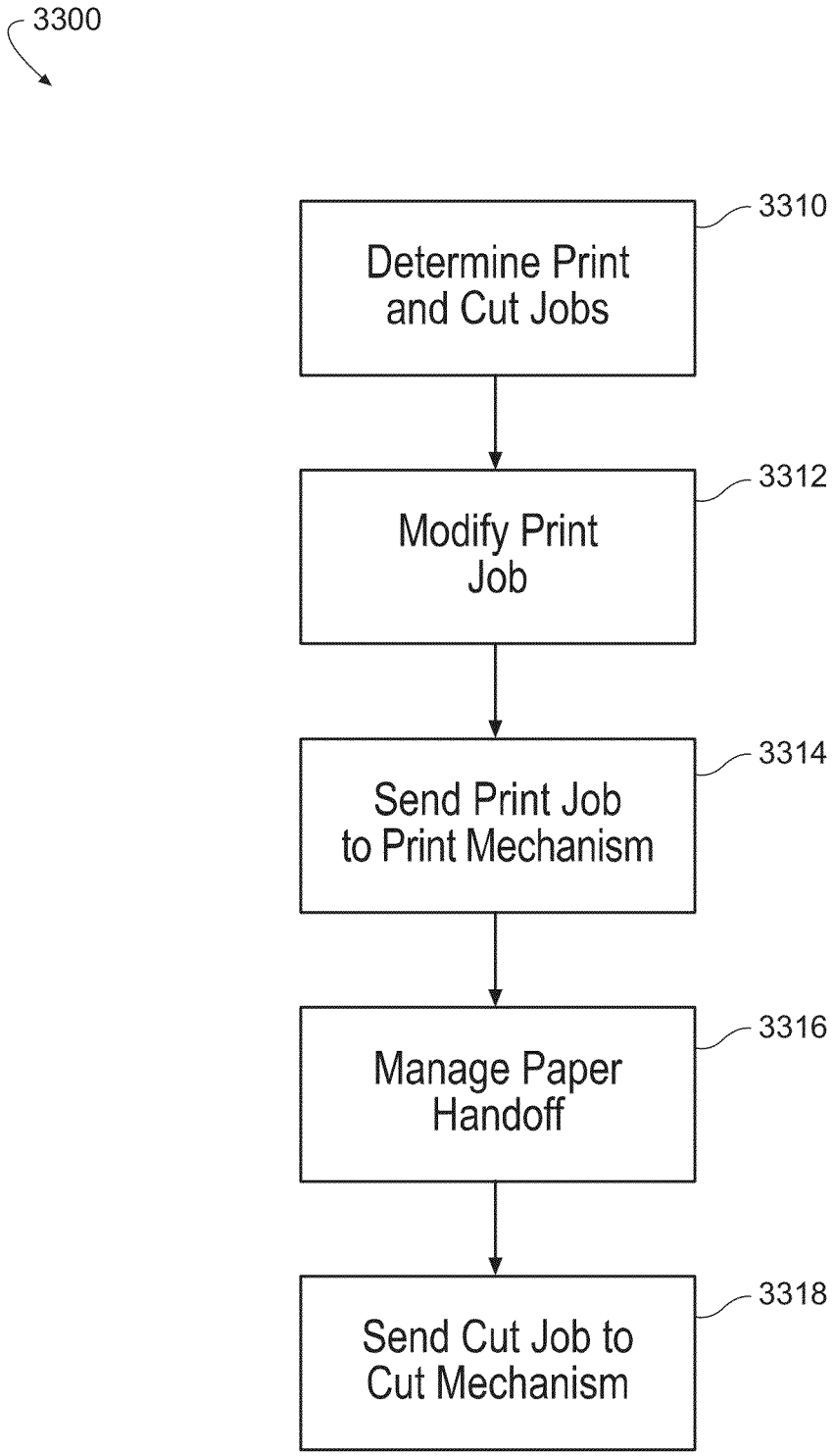
FIG. 33 is a schematic view of an exemplary arrangement of operations for executing a print and cut operation.

FIG. 33 provides a schematic view of an exemplary arrangement 3300 of operations, executable by the processor 2915, for executing a print and cut operation. The processor 2915 may provide separate print jobs and cut jobs to the printing engine 2910 and the cutting engine 2920, respectively. The operations include determining 3310 the print jobs and the cut jobs. This may include reading a print & cut file that may store multiple references to artwork as well as position and embellishment information. The operations may include creating or modifying 3312 a print job. For example, the processor 2915 may read the references to artwork and get the artwork information (e.g., from a cartridge 120 or a controller) and may generate the print job. This may include positioning the artwork on a page for printing. It may also include adding fiducials to the print job at predetermined locations so that the cutting engine 2920 may use them for alignment. The operations further include sending 3314 the print job to the printing engine 2910 for printing, managing 3316 the passing or handoff of the printed page from the printing engine 2910 to the cutting engine 2920 (see e.g., FIG. 30A-30C), and sending 3318 the cut job to the cutting engine 2920 (e.g., to the cutter head 2922). This may also include reading fiducial marks printed on the page with an optical sensor 2930 and adjusting the cutting paths to the paper's position and orientation.

Figure 34:
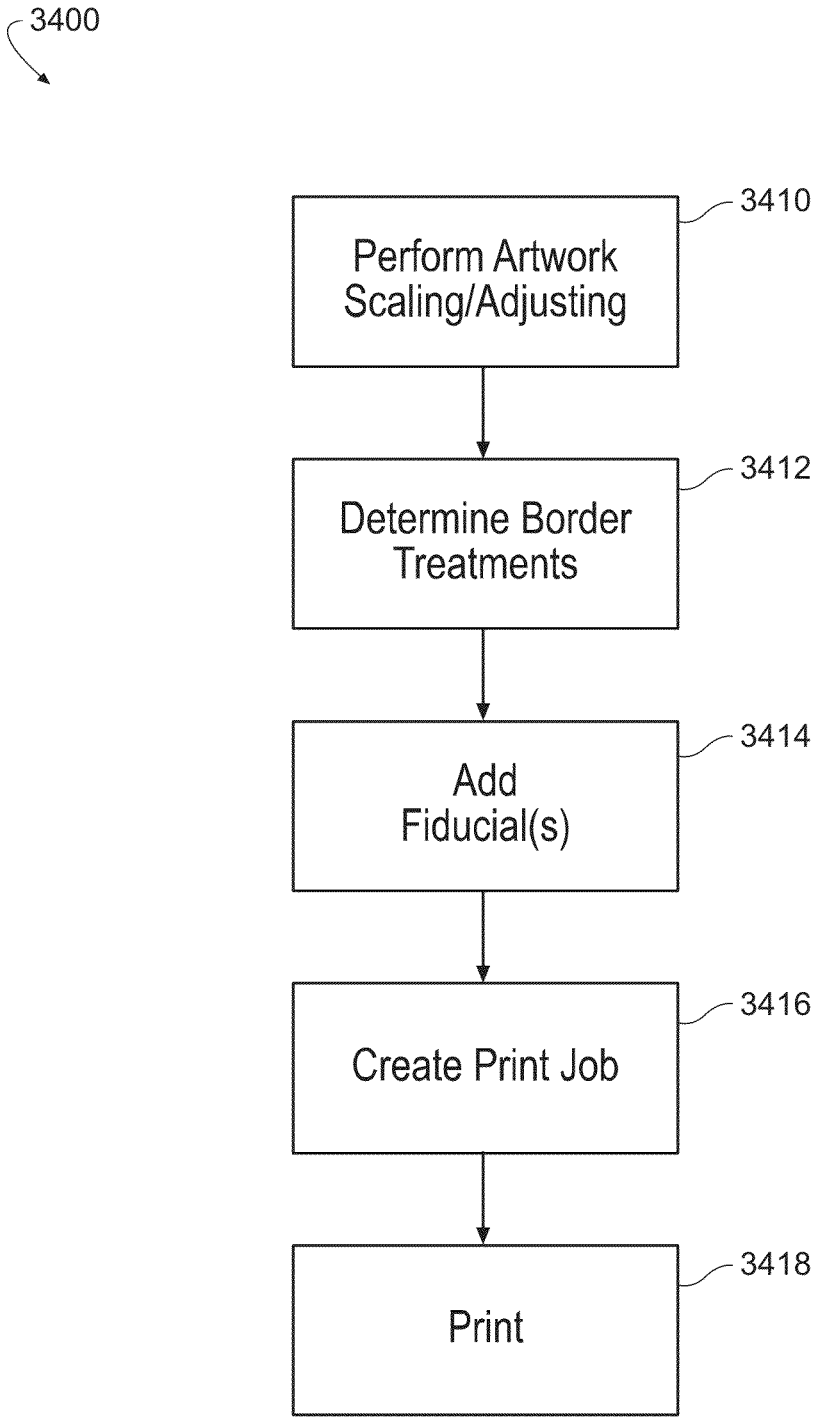
FIG. 34 is a schematic view of an exemplary arrangement of operations, executable by the processor, for modifying a print job prior to be sent to the printing engine.

FIG. 34 provides a schematic view of an exemplary arrangement 3400 of operations, executable by the processor 2915, for modifying a print job prior to be sent to the printing engine 2910. The operations include adjusting 3410 the artwork. An example may be scaling, modifications to bitmaps, replacement of color mapping or texture mapping, adjustments related to ink types, etc. The operations further include adjusting 3412 the borders of the images based on the expected cutting operation. This may include addition of borders, removal of borders, etc. This may also include creating two separate print jobs to provide for over-printing. In this case, the print & cut system 2900 may determine that a particular image or set of images should be overprinted in particular locations. The system may then create a second print job for the over printed areas. Moreover, there may be a predetermined delay to allow for partial drying or no delay to provide for additional saturation into the substrate at the over-printed areas. The operations further include adding 3414 fiducials at predetermined locations. Where the processor 2915 controls both the printing engine 2910 and the cutting engine 2920, the fiducials may be located anywhere on the page and the expected locations may then be passed to the cutting engine 2920 for reading by the optical sensor 2930. In addition, the operations include creating 3416 a print job and printing 3418 the job on the printing engine 2910. The print job may include standard commands and data (e.g., a bitmap) to be sent to the printing engine 2910. Alternatively, the operations may include providing direct control of the motion controller 2914 for the printing engine 2910 and the print head 2912.

Figures 35, 36, 37, 38:
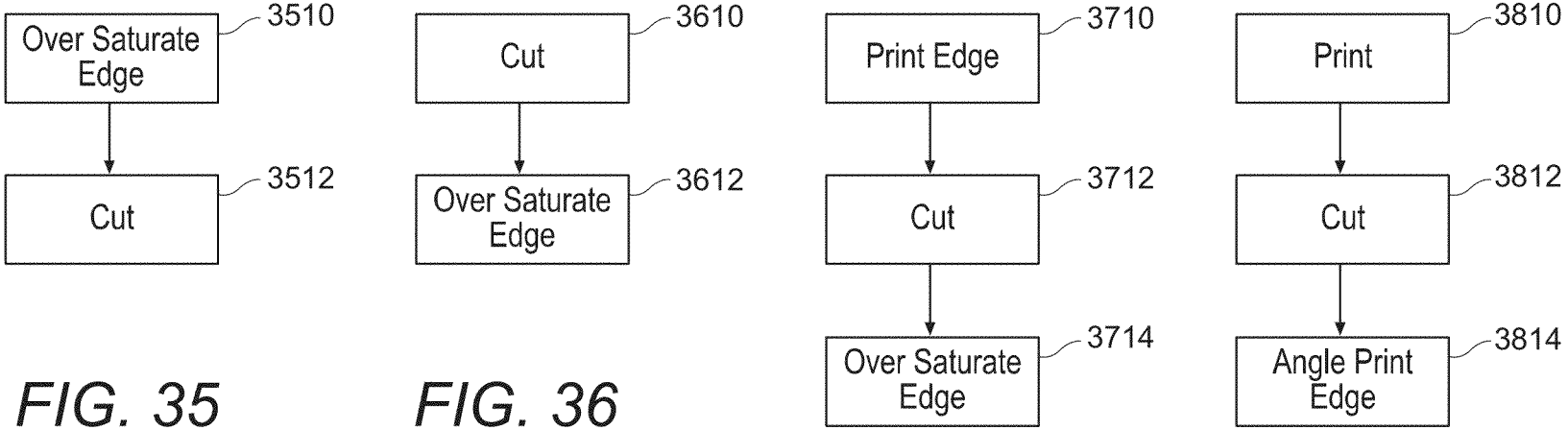
FIG. 35 is a schematic view of an exemplary arrangement of operations for over-saturation where an edge of a cut path is over-saturated with ink prior to executing a cutting operation.
FIG. 36 is a schematic view of an exemplary arrangement of operations for over-saturation of an edge of a cut path after a cutting operation is performed.
FIG. 37 is a schematic view of an exemplary arrangement of operations for printing, cutting, and then over-saturation of a cut edge.
FIG. 38 is a schematic view of an exemplary arrangement of operations for printing, cutting, and then angled printing into a cut path.

FIG. 35 provides a schematic view of an exemplary arrangement 3500 of operations for over-saturation where the edge of a cut path is over-saturated with ink prior to being cut. The operations executing 3510 multiple passes of a print head 2912 over the same area of a substrate W to re-apply ink and then cutting 3512 the substrate W with the cutting engine 2920.

FIG. 36 provides a schematic view of an exemplary arrangement 3600 of operations for over-saturation of an edge of a cut path after the cut is performed. In this example, the operations include cutting 3610 the substrate and then passing the substrate W to the printing engine 9210 for over-saturation printing 3612. The printing engine 2910 may perform registration with an optical sensor 2930 (or other methods) and then print over the cut path. Because the cutting leaves the incised substrate W exposed, the printing over the cut may allow for ink to cover the cut edge. Alternatively, the ink may wick into the cut edge by capillary action etc.

FIG. 37 provides a schematic view of an exemplary arrangement 3700 of operations for printing, cutting, and then over-saturation of a cut edge. This may be desirable where white paper is used and the printed edge is colored. Because the substrate W is white, this may show in contrast to the printed edge. Where the user desires not only the face of the substrate W to be colored, the edge may also be printed on after cutting. Here, the operations include printing 3710 the edge and passing the substrate W from the print engine 2910 to the cutting engine 2920, cutting 3712 the edge, and then passing the substrate W back to the printing engine 2910 and printing 3716 the edge again. The substrate W may then be released from the printing engine 2910 or it may be released from the cutting engine 2920.

FIG. 38 provides a schematic view of an exemplary arrangement 3800 of operations for printing, cutting, and then angled printing into a cut path. The operations include printing 3810 the edge and passing the substrate W from the print engine 2910 to the cutting engine 2920, cutting 3812 the edge, and then passing the substrate W back to the printing engine 2910 and printing 3816 the edge again at an angle into the cut path.

Figure 39A:
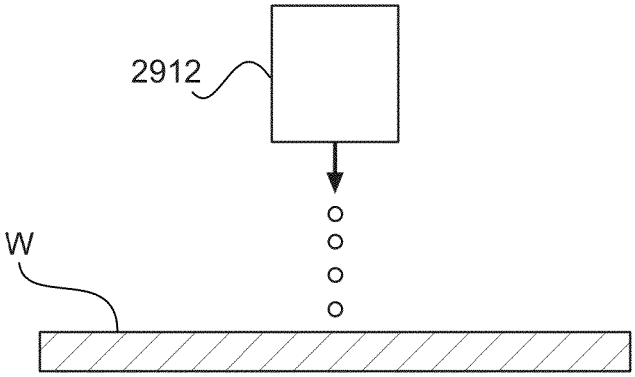
FIGS. 39A-39C are schematic views an exemplary inkjet printer head having one or more printing directions for printing a substrate.
Figure 39B:
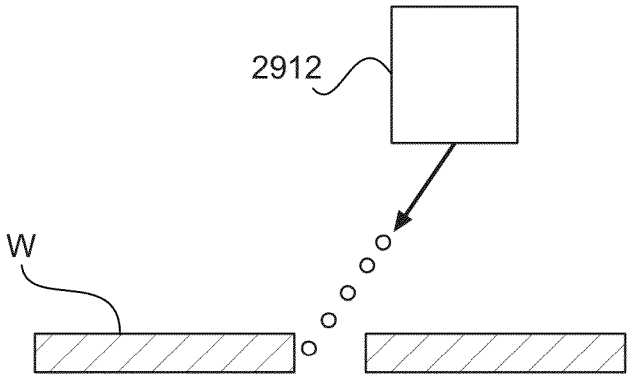
Figure 39C:
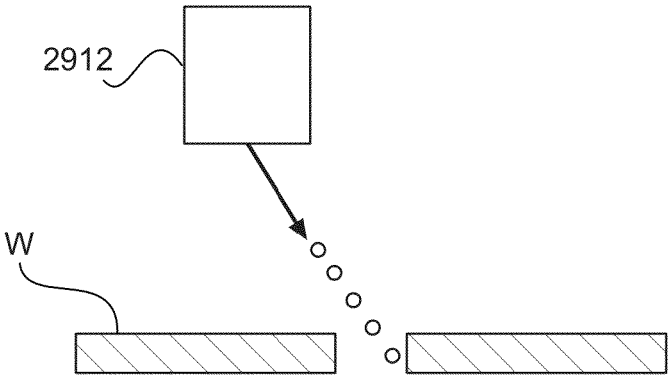

FIGS. 39A-39C provide a schematic views an exemplary inkjet printer head 2912 having one or more printing directions for printing a substrate W. FIG. 39A illustrates an example of an inkjet head 2912 printing substantially downwardly toward the substrate W. The substantially downwardly direction may be considered in a plane normal to the surface of the substrate W, which may also be considered the axis as discussed herein. FIG. 39B illustrates an example of an inkjet head 2912 printing off axis and to the left. FIG. 39C illustrates an example of an inkjet head 2912 printing off axis and to the right.

Figure 40:
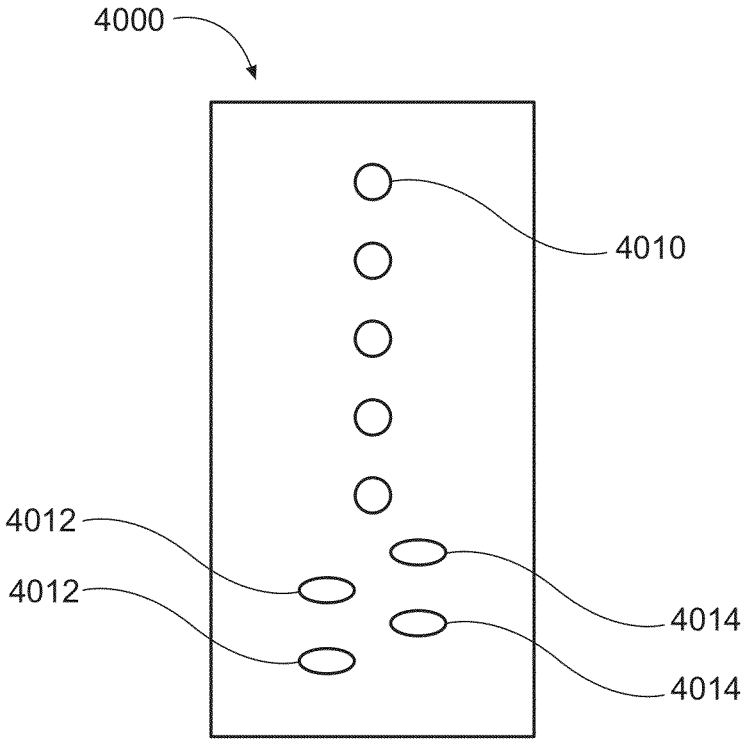
FIG. 40 is a schematic view an exemplary inkjet head nozzle plate having various nozzle orientations.

FIG. 40 provides a schematic view an exemplary inkjet head nozzle plate 4000 with various nozzles having various orientations. The inkjet head nozzle plate 4000 may include one or more down nozzles 4010 oriented to print substantially downwardly, one or more off-axis left nozzles 1012 oriented to print off axis to the left, and one or more off-axis right nozzles 4014 oriented to print off axis to the right. As shown, the off-axis nozzles 4012, 4014 may be oval in shape due to their being formed in the nozzle plate 4000 at an angle. Whereas the substantially downwardly printing nozzles 4010 may be formed straight through the nozzle plate 4000 normal to the surface. Alternatively, the off axis nozzles 4012, 4014 may be formed straight through the nozzle plate 4000 normal to the surface, but that the ink bubble generator (e.g., heating element or piezoelectric transducer) may be offset from the nozzle plate 4000 to force the ink to deflect away from the normal axis.

Figure 41:
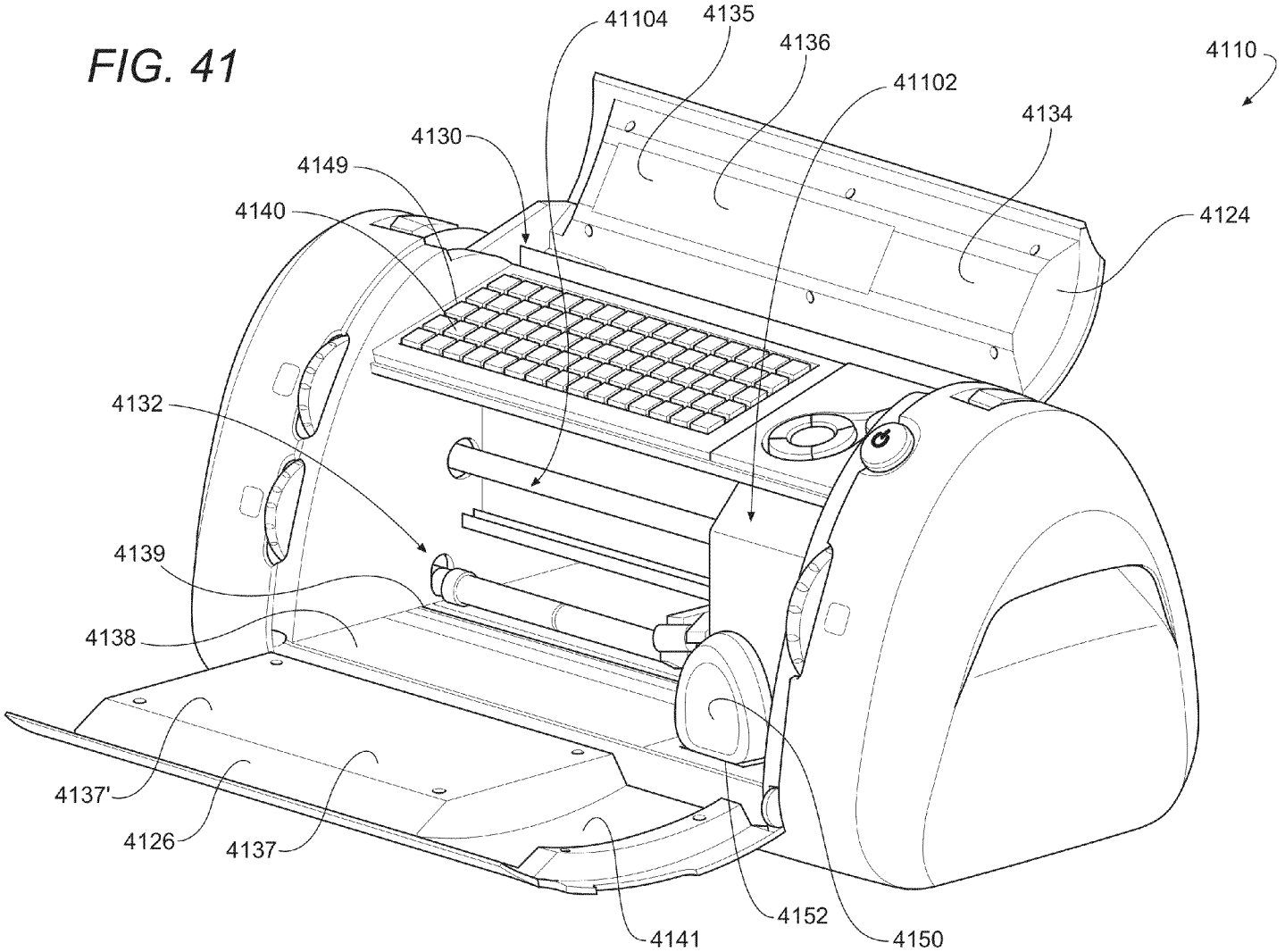
FIG. 41 is a perspective view of an apparatus for printing and cutting.

Referring now to FIG. 41, a printer/cutter 4110 is illustrated with printing and cutting mechanisms 41102 being movable along a guide 41104. A printing system, such as an inkjet printing system, may be used to deposit ink on paper or other materials to perform the printing function. A printer/cutter 4110 is illustrated in an open position as having a user interface 4130 and a cutter assembly 4132. A back surface 4134 of a top door 4124 houses a visual display 4135, such as an LCD display. Certain relevant data, such as the shape or shapes selected for being cut, the size of the shape, the status of the progress of a particular cut, error messages, etc. can be displayed on the display 4135 so that the user can have visual feedback of the operation of the machine.

A back surface 4137 of a bottom door 4126 provides a support tray for a mat and material being cut by the printer/cutter 4110 so that the material and mat (not shown) remain in a substantially horizontal orientation when being cut. In addition, the inner bottom surfaces 4138 of the printer/cutter 4110 are also generally horizontal and planar in nature to support the material being cut in a substantially flat configuration. In some prior art machines that have been adapted from the vinyl sign cutting field to the paper cutting field, the machines have generally retained a curved support surface. The curvature of the support surface was generally employed to accommodate the material being cut, namely adhesive backed vinyl, typically in a roll form. Such a configuration is not particularly conducive to cutting sheets of material such as paper and the like where bending can cause portions of the images being cut to lift from the planar surfaces defined by the sheet causing the blade or blade holder to catch any such raised portions that could damage the material of the shape being cut. The inner surface 4137 of the door 4126 thus includes a planar surface portion 4137' that is substantially coplanar with the inner bottom surface or bed 4138 of the cutter adjacent a drive roller 4139. In addition, the inner surface 4137 defines a recess 4141 for accommodating a cartridge 4150 when the door 4126 is in a closed position as shown in FIG. 41. This allows for a more compact configuration of the printer/cutter 4110 with the cartridge 4150 fitting within the door 4126. Thus, the printer/cutter 4110 can be transported with the cartridge 4150 positioned inside with the door 4126 closed.

The printer/cutter 4110 includes a memory storage device 4150 for storing various shapes and images, such as fonts, images, phrases, etc., that can be printed and cut by the printer/cutter 4110. The memory storage device 4150 may also include storage of different printing and cutting parameters such as the resolution of the image, the registration points for the image and the cutting boundaries, the tolerance required for printing and cutting at various sizes, etc. In the example shown, the memory storage device 4150 is in the form of a removable and replaceable cartridge. The cartridge 4150 is provided with a particular library or set of shapes that can be selected using a keyboard 4140. When a new set of shapes is desired, the cartridge 4150 can be removed form a socket 4152 (that received the cartridge 4150) and replaced with another cartridge 4150 containing the desired shape or shapes. In combination with a change of the cartridge 4150, the keyboard 4140 is provided with a removable and replaceable overlay 4149 that is formed of a flexible material such as silicon rubber, PVC or other rubber-type materials to allow the keys of the keyboard 4140 to be pressed when corresponding raised keys of the overlay are pressed. The overlay 4149 may be formed from a clear, transparent or translucent material to allow light from the keys of the keyboard 4140 to be seen through the overlay 4149. In order to identify which overlay 4149 corresponds to a particular cartridge 4150, the particular name of the font or image set (as well as the individual characters, phrases and functions) can be printed, as by silk screening or other methods, onto the overlay 4149 and the same name printed on the cartridge 4150 or printed on a label that is attached to the cartridge 4150. Also, if desired, by matching the color of a particular keyboard overlay 4149 with the color of a particular cartridge 4150, a user can easily verify that they are using the correct cartridge 4150/overlay 4149 combination. For any given color or material from which the overlay is formed, the overlay 4149 is not completely opaque. Thus, in order to signify to the user that a particular function key has been activated, such as CAPS or the like, an LED is positioned beneath the key to illuminate the key when activated. As such, by forming the overlay 4149 from material that is at least partially translucent, the light from the LED is visible to the user through the overlay 4149. Thus, both the keys of the keyboard 4140 and the overlay 4149 are formed from an at least semi-translucent material.

An alternative to the keypad and overlay 4149 may include a LCD touch screen capable of rendering the font or image set. To select a particular shape, the user may push on the shape directly as it is shown on the LCD touch screen and the system recognizes a selection from the touch screen.

Figure 42A:
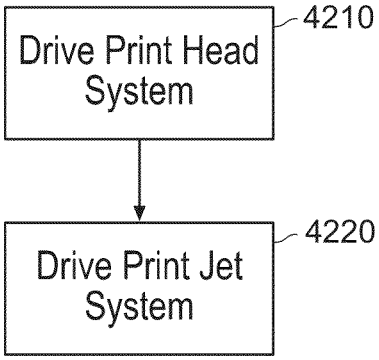
FIG. 42A is a schematic view of an exemplary arrangement of operations for continuous ink printing while a print head is in motion.

FIG. 42A provides a schematic view of an exemplary arrangement of operations for continuous ink printing while a print head is in motion (see step 4210). In some examples (e.g., where a flat field is desired) or regions of color are the same color, printer/cutter 4110 may employ a continuous printing method deposit a stream of ink (see step 4220) on the stock (e.g., paper). Instead of printing dots, the printer/cutter 4110 has printed a stream of color.

Figure 42B:
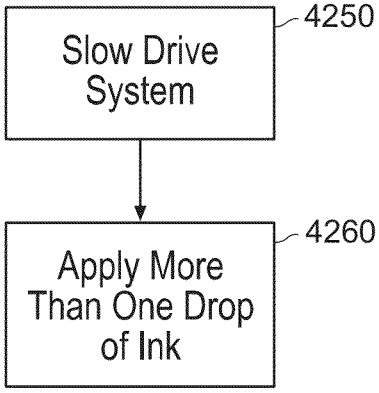
FIG. 42B is a schematic view of an exemplary arrangement of operations for applying ink to a pixel element.

FIG. 42B provides a schematic view of an exemplary arrangement of operations for applying heavy ink to a pixel element. The printer/cutter 4110 may apply "heavy ink" to a particular area. For example, where heavy ink is required, the printer/cutter 4110 may apply more than one drop of ink to that location. For example, at an area required to be rich with a particular color, the printer/cutter 4110 may slow or stop movement (see step 4250) apply more than one droplet of ink (see step 4260) to that location. At step 4260, the printing system may apply more than one droplet of ink to a particular location. This may be done on multiple passes, or this may be done if the printing system stops at a particular location, or this may be done by rapidly jetting ink at the location when the printing system is slow driving the print head.

Figure 43:
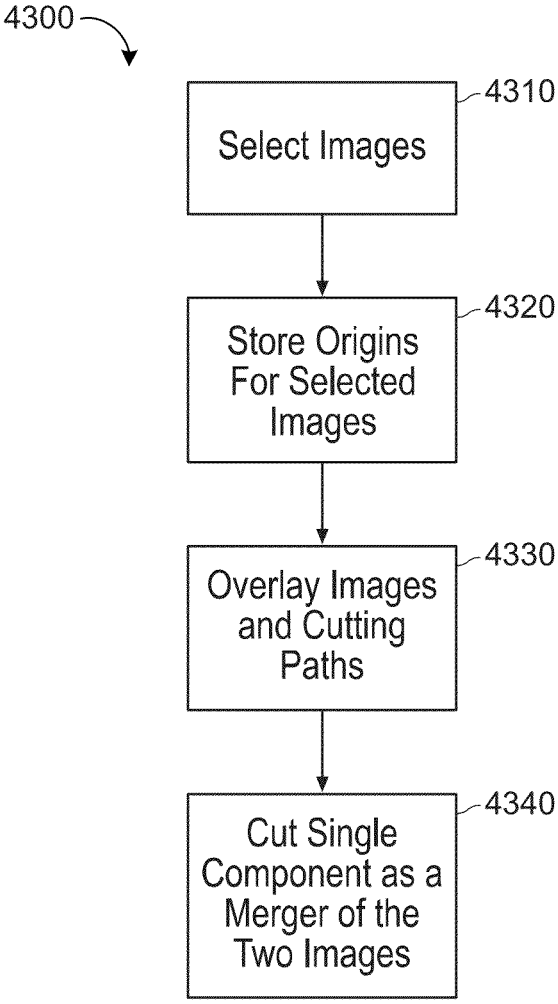
FIG. 43 is a schematic view of an exemplary arrangement of operations for merging multiple images together.

FIG. 43 provides a schematic view of an exemplary arrangement 4300 of operations for merging multiple images together (e.g., "welding" or "stringing" images together) to create a single image from many. The operations include selecting 4310 the images to be welded, storing 4320 the origin offsets for: locating each image that may be stored within a larger data structure as well as the data structure holding each image's data for graphics and cutting, and deciding 4330 how to overlay the images so that the images are welded together and are not cut individually. Such welding may include not cutting the portions that overlap, or where there are non-overlapping images, to insert a place-holder bridge between the image portions to hold them in registration with each other after printing and cutting are complete. The operations further include cutting 4340 the images from the same stock as a single piece.

Figure 44:
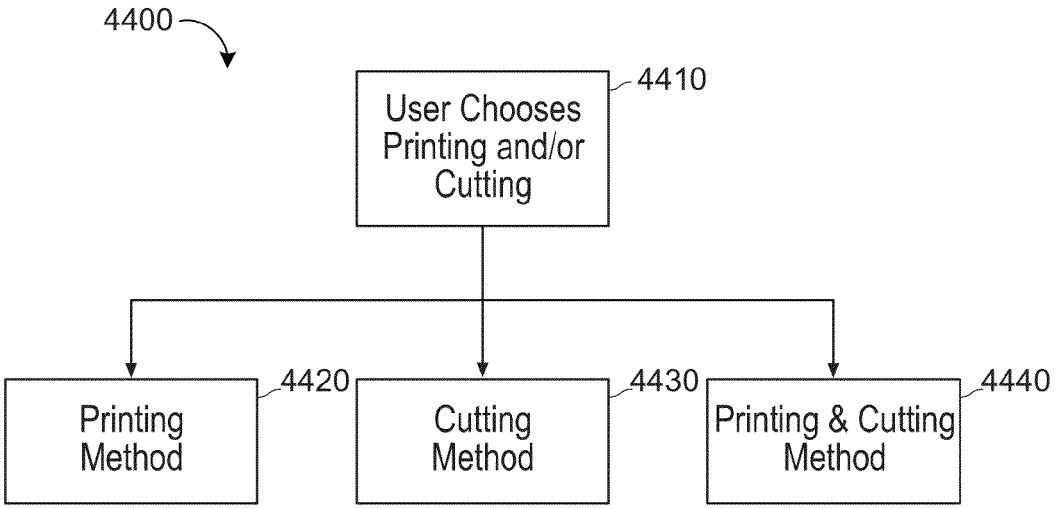
FIG. 44 is a schematic view of an exemplary arrangement of operations for printing and/or cutting.

FIG. 44 provides a schematic view of an exemplary arrangement 4400 of operations for printing or cutting, or printing and cutting. The printer/cutter 4110 may be used for both printing and/or cutting. Thus, the user need not purchase separate machines to perform each function individually; accordingly, both functions may be performed with the same machine. The user interface 4130 may be used to determine the mode of operation for the printer/cutter 4110. For example, the user may select an image or shape to be cut, and they may further select the mode of operation for the printer/cutter 4110 as: only printing, only cutting, or printing and cutting. In this way, the printer/cutter 4110 alters the functionality accordingly. The operations include receiving 4410 a user inputted printing/cutting mode. If the user chooses printing only, control transfers 4420 to the printing method. If the user chooses cutting only, control transfers 4430 to the cutting method. If the user chooses printing and cutting, control transfers 4440 to the print and cut method. In step 4420, the printing method reads the printing-related data from memory storage device 4150 and begins a printing operation. In step 4430, the cutting method reads the cutting-related data from memory storage device 4150 and begins a cutting operation. At step 4440, the print and cut method reads both printing-related data and cutting-related data from memory storage device 4150 and beings printing, and afterwards the cutting is performed.

Figure 45:
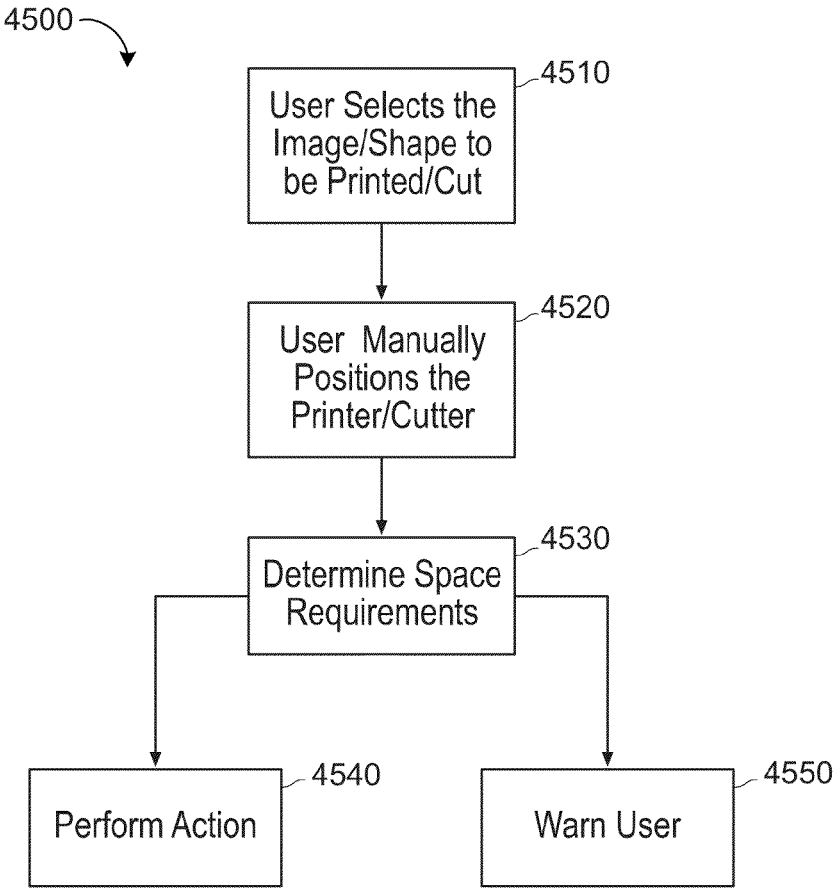
FIG. 45 is a schematic view of an exemplary arrangement of operations for determining space requirements after a user-manual alignment.

FIG. 45 provides a schematic view of an exemplary arrangement 4500 of operations for determining space requirements after user-manual alignment. The operations include selecting 4510 an image to be printed and/or a shape to be cut, along with parameters such as size, scaling, or feature addition (e.g., skew, addition of a background, etc.). The operations further include manually positioning 4520 the printer/cutter head system for the starting position on the page. Positioning of the head system may be done using arrow keys on user interface 4139, or by manual movement of the print/cut head (wherein a feedback system allows the printer/cutter 4110 to determine the absolute position of the head). The operations include determining 4530 the space requirements to print and/or cut an image or shape based on the "zero" position of the head system after manual alignment by the user. The printer/cutter 4110 may use the size of a new sheet of print/cut stock, or use stored information about the regions of the print/cut stock that has already been used, to determine the space requirements needed for performing the user's requested action. If there is enough area to perform the action, the operations include performing 4540 the print/cut operation. If there is not enough area to perform the requested action, the operations include warning 4550 the user that not enough area is present. The printer/cutter 4110 may then query the user to determine if they would like to scale the print/cut image/shape to a lesser size to fit the available area.

Figure 46:
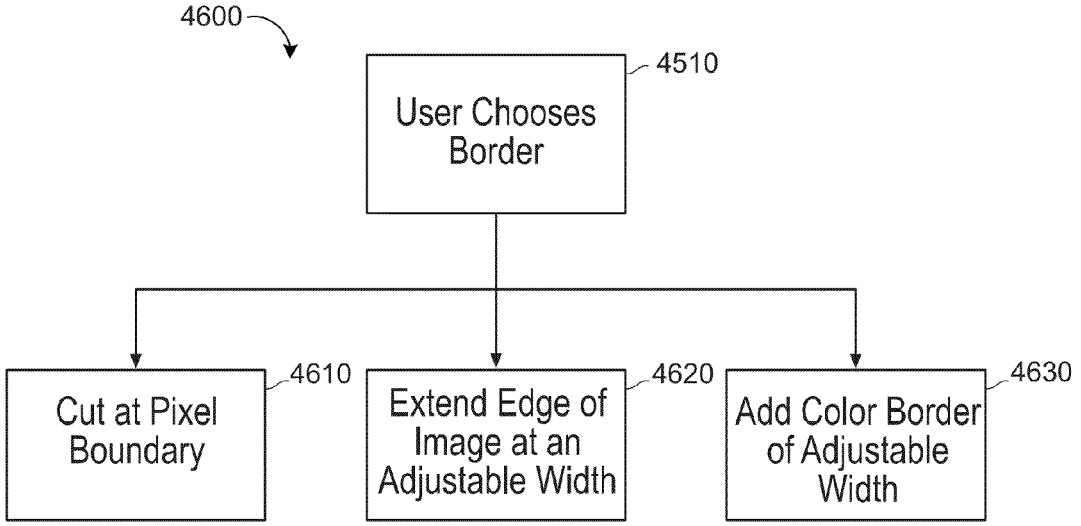
FIG. 46 is a schematic view of an exemplary arrangement of operations for performing border cutting to an arbitrary image or shape.

FIG. 46 provides a schematic view of an exemplary arrangement 4600 of operations for performing border cutting to an arbitrary image or shape. The border may be: the addition of a background color to the image beyond or at the cutting boundary, an extension of the colors of the image at the border, or an image filter applied to the edge of the image to provide an interesting border color. The operations include selecting 4602 the border mode. If no border is selected, the operations include cutting 4610 the image at the pixel boundary of the image. If an edge extension mode is selected, the operations include extending 4620 the pixels bordering the image to provide a crisp line when cut. The border selected may be of an adjustable width (generally shown in FIG. 46A). The printer/cutter may also add a national width to the border to provide that no "white space" remains when the cut is performed (generally shown in FIG. 46B).

If a color border (e.g., a black border or any other color) is selected, the operations include adding 4630 the color border as a fill to the surrounding portions of the image to provide an edge or key-line effect. The border selected may be of an adjustable width. The printer/cutter may also add an additional width to the border to provide that no "white space" remains when the cut is performed (generally shown in FIG. 46B).

Figure 46A:
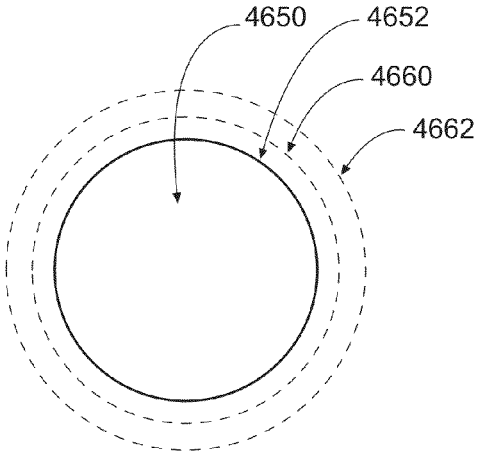
FIG. 46A is an example of an image having an outer boundary.

FIG. 46A is an example of an image 4650 having an outer boundary 4652. The user may select to have a border placed around the image boundary 4652, the border being of various widths. In a first example, the border is selected by the user to be an arbitrary width 4660. If the user desired, the border may be selected as a larger arbitrary with 4662. The printer/cutter 4110 may also automatically select the border width depending upon the resolution of the printing system and cutting system to maximize the smoothness and clarify of the image when cut. The extension of an outer boundary may also provide a margin of error where the cutting system is not perfectly registered with the printed image. For example, where there is an inaccuracy in the cutting locations, with respect to the printed image, the extended boundary allows for a clean cut through the colored boundary without "white" area being left after cutting. This "white" area need not be white in color, but rather, indicates the color of the media being printed upon, which may be substantially white in color.

The border may be determined, for example, by a user input (e.g., through a user interface such as a keypad, a thumbwheel, a touch screen, etc.). An example may be the user indicating that a 0.2" boundary is desired. In this case, the system extends the border by 0.2" around the outer boundary 4652. Alternatively, the border may be determined by extending the outer boundary 4652 by a predetermined amount. For example, where the precision of the cutting system is known to be at about 0.05", the border may extend the outer boundary by about 0.10" to provide a margin of safety depending on the working condition of the print and cut system (e.g., the age of the apparatus) or the type of work piece being cut. Alternatively, the outer boundary 4652 may be scaled up a predetermined distance to determine the border the thickness.

Figure 46B:
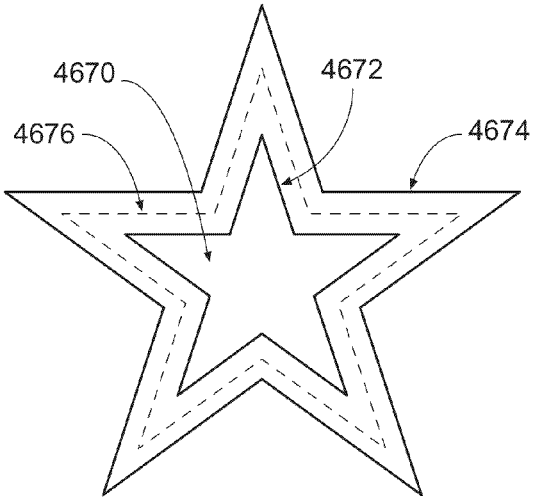
FIG. 46B is an example of an image having an outer boundary and a border extending from the outer boundary.

FIG. 46B is an example of an image 4670 having an outer boundary 4672, and a border 4674 extending from the outer boundary 4672. When the user selects a boundary width (represented by dashed line 4676), the printer/cutter 4110 may add an additional thickness to the border and extend the border to border line 4674. The automatic addition of border width allows the printer/cutter 4110 to cut the image at cut line 4676 while allowing for no white space being present in the cut image. By extending the border beyond the cut line 4676, the cut image is guaranteed to have a full color border. As discussed above, the extension of the colored border handles situations where the cutting path is reasonably out of registration, or when the cutting tool may not be able to perfectly change direction or cut an arc-path with sufficient precision.

Figure 47:
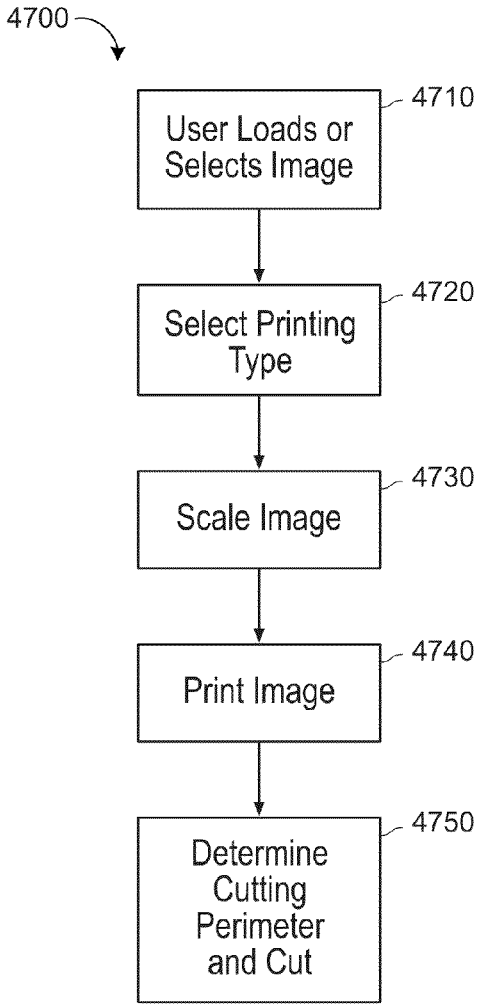
FIG. 47 is a schematic view of an exemplary arrangement of operations for printing an image in black & white, grayscale, and color, as a standalone machine.

FIG. 47 provides a schematic view of an exemplary arrangement 4700 of operations for printing an image in black & white, grayscale, and color, as a standalone machine. The operations include loading 4710 an image from a cartridge 4150 or other memory and selecting 4720 a printing type (e.g., color, black & white, grayscale, etc.) or add additional features such as sepia before printing. The operations may include scaling 4730 the image to a particular size, and then printing 4740 the image on the printer/cutter 4110 in the desired format and size. The operations include calculating 4750 a cutting perimeter (if any) based on the size of the print and allowing the user to print custom-sized photos that are cut from the stock material (e.g., photo-paper) at the size of the print. Using the methods illustrated in FIG. 46, the user may also add "frame" borders or other features such as scalloping, or shadowed borders to five the image depth.

The printed image and cutting path may be rasterized or vector based. Moreover, the image and cutting path may be contained in a cartridge or storage device together. When scaling the image and cutting path, the system may automatically modify the image and cutting path to scale up the image. Alternatively, the image and cutting path may be stored as a sufficiently large image and cutting path so that all or substantially all of the scaling is a downward scaling to reduce rasterization and pixelization effects. Moreover, where the image and cutting paths are scaled downwardly, some detail may be reduced to suit the particular resolution of the print system, as well as the precision of the cutting system. Thus, the reduction in detail may be different for the image and the cutting path based on their particular capabilities.

Figure 47A:
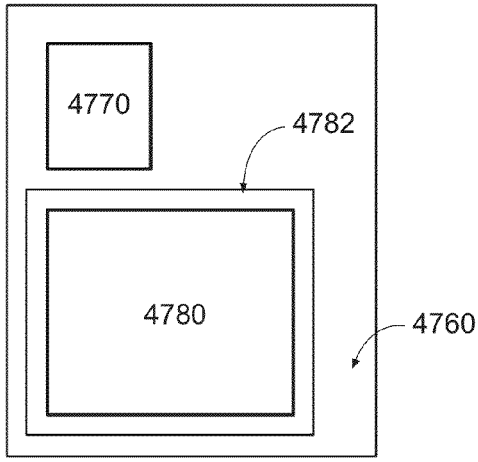
FIG. 47A is an example of printing multiple images to a sheet of stock.

FIG. 47A is an example of printing multiple images to a sheet of stock 4760 (e.g. photo-paper) where the user selects the size of the image, and the image is cut-to-size. A first image 4770 is printed and cut to size. A second image 4780 is printed and a border 4782 is added, the image is then cut to size at the border perimeter at 4782. In an example, the user could cut multiple images from a single sheet of stock, each image being of different size, or the same size, but being cut free from stock at the edge of the image. Such system then no longer requires the user to purchase multiple sizes of stock, but also does not require them to manually cut the image to size.

Figure 47B:
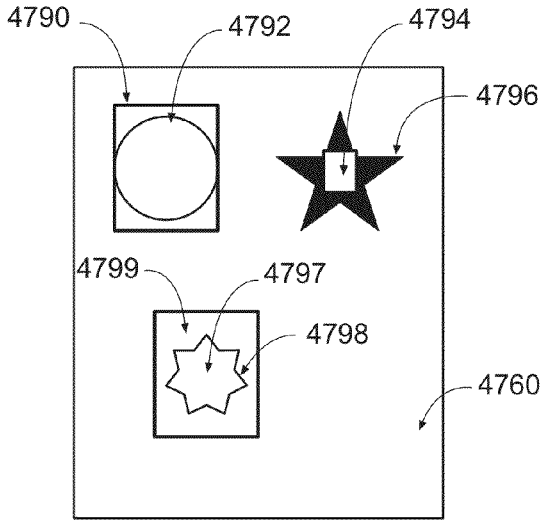
FIG. 47B is an example of printing various sized images with various borders and cutting paths.

FIG. 47B is an example of printing various sized images with various borders and cutting paths. For example, an image 4790 is provided where a cutting path 4792 is positioned over a portion of image 4790 to selectively cut out a region. In an alternative example, the image not circumscribed by cutting path 4792 is not printed on stock 4760. In another example, a cutting path 4796 is shaped like a star and an image 4794 is placed within the cutting path 4796. The printer/cutter 4110 may fill the area not occupied by the image 4794 with a color (shown by the black portion) as an aesthetic detail. In another example, a scalloped edge 4798 is made within the boundaries of image 4799 leaving a scalloped image portion 4797. The user may select the boundary from the user interface 4130 and the printer/cutter 4110 may apply the boundary to the image 4799, and maximize the size of the cutting path 4797. In an alternative example, the user may be displayed the image 4799 may be displayed on a graphical display and the user may then position the cutting path 4797 on the image arbitrarily.

Figure 48:
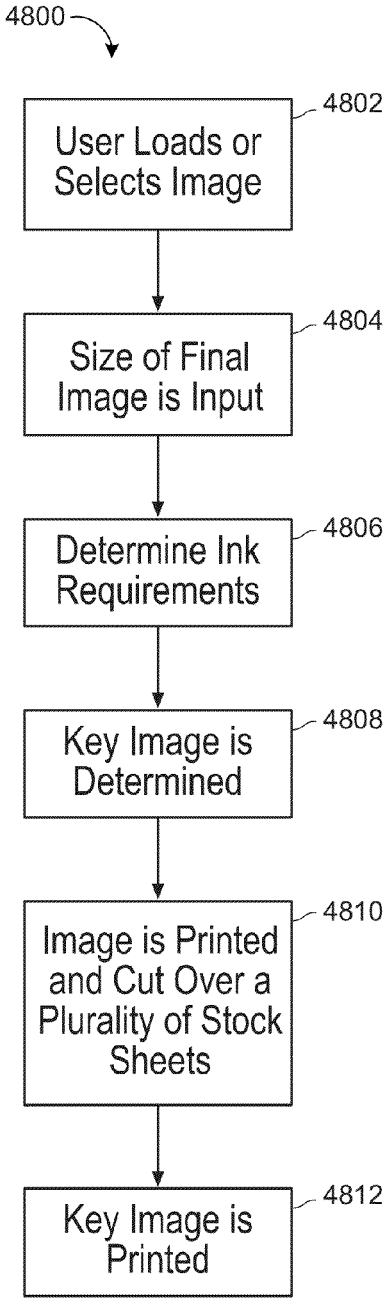
Figure 48A:
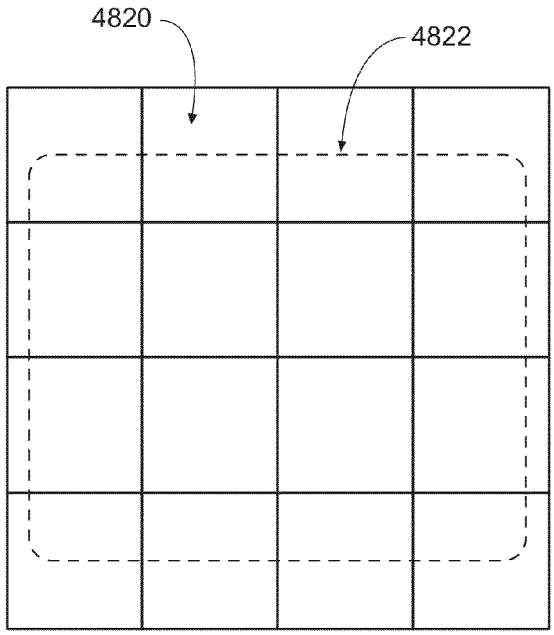
Figure 48B:
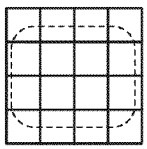

FIG. 48 provides a schematic view of an exemplary arrangement 4800 of operations for tiling an image and cutting paths. A large image may be printed across a plurality of pieces of stock (e.g., paper) and may be assembled by the user into a larger image. The operations include selecting 4802 an image and sizing 4804 the final image (e.g., as inputted by the user, such as 5 feet across). The operations may optionally include estimating 4806 the ink usage for printing the image across the plurality of sheet, and may also include the key image in the calculation. The printer/cutter 4110 may then warn the user if not enough ink is present based on estimates of consumption, or feedback from the printing system. The warning may be a general warning for multi-color systems, or it may warn that a specific color may be low such that the user can replenish only that color which may not last during the printing process. The operations include determining 4808 how to print and cut the image across the plurality of pieces of stock (see FIG. 48A) and creating a key image (see FIG. 48B). The key image may further include a numbering system for the user to identify where each sheet is located relative to the other sheets. A number may be added to each image portion cut in a non-obvious manner (e.g., by color-shifting or small black printing) so that the user can identify the sheet in relation to the key image. The operations further include manufacturing 4810 the image from multiple pieces of stock, cutting the border if desired, and printing 4812 the key image on a separate sheet of stock or on an unused area (waste) while manufacturing 4810 the image to conserve stock. During printing, if a tile (a sheet of the larger image) is defective or the printing/cutting is not completed satisfactorily, the user may redo a tile, or may start from a certain tile and continue the process. FIG. 48A shows an image printed and cut at a boundary 4822 from a plurality of sheets 4820. FIG. 48B shows a key image, which is a small version of the large scale image, that allows the user to identify each sheet of the image for placement. The key image is useful where each of the tiles may be in random arrangement, and the user must decide on the adjacencies of the placement. Thus, the key image substantially functions as a puzzle key image to direct assembly of each tile. The key image may be printed on a separate sheet, or it may be printed on a scrap area of the cut sheets that comprise the tiles.

Figure 49:
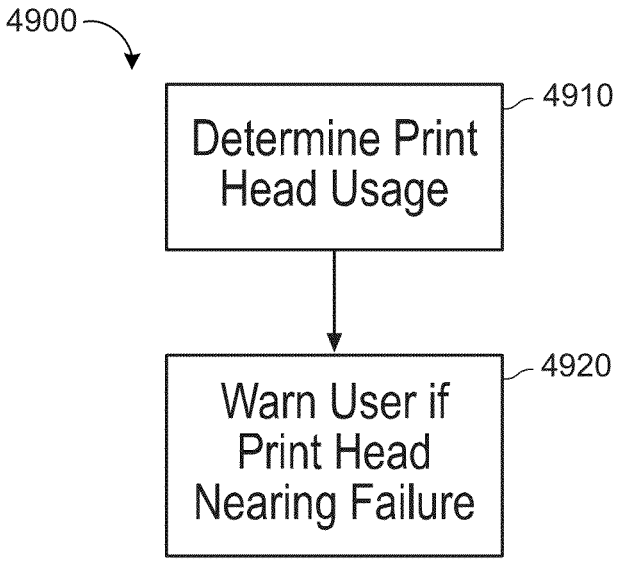

FIG. 49 provides a schematic view of an exemplary arrangement 4900 of operations for determining the number of ink cartridges used, and provide warnings to the user. The operations include determining 4910 the usage rate of the print head by the number of ink droplets used since the last print head change. The information may be stored in the memory of the printer/cutter 4110 or it may be stored in the print head itself. The operations further include warning 4920 the user to replace the print head if a new print head is desired. The system may also determine that the heads should be changed for quality and/or contamination issues based on the amount of ink used. If, for example, significant cutting is performed by the user but less printing, then the system may determine that a print head change should be performed based on the expected amount of contamination from paper dust, etc.

Figure 50:
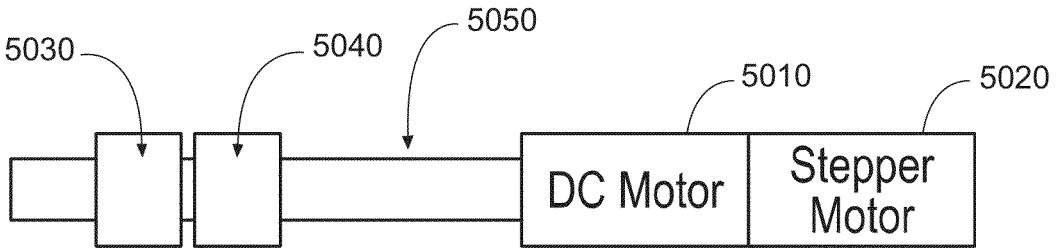

FIG. 50 is a system diagram of a combined stepper motor and DC motor driver for the cutting and printing system. DC motor 5010 is provided to move the print head 5030 in a smooth manner along a common shaft 5050. A stepper motor 5020 is provided to move the cutting head 5040 along the common shaft 5050. The print head 5030 and the cutting head 5040 may be commonly connected to the shaft 5050, or they may be selectively engaged, for example by clutch, latch, or operation of an electromechanical actuator. By providing a DC motor drive 5010, a smooth, closed loop feedback drive system may be employed for printing that may not require significant torque, while a stepper motor drive 5020 may provide a high torque system for cutting stock. If the print head 5030 and the cutting head 5040 are commonly connected to the shaft 5050, the DC motor implementation may still be used because the cutting torque requirements are not needed when the blade is not engaging stock. By using having the DC motor 5010 and the stepper motor 5020 connected to the common shaft 5050, a clutch mechanism for separately engaging the two motors 5010, 5020 can be avoided. For example, the DC motor 5010 can be powered down or not otherwise driven while using the stepper motor 5020 and the stepper motor 5020 can be powered down or not otherwise driven while using the DC motor 5010.

FIGS. 51A through 51K describe an alternative example for a printing and cutting or crafting apparatus 5100. The example may include control systems from both a print mechanism and a cutting mechanism. In addition, there may be merged systems that control both printing and cutting, and, in particular, the optimization and sequence of various print and cut operations.

Referring to FIGS. 51A and 51B, the crafting apparatus 5100 includes a carriage 5140 that rides along a central frame 5130 provides for movement in the X direction of a cutting mechanism (near 5142) and a printing mechanism (see FIG. 51C). In general, stock such as craft paper, vinyl, or other materials, is loaded into the cutting mechanism and moved in a Y direction by rollers 5116, 5118, provided on a roller shaft 5114. A roller motor system 5112 controls the roller shaft 5114 to move the craft. A carriage motor system 5110 provides movement to the carriage along the central frame 5130 to position the cutting and printing systems relative to the stock. The X and Y movement mechanisms are a positioning system allowing the work piece to be moved under the moveable print and cut systems. In this way, the positioning systems allow the print system and cut system access to the usable region of the work piece.

FIG. 51C is a back view of the printing and cutting apparatus 5100 shown in FIG. 51A. As shown, the printing mechanism includes a Cyan print system 5320, a Yellow print system 5322, a Magenta print system 5324, and a Black print system 5326. These colors used together form a "CYMK" printing system. As part of the carriage 5140, riding along the central frame 5130 the printing system slides laterally in the X direction along with the cutting system. As both the printing and cutting systems are provided on the same carriage 5140, they are mechanically in registration with each other. A docking station 5310 may be provided at one end of the crafting apparatus 5100 for cleaning and storing the ink cartridges when not in use. As shown in FIG. 51C, the print systems 5320, 5322, 5324, 5326 may be configured as inkjet print systems, each having a print head associated with the ink cartridge. For example, the inkjet print system may be configured as a thermal inkjet or a piezoelectric inkjet. The inkjet heads may be configured as a fixed-head or a disposable head. Where a disposable head is used, the head may be a separate component or built into the ink tank that supplies the ink.

The docking station 5310 may be a multipurpose system that allows for storage and cleaning of the print heads. For example, the print head may be susceptible to contaminants and/or drying of the ink that may cause failure of certain ink jets or ink passageways (e.g., leading through the print head to the nozzle). Such drying and clogging of the print head 5030 may lead to an irregular drop pattern and/or clogging of the nozzle that prevents normal operation of the inkjet nozzle. Moreover, contaminants from the cutting system, such as loose paper or paper dust, may threaten to clog the nozzles. In these examples, the docking station 5310 may be used to clean the print head 5030 and/or apply moisture to it to prevent drying.

For example, the docking station 5310 may include a felt material or a bristle-like material to clean the print head 5030. Moreover, when docked for long periods, the docking station 5310 may provide a seal around the print heads to prevent drying. In another example, moisture may be provided (e.g., by a user) to the docking station 5310 to maintain a moistened state of the print head 5030. In another example, the docking station 5310 may provide a suction mechanism so that when the print heads are docked that air is substantially evacuated to reduce drying of ink.

FIG. 51D is a right side view of the printing and cutting apparatus 5100 shown in FIG. 51A. The carriage motor system 5110 may drive the carriage 5140 (see FIG. 51A) using a belt drive system 5410. Alternatively, a tensioned cable or other semi-rigid configuration may be used, for example, to achieve acceptable accuracy. As shown, the cutting system (on the left side of FIG. 51D, but not shown) may be positioned opposite the print system (see 5320). The positioning on opposite sides of the central carriage 5140 (see FIG. 51A) provides a reduced package size (e.g., overall length) as compared with a side-by side printing and cutting system.

FIG. 51E is a left side view of the printing and cutting apparatus 5100 shown in FIG. 51A. The roller motor system 5112 may be connected to the roller shaft 5114 (see FIG. 510A) by a gear set 5512, 5520 and belt 5515 system. As the gear 5520 is rotated, the roller shaft 5114 rotates, as do the rollers 5116, 5118 to engage and move the work piece (e.g., the stock to be printed and/or cut). An end roller 5530 may be used at the opposite side of the mechanism to provide tension to the belt drive system 5410.

A floating/movable floor (see FIGS. 51D-51E and 51I-51K) provides a system to maintain an appropriate distance of the material being printed on and the print head systems. This distance may be measured, for example, by the distance of the bottom of the print head's bottom surface (e.g., where the exit point of the nozzles are) and the upper surface of the material being printed on (e.g., the stock or work piece). The printing and cutting system may also include material handling system that provides for various thicknesses of materials to be both printed on and cut. A typical material handling system for the stock material may be used, such as a sticky-mat that holds craft paper. However, where other materials are used as stock, or where the thickness of the material is unknown, other material handing systems may be needed. The thickness of the material may be important in the printing operation, more so than the cutting operation. This is due to the design of inkjet print heads. The inkjet print head is typically designed to be used at a predetermined distance, or a range of distances, from the material being printed upon. The design distance may be related, for example, to the droplet size of the ink projected from the inkjet print head. Where the material to be printed upon is too close, there may be excessive force on the ink droplet when it hits the material, causing the ink dot to become overly large and possibly splashing back to the print head causing clogging. Alternatively, when the material to be printed upon is too far away from the print head, there may not be enough force for appropriate adhesion of the ink to the material, and the ink droplet may become overly enlarged.

Each of these design problems may be solved with a floating floor 5120 under the print and cut system. The floating floor 5120 may include a floor 5920 (see FIG. 51I), that allows for vertical movement relative to the rollers 5116, 5118. The floor 5920 may define a channel 5122 that receives the lower roller assembly 5950, 5916 (FIG. 51H). Referring now to FIGS. 51D-51E, each side of the moveable floor 5120 is connected to a sliding arm 5440, 5440'. Each sliding arm at one end slides along a slot and pin 5450, 5450'. The movable floor 5120, 5920 is biased upwardly by springs 5420, 5420' to provide an upward force to press the stock against the rollers 5116, 5118. The moveable floor 5120, 5920 may also include pistons 5430, 5432, and 5430', 5432' that slide vertically (see also FIG. 51G). Because each sliding arm 5440, 5440' has two pistons 5430, 5432 and 5430', 5432', respectively, each sliding arm 5440, 5440' maintains a substantially parallel position when moved up and down. The pistons 5430, 5432, 5430', 5432' are generally perpendicular to the moveable floor 5920. However, movable floor 5120, 5920 may be configured to be at an angle, and as such the pistons 5430, 5432, 5430', 5432' are generally perpendicular to the upper rollers.

The movable floor 5120, 5920 and the lower roller maintains a substantially parallel position (with respect to the upper roller) when moved up and down. In this way, various thickness materials may be used with the printing and cutting system, while still maintaining a desired distance between the stock and the print head. In general, the pistons determine the orientation of the moveable floor, and also maintain the lower roller system as parallel with the upper roller system to maintain an equal distance between the upper and lower roller system along the length of the work piece. Moreover, the moveable floor provides support to the work piece in operation to avoid bending or twisting of the work piece, particularly during a cutting operation.

FIG. 15F is a top view of the printing and cutting apparatus shown in FIG. 51A. The printing mechanism (e.g., the Cyan print system 5320, Yellow print system 5322, Magenta print system 5324, and Black print system 5326) are shown opposite to the cutter 5150. As material is moved under the print and cut system, the controller may decide to engage a blade for cutting, or control the printing system. These steps may be performed simultaneously, or they may be staggered in time to reduce contamination to the print head or other reasons such as potential smearing of ink.

FIG. 51G is a bottom view of the printing and cutting apparatus 5100 shown in FIG. 51A. The docking station 5710 (also shown as 5310 in FIG. 51C) may be attached to the bottom side of the print and cut mechanism. The docking station 5710 may be used to clean the print heads 5030, as well as maintain the moisture level so that drying of ink and clogging of the inkjet nozzles is reduced. Here, the pistons 5430, 5432, and 5430', 5432' for the movable floor 5120, 5920 are shown in an alternative view.

FIG. 51H is a perspective view of the printing and cutting apparatus 5100 shown in FIG. 51A. The moveable floor 5120, 5920 may move up and down to adjust to the thickness of the stock material to be printed on and/or cut. The floor 5920 may also align with an outer door 5820 that may be integrated with the housing. The outer door 5820 may swing downwardly to expose the printing and cutting mechanism for use, as well as provide a stabilizing surface for the material to be cut. Also shown is a cartridge 5810 that allows the user to print and cut designs without requiring a computer-like device to control the print and cut system.

FIGS. 51I and 51J show a cross-sectional view of the printing and cutting apparatus 5100 shown in FIG. 51A. A movable floor 5930 is shown in cutaway as being biased upwardly (e.g., by springs 5420, 5420' to engage the lower roller 5950 against the upper roller(s) 5114, 5116, 5118. The moveable floor 5930 also engages stationary floor members 5920, 5922 when at the uppermost position. The stationary floor members 5920, 5922 provide a rigid surface for the work piece/stock to rest upon while being configured by the print and cut system. In use, the springs 5420, 5420' bias the work piece between the upper roller(s) 5114, 5116, 5118 and the lower roller 5950. This biasing, and the pressure between the rollers, allows the print and cut system to move the work piece in the Y direction when in use by rotating the upper roller(s) 5114, 5116, 5118. As shown, the outer door 5820 provides support for a work piece that may extend out of the front of the print and cut system, reducing bowing of the work piece that may be undesirable. The lower roller bar 5950 and rollers may be provided in a cavity 5932 provided in the movable floor 5120, 5930. In this way, the lower rollers 5950 are provided access to the work piece, while at the same time the movable floor maintains rigidity for a substantially parallel support surface.

FIG. 51K provides perspective views of a roller system 51110 for engaging a mat 51112. The moveable floor 5930 is shown between the stationary floor members 5920, 5922 and under the upper roller bar 5114. A mat 51112 may be provided to hold the work piece. The mat 51112 may be configured with a sticky surface to hold the work piece in place during printing and cutting operations, while allowing the work piece to be removed without substantial damage (e.g., tearing). FIG. 51K illustrates an example where the roller system 51110 engaging the mat 51112 as well as how the floor 5930 drops down to adjust for the thickness of the material or workpiece W being printed and/or cut. This downward motion is caused by the mat 51112, which may have relatively thick edges that force the rollers 5114, 5950 apart resulting in the bottom (floating) platform or floor 5930 to move down. This downward motion could also be caused by the thickness of the workpiece W itself.

To provide for various thicknesses of work pieces (e.g., the thickness of the stock), the mat 51112 may allow for shims 51120, 51122 to be attached near the edges of the mat 51112 to determine the distance between the upper rollers and the lower rollers. This may be advantageous where, in particular, the print and cut system may not desire to engage the work piece directly to prevent smearing or marking by the rollers. The shims 1120, 1122 may be permanently attached to the mat or they may be removable. If configured as removable shims, the user may be provided with various thicknesses for shims 1120, 1122 so that different thickness work pieces may be printed upon and cut. The shims 1120, 1122 are positioned on the mat 1112 so that they run between the upper and lower rollers to provide movement to the mat 1112.

FIG. 52 is a front schematic view of a floating roller system 5200 that accepts relatively thick material stock 5210, such as foam board. Upper and lower roller holders 5220, 5230 rotatably support opposing rollers 5240 forming a nip to firmly grip the stock 5210. Springs 5250 may be used to tension the roller holders 5220, 5230 and rollers 5240 toward each other to hold the stock 5210. Alternatively, a stepper motor drive or other tensioning system may be employed to provide that the rollers 5240 grip the stock 5210. As discussed above with respect to FIGS. 51A-51K, the floating roller system may allow for various thicknesses of material stock to be used while maintaining a threshold distance from the print head 5030 to the surface of the material stock. This threshold distance may be desirable because the print quality may suffer if the material stock is too close to, or too far away from, the print head 5030. The cutting system may include a plunge-type blade that may handle various thicknesses of material without regard for the distance of the bottom of the material stock (e.g., where the blade penetrates to). However, given that a blade has a fixed length, the distance to the bottom of the material stock may be limited by the maximum distance between the rollers, effectively limiting the required plunge distance of the cutting blade.

FIG. 53 provides a schematic view of an exemplary arrangement 5300 of operations for cutting three-dimensional shapes using the printer/cutter 5100. The operations include loading 5302 a 3-D image into memory and processing each layer of the image. The 3-D image may be stored on a cartridge or a memory. The operations further include cutting 5304 each layer of the image from the stock, such as foam board, paper, or other material, on the printer/cutter 5100 and layering 5306 the cut image portions to construct a 3-D design. In this way, the system provides for layered construction of a design based on multiple cut pieces. Moreover, the system may scale each layer according to the user's desired size to maintain relative size among the layers.

FIG. 54 shows a layered 3-D image in cross section of a pyramid, having a bottom layer 5402, middle layers 5404, 5406, and a top layer 5408. In this way, the user constructs the layered design. The printing system may also include assembly notes or instructions on some or all of the layered pieces. For example, the surface of each layer may include a printed indication of which is first and the sequence assembly (e.g., 1, 2, 3) when the printed indication is appropriately hidden by layers on top of it.

FIG. 55 is a schematic view of an exemplary arrangement 5500 of operations for user-defined cutting of a shape. The operations include selecting 5502 an image or blank stock, tracing 5504 a cut-line on the stock (e.g., using a pen having ink properties as defined below), loading the stock onto the printer/cutter 5100, and selecting 5506 a user-defined cutting mode. The operations further include determining 5508 the position of the pen's ink placed on the stock (e.g., using an optical reader). Once a line has been determined, e.g. using a search technique of the page, the printer/cutter 5100 may cut along a path defined by the pen's ink. The cutter may follow the user-defined cut path precisely by using an optical sensor to follow the path in real-time or near real-time, or the cutting path may be pre-scanned and stored for subsequent cutting. The optical sensor system may be sensitive to certain frequencies of light, such as UV or IR, and may also be provided with an illumination source (such as a UV or IR LED). In this way, the ink of the pen may also reflect UV or IR and the optical sensor, with illuminator, may track the position of the user-defined cutting line.

Other methods for the printer/cutter 5100 may include image or object selection for cropping. For example, the user may import an image of a person in front of a background. An object selection algorithm can determine the objects within an image (e.g., a person, a car, a house, etc.) and the user can select which object to crop. The printer/cutter 5100 can then crop the image to the object, printing only the object and cutting the object at its boundaries.

In another example, the cartridge 120, 4150, 5850 may include storage of an image, a mask, and a cutting boundary, in a single file, or multiple files identified with one another. The file may include raster data for the image, as well as vector data for the cutting path.

In another example, the printer/cutter 5100 may include a border detection system to determine where the border for an image is, and generate a cut path along the border. If using a pixel-based image, the border detection system may include the ability to cut through the pixels to avoid white areas at the cutting boundary. In another example, the printer/cutter 5100 may include an optical sensor to determine the paper size. The optical sensor may detect the presence or absence of paper under it by reflection of a beam of light generated by the printer/cutter 5100 or by ambient light reflection. In another example, the printer/cutter 5100 may include a touch screen allowing the user to select images, select objects in an image, or "finger edit" an image or cutting boundary. In another example, a writable cartridge 120, 4150, 5850 may be included allowing a user to create an image and cutting boundary and save it for later use or further editing. In another example, the printer/cutter 5100 may include persistent storage other than the cartridge 120, 4150, 5850 allowing the user to accumulate a library of images and/or cutting paths within the printer/cutter 5100 that may also be transferable to the cartridge 120, 4150, 5850 or a computer.

In another example, the printer/cutter 5100 may include a peripheral interface allowing for a tablet-input by the user. The user may then "draw" the cutting boundary or make edits to the image or cutting path using the tablet. The tablet may also be used to generate a free-hand cutting path that is stored or cut in real-time. In another example, the printer/cutter 5100 may include the ability to suspend a printing sequence to allow the user to refill an ink cartridge and then continue with printing. In another example, the printer/cutter 5100 may provide for the use of textured inks. In another example, the printer/cutter 5100 may provide for an embossing feature. The cutting mechanism (or knife) may be replaced with an embossing head and a rigid material may be placed under the paper. The printer/cutter 5100 then embosses at the cut path rather than cutting through the stock material. Alternatively, the embossing path may be displaced from the cutting path. In another example, the printer/cutter 5100 may include paper spooling ability, where a mat is not used and a spool or roll of backed paper allows for the production of banners.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Implementations of the subject matter and the functional operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

A computer program (also known as a program, software, software application, script, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks;

and CD ROM and DVD-ROM disks. The processor and the memory can be supplemented by, or incorporated in, special purpose logic circuitry.

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described is this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A method of operating a crafting apparatus, the method comprising:

moving a feed path bypass assembly disposed along at least one passageway between a cutter and a printer to a first position, the feed path bypass assembly directing movement of a received workpiece along a first feed path that bypasses a first pair of rollers disposed adjacent the cutter;

receiving the workpiece between a second pair of rollers disposed adjacent the printer for selectively controlling movement of the workpiece with respect to the printer during printing operations;

printing on the workpiece using the printer;

moving the feed path bypass assembly to a second position, the feed path bypass assembly directing movement of the workpiece along a second feed path between the first pair of rollers that receive and selectively control movement of the workpiece with respect to the cutter during cutting operations;

cutting the workpiece using the cutter; and moving a first toggle member to a first position allowing a second toggle member disposed along the at least one passageway downstream of the cutter and upstream of the printer to pivot to a corresponding first position, allowing movement of the workpiece along the first feed path bypassing the first pair of rollers.

2. The method of claim 1, further comprising moving the workpiece along the first feed path in a first direction while the feed path bypass assembly is in its first position and moving the workpiece along the second feed path in a second direction substantially opposite to the first direction while the feed path bypass assembly is in its second position.

3. The method of claim 1, further comprising moving the second pair of rollers to an engaged position for engaging and moving the workpiece therebetween when the feed path bypass assembly is in its first position.

4. The method of claim 3, wherein movement of the feed path bypass assembly to its first position causes movement of the second pair of rollers to its engaged position.

5. The method of claim 1, further comprising moving the second pair of rollers to a disengaged position allowing free movement of the workpiece therebetween when the feed path bypass assembly is in its second position.

6. The method of claim 5, wherein movement of the feed path bypass assembly to its second position causes movement of the second pair of rollers to its disengaged position.

7. The method of claim 1, further comprising moving a carrier arm disposed along the at least one passageway and rotatably supporting an upper roller of the second pair of rollers to a first position upon moving the second toggle member to its first position, the carrier arm selectively engaging the upper roller of the second pair of rollers against a lower roller of the second pair of rollers while in its first position.

8. The method of claim 7, further comprising moving the first toggle member to a second position allowing the second toggle member to pivot to a corresponding second position, allowing movement of the workpiece along the second feed path between the first pair of rollers.

9. The method of claim 8, further comprising moving the carrier arm to its second position disengaging contact between the second pair of rollers upon moving the second toggle member to its second position.

10. The method of claim 1, further comprising inducing a curvature in the workpiece about a direction of movement of the workpiece as the workpiece moves downstream of the printer.

11. The method of claim 10, further comprising moving the workpiece past an exit ramp disposed downstream of the printer, a portion of the exit ramp defining an arcuate profile transverse to the feed path of the workpiece to induce the curvature of the workpiece.

12. The method of claim 11, further comprising maintaining the workpiece substantially flat upstream of the arcuate profiled portion of the exit ramp.

13. The method of claim 12, further comprising moving the workpiece past edge holders that engage lateral edge portions of the workpiece to maintain the workpiece substantially flat.

14. The method of claim 1, further comprising determining a workpiece alignment, the workpiece alignment comprising at least one of an angular skew and a lateral offset of the workpiece with respect to the feed path of the workpiece.

15. The method of claim 14, further comprising moving first and second sensors along respective first and second orthogonal directions for detecting at least one of an edge of the workpiece and a fiducial on at least one of a mat supporting the workpiece and the workpiece and determining the workpiece alignment based on a coordinate signal from each sensor.

16. The method of claim 15, wherein each sensor detects at least one of a top edge, a left edge and a right edge of the workpiece.

17. The method of claim 14, further comprising cutting the workpiece based on the determined workpiece alignment.

18. The method of claim 14, further comprising printing an image on the workpiece based on the determined workpiece alignment.

* * * * *

UNITED STATES PATENT AND TRADEMARK OFFICE

CERTIFICATE OF CORRECTION

PATENT NO. : 8,657,512 B2
APPLICATION NO. : 12/869094
DATED : February 25, 2014
INVENTOR(S) : Jeremy B. Crystal et al.

It is certified that error appears in the above-identified patent and that said Letters Patent is hereby corrected as shown below:

In the Specification:

At column 8, line number 28, delete the letter "K" after FIG. 25J.

Signed and Sealed this
Twenty-fourth Day of June, 2014

Michelle K. Lee

Michelle K. Lee
*Deputy Director of the United States Patent and Trademark Office*